US009085972B1

(12) United States Patent
Hill et al.

(10) Patent No.: US 9,085,972 B1
(45) **Date of Patent: *Jul. 21, 2015**

(54) INTEGRATED IN SITU RETORTING AND REFINING OF HEAVY-OIL AND TAR SAND DEPOSITS

(76) Inventors: Gilman A. Hill, Englewood, CO (US); Joseph A. Affholter, Midland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/567,174

(22) Filed: Aug. 6, 2012

Related U.S. Application Data

(60) Division of application No. 11/510,751, filed on Aug. 26, 2006, now Pat. No. 8,235,117, which is a continuation of application No. 11/455,438, filed on Jun. 19, 2006, now Pat. No. 7,980,312.

(51) Int. Cl.
*E21B 43/24* (2006.01)
*E21B 43/241* (2006.01)

(52) U.S. Cl.
CPC ..... *E21B 43/24* (2013.01); *E21B 43/241* (2013.01)

(58) Field of Classification Search
None
See application file for complete search history.

(56) References Cited

U.S. PATENT DOCUMENTS

| | | | | |
|---|---|---|---|---|
| 1,422,204 | A | | 7/1922 | Hoover et al. |
| 2,911,206 | A | | 11/1959 | Purre |
| 2,974,937 | A | | 3/1961 | Kiel |
| 3,055,423 | A | | 9/1962 | Parker |
| 3,072,187 | A | | 1/1963 | Carr |
| 3,116,792 | A | | 1/1964 | Purre |
| 3,205,942 | A | * | 9/1965 | Sandberg ..... 166/245 |
| 3,241,611 | A | | 3/1966 | Dougan |
| 3,322,194 | A | * | 5/1967 | Strubhar ..... 166/259 |
| 3,358,756 | A | * | 12/1967 | Vogel ..... 166/266 |
| 3,474,863 | A | | 10/1969 | Deans et al. |
| 3,528,501 | A | | 9/1970 | Parker |
| 3,598,182 | A | | 8/1971 | Justheim |
| 3,608,638 | A | * | 9/1971 | Terwilliger ..... 166/272.1 |
| 3,730,270 | A | | 5/1973 | Allred |
| 3,838,738 | A | * | 10/1974 | Redford et al. ..... 166/271 |
| 3,847,219 | A | | 11/1974 | Wang et al. |
| 3,946,810 | A | * | 3/1976 | Barry ..... 166/272.3 |
| 3,983,939 | A | * | 10/1976 | Brown et al. ..... 166/269 |
| 3,986,556 | A | | 10/1976 | Haynes |
| 4,265,310 | A | * | 5/1981 | Britton et al. ..... 166/259 |
| 4,438,816 | A | | 3/1984 | Urban et al. |
| 4,470,460 | A | * | 9/1984 | Hettinger, Jr. ..... 166/260 |

(Continued)

OTHER PUBLICATIONS

"porous" The Free Dictionary by Farlex, retrieved Jun. 17, 2013 from http://www.thefreedictionary.com/porous.*

(Continued)

*Primary Examiner* — Angela M DiTrani
(74) *Attorney, Agent, or Firm* — Edwin H. Crabtree; Ramon L. Pizarro

(57) ABSTRACT

A system for producing hydrocarbons in situ from a heavy-oil and tar sand fixed bed, hydrocarbon deposit distributed substantially within a porous formation. The system includes at least one injection well and at least one production well drilled into the formation. A heated thermal-energy carrier fluid is circulated into the injection well and through a hydraulic fracture in the formation. The fracture is disposed between the injection well and the production well. The carrier fluid mobilizes hydrocarbons in situ by heating the hydraulic fracture and producing mobilized hydrocarbons through the production well. The hydrocarbons are then divided into at least two fluid fractures having differing chemical compositions.

50 Claims, 53 Drawing Sheets

Horizontal Well Configuration for Propped Hydraulic Fracture Retorts in R-7 Zone Elevation View

(56) References Cited

U.S. PATENT DOCUMENTS

| | | | | |
|---|---|---|---|---|
| 6,056,057 | A | 5/2000 | Vinegar et al. | |
| 6,929,066 | B2 | 8/2005 | Hill | |
| 7,096,943 | B2 | 8/2006 | Hill | |
| 7,395,859 | B1 | 7/2008 | Hill | |
| 7,647,969 | B1 | 1/2010 | Hill | |
| 7,784,533 | B1 | 8/2010 | Hill | |
| 7,980,312 | B1 * | 7/2011 | Hill et al. | 166/303 |
| 8,091,626 | B1 | 1/2012 | Hill et al. | |
| 8,235,117 | B1 * | 8/2012 | Hill et al. | 166/303 |
| 8,261,823 | B1 * | 9/2012 | Hill et al. | 166/272.1 |

OTHER PUBLICATIONS

"pore" The Free Dictionary by Farlex, retrieved Jun. 17, 2013 from http://www.thefreedictionary.com/pore.*

"zone" The Free Dictionary by Farlex, retrieved Jun. 17, 2013 from http://www.thefreedictionary.com/zone.*

"Why the US Cannot Extract Most of its Oil Reserves" The Oil Drum, retrieved Jun. 17, 2013 from http://webcache.googleusercontent.com/search?q=cache:Irwli5jyu78J:oilprice.com/Energy/Crude-Oil/Why-the-US-cannot-Extract-most-of-its-Oil-Reserves.html+green+river+formation+and+heavy+oil&cd=4&h1=en&ct=clnk&gl=us.*

* cited by examiner

Initial Unit Retorted Area = 24.8% of Primary Retorting Area

Figure 1A: Relationship of Key Terms Used Herein to Refer to Various Modes of In Situ Hydrocarbon Mobilization
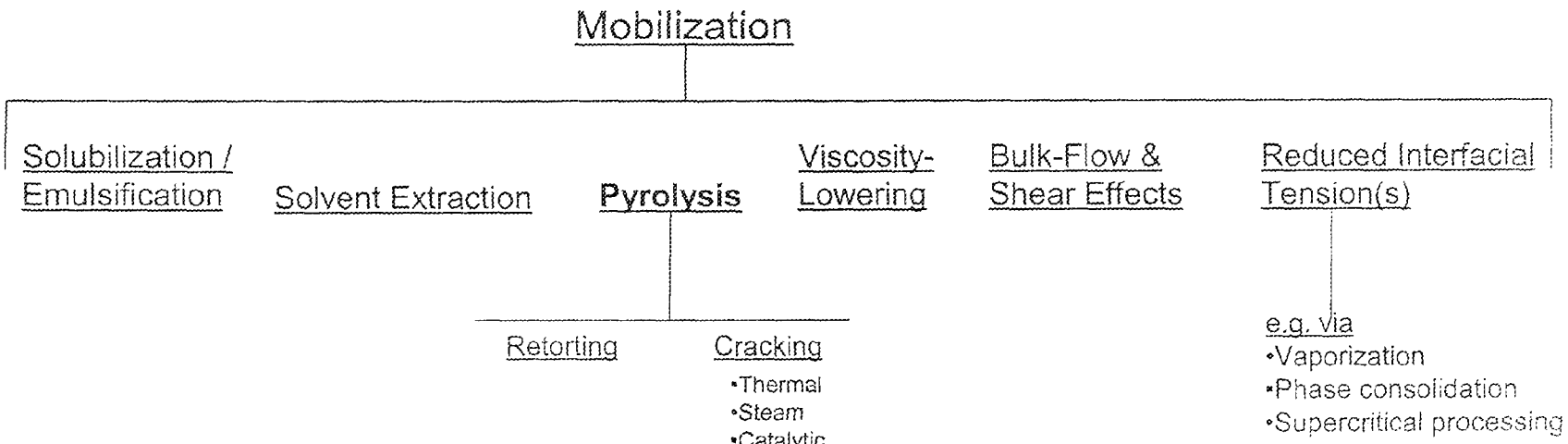

Figure 2a: Full Scale Unitized Operations in Stage A
Total Land = 180 sq Miles = 130 sq Miles Retorted + 50 sq Miles Hydrodynamic Barrier
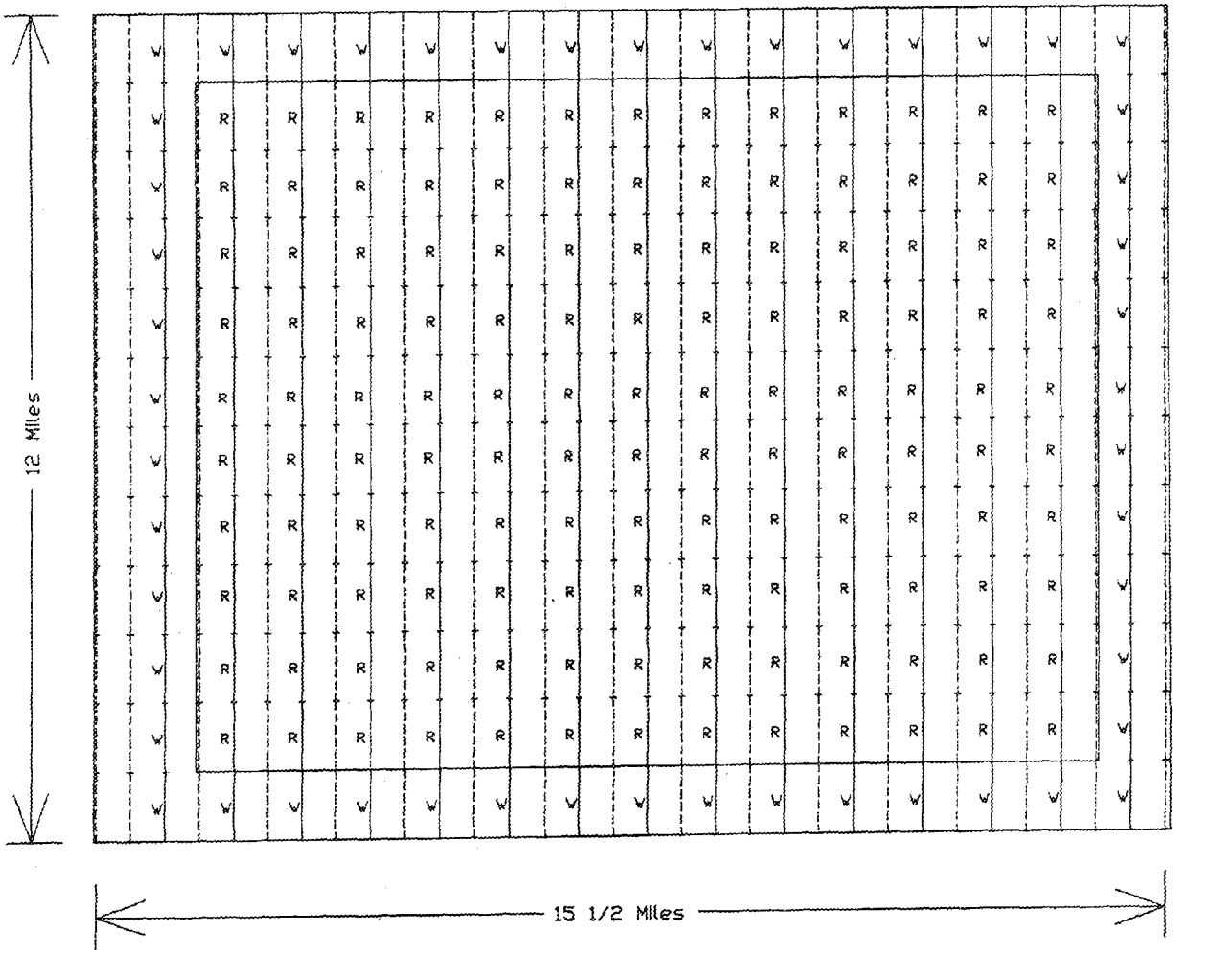

Figure 2b: Full Scale Unitized Operations In Stage B
Total Land = 180 sq Miles = 130 sq Miles Retorted + 50 sq Miles Hydrodynamic Barrier
W = Water Injection (62 Miles, 992 wells in each of 4 depth zones = 3,968 Wells / 4 Zones)
R = Retorting Injection (130 Miles, 2080 wells in each of 4 depth zones = 8,320 Wells / 4 Zones)
= Production (192 Miles, 3,072 wells in each of 4 depth zones = 2,288 Wells / 4 Zones)
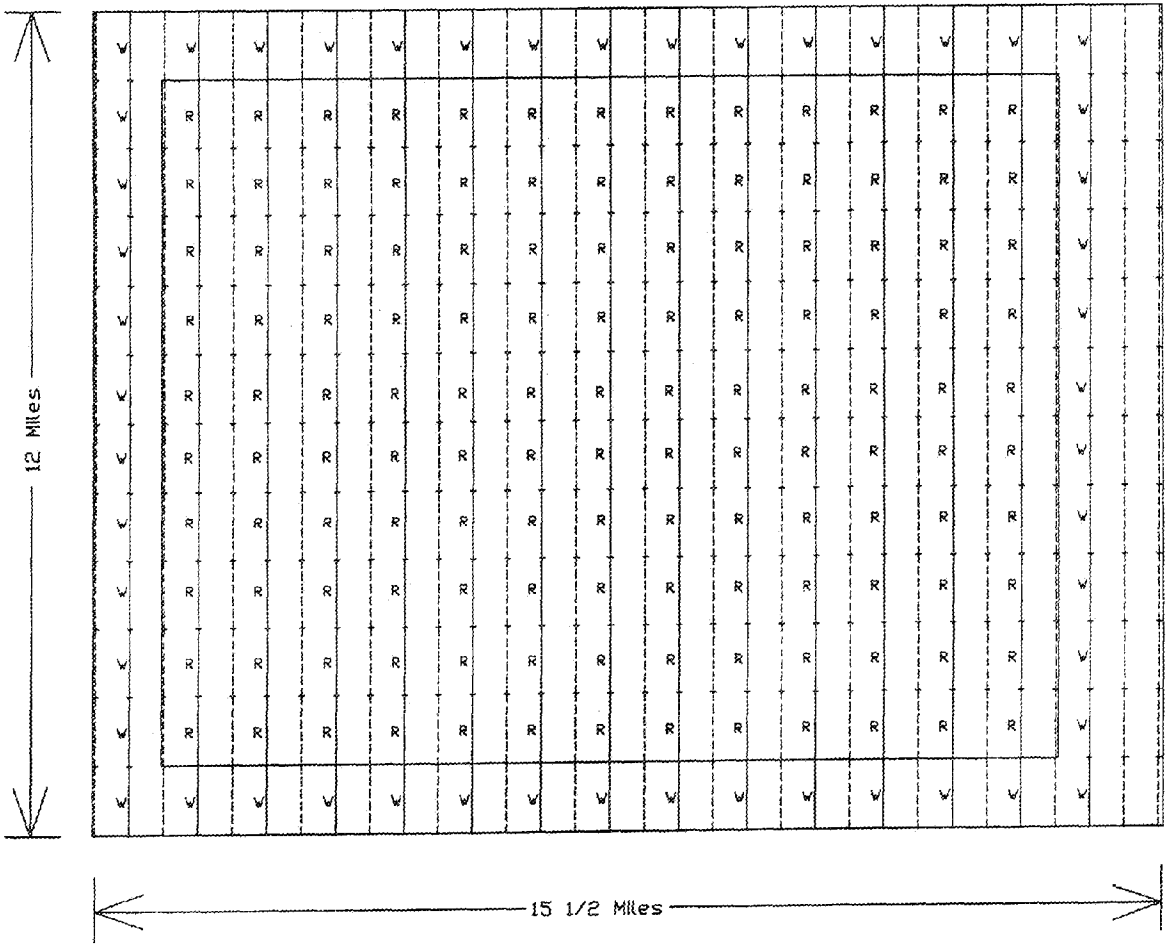

Figure 3: Thermal Energy Required For Retorting Oil Shale
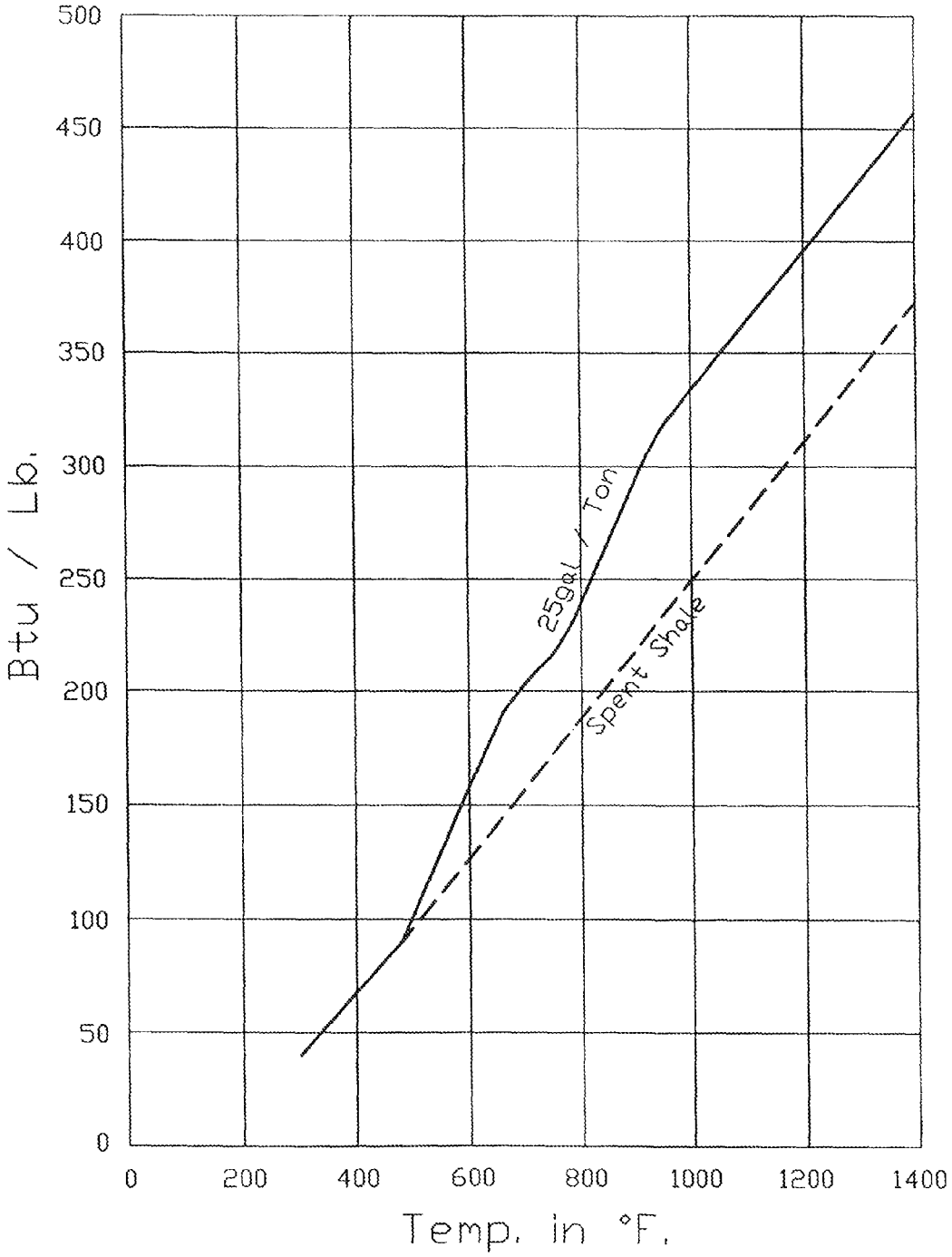

Figure 4: Typical Stratigraphic Column of Oil Shale Zones in the Eureka Creek Area, Rio Blanco Co, Colorado
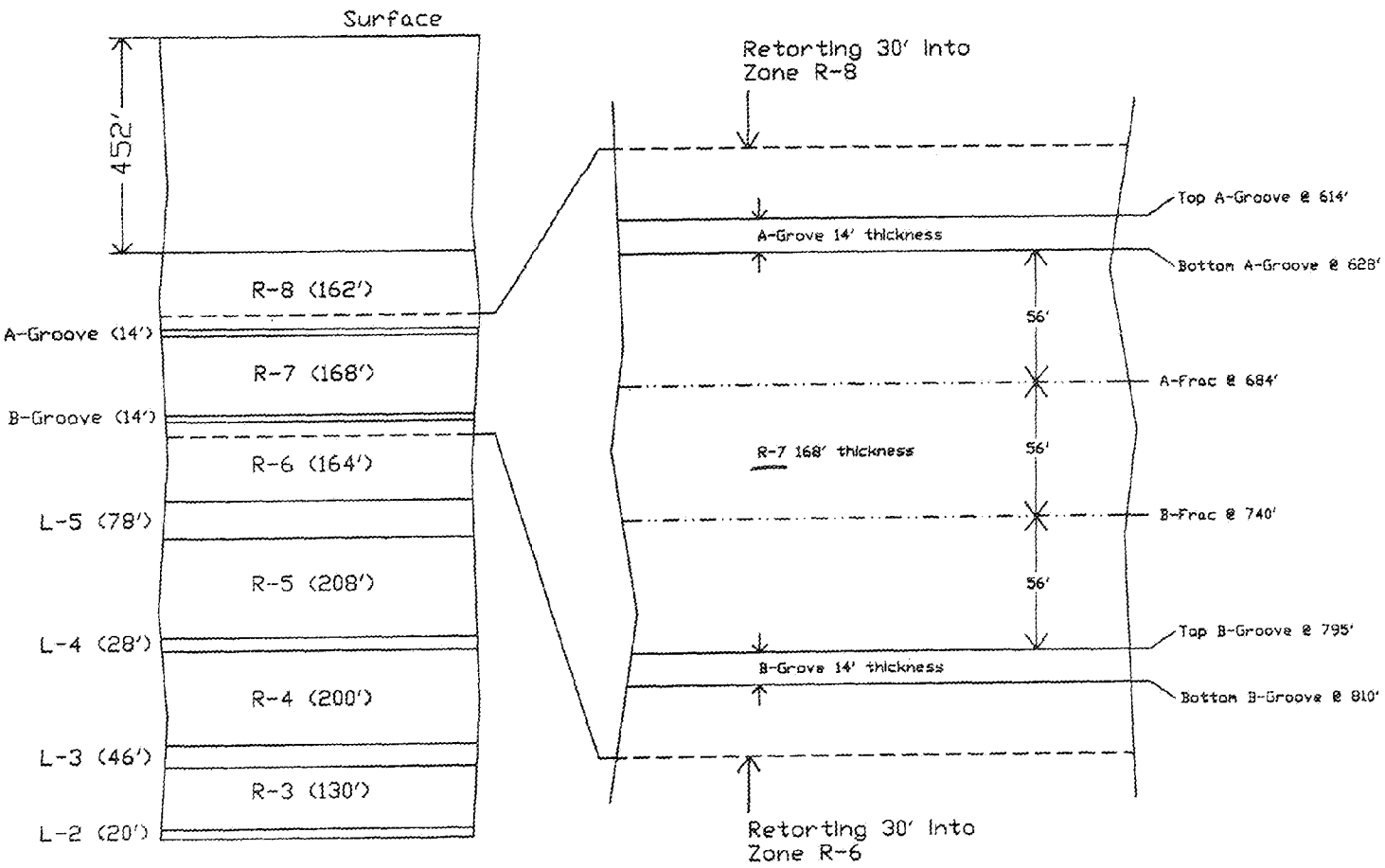

Figure 5a: 'B-Groove' Aquifer Retorting Injection Pressures, Production Pressures and Avg. Aquifer Pressures, Vs. Depth and Potentrometric Surface Elevations in the Initial Eureka Wells.
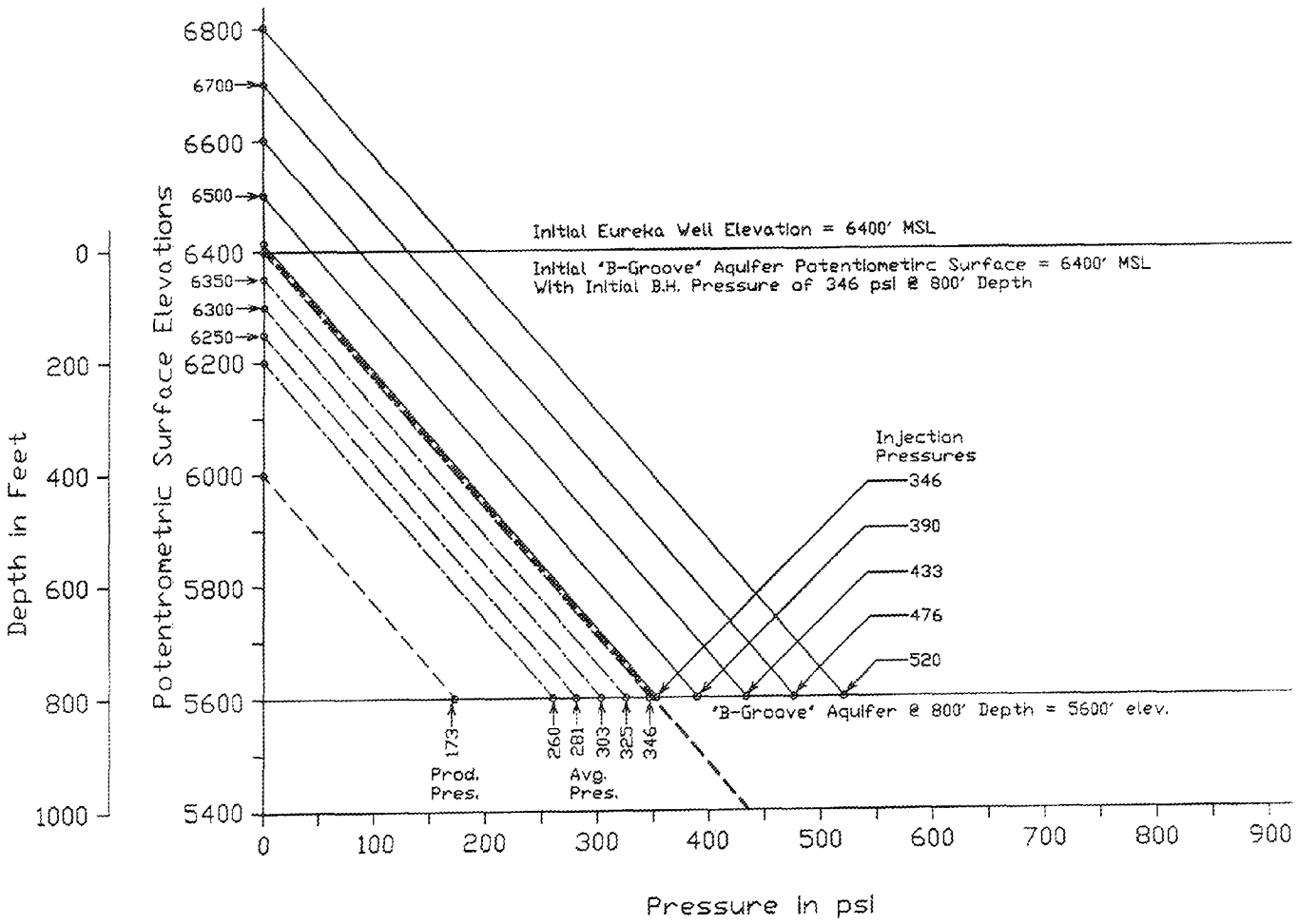

Figure 5b: 'A-Groove' Aquifer Retorting Injection Pressures, Production Pressures and Avg. Aquifer Pressures, Vs. Depth and Potentrometric Surface Elevations in the Initial Eureka Wells.
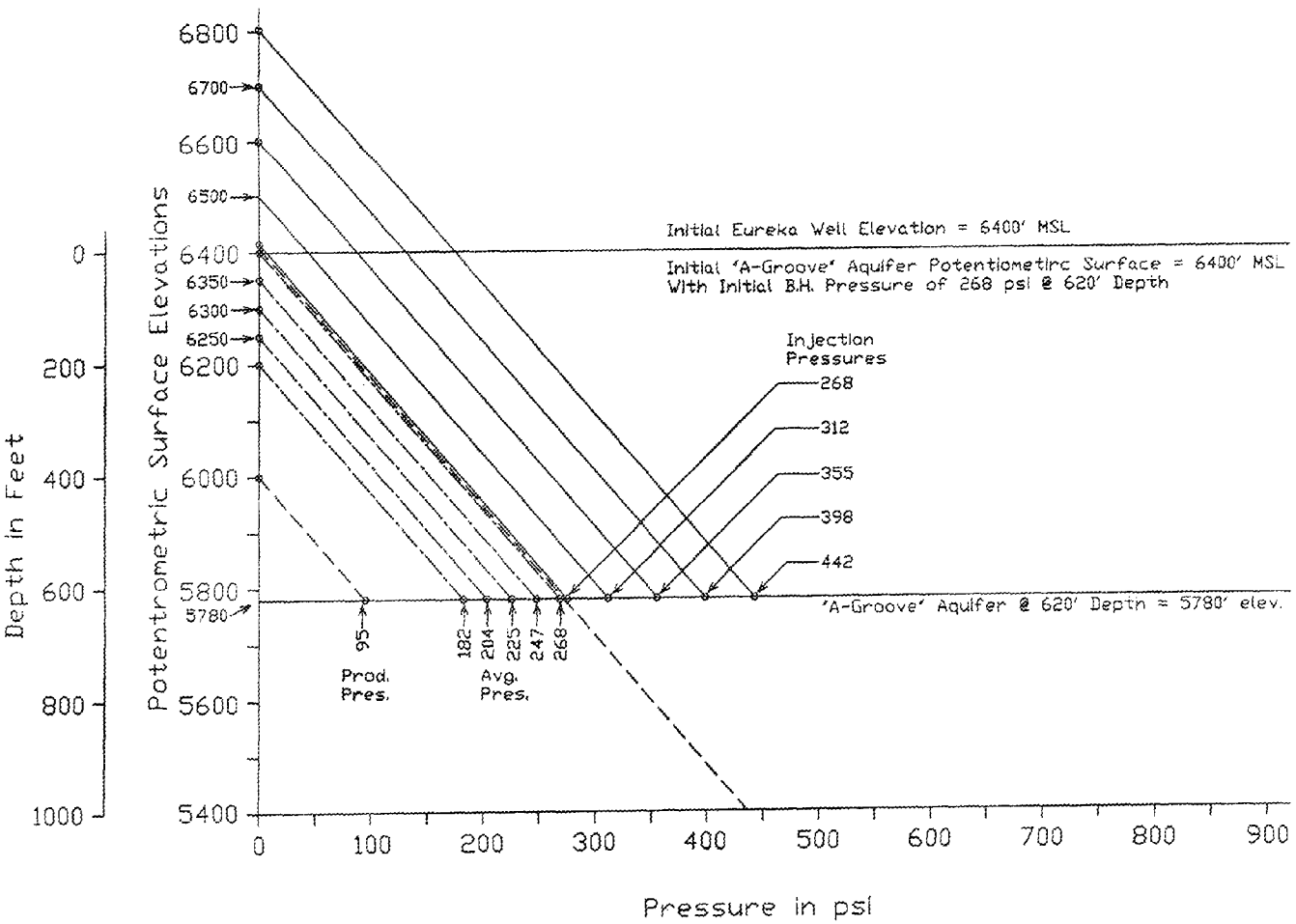

Figure 5C: 'B-Frac' Aquifer Retorting Injection Pressures, Production Pressures and Avg. Aquifer Pressures, Vs. Depth and Potentrometric Surface Elevations in the Initial Eureka Wells.
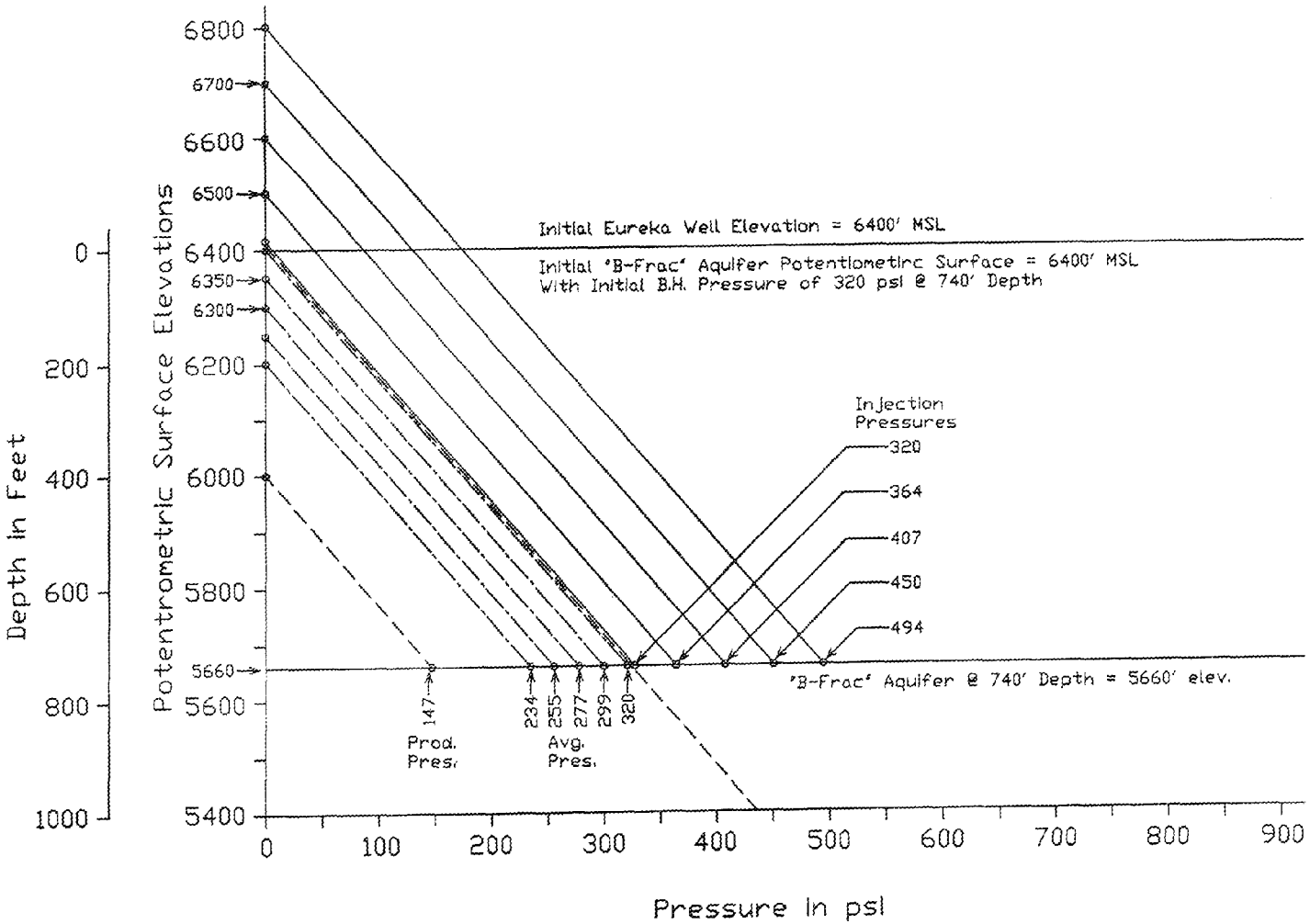

Figure 5d: 'A-Frac' Aquifer Retorting Injection Pressures, Production Pressures and Avg. Aquifer Pressures, Vs. Depth and Potentrometric Surface Elevations in the Initial Eureka Wells.
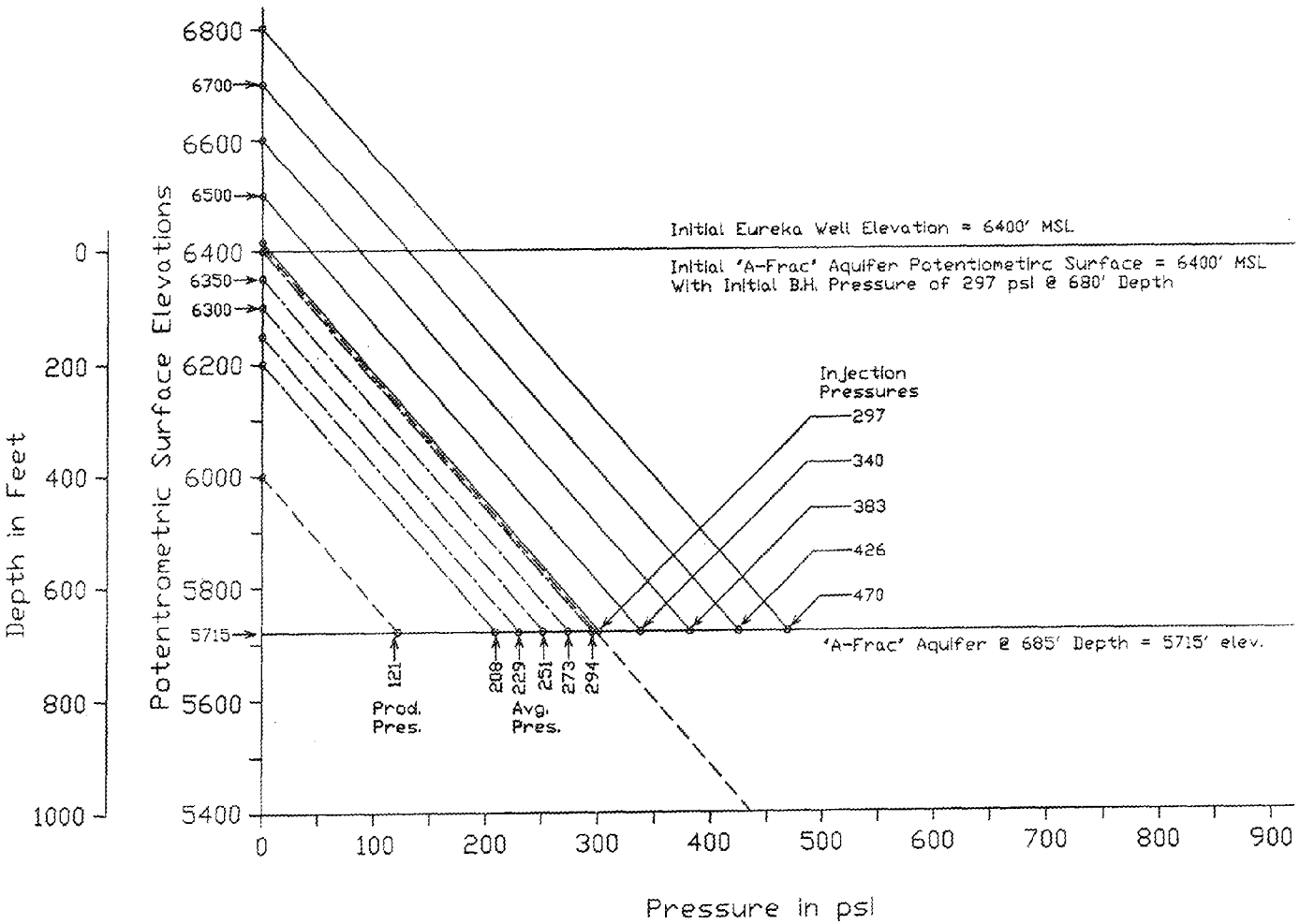

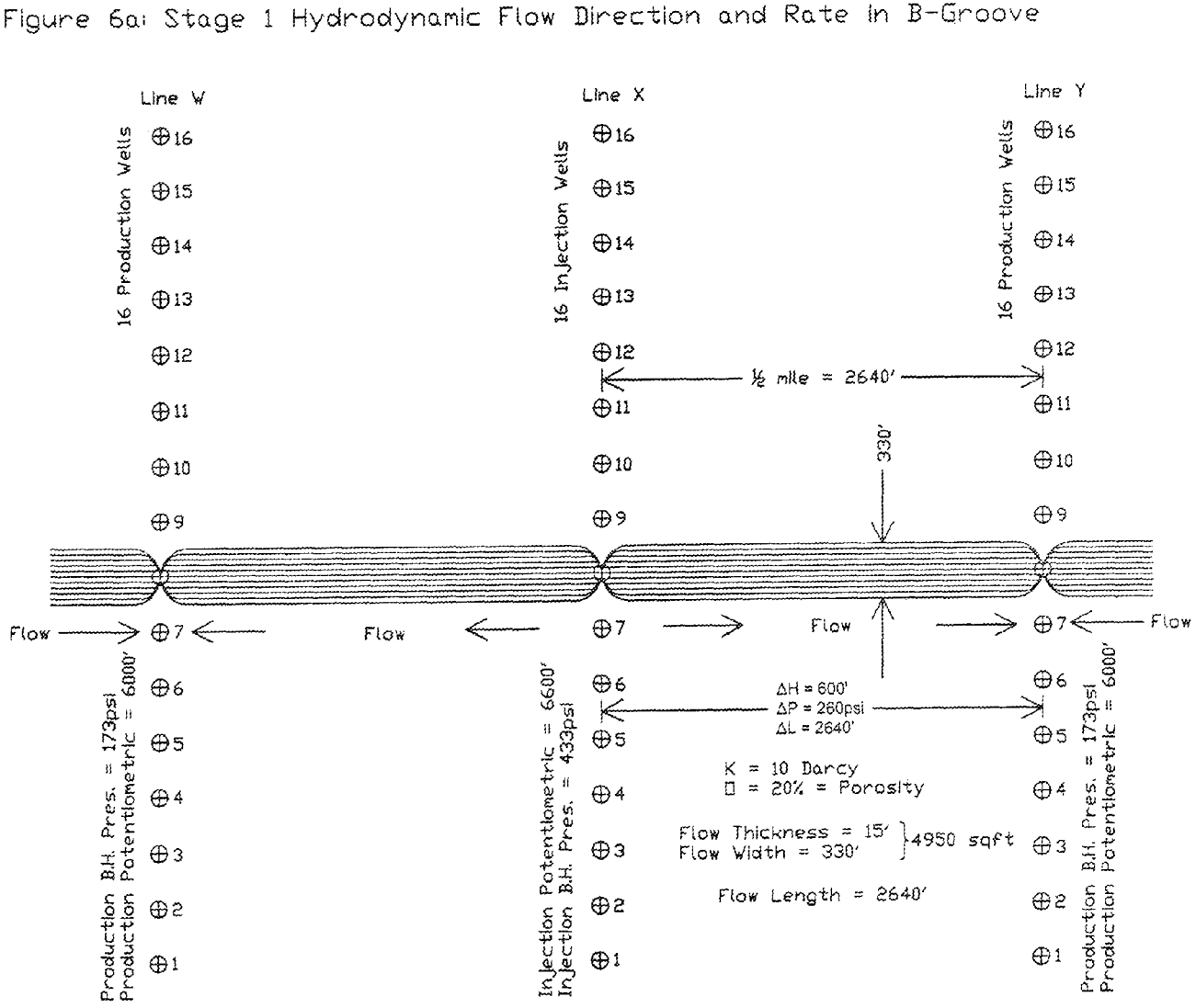
Figure 6a: Stage 1 Hydrodynamic Flow Direction and Rate in B-Groove

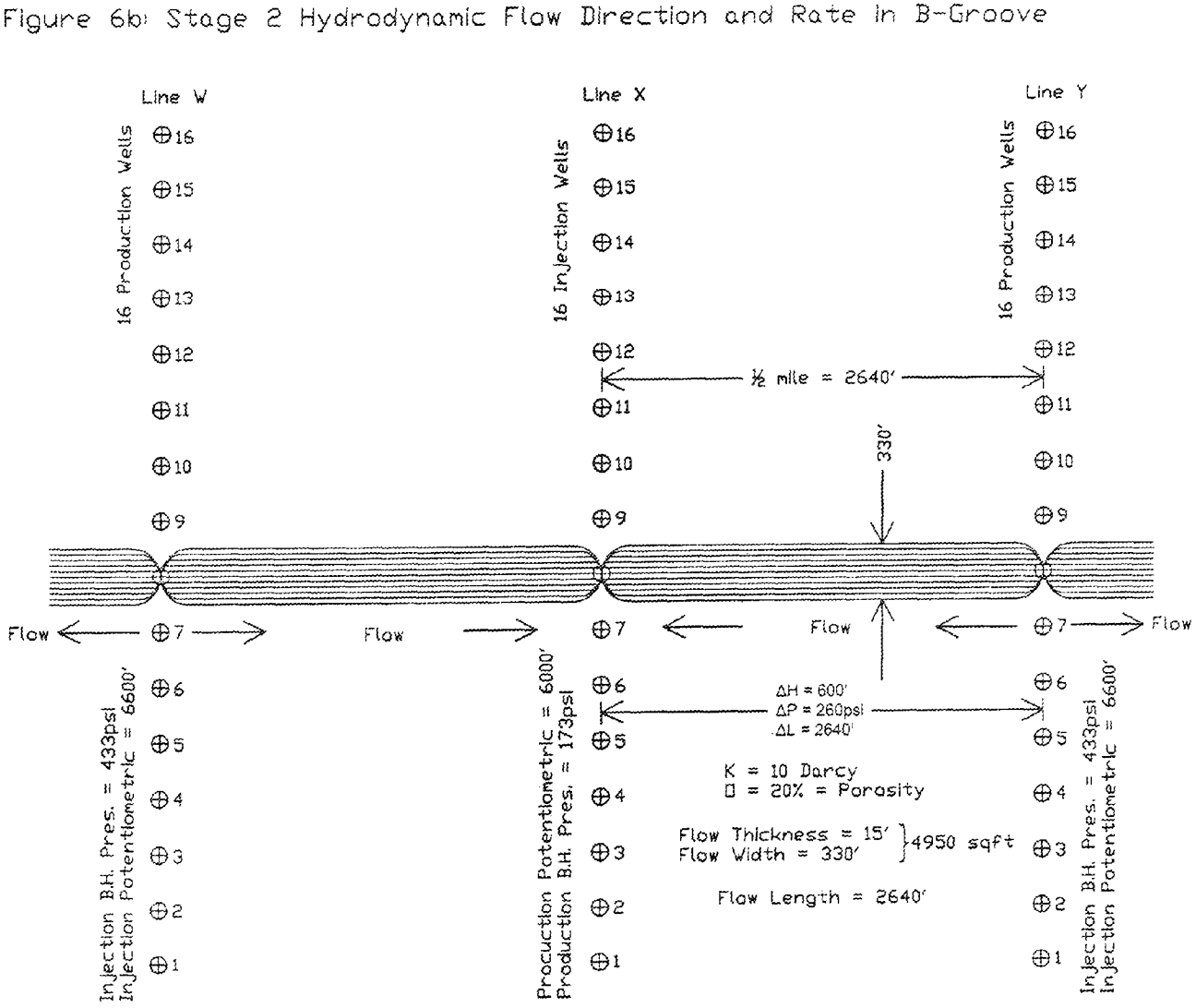
Figure 6b: Stage 2 Hydrodynamic Flow Direction and Rate in B-Groove

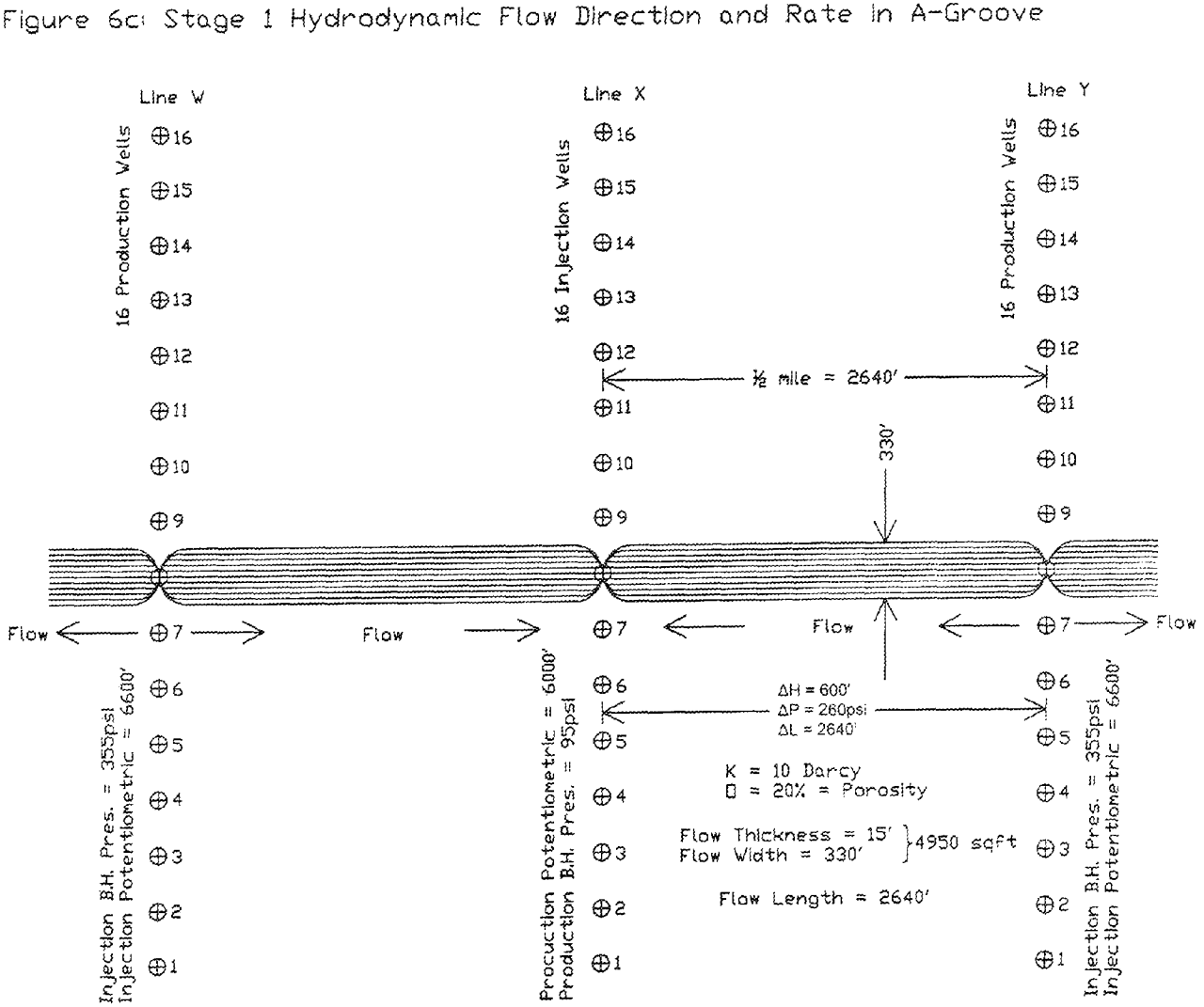
Figure 6c: Stage 1 Hydrodynamic Flow Direction and Rate in A-Groove

Figure 6d: Stage 2 Hydrodynamic Flow Direction and Rate in A-Groove
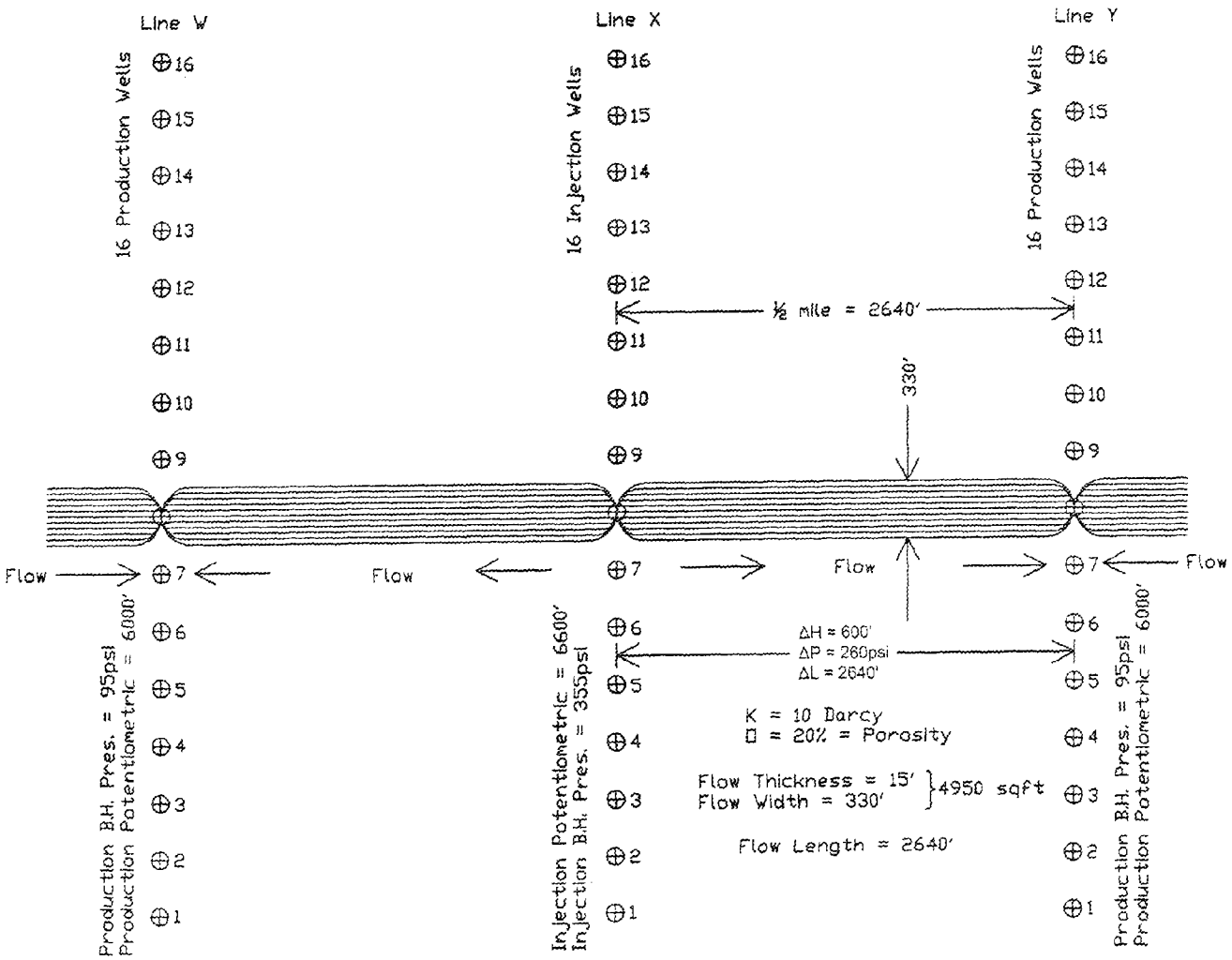

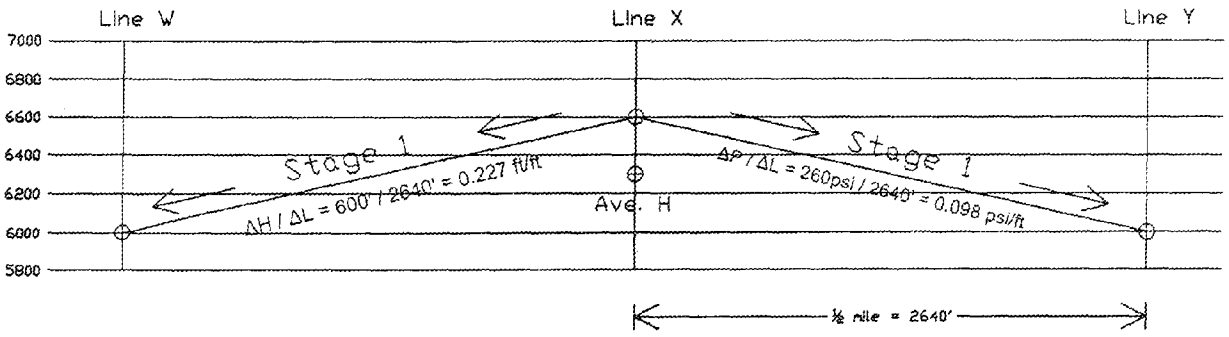
Figure 7a: Stage 1 Potentiometric Gradients and Pressure Gradients in B-Groove and B-Frac
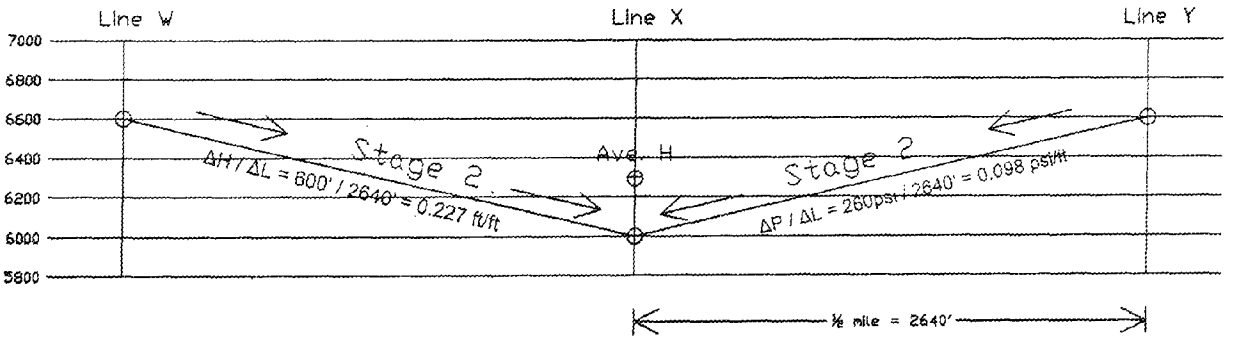
Figure 7b: Stage 2 Potentiometric Gradients and Pressure Gradients in B-Groove and B-Frac

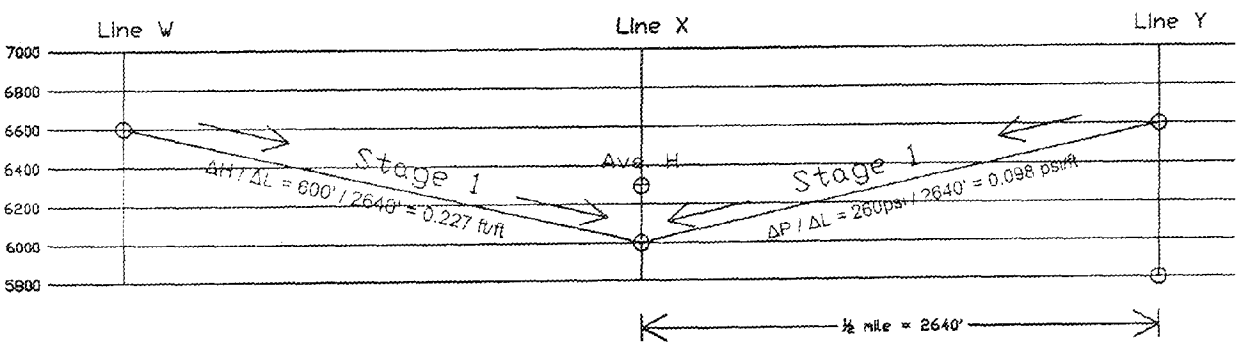
Figure 7c: Stage 1 Potentiometric Gradients and Pressure Gradients in A-Groove and A-Frac
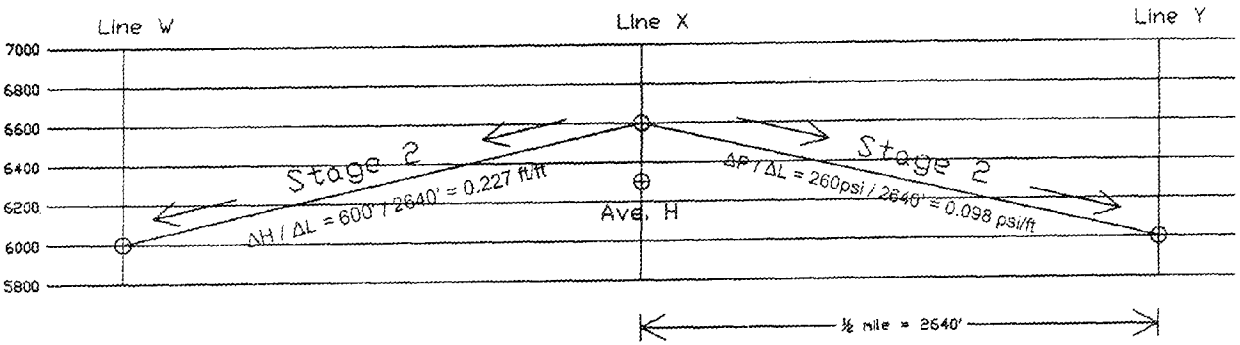
Figure 7d: Stage 2 Potentiometric Gradients and Pressure Gradients in A-Groove and A-Frac Figure 8a: Stage 1 Potentiometric Gradients and Pressure Gradients in B-Groove and B-Frac
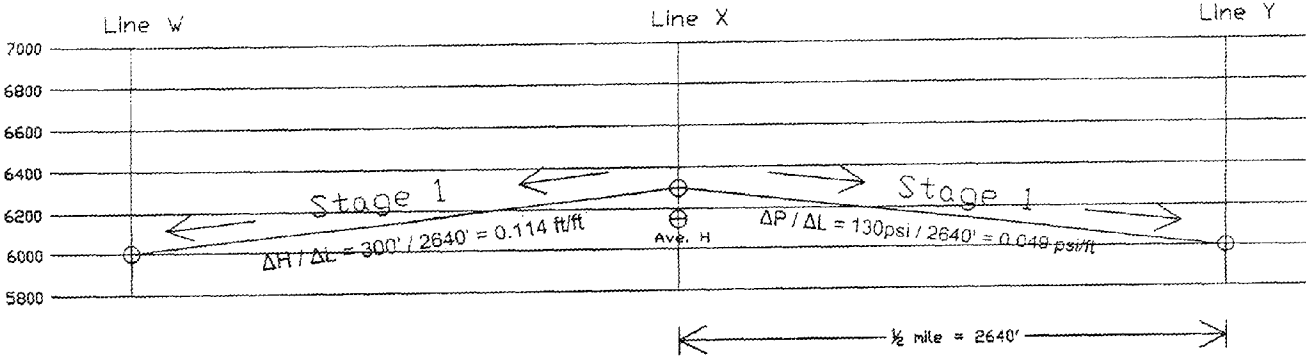
Figure 8b: Stage 2 Potentiometric Gradients and Pressure Gradients in B-Groove and B-Frac
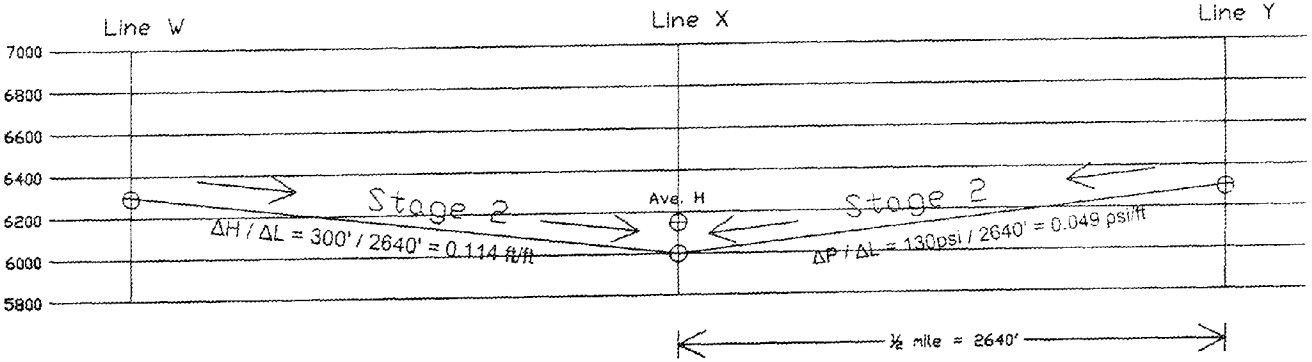

Figure 8c: Stage 1 Potentiometric Gradients and Pressure Gradients in A-Groove and A-Frac
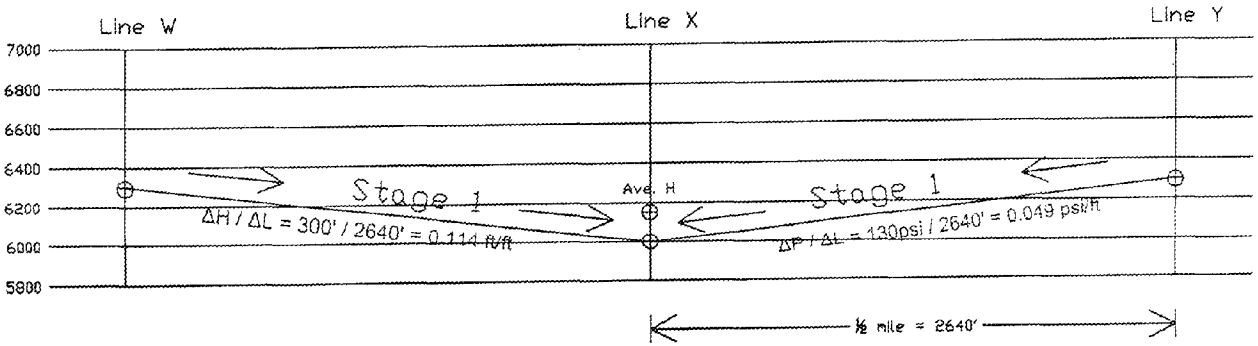
Figure 8d: Stage 2 Potentiometric Gradients and Pressure Gradients in A-Groove and A-Frac
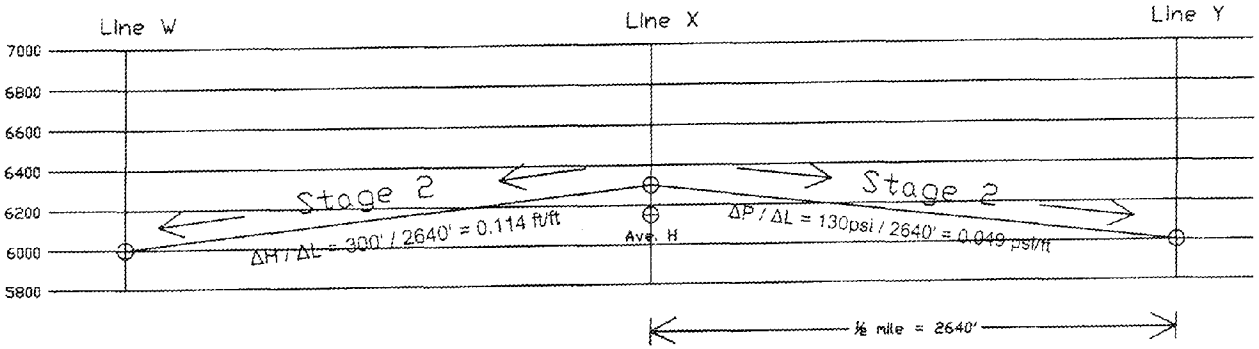

Figure 9a: Hydrodynamic Caprock to Prevent Leakage From R-7 to R-8 and Above
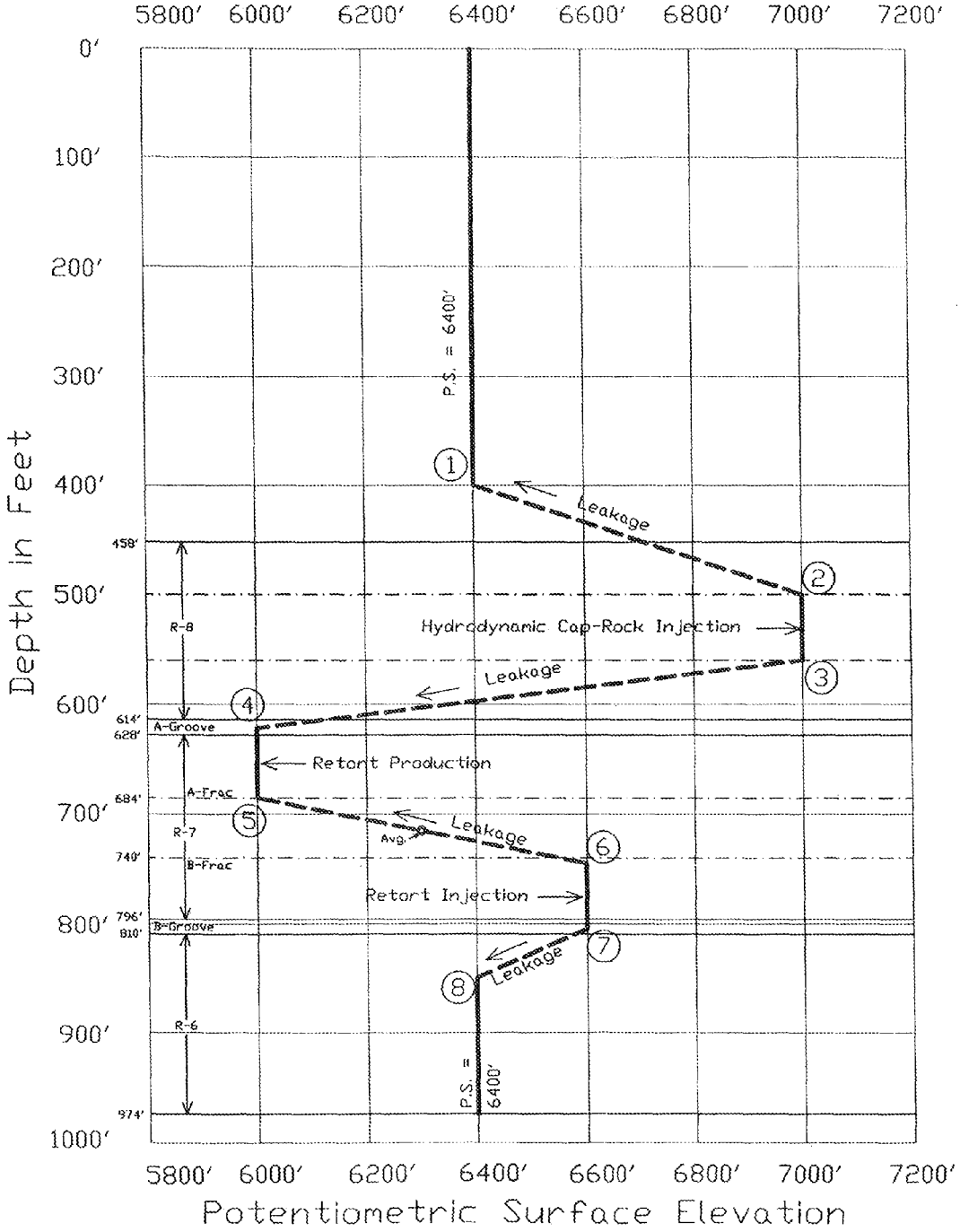

Figure 9b: Hydrodynamic Caprock to Prevent Leakage From R-7 to R-8 and Above
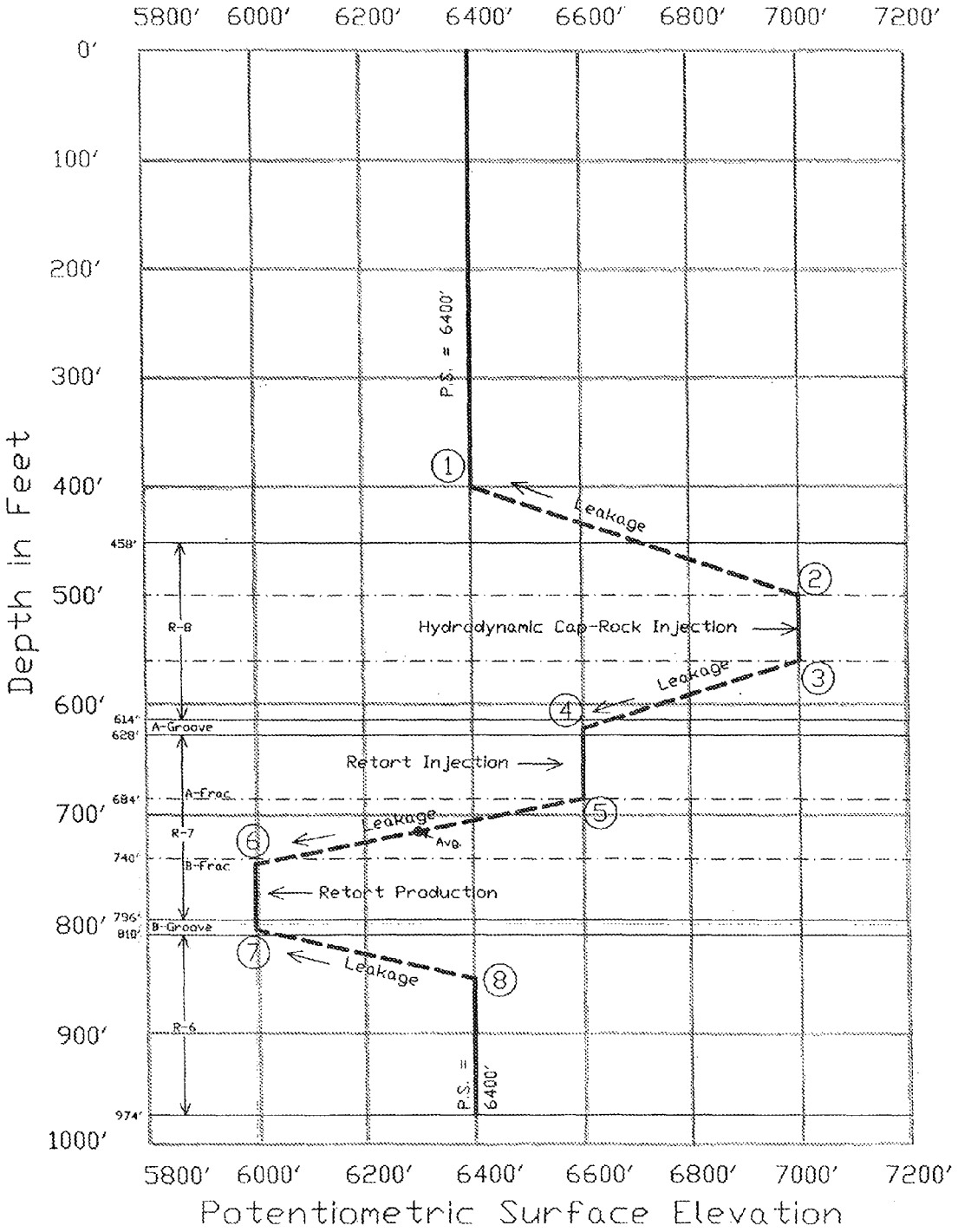

Figure 9c: Hydrodynamic Caprock to Prevent Leakage From R-7 to R-8 and Above
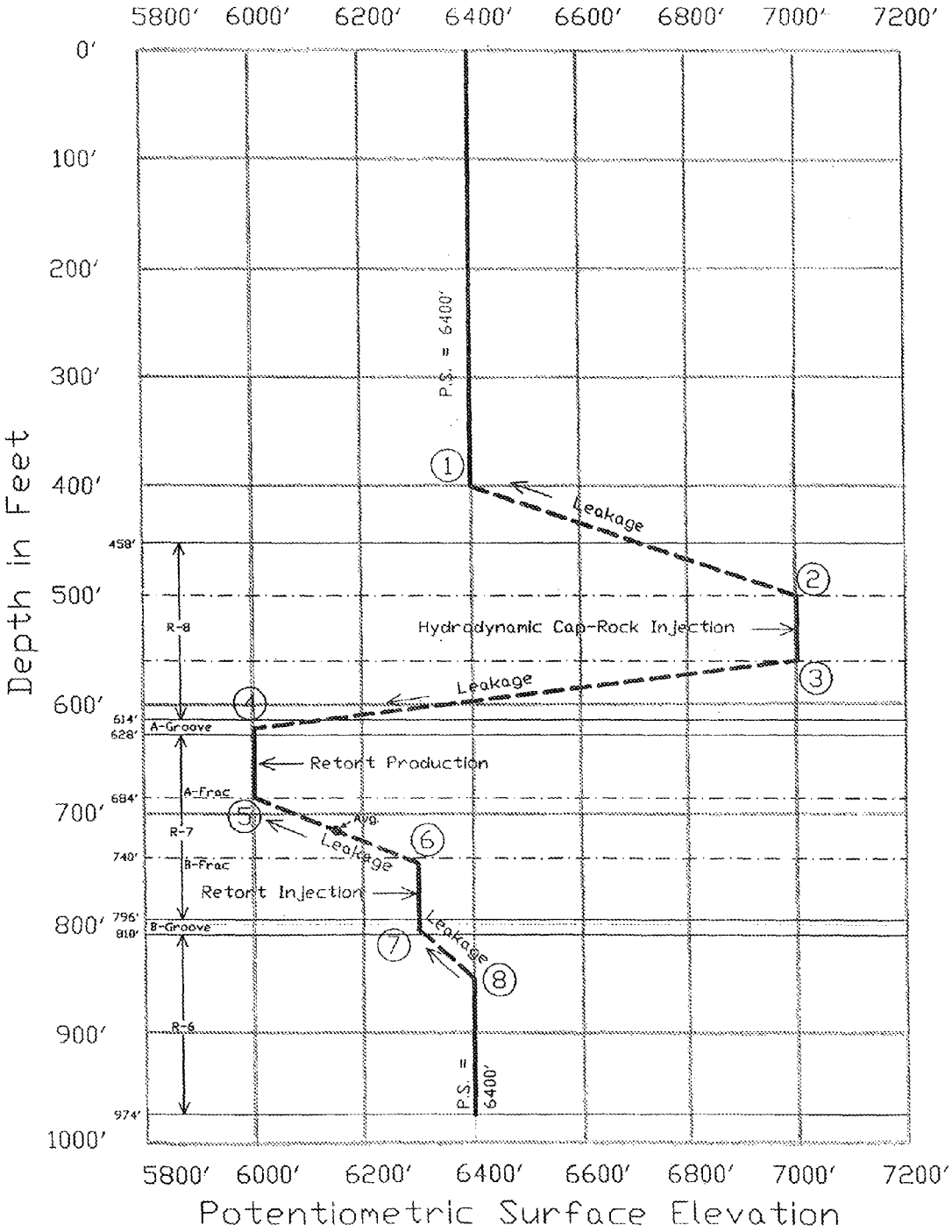

Figure 9d: Hydrodynamic Caprock to Prevent Leakage From R-7 to R-8 and Above
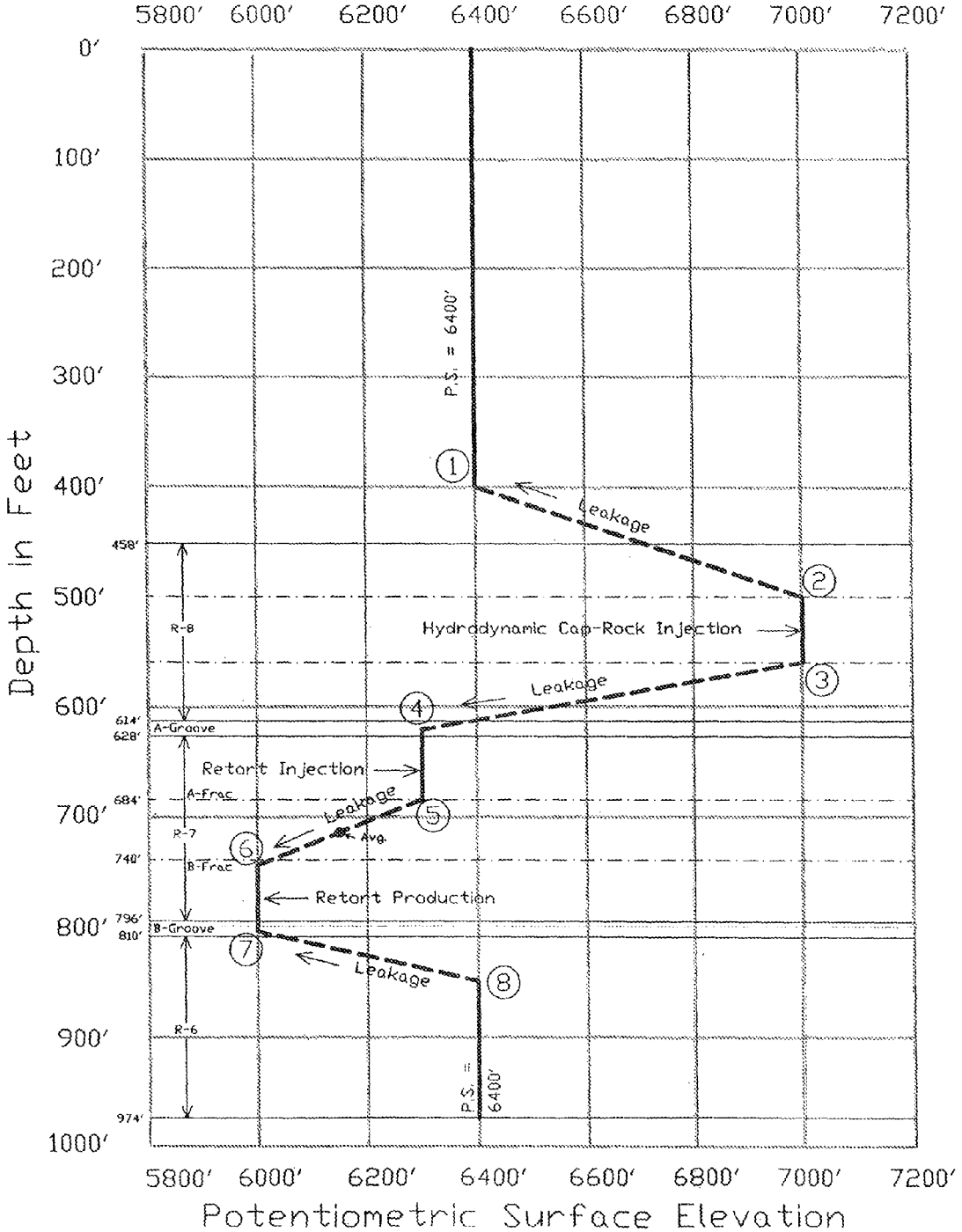

Figure 10a: Hydrodynamic Caprock to Prevent Leakage From R-7 to R-8 and Above
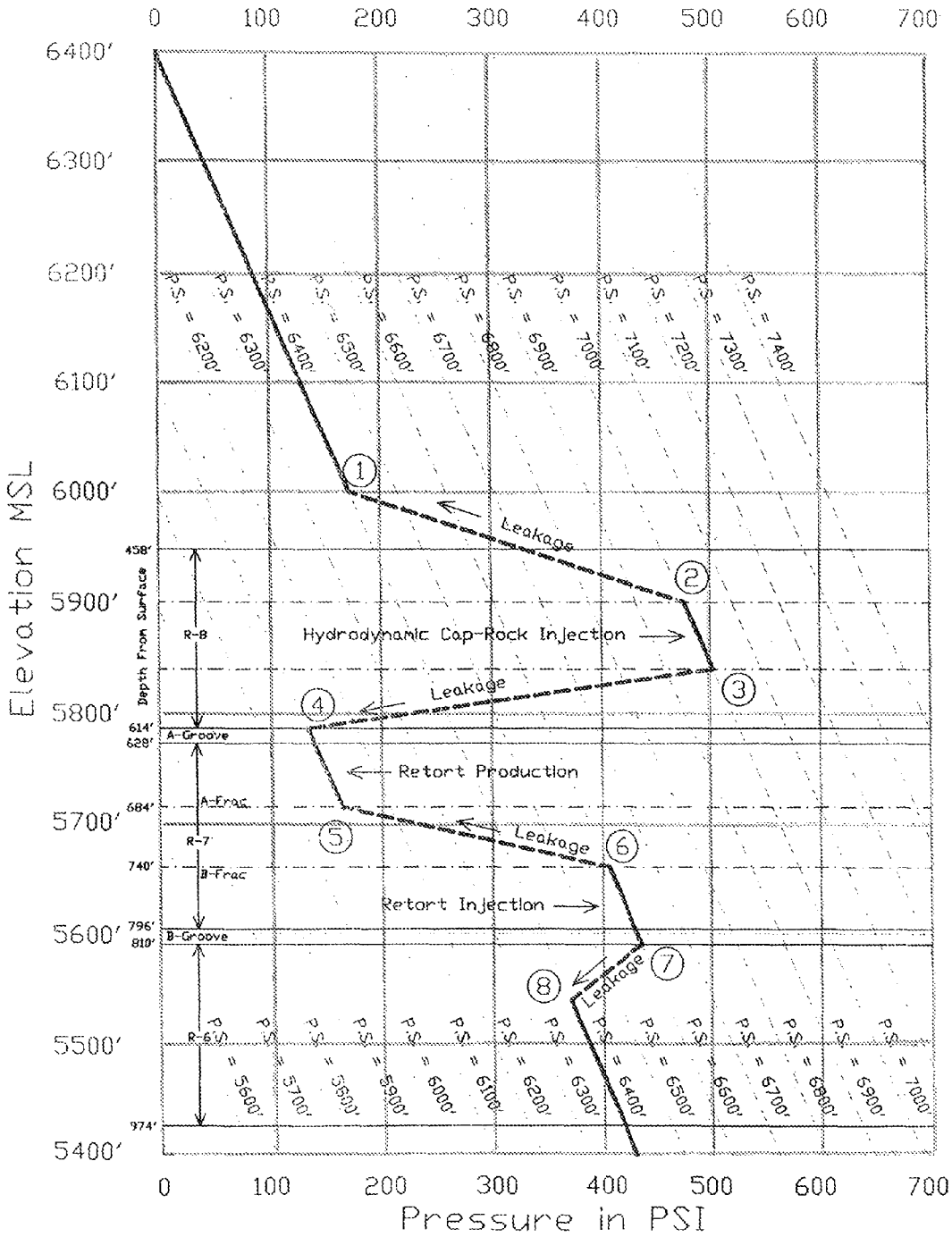

Figure 10b: Hydrodynamic Caprock to Prevent Leakage From R-7 to R-8 and Above
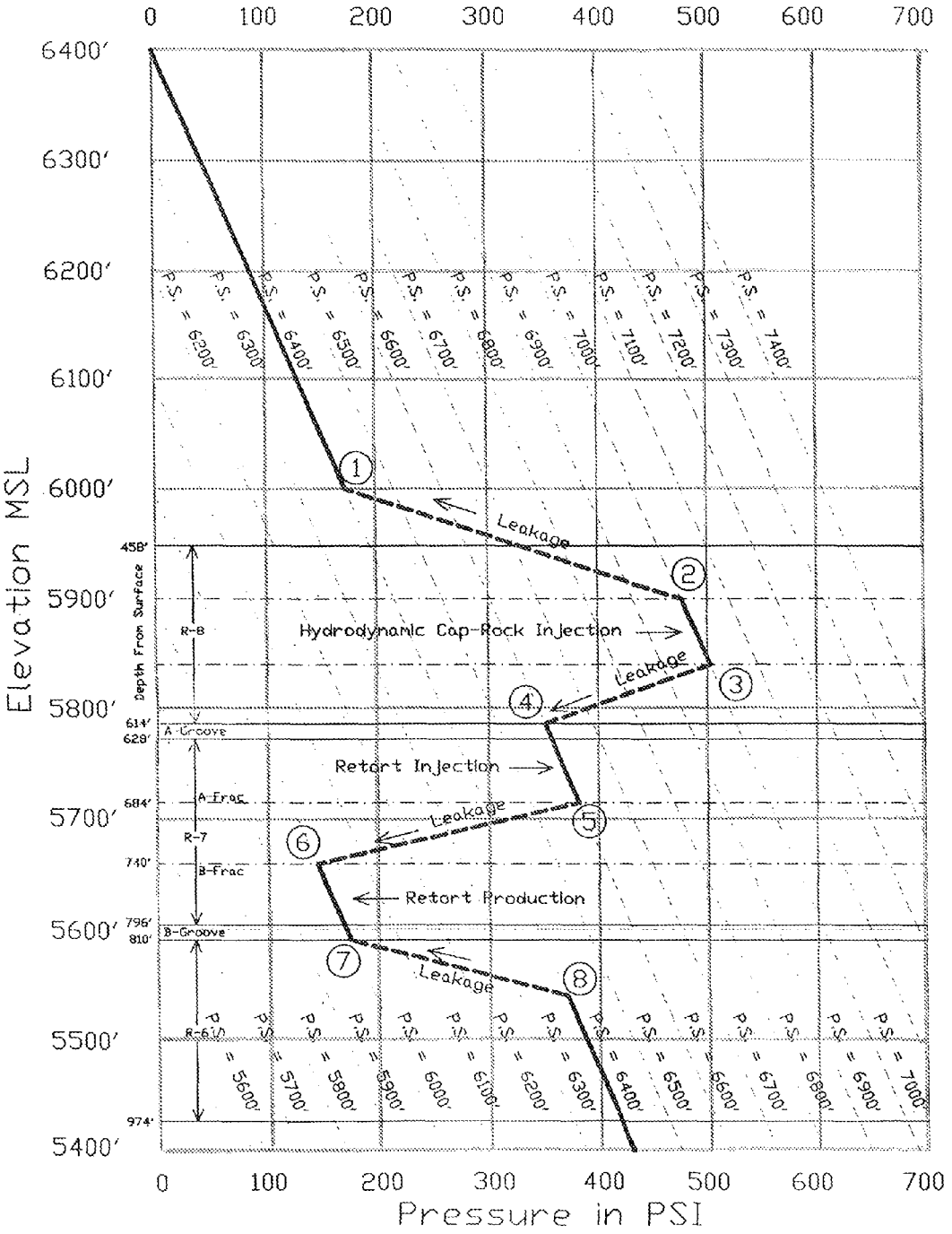

Figure 10c: Hydrodynamic Caprock to Prevent Leakage From R-7 to R-8 and Above
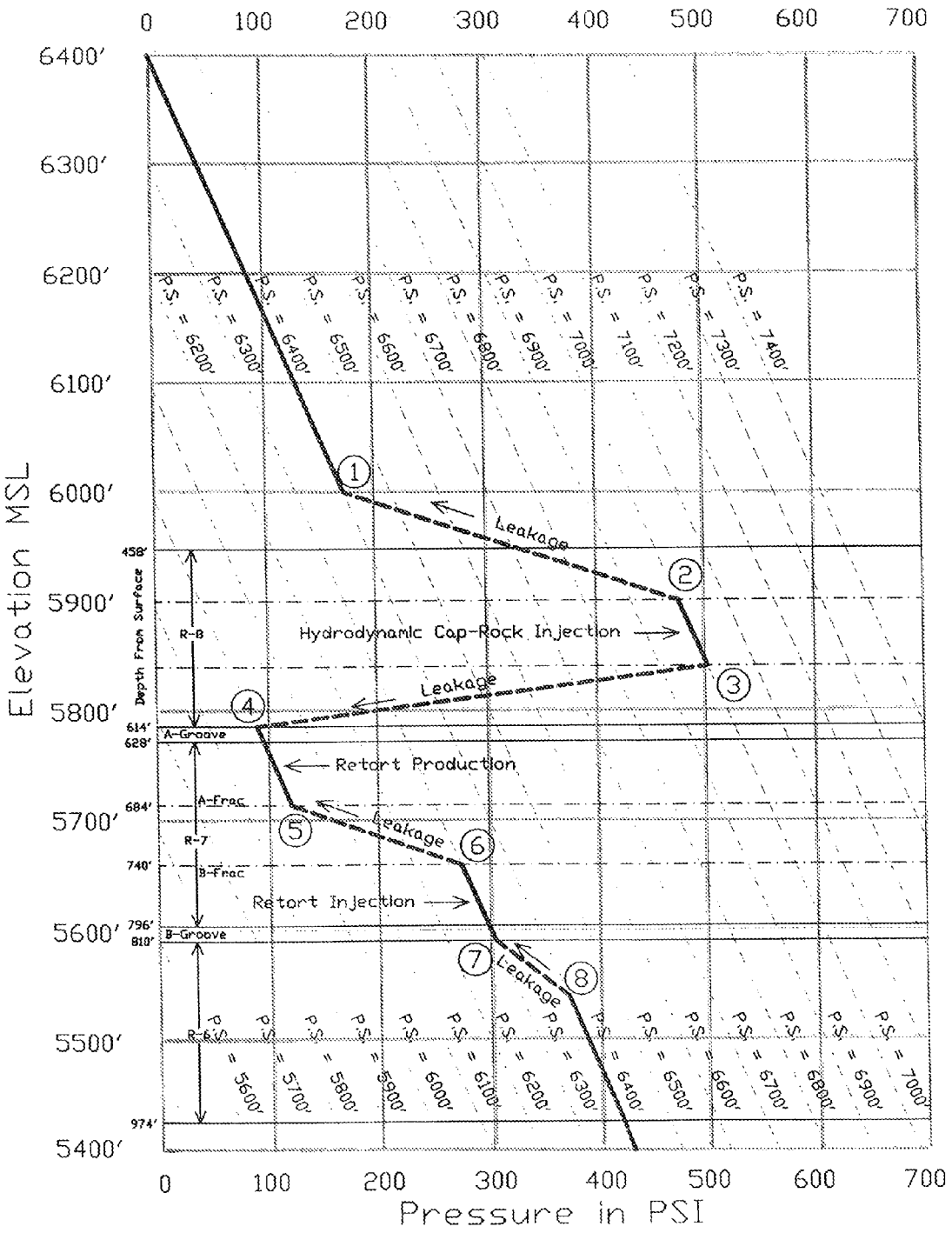

Figure 10d: Hydrodynamic Caprock to Prevent Leakage From R-7 to R-8 and Above
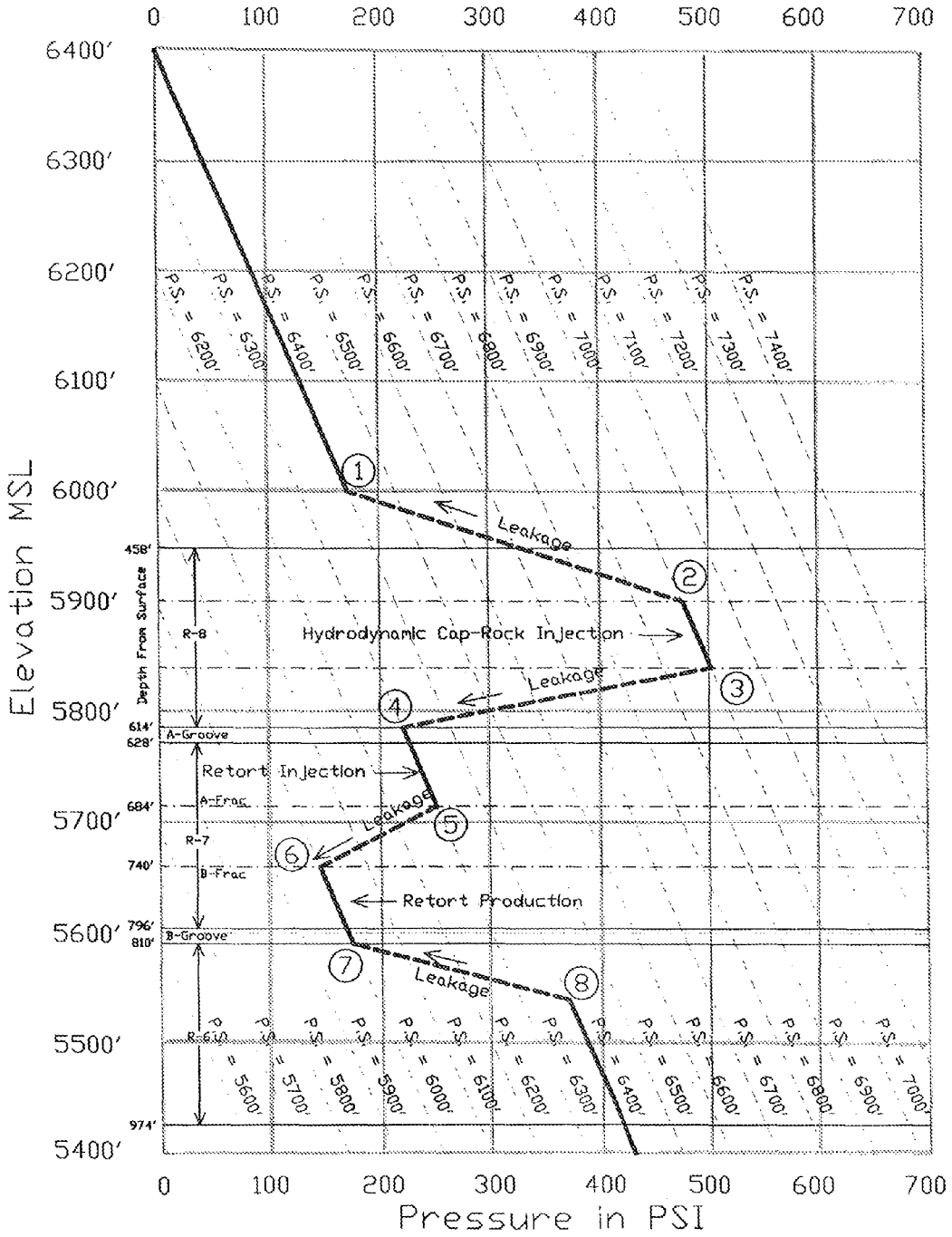

S = Steam Injection Wells (each segment = 1 mile of wells)
R = Retorting Injection Wells (each segment = 1 mile of wells)
= Production Wells (each segment = 1 mile of wells)

Figure 12a: Heat content (in BTU/Lb.) as a function of temperature of selected TECF @ constant pressure.
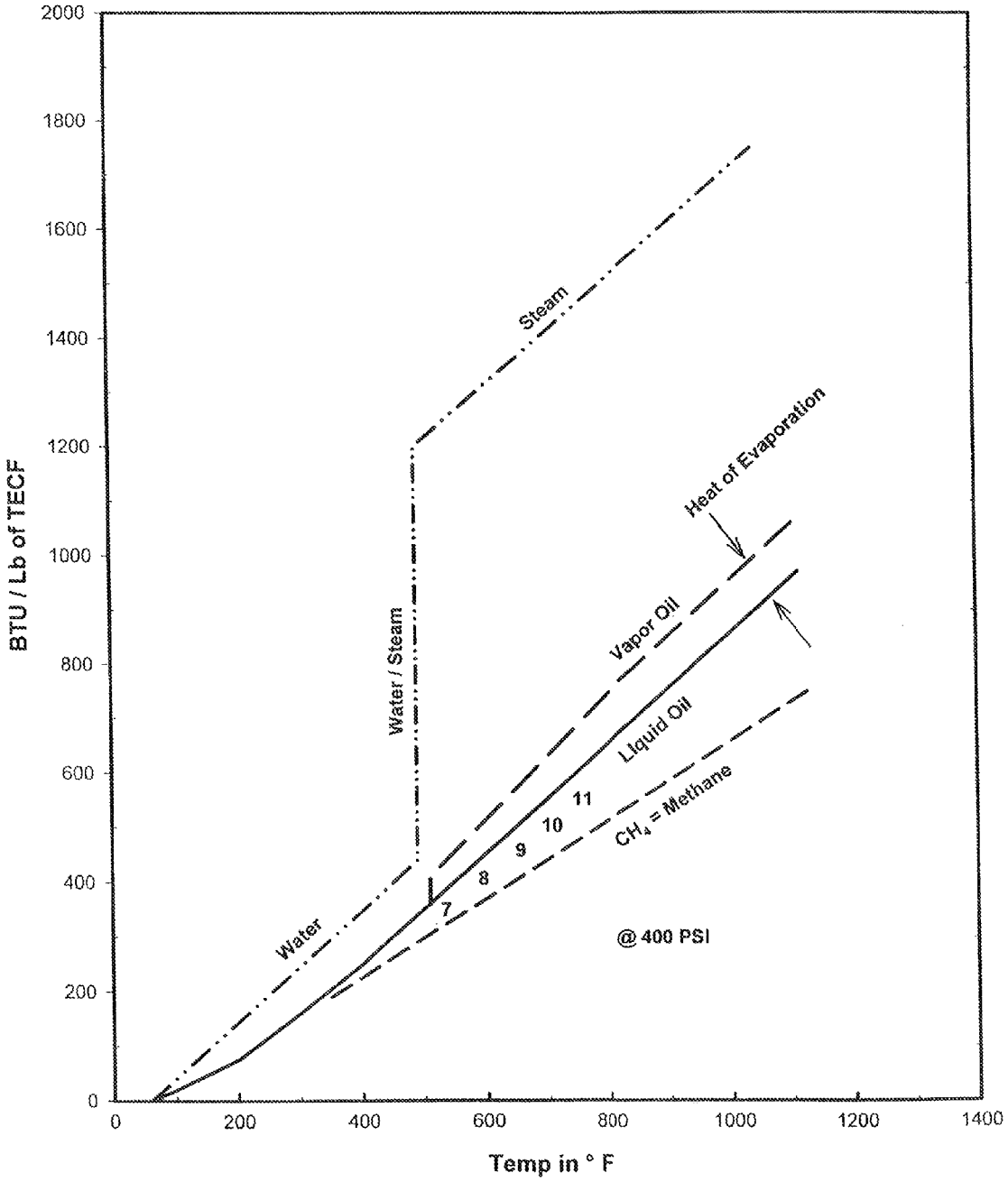

Figure 12b: Heat content (in BTU/Lb.) of steam and combustion air products as a function of temperature
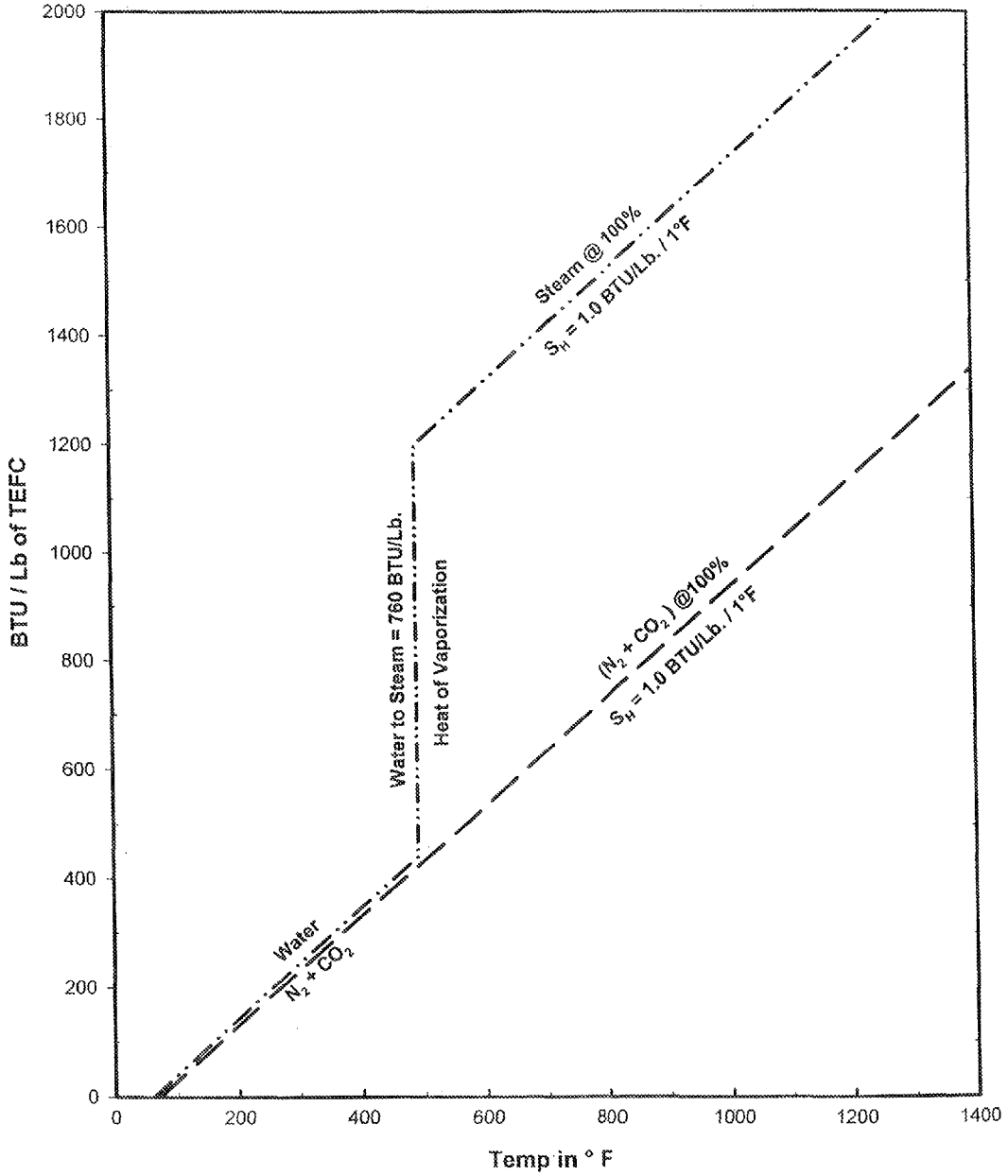

Figure 12c: Heat content (in BTU/Lb.) of a mixture of 20% steam plus 80% combustion air products as a function of temperature
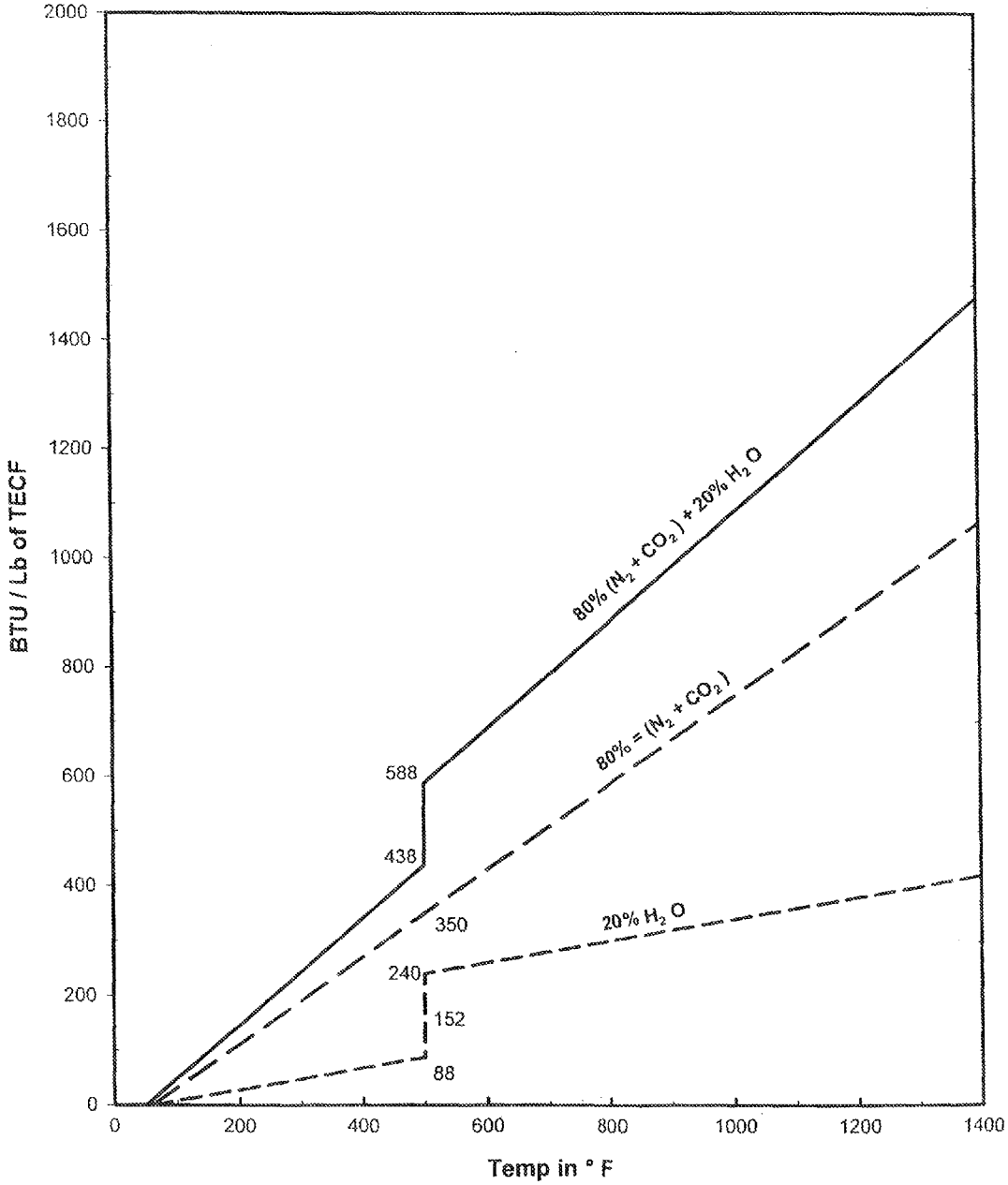

Figure 12d: Heat content (in BTU/Lb.) of a mixture of 40% steam plus 60% combustion air products as a function of temperature
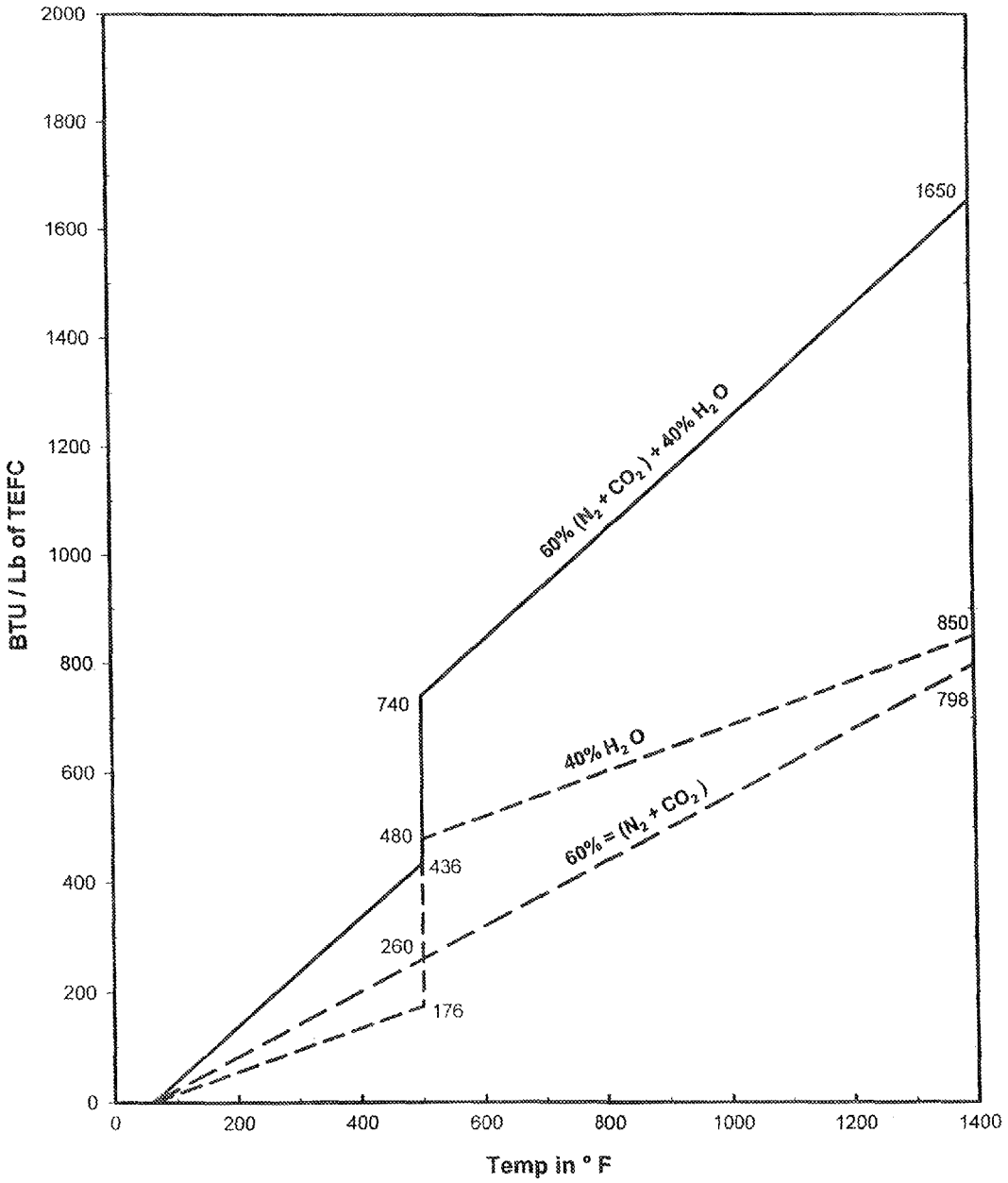

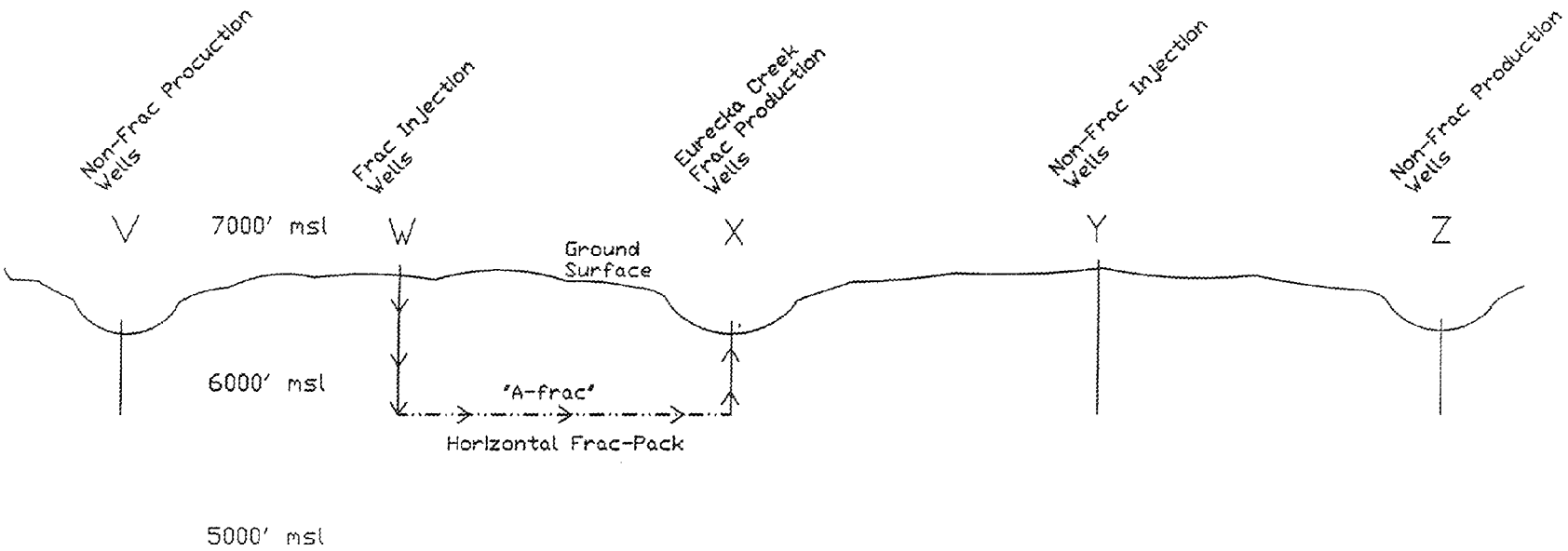
Figure 13a: Horizontal Frac Injection & Productions Wells to Proppant pack from "X" to "W" For "A-frac" @ 658' depth in valley & about 900' depth under ridges with Overburden Lifting Frac Pressures of about 720psi and 945psi respectively

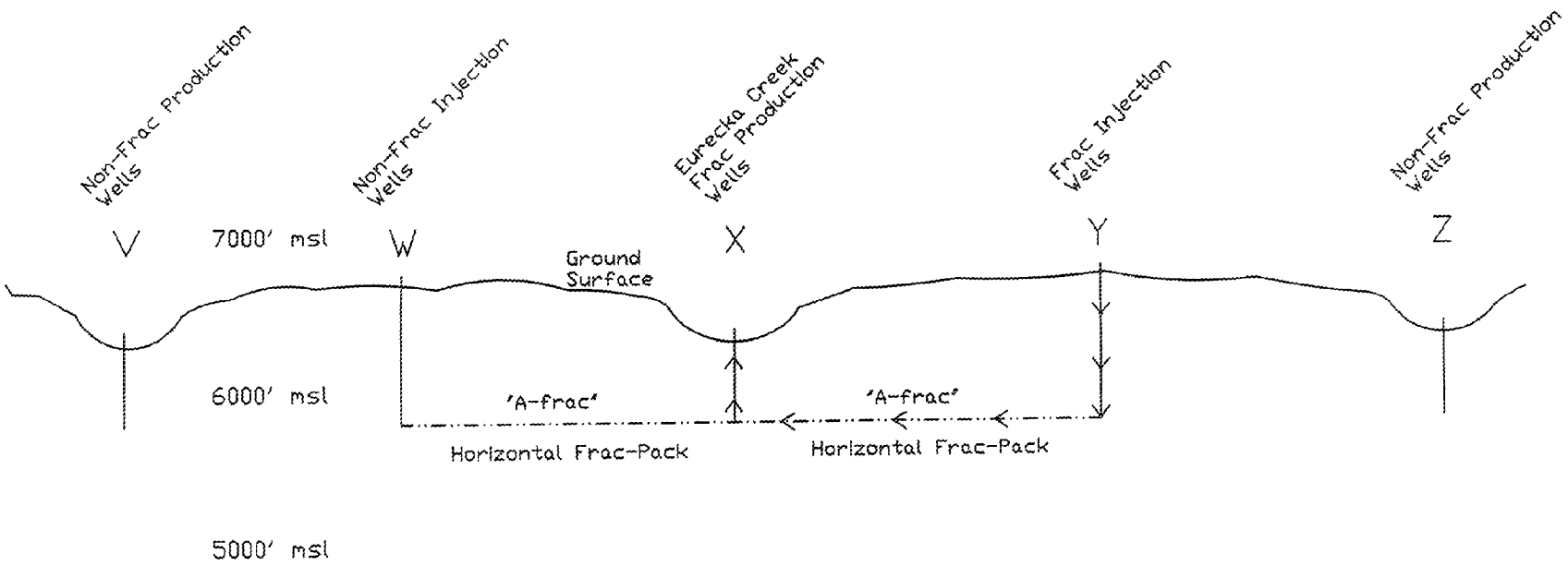
Figure 13b: Horizontal Frac Injection & Productions Wells to Proppant pack from 'X' to 'Y' For 'A-frac' @ 658' depth in valley & about 900' depth under ridges with Overburden Lifting Frac Pressures of about 720psi and 945psi respectively

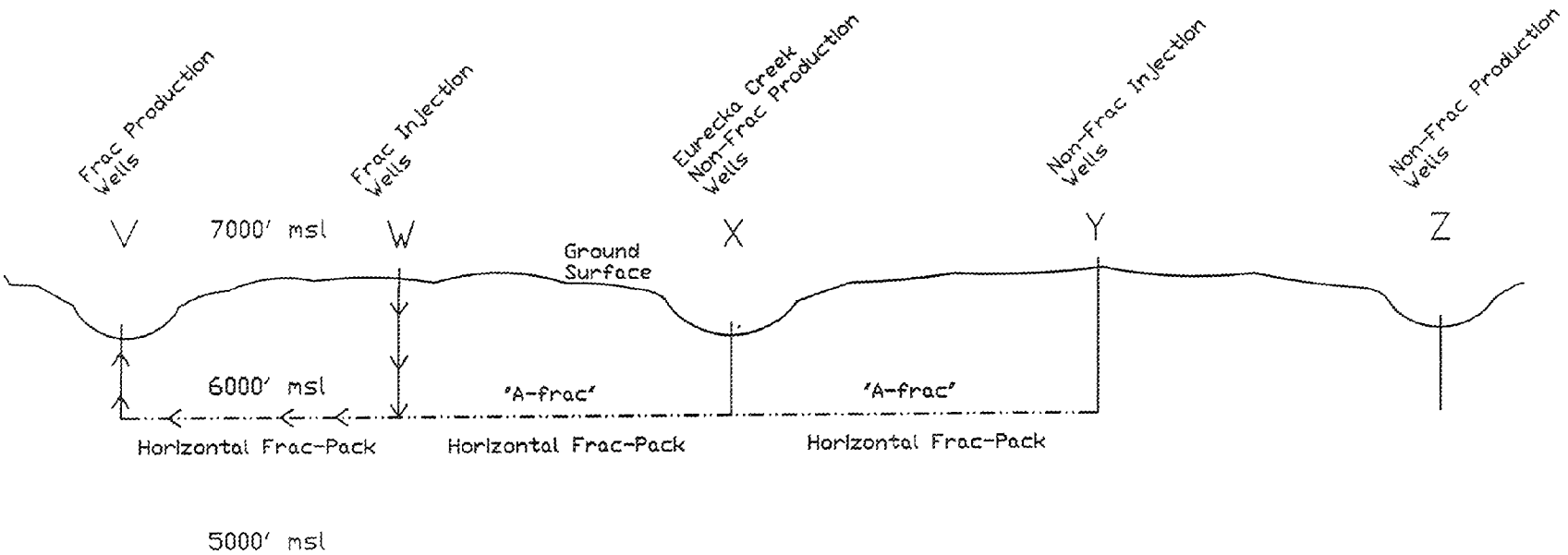
Figure 13c: Horizontal Frac Injection & Productions Wells to Proppant pack from 'V' to 'W' For 'A-frac' @ 658' depth in valley & about 900' depth under ridges with Overburden Lifting Frac Pressures of about 720psi and 945psi respectively

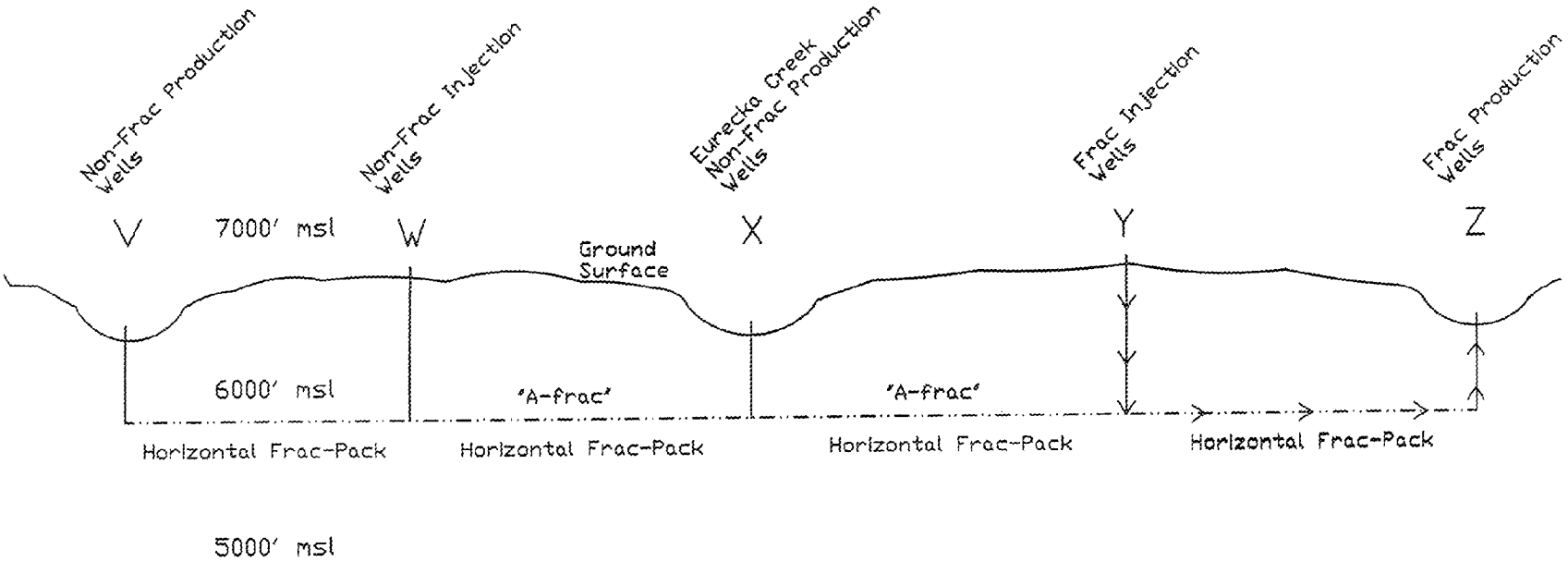
Figure 13d: Horizontal Frac Injection & Productions Wells to Proppant pack from 'Z' to 'Y' For 'A-frac' @ 658' depth in valley & about 900' depth under ridges with Overburden Lifting Frac Pressures of about 720psi and 945psi respectively

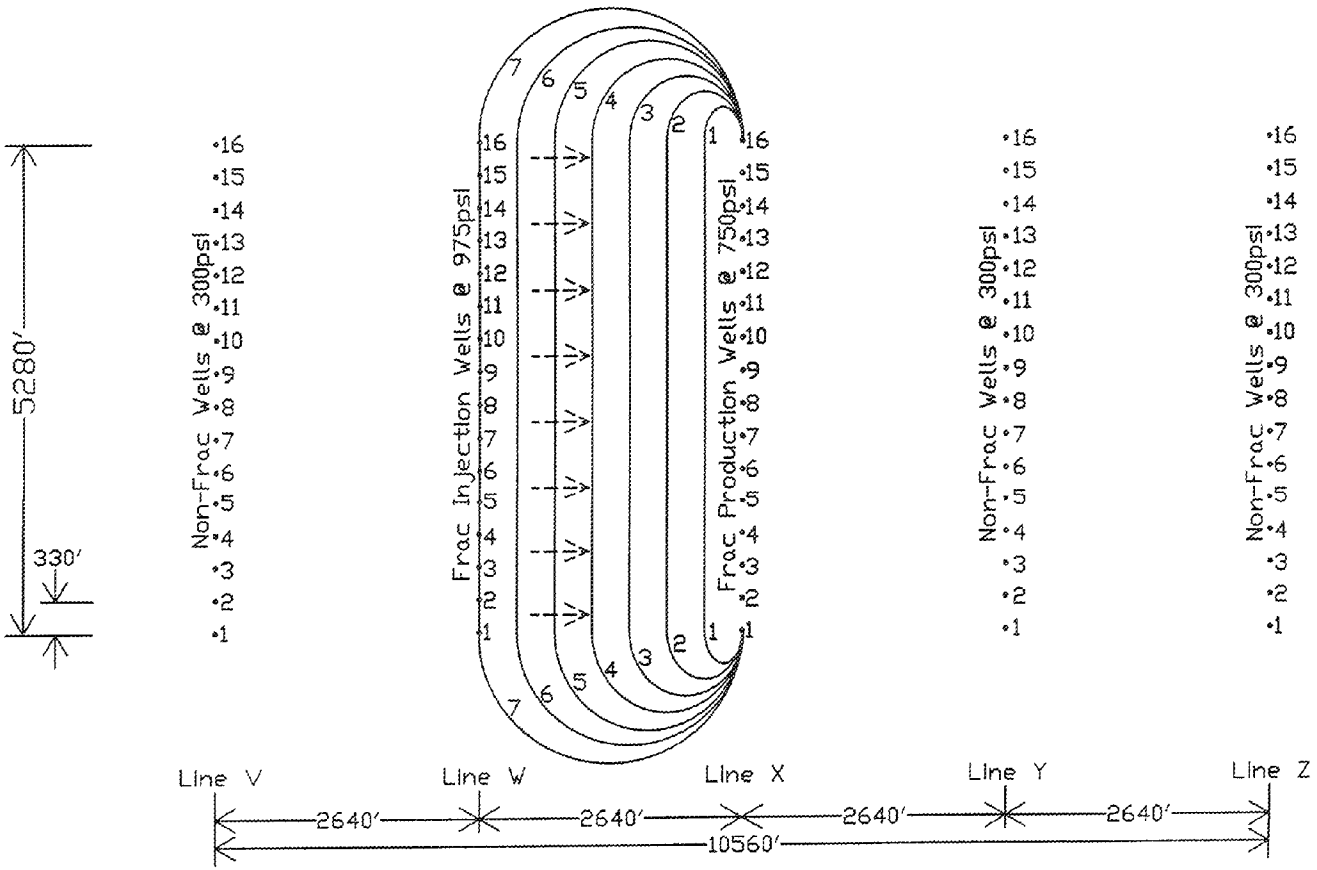
Figure 14a: Procedure for packing horizontal fracture by screeningout from Frac Production wells back to the Frac Injection wells.

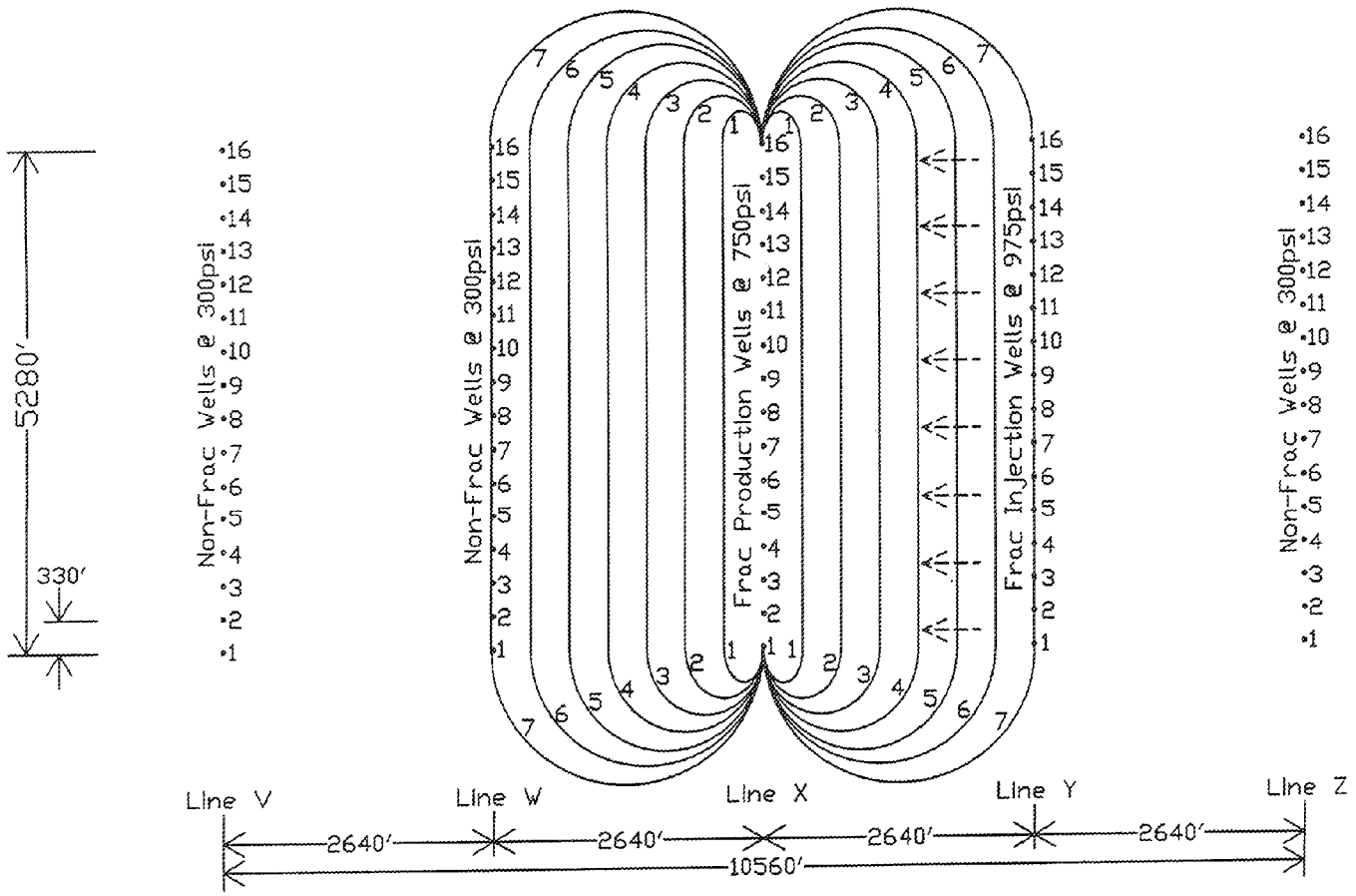
Figure 14b: Procedure for packing horizontal fracture by screening out from Frac Production wells back to the Frac Injection wells.

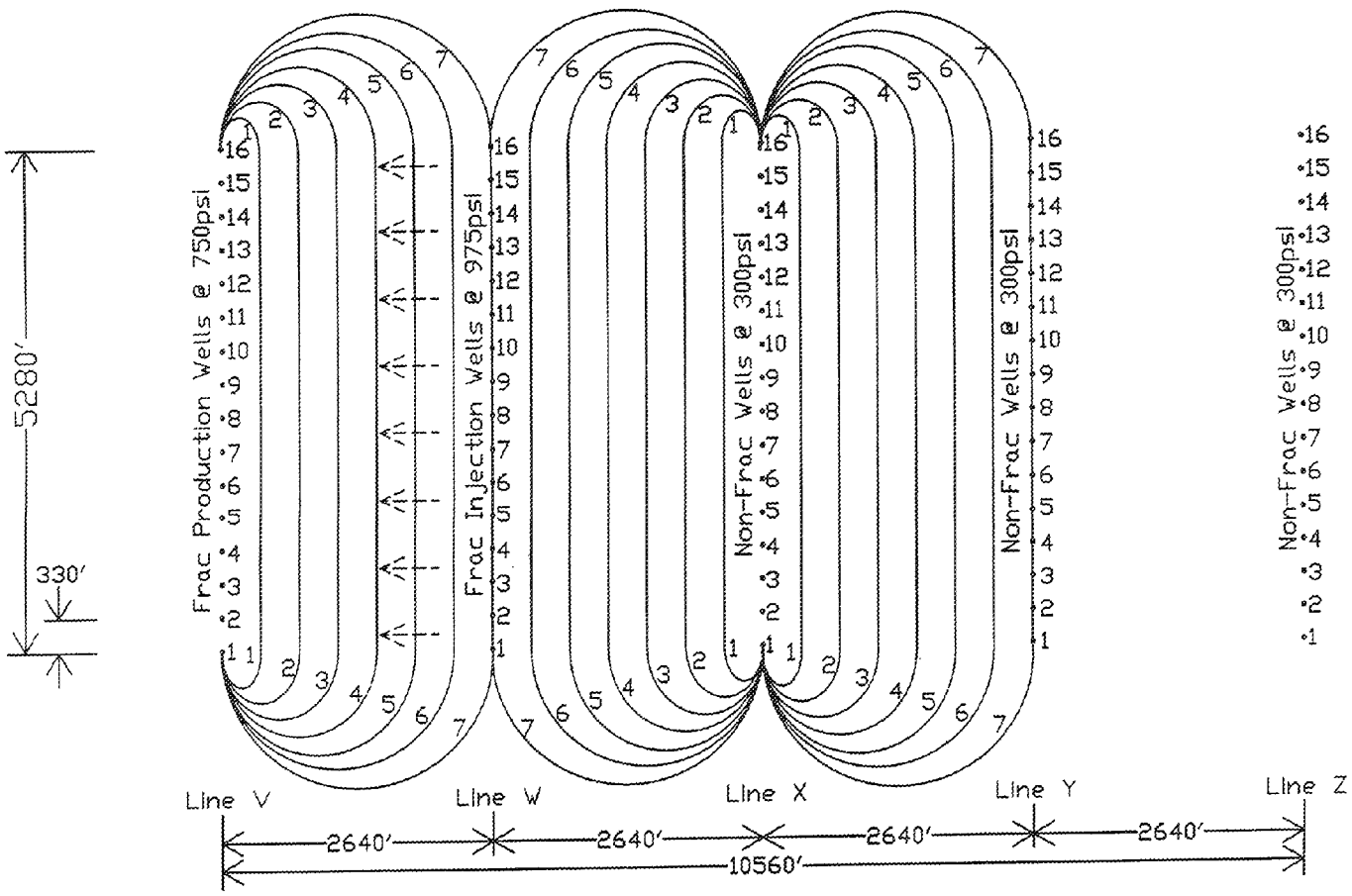
Figure 14C: Procedure for packing horizontal fracture by screening out from Frac Production wells back to the Frac Injection wells.

Figure 14d: Procedure for packing horizontal fracture by screening out from Frac Production wells back to the Frac Injection wells.
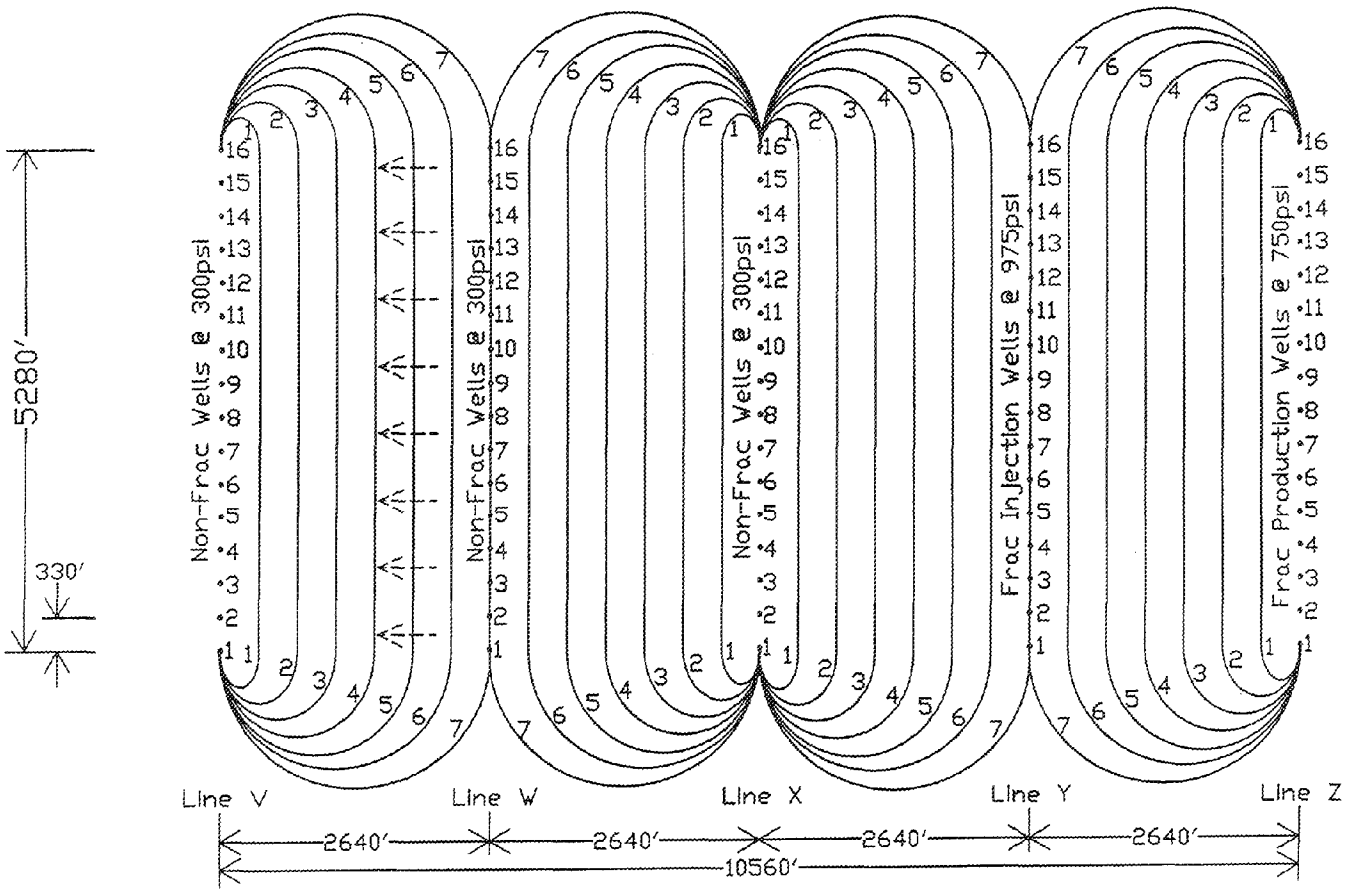

Figure 15: Horizontal Well Configuration for Propped Hydraulic Fracture Retorts in R-7 Zone
Elevation View
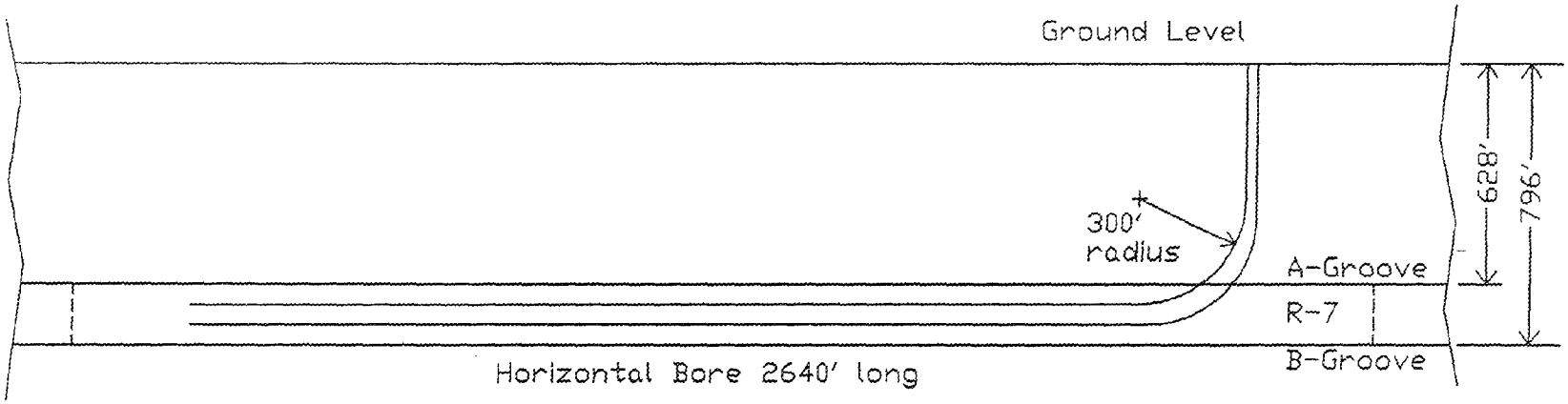

Figure 16a: Horizontal Well Configuration for Propped Hydraulic Fracture Retorts in R-7 Zone
Average Retort Module = 3300' wide x 5280' long = 17,424,000 sqft = 400 acres
4 Injection wells & 4 Production wells = 4,356,000 sqft / Injection well
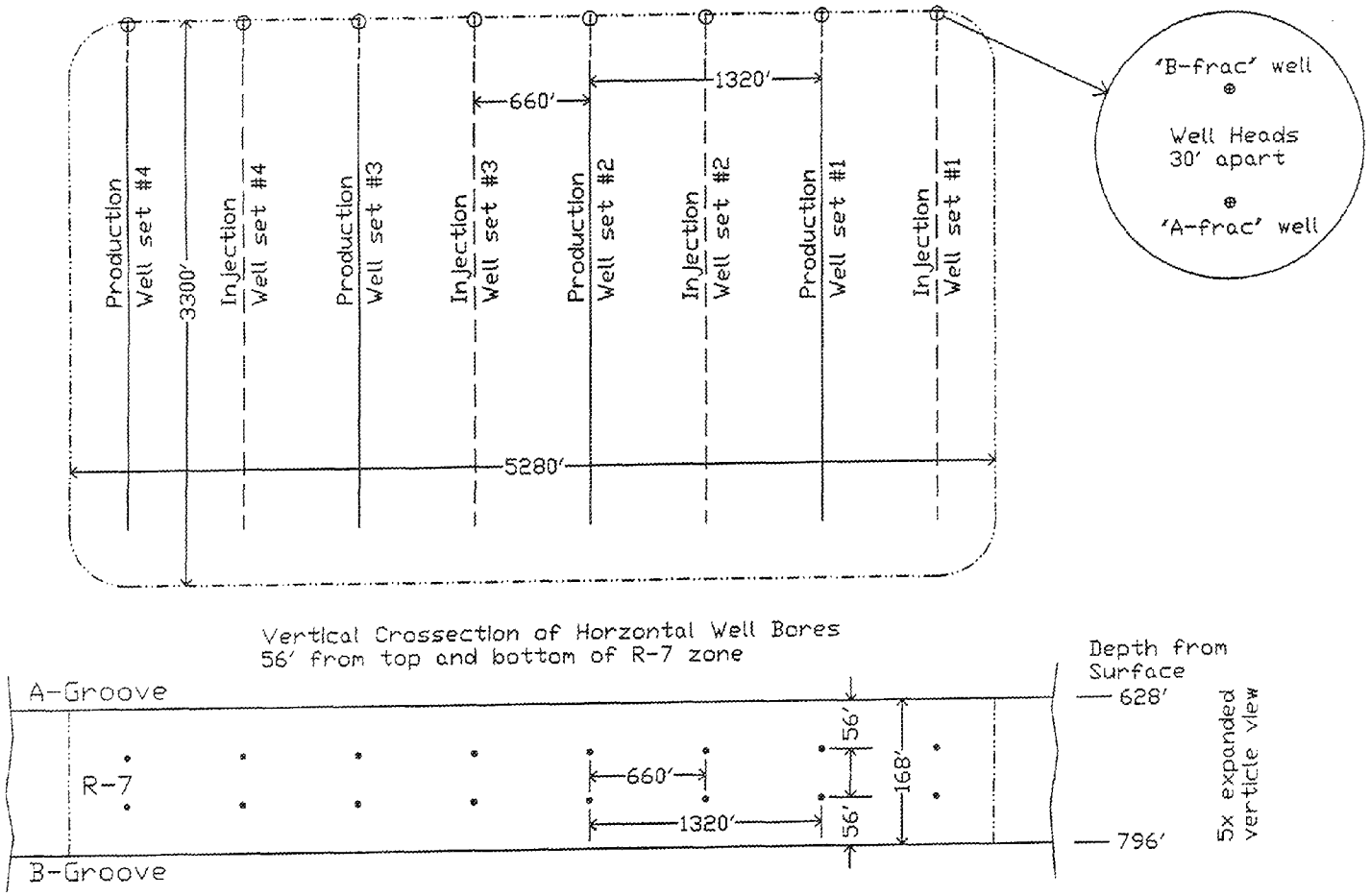

Figure 16b: Horizontal Well Configuration for Propped Hydraulic Fracture Retorts in R-7 Zone
Average Retort Module = 3300' wide x 5280' long = 17,424,000 sqft = 400 acres
8 Injection wells & 8 Production wells = 2,178,000 sqft / injection well
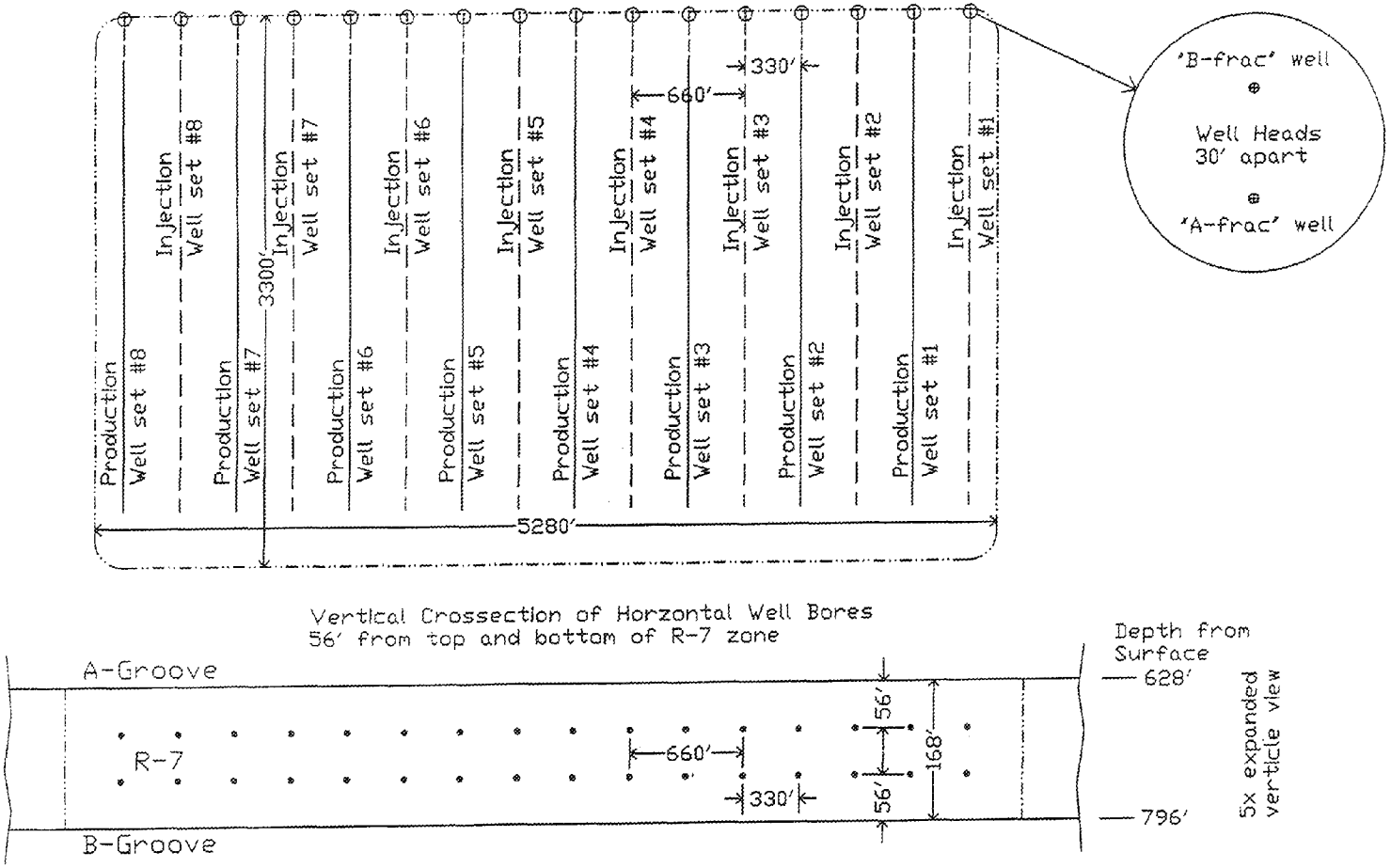

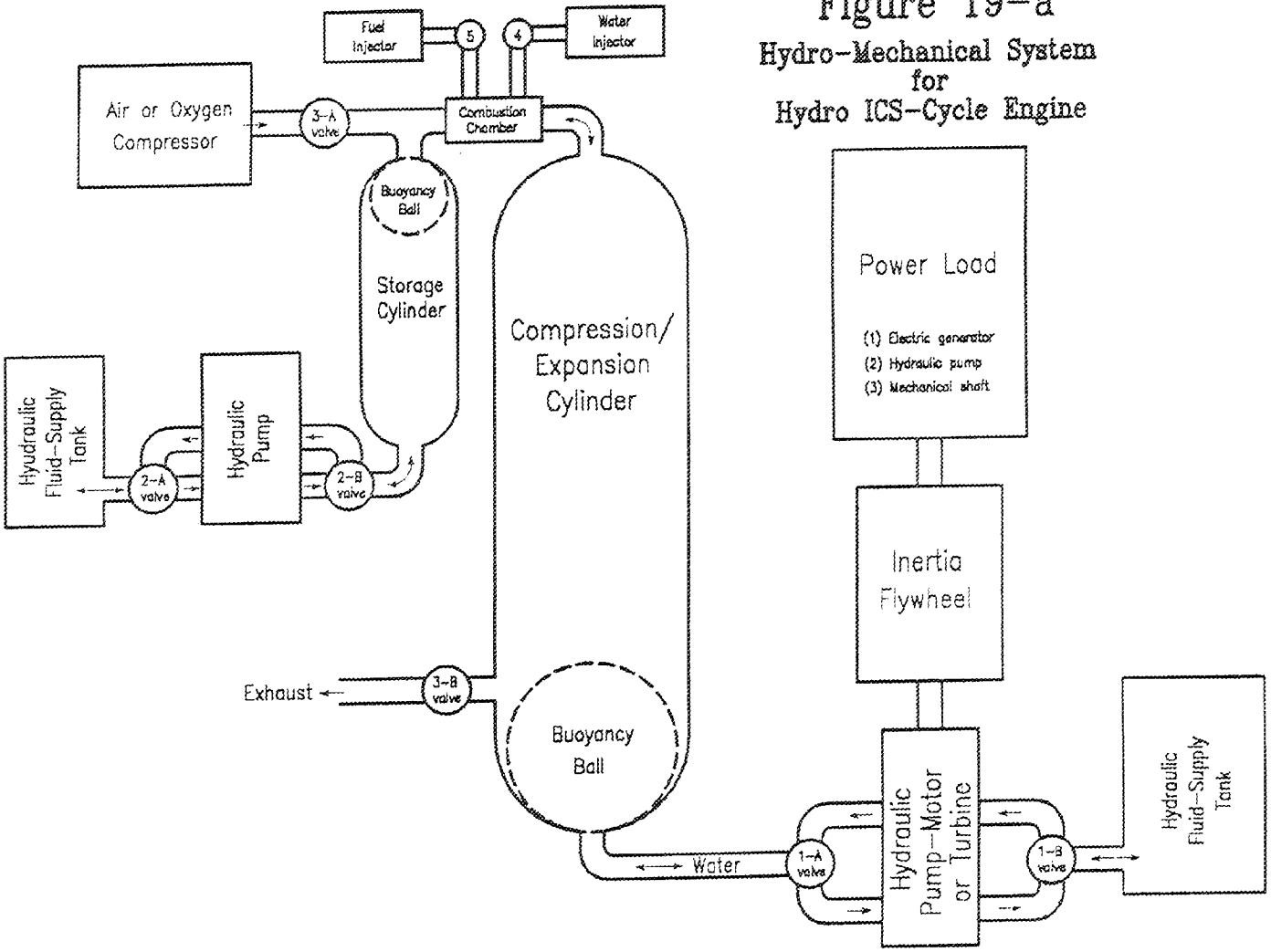
Figure 19-a
Hydro-Mechanical System for Hydro ICS-Cycle Engine

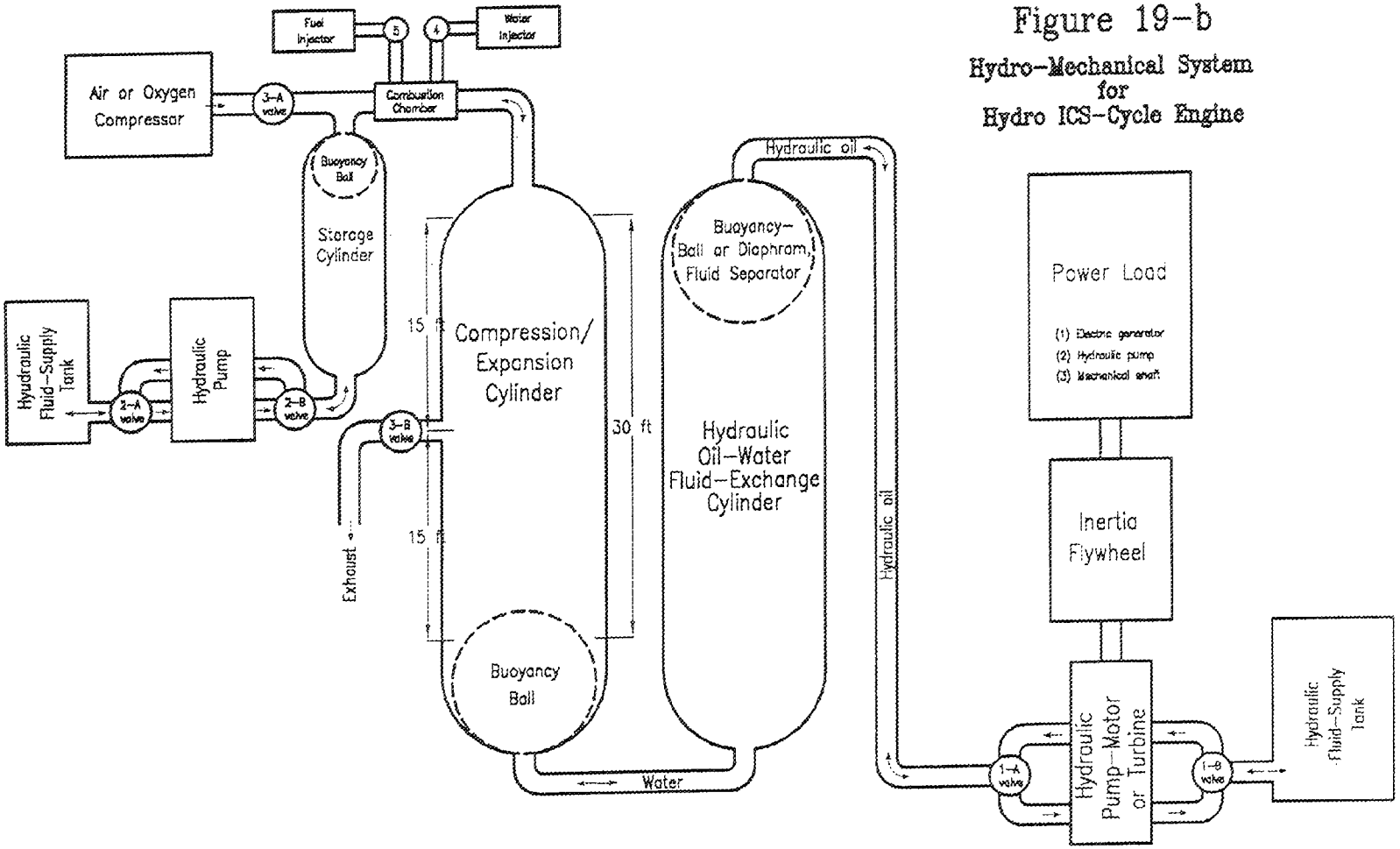
Figure 19-b
Hydro-Mechanical System for Hydro ICS-Cycle Engine

INTEGRATED IN SITU RETORTING AND REFINING OF HEAVY-OIL AND TAR SAND DEPOSITS

This application is a Divisional patent application of a Continuation patent application Ser. No. 11/510,751, filed on Aug. 26, 2006, now U.S. Pat. No. 8,235,117 based on a parent patent application Ser. No. 11/455,438, filed on Jun. 19, 2006, by the subject inventors and having a title of "INTEGRATED IN SITU RETORTING AND REFINING OF OIL SHALE" and now U.S. Pat. No. 7,980,312, issued on Jul. 19, 2011.

BACKGROUND OF THE INVENTION

1. Field of the Invention

The present invention relates generally to methods and systems for production of hydrocarbons, hydrogen, and/or other products from various petroleum, kerogen, bitumen, oil shale, lignite and coal formations. Certain embodiments relate to in situ conversion of hydrocarbons and hydrocarbon-precursors (such as are found in coal, lignite and other carbon-containing geological formations) to produce hydrocarbons, hydrogen, and/or novel product streams from underground petroleum, oil shale and coal formations.

2. Description of Related Art

Carbon-rich deposits found in subterranean (e.g., sedimentary) formations are commonly used as energy resources, raw materials and chemical feedstocks. In recent years, concerns over depletion of available hydrocarbon resources and the declining quality of hydrocarbons produced by traditional methods have led to development of processes that allow for more efficient recovery, processing and/or use of geologically derived hydrocarbon resources. Work conducted over the last century established the possibility of producing liquid or gas hydrocarbons from mineralized and entrained sources. However, the work largely failed the test of practicality.

Conventional crude oil deposits normally contain oil, water, and gas as three separate phases that are produced by multiphase fluid flow. In such multiphase fluid flow, the volumetric content, as well as differences in adherence, surface area and interfacial surface tension of materials plays an important role in the recoverability of the various materials. For example, differences in interfacial surface tension between any two phases (and/or the materials within them) may interfere with the fluid flow of materials in one or more of these or other phases. This impedance may result in reduced relative permeability of the formation to at least one fluid phase. It may also reduce the effective permeability of the formation as a whole.

Likewise, interstitial forces acting upon the multi-phase formation fluids may impede mobility of such fluids in the formation. For example, interfacial tension between an oil droplet within the formation fluid and the mineral structure surrounding it acts to create a substantial capillary force that may act to retain the droplet in position. Acting across a formation, these localized interfacial behaviors may result in substantial non-recoverable, residual oil saturation left behind after the relative permeability to oil has been reduced to a low value. In addition, the differential viscosity and capillarity of each phase may cause interfingering (e.g. 'channeling') of flowing water and gas phases, thereby bypassing large segments of oil-saturated reservoir rock. This interfingering of flow is believed to account for a portion of the large residual, non-producible oil saturations remaining after depletion of most oil fields. Even after secondary and tertiary oil recovery technologies have been used, large volumes of oil, typically 35% to 70% of original oil-in-place, may remain in the depleted reservoir rock as non-recoverable oil.

In heavy oil and tar sand deposits, these differential viscosity and capillarity problems in multiphase flow may be even more significant, resulting in both very slow production rates and very high residual oil left behind after depletion. Steam injection is often used to heat the heavy oil or tar/bitumen to reduce oil viscosity, increase the oil production rate and decrease the bypassed residual, non-recoverable oil saturation. Chemical agents that reduce interfacial tension and capillary forces may further reduce the non-recoverable, residual oil left behind after depletion and abandonment. Even after such reduction of interfacial tension and decreased viscosity by steam heating, substantial volumes of this oil still remains non-recoverable at economic rates, based on such multiphase fluid flow.

Methods that reduce interfacial tensions, and the impedance of flow that may result from it, are highly desirable in the field of terrestrial hydrocarbon recovery and production. In situ methods for consolidating formation hydrocarbons into a single fluid phase are of immense interest in the field of fuel and chemical production. It is also highly desirable to employ in situ methods that allow for production of formation hydrocarbons having a substantially narrower, and/or more defined, and/or more controlled range of compositions than is found using conventional petroleum and natural gas production technologies. Generally, methods that would allow an operator increased control over the physical chemistry (phase behavior) of formation fluids would be of great value. Similarly, methods that provide an operator with increased control of the chemical composition of formation fluids would be of great value, especially in producing energy and chemical products. Methods that could allow an operator to gain control of the physical chemistry of formation fluids may also provide that operator to also gain a degree of compositional control over the chemistry of the fluids being produced from the formation. Conversely, gaining control of the compositional chemistry operating within the formation fluids, may provide an operator with increased control of the yield, physical chemistry and flow properties of the formation fluids.

The subject of this invention is the mobilization, transformation and recovery to advantage in an advantageous form of carbon-based materials from various geological formations. While the focus of the present invention is recovery of hydrocarbons from carbonaceous resources having limited mobility and/or recoverability under normal formation conditions, it is appropriate to liquid petroleum formations as well. While not limited to solids (such as oil shale and other kerogen-containing deposits) or high-viscosity oil and tars, the present invention focuses on these as models of what is generally referred to herein as substantially immobile (or fixed-bed) carbonaceous materials or formations.

Methods for developing formations containing substantially immobile hydrocarbon deposits often fail the test of practicality because they are not: a) effective at achieving high volumetric productivity, b) flexible with respect to in situ hydrocarbon chemistries and recovery methods, c) predictable and effective across a broad range of common geological formations, and/or d) compatible with the effective protection of the surrounding environment and/or ecosystems. Nevertheless, recovering carbon and hydrocarbon products without costly and complex mining operations remains a desirable objective. As discussed elsewhere herein, the methods of the present invention focus broadly on the mobilization, fluidization, and in situ modification of carbonaceous deposits so as to provide an efficient means of producing fluid hydrocarbon products. Accomplishing this objective may require methods that elicit limited, but important changes in the chemical structure and/or physical state of the deposited resource within the formation. Practical methods that enable systematic development and fluidization of a variety of different fixed-bed hydrocarbons resources could prove particularly important in both chemical and fuel industries. To achieve material fluidity, such methods may include defined, in situ chemical reactions, as well as changes in chemical composition, solubility, density, viscosity, phase, and/or physical partitioning of the hydrocarbon material within the formation. For the purposes of this invention a fluid may be, but is not limited to, a gas, a liquid, a supercritical fluid, an emulsion, a slurry, and/or a stream of solid particles that has flow characteristics similar to liquid flow.

The present invention addresses the in situ transformation and recovery of energy and chemical products from subterranean carbonaceous formations. The methods of this invention comprise a means of producing fluid hydrocarbon from formations comprising one or more FBCD, and for extending unusual levels of protection to the surrounding environment by a combination of aquifer management methods, low-impact surface processing facilities, and a low-density distribution of surface wells and equipment. The invention further comprises both methods and systems that enable physicochemical transformation of a wide range of carbon-rich deposits, and the recovery of these produced materials. Such materials may be useful as basic fuels, chemicals products, intermediates and other classes of product. These products largely comprise saturated and unsaturated, non-aromatic hydrocarbons, although aromatic and other non-hydrocarbon products may be produced in abundance. Molecular hydrogen, for example, may be generated via these methods, as may high levels of aromatic hydrocarbons under certain conditions.

The methods of this invention apply to any carbon-rich geological formation, including but not limited to those containing deposits of: kerogen; bitumen; lignite; coal (including brown, bituminous, sub-bituminous and anthracite coals); liquid petroleum; depleted oil fields; tar or gel phase petroleum; and the like. While applicable to liquid hydrocarbon formations, preferred applications include those wherein the carbonaceous materials are either mineralized (e.g. largely fixed in position), highly viscous, or rendered substantially immobile by entrainment in soils, sands, tars and other geologic materials. For the purposes of this invention, all of these embodiments are the to represent fixed-bed hydrocarbon formations (FBHFs). The carbonaceous material itself may be referred to as fixed-bed hydrocarbon (FBH) even though it may exist in many forms, such as a soil-entrained fluid, a high-viscosity gel or fluid (e.g. tar), a mineralized, non-hydrocarbon solid (e.g. kerogen, lignite, coal, etc.). Formations containing deposits such as these may be found at depths ranging from surface formations to tens of thousands of feet. A FBHF may be found both under both land and sea surfaces.

Some fixed-bed hydrocarbon formations occur as relatively simple deposits of a single thick seam of carbonaceous material. Others, may be more complex in configuration. Although some of these deposits have been well characterized, practical methods for targeting and developing their carbon-rich deposits are lacking in the art. In situ methods for developing and producing such carbonaceous structures are highly desirable.

For the purposes of this invention, it is instructive to consider one type of carbonaceous formation—the well-characterized oil shale beds of N.W. Colorado. While not wishing to be bound by theory, it has been suggested that, at the time of deposition, some of the precipitating dolomitic marlstones present in the Piceance Basin of Colorado, simultaneously acquired relatively high kerogen content and also relatively high content of soluble sodium minerals, such as nahcolite, dawsonite, and halite. In some portions of the Piceance Basin, these water-soluble sodium minerals may have been dissolved, resulting in greatly increased porosity and permeability of these oil-shale beds, and forming, over time, which then become significant aquifers within the oil-shale zones. The removal of these soluble salts, by water-flow leaching seems to have created large voids or cavities which at times may have collapsed, resulting in brecciation of the rock. Those of skill in the art will note that zones formed in such a manner might often exhibit very high-permeability. Indeed, the stratagraphic mapping of the Piceance Basin oil shale beds reveal some layers having very high permeability (i.e., multi-Darcy) aquifers, consistent with this model and others having lower permeability.

Other portions and strata of the Piceance Basin exhibit different properties than those described above. For example, the Mahogany Zone occurs near the top of the oil-shale section, and is marked by a much lower content of soluble minerals than those observed in the permeable zone(s). A lower content of soluble minerals results in less material available for leaching to form aquifers. Such oil-shale zones, especially the Mahogany Zone, will tend to have very low permeability with very few, if any, significant aquifers.

On average, the oil-shale section of the Uinta Basin in N.E. Utah exhibits fewer and thinner carbonaceous beds than the Piceance Basin formation. According to geological theory, this is consistent with a scenario in which the layers of the Utah formation were deposited with lower content of soluble minerals, resulting in less subsequent leaching and less development of permeable aquifers in the oil-shale section. Both low and high permeability zones are important targets for development of chemical and hydrocarbon production methods. However, the few ex situ methods or in situ methods of oil shale development examined to date favor the less permeable materials over the more permeable ones.

In the geologies often observed in coal, lignite and petroleum formations, the presence of high permeability water saturated aquifers is most often seen as a liability that limits successful development. In contrast, low permeability boundaries surrounding the carbonaceous or hydrocarbon resources is often seen as an essential factor in successful extraction of heavy oil, and tar sand formations.

A systematic set of tools for enabling the in situ development of both high and low permeability zones is an important, ongoing and often critical need in the art of hydrocarbon production from depleted, conventional and unconventional carbonaceous geological resources.

A variety of methods for heating formation fluids so as to initiate a hydrocarbon recovery process are described in the art. For examples, several inventions utilize downhole heaters and are illustrated in U.S. Pat. No. 2,634,961 to Ljungstrom, U.S. Pat. No. 2,732,195 to Ljungstrom, U.S. Pat. No. 2,780,450 to Ljungstrom, U.S. Pat. No. 2,789,805 to Ljungstrom, U.S. Pat. No. 2,923,535 to Ljungstrom, and U.S. Pat. No. 4,886,118 to Van Meurs et al. Other inventions showing downhole combustion chambers are illustrated in U.S. Pat. No. 4,397,356 to Retallick and U.S. Pat. No. 4,442,898 to Wyatt. Each of the patents cited in this paragraph are incorporated by reference as if fully set forth herein.

Recently, methods have been developed to facilitate the processing of oil shale and entrenched subterranean hydrocarbon. A series of patents issued to the Shell Oil Company since November 2002 (U.S. Pat. Nos. 6,880,663; 6,485,232, 6,581,684, 6,588,504, 6,591,906, 6,591,907, 6,607,033, 6,609,570, 6,698,515, 6,702,016, 6,708,758, 6,712,135, 6,712,136, 6,712,137, 6,715,546, 6,715,547, 6,715,548, 6,715,549, 6,722,429, 6,722,430, 6,725,920, 6,725,921, 6,725,928, 6,729,395, 6,729,396, 6,729,397, 6,729,401, 6,732,794, 6,732,796, 6,739,393, 6,739,394, 6,742,587, 6,742,588, 6,742,593, 6,745,831, 6,745,837, 6,749,021, 6,752,210, 6,758,268, 6,761,216, 6,769,483, 6,769,485, 6,880,663, 6,915,850, 6,918,442, 6,918,443, 6,923,257, 6,929,067, 6,951,247, 6,991,032, 6,991,033, 6,994,169, 6,997,518, 7,004,247, 7,004,251, 7,013,972, 7,032,660, 7,040,397, 7,040,399, 7,051,811) issued to a series of inventors listed here as Wellington et al.; Vinegar et al.; de Rouffignac et al.; and Zhang et al.) describe the use of a variety of downhole heaters to accomplish the in situ retorting of oil shale. Because these patents deal largely with a single subject matter by an affiliated group of inventors, they are referred to generally herein as the "Shell Series". This series constitutes the bulk of the recent work on in situ retorting of oil shale. As is evident in the ensuing pages, the in situ retorting and hydrocarbon processing methods of the present patent are quite distinct from the methods described in this series of disclosures. The Shell Series is incorporated herein by reference as if fully set forth herein.

While patents listed in the paragraph above seem to describe a number of concepts for producing hydrocarbons from oil shale deposits, the methods offer limited utility and practicality for a number of reasons. First, the oil shale methods described in the Shell Series rely largely on use of radiant and conductive well-bore heaters for the purpose of heating an oil shale formation by thermal conductivity from the well bore walls Outward into the surrounding rocks. These well-bore heaters are understood to be largely fixed in a geometry defined by that of a given (heater) well-bore. Second, the preferred heaters are understood to be electrically-powered heating elements of various design and dimensions. The consequence of using such devices is likely to be an enormous, impractical electrical energy demand and associated cost. Third, the formation development strategies (e.g. density of individual heater wells required), and the limited heat-penetration offered by such methods suggests that these methods may be appropriate only for heating of very high organic content, low-permeability oil shale deposits. Fourth, the application of the above methods seem to be limited to those that are substantially dewatered such as by a series of water production and/or water recovery wells. Fifth, the practical operation of such methods seems to require establishment of a solid physical diffusion barrier between the treated zone and the surrounding formation and aquifers. In particular, this barrier seems to be provided primarily through construction of a freeze-wall containment system. Sixth, the establishment of a freeze-wall, containment system represents yet another energy-intensive operation likely to require extraordinary quantities of injected refrigerant or additional electrical energy.

Other important work in the field is described in U.S. Pat. No. 6,588,503, issued in 2003 to Karanikas et al.; U.S. Pat. No. 6,742,589, issued in 2004 to Berchenko et al.; U.S. Pat. No. 6,763,886, issued in 2004 to Schoeling et al.; U.S. Pat. No. 6,736,215, issued in 2004 to Maher et al.; U.S. Pat. No. 6,719,047, issued in 2004, Fowler et al.; and U.S. Pat. No. 6,722,431, issued in 2004 to Karanikas et al. These patents also describe important aspects of the present art related to methods for producing and recovering hydrocarbon-products from oil shale formations (e.g. one class of FBHF). Each of these patents is set forth herein by reference as if fully set forth herein.

Application of heat (usually in the form of steam) is well known in conventional liquid petroleum recovery operations. As practiced, however, such methods have had only limited success in enhancing recovery of oil and hydrocarbons from depleted and heavy oils fields, and even more limited success of enhancing fluid production from other types of carbonaceous deposits. The limited success may be due to in part to the, complex interfacial barriers that exist in multi-phase fluids, especially when they are partially entrained within a solid-phase (e.g. mineral) matrix. The nature of these interfacial effects is described elsewhere in this disclosure. Although the methods have proven uneconomical, there have been sporadic attempts, and even some technical success, in producing fuel hydrocarbons by in situ heating of oil shale deposits. Some such methods are described in U.S. Pat. No. 2,923,535 to Ljungstrom and U.S. Pat. No. 4,886,118 to Van Meurs et al. Each of these patents is set forth herein by reference as if fully incorporated herein. In some processes disclosed by Ljungstrom, for example, an oxygen containing gaseous medium is introduced to a permeable stratum, preferably while still hot from a preheating step, to initiate combustion. More recent disclosures (e.g. the Shell Series, etc. . . . ) illustrate other concepts for heating oil shale formations using well bore-based heating elements.

In several methods described in the previous several paragraphs, heat is applied for the purpose of lowering viscosity and increasing flowability of formation fluids. In some oil shale methods, heat is used to pyrolyze a solid to release a fluid hydrocarbon. Thus, the heat is used substantially to release formation fluids from formation solids without eliciting substantial changes in the chemical identities of the fluids once mobile (e.g. transformations in chemical structures due to one more intra- or inter-molecular chemical reactions).

While some of the methods listed above describe a general concept of producing differential hydrocarbon populations from oil shale, and perhaps other liquid hydrocarbon-containing formations, the methods do not provide systems for producing formation fluids highly enriched in any specific olefin or paraffin fraction in response to operator input or instruction. Such methods would be of considerable value in the field. The proceeding methods provide little technical guidance toward producing a substantially more defined natural gas or petroleum product than would be typical, for example, of a light- or middle distillate petroleum stream. One aspect of the present invention is a method for controlling, directing and/or recovering substantially defined distributions of hydrocarbon products from oil shale and other FBH formations.

A variety of methods have been described for heating an oil shale or liquid hydrocarbon formation. Electric heaters may be used to heat a subterranean formation by radiation and/or conduction. For example, an electric heater may resistively heat an element. U.S. Pat. No. 2,548,360 to Germain, which is incorporated by reference as if fully set forth herein, describes an electric heating element placed within a viscous oil within a well bore. The heater element heats and thins the oil to allow the oil to be pumped from the well bore. U.S. Pat. No. 4,716,960 to Eastlund et al., which is incorporated by reference as if fully set forth herein, describes electrically heating tubing of a petroleum well by passing a relatively low voltage current through the tubing to prevent formation of solids. U.S. Pat. No. 5,065,818 to Van Egmond, which is incorporated by reference as if fully set forth herein, describes an electric heating element that is cemented into a well borehole without a casing surrounding the heating element. U.S. Pat. No. 6,023,554 to Vinegar et al. describes an electric heating element that is positioned within a casing. The heating element generates radiant energy that heats the casing. A granular solid fill material may be placed between the casing and the formation. The casing may conductively heat the fill material, which in turn, may conductively heat the formation. U.S. Pat. No. 4,570,715 to Van Meurs et al., describes an electric heating element. The heating element has an electrically conductive core, a surrounding layer of insulating material, and a surrounding metallic sheath. The conductive core may have a relatively low resistance at high temperatures. The insulating material may have electrical resistance, compressive strength, and heat conductivity properties that are relatively high at high temperatures. The insulating layer may inhibit arcing from the core to the metallic sheath. The metallic sheath may have tensile strength and creep resistance properties that are relatively high at high temperatures. U.S. Pat. No. 5,060,287 to Van Egmond, describes an electrical heating element having a copper-nickel alloy core.

Combusting a fuel is most often more economical than using electricity to heat a formation. Combustion of a fuel may be used in a variety of ways to heat a formation. Several different types of heaters may use fuel combustion as a heat source that heats a formation. The combustion may take place in the formation, in a well, on or near the surface. Combustion in the formation may be by way of a fireflood. An oxidizer may be pumped into the formation. The oxidizer may be ignited to advance a fire front towards a production well. Oxidizer pumped into the formation may flow through the formation along permeable/porous zone or fracture lines in the formation. Ignition of the oxidizer may not result in the fire front propagating through the formation. Indeed the traditional fireflood and fire front propagates through a reservoir primarily by penetration of the fire front into the permeable/porous zones and fractures of the formation, and then indirectly by convection. The methods disclosed later in this invention provide for a more uniform and controlled heating of a formation, or a segment of a formation, through use of a mobile heat source.

A mobile heat stream comprising one or more heat transfer fluids, may also be generated by heating in, at, on or through a surface heat source. For example, heat may be transferred to a mobile injectable fluid or vapor via a surface heater in which combustion gases are burned, primarily for the purpose of achieving heat transfer prior to injecting the mobile agent. Alternatively, the combustion gases themselves can be circulated from a surface source through well bores to heat the formation. Examples of fired heaters, or surface burners that may be used to heat a subterranean formation, are illustrated in U.S. Pat. No. 6,056,057 to Vinegar et al. and U.S. Pat. No. 6,079,499 to Mikus et al., which are both incorporated by reference as if fully set forth herein.

A flameless combustor may be used to combust a fuel within a well. U.S. Pat. No. 5,255,742 to Mikus, U.S. Pat. No. 5,404,952 to Vinegar et al., U.S. Pat. No. 5,862,858 to Wellington et al., and U.S. Pat. No. 5,899,269 to Wellington et al., describe flameless combustors. Flameless combustion may be accomplished by preheating a fuel and combustion air to a temperature above an auto-ignition temperature of the mixture. The fuel and combustion air may be mixed in a heating zone to combust. In the heating zone of the flameless combustor, a catalytic surface may be provided to lower the auto-ignition temperature of the fuel and air mixture.

Methods disclosed by McQueen et al. in US Patent Application 20040149433 describe a heating process whereby a hole is drilled into an oil shale formation and a processing gas inlet conduit is positioned within the hole so as to allow injection of the heated gas into the formation to create a thermal energy front and allow for conversion of kerogen into hydrocarbonaceous products. The products are harvested from an effluent gas conduit positioned in the same well bore. The method appears to use thermal conductivity in a well bore as the means to heat the formation and produce retorted fluid through the same well bore that is used to heat the oil shale. In these and other aspects, the method appears to lack utility for continuous production and efficient heating of a formation.

A variety of alternative physical and or chemical treatments may be used to heat a formation as part an oil shale and/or hydrocarbon retorting process. Work conducted by Phillips Petroleum and others, shows that acoustic tools can be used to enhance oil recovery in secondary and tertiary recovery operations. While methods for acoustic excitement vary widely, they generally involve a variable frequency signal generator in or near the injection and/or producing wells. US Patent Application 20040149433 contains a brief description of the use of an acoustic vibration to enhance recovery of products from oil shale. In one embodiment, this patent comprises the use of acoustic tools to enhance the release of hydrocarbonaceous products from a kerogen-containing formation as thermal energy carrier fluid passes from an injection well toward a producing well. The vibration will primarily affect the mobility of hydrocarbon materials that have become liquefied. It is less likely to have dramatic effects on the mineralized, still-immobile carbonaceous compounds.

Microwave energy has also been disclosed as a means of obtaining hydrocarbon fuels from oil shale and oil sand formations. U.S. Pat. No. 4,419,214 to Balint, et al., describes a method of separating bitumen and tars from shale oils and tar sands through the use of microwave treatment of feedstock under pressure and in the presence of chlorinated-fluorinated hydrocarbons, carbon tetrachloride and chloroform. In U.S. Pat. No. 4,153,533, Kirkbride teaches a process for recovering oil from shale through the microwave irradiation of feedstock under high pressure and in the presence of hydrogen and water vapor. It is taught that the moisture content of the feedstock is to be kept below 3% while the process includes the drying of the feed shale oil particles. It is further noted that Canadian Patent No. 1,308,378 to Philippe teaches separating bituminous materials from tar sands through the use of gravity. The tar sands are treated by microwave irradiation in the presence of water. Separation of the bituminous fractions from the mineral fractions by gravity takes place at temperatures less than the boiling point of water. Each of the patents cited here are incorporated herein by reference as if fully set forth herein. In addition to the microwave methods described above, it is noted that a number of patents describe the application of microwave energy for heating oil shale, tar sand and similar hydrocarbon sources. For example, microwave energy was used to retort feedstock in U.S. Pat. No. 2,543,028 to Hodge, in U.S. Pat. Nos. 3,449,213 and 3,560,347 to Knapp and in U.S. Pat. No. 3,503,865 to Stone. U.S. Pat. No. 4,408,999 to Nadkarni treats the oil shale and coal under microwave irradiation in an acidic slurry to assist the solution of the mineral components. Each of these patents are incorporated herein by reference as if fully set forth herein. These vibrational and microwave methods may be used beneficially for enhancing mobilization or heating of formation hydrocarbons in the present invention, and/or for enhancing product composition and production efficiency.

In spite of the disclosure, the methods described above have not been embraced commercially. In general, they do not yield hydrocarbon products that are economically competitive with natural crude oil. Those processes which employ the use of microwave energy require the high consumption of electrical energy for implementation. Microwave energy is absorbed by water, a substance exhibiting extremely high dielectric losses. The same microwave energy is often times employed for the heating and evaporation of water, again, resulting in an economically uncompetitive process. Further energy losses arise from the heating of the rock and sand sources while only a small fraction of the microwave energy is applied to the oils themselves.

US Patent Application No. 20040031731 discloses a method whereby metal oxide sensitizers are used as intermediate transfer agents to facilitate transfer of microwave energy to oil shale and tar sand materials do facilitate cracking. This application is hereby incorporated fully by reference as if set forth fully herein. While instructive, the foregoing methods neither contemplate nor describe the in situ application of microwave energy to facilitate or otherwise supplement the combined kerogen pyrolysis and hydrocarbon cracking that comprise an important aspect of the present invention.

Synthesis gas may be produced in reactors or in situ within a subterranean formation. Synthesis gas may be produced within a reactor by partially oxidizing methane with oxygen. In situ production of synthesis gas may be economically desirable to avoid the expense of building, operating, and maintaining a surface synthesis gas production facility. U.S. Pat. No. 4,250,230 to Terry, which is incorporated by reference as if fully set forth herein, describes a system for in situ gasification of coal. A subterranean coal seam is burned from a first well towards a production well. Methane, hydrocarbons, H.sub.2, CO, and other fluids may be removed from the formation through the production well. The H.sub.2 and CO may be separated from the remaining fluid. The H.sub.2 and CO may be sent to fuel cells to generate electricity.

U.S. Pat. No. 4,057,293 to Garrett discloses a process for producing synthesis gas. A portion of a rubble pile is burned to heat the rubble pile to a temperature that generates liquid and gaseous hydrocarbons by pyrolysis. After pyrolysis, the rubble is further heated, and steam or steam and air are introduced to the rubble pile to generate synthesis gas.

U.S. Pat. No. 5,554,453 to Steinfeld et al. describes an ex situ coal gasifier that supplies fuel gas to a fuel cell. The fuel cell produces electricity. A catalytic burner is used to burn exhaust gas from the fuel cell with an oxidant gas to generate heat in the gasifier.

Carbon dioxide may be produced from combustion of fuels, such as may be used for generating heat in the present inventions, as well as many prior art inventions in the area of oil, gas and carbonaceous formation development. Carbon dioxide may also be produced from combustion of formation fluids and from many chemical processes. Carbon dioxide may be used for various purposes, such as flooding of a depleted oil field, or for use in enhanced oil recovery. Similarly, it may be used in coal bed demethanation to recover high-methane natural gas(es). It may also be used as a feed stream for a dry ice production facility, as a supercritical fluid in a low temperature supercritical fluid process, and in many other industrial and commercial applications. Although some carbon dioxide is productively used, many tons of carbon dioxide are vented to the atmosphere. Additional uses of process-derived carbon dioxide may be required to make such methodologies widely useful. The present invention incorporates these and other important uses of process-derived carbon dioxide.

Recent work by Wellington et al, (U.S. Pat. No. 6,880,633, and other Shell Series patents) teach that hydrocarbons may be generated from oil shale formations via in situ heating. One of skill in the art may find that the development plan, heating and recovery methodologies provided in these disclosures prove to be limited, cumbersome, and/or cost-prohibitive. As proposed in these inventions a heater(s) or heat source(s) provide heat to the formation primarily by conductive and/or radiative heat transfer from a well bore-confined heating element. The examples provided allow for the heat source to include electric heaters such as an insulated conductor, elongated member, and/or a conductor disposed within a conduit, and the like. The heaters are the to include those that generate heat by burning a fuel, although little guidance is given to enable use of such heaters. These "heaters" are described as forming a template within a formation that progressively heats the formation, through a radiative conduction process centered locally on each of those well bore heat sources. As described later, the present invention employs a very different strategy for heating a formation and producing hydrocarbon and chemical products from oil shale and other formations.

Other distinctives that limit the utility of the methods proposed in the Shell Series include: a) targeting of low water, low permeability, and low hydrogen formations; b) use of costly, slow stepwise heating to evaporatively remove water prior to ignition of pyrolysis; c) preference for formation temperatures of about 480-750 degree F. to provide desired hydrocarbons, d) limited control of formation chemistry; e) limited capacity to address specific formation geology (e.g. target differing strata using differing techniques) and/or use formation permeability differences to advantage, and f) use of a freeze-wall, solid wall aquifer containment system. Methods and systems provided in our detailed description are distinct from prior inventions in these and many other respects.

Carbon mobilization from a FBHF most often requires a degree of pyrolysis. Generally, this is understood to require temperatures at or above about 480-520 degree F. For the purposes of the present invention, any pyrolysis-based mobilization of hydrocarbons or related compounds from mineralized or otherwise low mobility geological carbon deposits is included in the general use of the term "retorting".

Traditionally, the proposed methods for retorting oil shale were largely above-ground (e.g. surface) operations. Such retorting of oil shale would typically involve mining followed by a surface pyrolysis process in which kerogen-contained rocks are burned at temperatures of >750 degree in a vessel from which liberated hydrocarbons may be recovered for use as combustion fuels, and oils. The quality of the oils produced from such retorting processes are typically been quite poor and would require costly upgrading in a commercial operation. Because of the required mining, transport and processing, aboveground retorting is seen as having a profoundly adverse impact on environmental and water resources. Many U.S. patents have been issued relating to aboveground retorting of oil shale. Currently proposed above-ground retorting processes include, for example, direct, indirect, and/or combination heating methods. Of these, none have proven to be commercially viable.

Except for coals, which are mined and burned directly as fuel, a similar history of costly and complex process development and capital requirements have limited development of ex situ strategies for retorting (e.g. pyrolyzing) or otherwise mobilizing other fixed-bed carbonaceous resources.

Below-ground, or in situ methods for retorting oil shale have also been proposed. While long-envisioned, practical and non-catastrophic in situ retorting of oil shale (e.g. in the form of kerogen) remains a largely elusive goal. In situ retorting involves retorting oil shale without removing the oil shale from the ground by mining. In practice, however, moderate success has been reported only in "modified" in situ process in which retorting is enabled through an underground process that produces cavernous subterranean retort chambers. An example of a "modified" in situ process includes a method developed by Occidental Petroleum that involves mining approximately 20% of the oil shale in a formation, explosively rubblizing the remainder of the oil shale to fill up the mined out area, and combusting the oil shale by gravity stable combustion in which combustion is initiated from the top of the retort. Other examples of "modified" in situ processes include the "Rubble In Situ Extraction" ("RISE") method developed by the Lawrence Livermore Laboratory ("LLL") and radio-frequency methods developed by IIT Research Institute ("IITRI") and LLL; which-involve tunneling and mining drifts to install an array of radio-frequency antennas in an oil shale formation.

As for ex situ methods, in situ retorting and fluidization opportunities exist for a wide range of substantially immobile carbonaceous resources. (e.g. FBCD). With the exceptions of coal gasification, oil shale retorting and secondary oil recovery, however, the methods remain largely undeveloped and unexplored. For continiuous production, true in situ retorting of oil shale and other FBCD requires the development of a formation such that there is substantial communication of materials between wells. Because work on oil shale has been in done in largely impermeable formations, obtaining permeability within an oil shale formation (e.g., between injection and production wells) has tended to be difficult and cost-prohibitive. Many methods have attempted to link injection and production wells, including: hydraulic fracturing such as methods investigated by Dow Chemical and Laramie Energy Research Center; electrical fracturing (e.g., by methods investigated by Laramie Energy Research Center); acid leaching of limestone cavities (e.g., by methods investigated by Dow Chemical); steam injection into permeable nahcolite zones to dissolve the nahcolite (e.g., by methods investigated by Shell Oil and Equity Oil); fracturing with chemical explosives (e.g., by methods investigated by Talley Energy Systems); fracturing with nuclear explosives (e.g., by methods investigated by Project Bronco); and combinations of these methods. As is apparent in examples found later in this document, such methods might also be employed to advantage in in the present invention. Many of such methods, however, have relatively high operating and environmental costs and lack sufficient injection capacity.

In contrast, the methods presented in detail later in this invention comprise the use of thermal-energy carriers to retort fixed-bed carbon materials in high-permeability formations, such as are often associated with coal and lignite deposits. However, the methods also comprise the effective retorting of oil shale from high permeability oil shale formations, such as those described in the Piceance Basin in N.W. Colorado; and to a lesser extent in the N.E. Utah (e.g. Lake Uinta), and the Washakie and Green River Basins in S.W. Wyoming (e.g. Lake Gosiute). Moreover, the methods of the present invention address cost-effective means of introducing and using to advantage formation permeability, whether natural or artificially induced. Also, the methods of the present invention provide for controllably propagating hydraulic fractures, and for creating high permeability, propped fractures in the formation. Such methods often provide an inexpensive means to introduce additional permeability into any FBHF when desired.

One proposed in situ retorting process is illustrated in U.S. Pat. No. 3,241,611 to Dougan, assigned to Equity Oil Company. discloses a method involving the use of natural gas for conveying kerogen-decomposing heat to the formation. The heated natural gas may be used as a solvent for thermally decomposed kerogen. The heated natural gas exercises a solvent-stripping and retorting action with respect to the oil shale through creating new retorted porosity and local permeability around the injection well bore. By increasing the injection pressure, the heated natural gas is pushed further into the newly created retorted pore spaces to produce decomposition product vapors and gases. Then, when the injection pressure is decreased, these retorted vapors and gases and the injected natural gas expand and flow back into the production portion of the same well bore for production flow to the surface. The pulsed sequence of high pressure injection of heated natural gas into the retorted pore spaces followed by low pressure production of this natural gas plus newly formed retorted shale oil vapors and gases is accomplished through a single well bore. Certain methods of this patent may prove useful in the operation of the present invention.

Barriers that serve to limit formation fluids and solutes from an area being actively treated are important in the operation of the present invention. A number of useful barrier development, biological degradation and adsorption methods are known in the art that may be of relevance in the methods of this invention. For examples, U.S. Pat. No. 5,297,626 Vinegar et al. and U.S. Pat. No. 5,392,854 to Vinegar et al., describe a process wherein an oil containing subterranean formation is heated. The following patents related to this subject invention are U.S. Pat. No. 6,152,987 to Ma et al.; U.S. Pat. No. 5,525,322 to Willms; U.S. Pat. No. 5,861,137 to Edlund; and U.S. Pat. No. 5,229,102 to Minet et al. These patents disclose valuable methods that can be employed to advantage in the present invention.

U.S. Pat. No. 5,018,576, issued to Udell et al., describes a method for decontaminating subsurface soil and groundwater using a combination of steam injection wells and sub-atmospheric extraction wells. As described, the method is useful for the decontamination of subsurface environments containing volatile contaminants and nonvolatile water-soluble contaminants, as well as some non-aqueous, non-volatile contaminants. In the methods of the patent, steam injection is intermittent and/or otherwise stopped for some or all of the extraction (volatilization and collection) phase. As presented, the method is largely described as a means of removing unwanted environmental contaminants resulting largely from human activity. Specifically, the patent addresses the release of entrained, trapped water and contaminants from soil after cessation of steam injection. This patent is incorporated in its entirety herein by reference for all purposes. The methods disclosed therein provide several aquifer containment methodologies for use in conjunction with the water and aquifer management methods of this invention.

U.S. Pat. Nos. 4,761,225 and 4,832,122 further disclose methods for removing hydrocarbons from groundwater and/or otherwise decontaminating a water table using a variety of extraction wells and heat, fluid and/or gas injection methods. In the '122 patent methods are specifically disclosed for injecting a fluid or gas upwardly through a contaminated zone so as to facilitate withdrawal of water through an extractor. These systems and methods are employed in this invention for controlling and purifying aquifer-associated water in the context of heat-based hydrocarbon recovery from oil shale(s) and other geological formations. The methods disclosed therein provide additional barrier development and aquifer treatment methodologies used in conjunction with the methods of this invention. Both of these patents are incorporated herein by reference as if set forth fully herein.

U.S. Pat. No. 6,224,770, issued to Savage et al., provides for the bioremediation of a hydrocarbon-contaminated groundwater by creating a sub-surface bioreactor. This patent discloses the use of sub-surface bioreactors to create a biological "wall" (or "bio-curtain") in which migrating hydrocarbon contaminants can be trapped and biologically degraded. Although many methods exist for creating a subsurface bio-curtain, the '770 patent is illustrative of both the general principles and a specific methodology for doing so. Thus, it is incorporated herein by reference, in its entirety, for all purposes.

A widevariety of microbiological strategies for in situ bioremediation are known in the art. Some methods combine ex situ cultivation and conditioning with aquifer injection of microbial cultures. A variety of methods useful for ex situ and in situ bioremediation are disclosed in U.S. Pat. Nos. 4,992,174; 5,486,291; 4,649,114; and 4,661,458. Each of these patents, is hereby incorporated by reference in its entirely for all purposes. Even so, it is understood that many other methods for microbial cultivation, injection, selection, aeration, propagation, etc. are also known to those of skill in the art of environmental bioremediation. Together, these patents and methods provide a means of aquifer moisture containment and/or development of effective biological barriers or in situ bio-treatment methods that may be particularly useful in developing these aspects of the present invention.

U.S. Pat. No. 6,679,326, issued to B. Zakiewicz, in 2004, describes the creation of a high pressure fluid barrier forming an enclosure boundary in a fluidizable mineral or hydrocarbon production operation with respect to an overburden and floor strata that are separated by one more layers of production strata. As described in the '326 patent, the method comprises the confinement of a deposit by high pressure fluid barrier forming an enclosure boundary with respect to overburden and floor strata separated by one or more production strata containing desirable fluidizable deposits and/or potential reaction materials with simultaneous action of rubbilization (reduction of a "rocky', large particle, or largely continuous solid material to smaller, more discontinuous material, such as rubble), mineral fluidization and dynamic-turbulent, centripetal displacement of fluidized minerals from the boundary strata of the mining field towards a collecting point. The methods of this invention may employ, for example, methods substantially similar to methods analogous to those shown for the Super Daisy Shaft, or similar technology In the '326 patent.

Other patents by Zakiewicz disclose: the underground bore-hole mining of bituminous coal by pyrolytic gasification (U.S. Pat. No. 4,289,354); and the thermo-chemical and thermo-fluid processes for heavy crude recovery (U.S. Pat. Nos. 4,289,354 and 6,318,468). In these methods and others (e.g. U.S. Pat. Nos. 4,305,463; 4,550,779; 4,289,354), "daisy wells" are drilled with inclined six-leg extensions. The recycled high-temperature fluids, enriched with organic materials are used to fluidize and/or displace slow-moving crude fractions. While the methods generally require rubbilization, the application of centripetal flow from distal injection sites toward central collection points is relevant to the non-rubblizing methods disclosed herein. Specifically, centripetal flow comprises one of many methods for confining a mining or retorting field in the present invention. However, unlike previous disclosures, its use in this invention does not require prior rubblization of minerals. The methods of the '326 patent and those listed in this paragraph provides additional means of controlling sub-surface fluid flow according to the methods of this invention.

In addition to spiral flow-based containment, a wide variety of strategies exist for creating diffusion barriers for selected aquifers. In general, these methods involve the creation of a hydrodynamic "ridge", past which solute flow is either prohibited or highly disfavored. In geological engineering terms, a hydrodynamic "ridge" is a region or segment of a formation displaying an elevated potentiometric surface. In a series of recent patents, Wellington et al., propose the freezing of formation water as means of prohibiting flow of hydrocarbons and other materials from a selected portion of an oil shale formation. Likewise, concrete encasement, or "walling-off" an area (e.g. as with clay or concrete barriers) has been used in the mining, petroleum, natural gas and other industries for diffusion and/or aquifer control. While these may provide an effective means of controlling moisture egress, the present invention favors less invasive hydrodynamic and other methods. As discussed in detail later, the present invention uses formation properties in combination with various hydrodynamic methods to establish elevated potentiometric surfaces that limit egress within the formation of retorted material from an active retort zone in a formation. Similar methods are used to allow one to limit egress of formation waters and other fluids from a treatment area.

By convention, crude oil and other formation-derived hydrocarbon materials are often collected and transported by pipe or vessel to a sophisticated, integrated refinery and chemical manufacturing facility. At such facilities hydrocarbons may undergo a wide range of catalytic and thermal chemical processing steps to produce the reformed fuels and chemical products most often associated with petroleum refining. The present invention describes methods by which at least a portion of the initial modification of hydrocarbon products may occur in situ.

While there are many variations on each of the following themes, conventional processes for petroleum fuel and petrochemical production consist of the following major operations:

1) in-field extraction of carbonaceous raw material;
2) collection and transport of crude material(s)
3) refining and reformation of fuel and chemical products
4) separation and segmentation of fuels and chemicals
5) extraction, processing, distribution and regeneration (e.g. of catalysts, etc.) As surface operations, each of these are complex, capital and resource intensive operations. It is desirable to consolidate a plurality of these operations into an increasingly simple, integrated process, and preferably, into single subsurface unit operation. Such methods offer potentially enormous savings of time, money and other resources associated both, with developing a global scale petrochemical facility, and with developing a high-yield geological formation.

Hydrocarbon cracking refers to a variety of pyrolytic methods used industrially to produce lighter, lower molecular weight hydrocarbons from heavier, often more viscous materials. The art of petroleum cracking comprises a variety of reactor-based methods for using heat energy, catalysts, hydrogen, and/or other additives to split longer chain hydrocarbons (and related compounds) into smaller molecules. Industrially, most forms of cracking are applied to heavy petroleum feed. Thermal cracking of linear, branched and aromatic hydrocarbon materials is well described in the art. Typically, industrial processes run at temperatures in excess of 650 degree F., although some cracking does occur at lower temperatures as well. As a matter of practice, this sets the minimum boiling point of about 650 degree F. for the heavy materials that are to be subjected to thermal or catalytic cracking. At temperatures above 650 degree F. cracking may occur efficiently, even without catalyst. Petroleum cracking refers to the pyrolytic decomposition of hydrocarbon materials chains that occurs upon heating to extreme temperatures, often in excess of 900 degree F. However, addition of cracking catalyst can allow a greater extent of cracking to be achieved more readily. Under thermocracking conditions, pyrolytic efficiency continues to increase with temperature (e.g. resulting in increased level of splitting and chain desaturation of hydrocarbons and other compounds with C—C backbone) up to temperatures of about 2000-2200 degree F. AS temperatures approach 2000 degree F., conditions begin to favor burning of hydrogen from hydrocarbons, resulting in deposition of a stable carbonaceous 'coke' material that is rich in aromatic carbon content and deficient in hydrogen. This so-called 'coking' process is observed, to some extent in all commercially used hydrocarbon cracking operations. In some kerogen deposits, and other carbonaceous formations, however, the maximum allowable temperature is more limited (e.g. about 1400 degree F.) due to the thermal instability and potential decomposition of the non-carbon components of mineral matrix, such as limestone, dolomite, and other materials.

Hydrocarbons liberated from a carbonaceous deposit may be subjected to a series of conditions that allow for conversion to higher value or more easily processed materials. These conversions are typically carried out, ex situ, in a series of surface petroleum refining and processing operations that are well known in the art of petroleum and petrochemical engineering. Such methods often include condensation, distillation and other separations based largely on boiling points of various fractions. Subsequently, a series of thermal and catalytic cracking methods may be applied to convert heavier and saturated hydrocarbon materials to lighter and less-saturated derivatives. For example, methods described elsewhere in this invention allow for certain, key refining steps to be conducted in situ. Hydrocarbon cracking represents the most important of these. As run under a variety of industrial and refining formats, the petroleum cracking processes are amenable to a wide range of operator-level and catalytic interventions that may alter rate, temperature, product distribution, coke formation, hydrogen production, olefin, aromatic hydrocarbon and/or light chain hydrocarbon production.

Thermal cracking of hydrocarbons has been recognized for over a century as a means to generate useful commercial chemicals and intermediates. Commercially, the first successful cracking process was developed and patented by W. M Burton. The process operated by batch processing in horizontal stills at 750 F and 75-95 psi. A decade or so later, Clark made important changes in Burton's process, allowing it to run continuously. Cross and Dubbs made further improvements in the continuous process to provide the earliest precursor to today's operationally-intense, continuous cracking processes.

Steam (or thermal) cracking may operate either catalytically and non-catalytically to generate a wide range of saturated, unsaturated and aromatic hydrocarbons, as well as molecular hydrogen. Typically thermal cracking operations require somewhat higher temperatures than their catalytically driven analogs.

Thermal cracking of petroleum typically yields a population of saturated (e.g. paraffins) and unsaturated straight-chain hydrocarbons (e.g. olefins) having lower carbon numbers than the parent compounds. Depending on reaction conditions, feed material, presence of impurities, catalysts, and other factors, cracking may yield various cyclic hydrocarbons, heterocyclic compounds, liquid fuels (e.g. gasoline), synthesis gas components, molecular hydrogen, and other chemical and fuel products. Industrially, the balance of products in a petroleum cracker is a critical parameter in managing refinery operations and economics.

Examining the course of development of petroleum cracking technology provides insight into distinct applications of the technology that are described elsewhere in this invention. The large scale, high temperatures, variable feedstocks and other operational challenges intrinsic to petroleum cracking made it a target for catalyst and process developers from its earliest days. Opportunities to increase cracking efficiencies (e.g. of heavy petroleum feedstocks, etc. . . . ), minimize formation of low-value products (e.g. the heavy tars, refinery "bottoms" stream, etc. . . . ), and/or increase the volumetric productivity of existing capital all attracted substantial research investment. Interest in vapor phase cracking, for example, emerged during World War I. The work progressed slowly until the late 1920s. By that point, the rapid growth of the automobile fuels market was creating a large demand for a high-quality, anti-knock gasoline. By the early 1930s, the work on vapor phase processing and the standard liquid processes led to creation of a mixed-phase process. This process would became widely in commercial refineries until the 1940s.

As vapor and mixed phase cracking processes were developing (in the late 1920s), Eugene Houdry introduced several key principles of catalyst use and regeneration to those working on potential next-generation processes. His work would dramatically alter the future of petroleum refining. Like other experimenting with the use of catalysts Houdry was deeply frustrated by the rapid inactivation he observed under cracking conditions. He postulated that some or all of this inactivation might be reversible, by the removal of the carbonaceous "coke" from the catalytic materials. To test this hypothesis, he subjected treated the catalysts at temperatures well in excess of cracking temperatures (e.g. >>1000 F) in an attempt to burn off the coke. When he did so, he found that substantial activity could be restored.

As with many advances in petroleum cracking, Houdry's results were met with initial skepticism. Questions surrounding the practicality and efficiency of catalyst regeneration and replacement were but a few of myriad operational concerns that were raised. By the late 1930s, however, many of the most important objections/concerns had been overcome, allowing for rapid emergence of a variety of semi-continuous and continuous catalytic cracking processes.

Initial catalytic cracking processes employed fixed bed catalysts, but these proved inadequate to produce the vast volume of liquid fuels required for the rapidly growing aviation and motor fuel markets. The development of moving bed reactors quickly followed. These allowed development of the first truly continuous catalytic cracking operations.

Today, catalytic cracking processes come in three distinct forms, including mixed-bed, fluid catalytic cracking (FCC); hydrocracking, using hydrogen to mediate reductive cracking, and oxidative cracking. Whereas all three methods employ catalysts, FCC uses powdered rather than pelleted catalyst particles. This is important for maintaining mobility under process conditions. While similar catalyst materials may be used in both hydrocracking and FCC, nowhere are the catalyst design requirements as arduous as in FCC. Typically, particles of <100 microns are required, and are kept afloat in a vapor phase by a sophisticated system of blowers within the reactor. Some key development stages and events and in the history of FCC technology are highlighted in the following table (adapted from W.R. Grace & Co.'s publication, "*Guide to Fluid Catalytic Cracking, Volume* 1", 1993.). This history of catalytic cracking technology provides useful insight into application and potential limitations of the present invention.

Key Breakthroughs in the History of FCC Technology Development

| Breakthrough | By | |
|---|---|---|
| 1st Thermal Cracking Operation Established | W. R Burton | ca 1910 |
| Activated Clay Catalyst Used in Cracking | E. G. Houdry | 1928 |
| Fluidizable Catalyst Developed | Exxon | 1942 |
| Synthetic Low Alumina Catalyst | Grace Davison | 1942 |
| Microspheroidal Catalysts Developed | Grace Davison | 1948 |
| Synthetic High Alumina Catalyst | Grace Davison | 1955 |
| Spray-dried Zeolite Catalyst | Mobil | 1964 |
| Ultra-stable Y (USY) Zeolite Catalyst | Grace Davison | 1964 |
| Silica-Sol Bound (Structured) Catalysts | Grace Davison | 1973 |
| Platinum CO Combustion Promoter | Mobil | 1974 |
| Octane-selective Catalyst | Grace Davison | 1975 |
| Sb Nickel Passivation Method for Cracking Catalyst | Phillips | 1975 |
| Alumina-Sol Bound Catalysts | Grace Davison | 1981 |
| ZSM-5 Octane (Catalyst) Additive | Mobil | 1986 |
| Bi Nickel Passivation Method for Cracking Catalyst | Chevron | 1987 |
| USY Zeolite w/Enhanced Gasoline Selectivity | Grace Davison | 1989 |
| Development of Custom Catalyst Matrix & Assembly Methods | Various | 1990s |

While not wishing to be bound by theory, the products of the cracking process and mechanistic studies conducted by numerous researchers are consistent with a free-radical mediated process. Generally, there is little preference for primary, secondary or tertiary carbons during free radical formation. This means that the product mix is typically a broad, complex distribution of compounds. For this reason, in the early stages of the in situ cracking process, the products generated can be even more diverse than the originating feedstocks. As the extent of cracking increases, however, the average hydrocarbon chain-length decreases progressively. When the hydrocarbon products reach an average carbon number of less than about 10, systemization and separation of discrete product streams becomes increasingly efficient and achievable. For example, the light-chain olefins, dry gas, wet gas, octane (e.g. gasoline) and other condensable streams begin to be produced in abundance.

Cracking of hydrocarbon feedstocks yields a variety of products depending, in part, on the nature of the feed. The principal cracking products generated from a variety of hydrocarbon feedstock hydrocarbons and cracking reactions can be summarized as follows.

| Feed Hydrocarbon | (Predominant Reaction) | Products |
|---|---|---|
| Paraffins | (Chain Scission) | Shorter Paraffins + Olefins |
| Olefins | (Dehydrogenation + Scission) | LPG Olefins |
| | (Cyclization) | Naphthenes |
| | (Hydride Transfer) | Paraffins |
| | (Isomerization + Hydride Transfer) | Branched Olefins/ Paraffins |
| | (Cyclization, Condensation + Dehydrogenation) | Coke (deposition) |
| Naphthenes | (Scission) | Olefins |
| | (Dehydrogenations) | Cyclic Olefins + Aromatics |
| | (Isomerization) | Various Naphthenes |
| Aromatics | (Side-chain Scission) | Olefins + Unsubstituted Aromatics |
| | (Transalkylation) | Alkylaromatics |
| | (Dehydrogenation + Condensation) | Polyaromatics |
| Polyaromatics | (Alkylation + Dehydrogenation + Condensation) | Coke |

While far from exhaustive, this list serves to identify key categories of products likely under a variety of scenarios. For example, where feedstocks are heavy, as in tar sand and oil shale applications, the abundance of long-chain paraffins and heavy aromatics may predominate early. Upon further cracking, however, the chains will shorten, begin to favors olefins and lighter paraffins. Under the same conditions, substantial quantities of the heavier materials (e.g. multi-ring aromatics, etc.) will deposit as carbonaceous coke. Such coke may, however, be remobilized and recovered later in the operations as in situ thermal conditions become increasingly harsh.

Catalytic cracking is used most often as a downstream treatment for the high boiling petroleum distillation fractions. These fractions are often reduced to saturated linear and branched chain paraffins, naphthenes and aromatics. These materials are brought into contact with a one or more cracking catalysts, such as amorphous aluminum silicates or, more typically, crystalline aluminum silicates (e.g, zeolites), and other less common catalysts such as the manganese-based Houdry catalyst. The best performing zeolite catalysts are most often those containing rare earth cations present as catalyst stabilizers. Generally, the catalysts undergo inactivation by coking and must be subsequently regenerated. They often contain traces of platinum to assist with the conversion of carbon deposits to carbon dioxide during regeneration. In catalytic cracking operations, hydrocarbons are generally brought into contact with such catalysts at temperatures of >840-930 degree F. within a fluidized-bed catalytic cracker or a catalyst riser reactor.

Hydrocracking refers to the catalytic cracking of hydrocarbons in the presence of hydrogen. As with catalytic cracking, it is used industrially to partially pyrolize high boiling distillates into lower boiling products. Modern hydrocracking uses bifunctional metallic hydrogenation-dehydrogenation catalysts (e.g. Pd, Pt, C0-Mo) and acidic cracking components such as zeolites containing Al2O3-SiO2. The processes tend to run at temperatures of about 520 to 930 degree F. and about 1150-2900 psi, and require substantial capital investment both for hydrogen production and for the hydrocracking operation. Unlike other cracking operations, product streams from a hydrocracking unit operation usually contain little to no olefins, but they do tend to contain isobutane, naphtha, as well as fuel oil and gasoline components.

A large volume of art exists describing the development and operation of hydrocarbon cracking catalysts, either in the cat-cracking, fluid cracking, oxidative cracking, and other modes. However, little, if any, art exists describing the practical use of these catalysts and processes in conjunction with in situ retorting and conversion of FBH formations (such as oil shale, and others). Such methods are highly desirable.

The art of fluidized catalytic cracking (FCC) is particularly important. It has enjoyed great favor for decades in the field of petrochemical processing. A vast literature and product repertoire exists in this technology, making it possible for one of ordinary skill to identify catalyst products of value in a wide range of process settings. As used industrially, FCC is a method of choice for converting a heavy petroleum feedstocks into lighter, more valuable products such as high octane gasoline and/or light olefins represent. In FCC, as with other catalytic cracking methods, pyrolysis occurs in the absence of externally added hydrogen. In industrial FCC operations, an inventory of excess catalyst is typically required so that used material may cycle between an active cracking reactor and a catalyst regenerator. Typically, a petroleum-based feed contacts 60-80 micron catalyst in a reactor at about 795 degree F.-1110 degree F., and usually 860 degree F.-1040 degree F. The hydrocarbons crack, and deposit carbonaceous coke on the catalyst. Cracked products are separated from the coked catalyst, which is stripped of volatiles, usually with steam, and then regenerated. In the catalyst regenerator, coke is burned, restoring catalyst activity and heating the catalyst to 930 degree F.-1650 degree F., usually 1110 degree F.-1380 degree F.

While a large number of catalysts will provide activity, the more moisture and coke resistant, the more likely the catalyst will provide sustained activity in the presence of a complex, flowing feedstock.

A thorough description of the catalytic cracking process may be found in the monograph, "Fluid Catalytic Cracking With Zeolite Catalysts", Venuto and Habib, Marcel Dekker, New York, 1978, incorporated herein by reference. However, a brief review of some traditional and more recent discoveries pertaining to zeolite catalysts is helpful in assessing the type of catalyst that is most suitable for a given cracking operation. Most older FCC units regenerate spent catalyst in a single dense phase fluidized bed of catalyst. Although there are myriad individual variations, typical designs are shown in U.S. Pat. No. 3,849,291 (Owen) and U.S. Pat. No. 3,894,934 (Owen et al), and U.S. Pat. No. 4,368,114 (Chester et at.) which are incorporated herein by reference. Many newer units use high efficiency designs, with a fast fluidized bed coke combustor, dilute phase transport riser, and second dense bed to collect regenerated catalyst.

Because of their unique sieving characteristics, as well as their catalytic properties, crystalline molecular sieves and zeolites are especially useful in applications such as hydrocarbon conversion, gas drying and separation, and are particularly useful in the methods of this invention. Although many different crystalline molecular sieves have been disclosed, the chemistry continues to develop with suppliers such as W.R. Grace, Engelhard, Grace-Davison, UOP, and others providing ongoing innovation. For example, zeolites have desirable properties for gas separation and drying, as well as hydrocarbon and chemical conversions, and other applications. New zeolites may vary in their internal pore architecture, size, selectivity, stability, etc.

Typically, crystalline aluminosilicates are prepared from aqueous reaction mixtures containing alkali or alkaline earth metal oxides, silica, and alumina. Crystalline borosilicates are usually prepared under similar reaction conditions except that boron is used in place of aluminum. By varying the synthesis conditions and the composition of the reaction mixture, different zeolites can often be formed. In U.S. Pat. No. 6,881,323 (incorporated in its entirety herein by reference for all purposes), Zones (Chevron, USA, Inc) describes the latest development in a long line of SSZ-series zeolites developed for use in fluid catalytic cracking (FCC) operations and other applications. The patent provides both a process for converting hydrocarbons using the SSZ-54 catalyst as well as a description of its synthesis. Briefly, the catalyst comprises a zeolite having a mole ratio greater than about 20 of an oxide of a first tetravalent element to an oxide of a second tetravalent element which is different from the first tetravalent element, trivalent element, pentavalent element or mixture thereof and having, after calcination, has a defined X-ray diffraction pattern. A hydrocracking process using this catalyst comprises contacting a hydrocarbon feedstock under hydrocracking conditions with a preparation of SSZ-54 catalyst comprising the zeolite of this invention, preferably predominantly in the hydrogen form. The invention also includes a process for increasing the octane of a hydrocarbon feedstock to produce a product having an increased aromatics content comprising contacting a hydrocarbonaceous feedstock which comprises normal and slightly branched hydrocarbons having a boiling range above about 105 degree F. and less than about 390 degree F., under aromatic conversion conditions with a catalyst comprising the zeolite of this invention made substantially free of acidity by neutralizing the zeolite with a basic metal. Also provided in this disclosure is a process wherein the zeolite contains a Group VIII metal component.

While zeolites provide remarkable activity and stability, phosphorous stabilized structures often appear most suitable to the harsh conditions encountered in the in situ processes disclosed herein. FCC and other cracking catalysts are often the to be "stabilized" by addition of certain additives. For example, phosphorous content may be enhanced for stability. Zeolite ZSM-5 zeolite may be added for enhanced stability, productivity and selectivity. Moreover, phosphorous may be added to ZSM-5 containing catalysts. The result of such stabilization may be to produce a higher yield of light hydrocarbons and/or olefins than is produced with a catalyst composition that has not been stabilized by phosphorus. This comparison is normally made after deactivation with steam. Catalysts sold under trade name of OlefinsMax™ (Grace Davison) are often enhanced in this manner. U.S. Pat. No. 5,110,776 teaches a method for preparing FCC catalyst comprising modifying the zeolite, e.g., ZSM-5, with phosphorus. U.S. Pat. No. 5,126,298 teaches manufacture of an FCC catalyst comprising zeolite, e.g., ZSM-5, clay, and phosphorus. See also WO 98/41595 and U.S. Pat. No. 5,366,948. Phosphorus treatment has been used on faujasite-based cracking catalysts for metals passivation (see U.S. Pat. Nos. 4,970,183 and 4,430,199); reducing coke make (see U.S. Pat. Nos. 4,567,152; 4,584,091; and 5,082,815); increasing activity (see U.S. Pat. Nos. 4,454,241 and 4,498,975); increasing gasoline selectivity (See U.S. Pat. No. 4,970,183); and increasing steam stability (see U.S. Pat. Nos. 4,765,884 and 4,873,211).

In U.S. Pat. No. 3,758,403, use of large-pore cracking catalyst with large amounts of ZSM-5 additive gives only modest increase in light olefin production. A 100% increase in ZSM-5 content (from 5 wt. % ZSM-5 to 10 wt. % ZSM-5) increased the propylene yield less than 20%, and decreased slightly the potential gasoline yield ($C_{5+}$ gasoline plus alkylate).

When attempting to improve or enhance the catalytic activity of these compositions, the amounts of the various components in a catalyst or catalyst additive and the relevant effect these components have on attrition have to be taken into account in order to maximize attrition resistance. The importance of attrition becomes increasingly acute when, for example, the ZSM-5 content of a catalyst is increased to enhance the catalyst's activity. In certain instances, increasing a catalyst's ZSM-5 content results in the use of less binder and matrix, and as a result, "softer" or more attrition prone particles can be created. Even though particles having a ZSM-5 content up to 60% and an attrition index less than 20 have been reported (U.S. Pat. No. 5,366,948), it has been difficult to prepare catalysts and additives which contain a great majority, i.e., greater than 60% of the active component over the other components in the catalyst. For example, it would be desirable to increase the amount of ZSM-5 to these high levels in certain catalysts in order to produce a particle which is more active in producing $C_3$-$C_5$ olefin.

In U.S. Pat. No. 5,481,057, inventors Bell et al. (Mobil Oil Corporation), disclosed the use of removed (e.g. spent) equilibrium cracking catalyst (E-Cat) from an FCC unit as an alkylating catalyst for upgrading olefins. To achieve these seemingly incompatible objectives, the inventors used a phosphorus stabilized or modified large pore zeolite cracking catalyst, and an unexpectedly effective water activation treatment. This patent is incorporated herein by reference.

Other phosphorus stabilized, shape selective zeolites are also well known and widely used in the art. In U.S. Pat. No. 3,962,364, Young teaches alkylation in the presence of phosphorus-modified zeolite ZSM-5. U.S. Pat. No. 3,965,208, Butter et al, teaches methylation of toluene using ZSM-5 modified by the addition of phosphorus, arsenic or antimony. U.S. Pat. No. 3,972,832 Butter and Kaeding claims a shape selective zeolite with at least 0.78 wt % phosphorus in the crystal structure, while U.S. Pat. No. 4,044,065 claims conversion using this phosphorus-containing zeolite. In U.S. Pat. No. 4,356,338, Young discloses extending catalyst life by treating a shape selective zeolite with phosphorus and/or steam. Together, these patents illustrate the use and benefit of phosphorus treatment/stabilization methods on shape selective zeolites, such as ZSM-5. Each, of these patents is incorporated herein by reference.

Phosphorus stabilized large pore cracking catalyst is also known. Pine et al, U.S. Pat. No. 4,454,241, incorporated by reference, discloses a clay derived Y zeolite activated with dihydrogen phosphate or dihydrogen phosphite anion having increased cracking activity. Although phosphorus treatment of zeolites is widely known, the fragility of the phosphorus/zeolite bond has also been reported. Molecules of phosphoric acid which have interacted with the strong acid sites on the zeolite "can easily be removed by extraction . . . " Ohlymann et el, CATALYSIS ON ZSM-5 ZEOLITES MODIFIED BY PHOSPHORUS, Catalysis and Adsorption by Zeolites, Elsevier 1991 (incorporated fully herein by reference).

All known commercial FCC processes using phosphorus-stabilized zeolite are believed to operate either water free, or at high temperatures. FCC catalyst is steamed during the stripping step, but steaming occurs at temperatures of 900 to 1000 degrees F. (near the riser top temperature) so that catalysts are not exposed to liquid water. The FCC regenerator typically contains 5-10 psi steam partial pressure (from water of combustion and entrained/or stripping steam), but operates at 1200-1400 degrees F.

Disclosures such as these show the robustness, stability and versatility of zeolite materials in FCC and related applications. They further provide general guidelines for the use of FCC catalysts in conjunction with the present inventions. In U.S. Pat. No. 6,916,757, inventor Ziebarth et al. (W.R Grace & Co.) discloses one of many recent advances in developing attrition resistant cracking catalysts and enhancing production of not only C3-C5 olefins, but C2 (ethylene) as well. Other catalysts have been found to increase the C3-C5 olefins at the expense of ethylene. In the '757 patent (incorporated in its entirety herein by reference for all purposes), the inventors found that they could develop attrition resistant catalyst particles having a high level (30-85%) of stabilized zeolites and having a constraint index of 1 to 12. The stabilized zeolite is bound by a phosphorous compound, alumina and optional binders wherein the alumina added to make the catalyst is about 10% by weight or less and the molar ratio of phosphorous ($P_2O_5$) to total alumina is sufficient to obtain an attrition index of about 20 or less.

Particulated catalyst additives can also perform as conventional large pore cracking catalysts for FCC processes and methods such as those disclosed elsewhere herein. These additives are very useful in octane numbers of the fuel or hydrocarbon product. Such additives also are especially suitable for enhancing yields of $C_3$-$C_5$ olefins. Those olefins are useful in making ethers and alkylates that may be used as octane enhancers for gasoline, as well as useful in making other chemical products. These particulated catalysts and additives are prepared from a number of compounds in addition to the primary active catalytic species. For example, the catalyst compositions can comprise clay and other inorganic oxides in addition to catalytically active ZSM-5. Alumina as an inorganic oxide (e.g. $Al_2O_3$) may also be added to (or used as a) catalyst. EP 256 875 reports that alumina in conjunction with rare earth compounds improves hydrothermal stability and selectivity of zeolite Y. The catalyst materials disclosed in the '757 may be used to advantage in the present invention using methods provided elsewhere in the document.

Refiners, e.g., FCC refiners, DCC (Deep Catalytic Cracking) refiners, as well as fixed fluidized bed refiners, would also find it advantageous to enhance ethylene yields in order to maximize the yield of valuable products from their refinery operations. Additives or compositions comprising novel catalysts are potential avenues for enhancing ethylene yields. Using those additives or compositions, however, without materially affecting the yield of other olefins can be difficult, especially in light of the other concerns mentioned above with respect to attrition.

Therefore, with certain refiners, it would not only be highly desirable to prepare a catalyst composition having a high attrition resistance, it would also be desirable to provide catalyst compositions having improved activity for ethylene production as well as substantially maintain the compositions' ability to produce other olefins. Those skilled in the art will also appreciate that improved attrition resistance as well as improved activity will translate into reduced catalyst makeup rates. The catalyst materials, methods and references cited in this brief description describe numerous, zeolite-based catalyst formulations. These are given as examples of materials that are useful in the catalytic process examples cited later in this disclosure.

The methods of the present invention describe the advantageous use of pyrolytic cracking processes in conjunction with one or more in situ retorting and/or mobilization processes.

As outlined above, there has been a significant amount of effort to develop methods and systems to economically produce hydrocarbons, hydrogen, and/or other products from oil shale formations. At present, however, there are still many oil shale formations from which hydrocarbons, hydrogen, and/or other products cannot be economically produced. Thus, there is still a need for improved methods and systems for production of hydrocarbons, hydrogen, and/or other products from various oil shale formations.

BRIEF SUMMARY OF THE INVENTION

Growing global demand for energy and chemical products, makes it increasingly necessary to develop new and alternative sources of raw materials. Oil shale, heavy oil, tar sands, other kerogen- and/or bitumen-containing deposits, lignite, coal and depleted oil fields represent some of the natural carbonaceous deposits that may prove useful in delivering new sources of gaseous and liquid hydrocarbons, and other products. Many resource formations targeted by the present invention comprise solid-phase (e.g. non-diffusing) carbonaceous deposits. Some comprise hydrocarbon(s) and/or other carbonaceous materials in a viscous liquid and/or gel form that diffuses or moves slowly under formation conditions. In some examples, a resource formation of interest in the present invention contains one or more hydrocarbon fluids (e.g. an oil or gas) that is/are substantially entrained, adsorbed or otherwise substantially unrecoverable using conventional recovery methods (e.g. oil sands, depleted oil or gas fields, etc. . . . ). The methods and systems of the invention may also apply to developing conventional oil or gas formations in which a substantial portion (e.g. >25%, for example) of the hydrocarbon is, or would be, left behind using one or more conventional methods. Many methods are available in the art to determine, measure or otherwise predict the percentage of an oil or gas hydrocarbon resource that may be recovered from a given formation. The methods and systems of this invention address the effective in situ mobilization (e.g. fluidization), transformation, and recovery of hydrocarbons and related materials from formations in which a portion of the carbonaceous resource is substantially non-coverable using standard formation-development and fluid recovery methods. As such, the carbonaceous materials comprising such resources are the to be "substantially immobile" natural resources, and may be referred to generally herein as "fixed-bed hydrocarbons" (FBH) and/or "fixed-bed carbonaceous deposits" (FBCD). A formation comprising a FBH or FBCD may be the to be a fixed-bed hydrocarbon formation (FBHF).

Often, very limited amounts of a carbonaceous resource in a geological formation may be produceable using methods designed for natural gas and/or liquid hydrocarbon recovery. Moreover, the fluid resources amenable to current extraction technologies may represent only a small fraction of the total carbonaceous deposit. For example, coalbed methane and shale gas operations, target the recovery of fluids that together appear to represent only a small portion of available carbonaceous materials. Without wishing to be bound by theory, such fluids are understood to be generated over extended geological time periods by the natural forces and conditions acting within the formation to decompose the heavier, "fixed-bed" carbonaceous minerals and materials. Often, even the fluids targeted by modern oil and gas methods remain unrecovered in a fully developed and/or depleted formation.

Multiple FBH deposits may co-exist within a formation. A portion of one or more deposits in one or more formations may be selected for treatment using the methods of this invention. A selected segment may be referred to as such, or as a treatment area; or as treatment, heating or selected zone(s); or other similar terms. Many of the carbonaceous resource deposits targeted by this invention have been viewed, historically, as sources of low-value, "burnable" energy products (e.g. coal, lignite, etc.), accessible primarily through mining operations. Even so, substantial technology, environmental and cost barriers have limited the recovery and use of several of these materials, even as solid energy products. This invention focuses on the application of certain chemistry, geology and engineering tools to accelerate conversion of such fixed-bed and solid-phase deposits into certain fluid (e.g. gas and liquid) energy and chemical products.

This invention provides for the rapid, scalable development of a variety of geological formations under conditions that offer a high-level of environmental containment and protection. While the methods of this invention may apply to a broad range of geological resources (e.g. both carbonaceous and non-carbonaceous), the focus of the present invention is the efficient development of geological formations containing deposits of carbonaceous material(s). This invention provides tools, methods and systems that are particularly useful for the in situ mobilization, synthesis and/or production of useful chemicals, fuel hydrocarbons and other products from geological formations containing substantially immobile carbonaceous materials, such as kerogen, bitumen, lignite, coals (anthracite, sub-bituminous, bituminous), and other FBCD.

In summary, this invention employs to advantage, natural and/or artificial fluid permeability present in a geological formation(s) comprising a FBCD. In a typical embodiment, a heated fluid is injected into a permeable (i.e. either natural or created) path through the formation so as to release a substantial portion of its heat content along a flow-path extending generally from a site of injection toward at least one production opening in the formation. At least a portion of the thermal energy contained in the injected fluid is transferred to the carbonaceous material (e.g. FBCD) by direct contact. This heat transfer may provide for the generation of fluid hydrocarbon from one or more of the carbonaceous materials, such as FBCD. Often, a substantial portion of the carbonaceous materials in direct contact with the injected fluid will undergo transition from low-mobility (e.g. fixed-bed) materials to fluids having substantial mobility. This transition from immobile to mobile materials may be referred to generally as "mobilization". Carbonaceous materials heated via indirect contact (e.g. conduction, convection, etc. . . . ) with the injected fluid may undergo a similar transition. Usually, mobilization of materials from an indirect-contact heating zone will follow mobilization of at least a portion of the FBCD available in a direct-contact heating area (e.g. having higher permeability). Mobilization of carbonaceous materials from a FBCD may further comprise any one, or any combination of the following: a) pyrolysis, b) molecular displacement, c) adsorption or desorption, d) extraction, e) emulsification, f) solubilization, g) ultrasonic treatment, h) vibrational treatment, i) treatment employing microwave radiation, j) treatment using other forms of radiation (e.g. x-ray, gamma, beta, etc), k) a shear (or shearing) force, l) capillary action, m) oxidation, n) chemical activation, o) vaporization, p) chemical decomposition, q) a bulk flow effects, r) reduction or elimination of surface or interfacial tension between at least two formation fluids (or, optionally, between a formation fluid and a formation solid), s) cracking (e.g. thermal, catalytic etc.), and/or r) retorting. Several aspects of mobilization important to the present invention are shown in hierarchical form in FIG. 1(A).

Following mobilization, one or more formation fluid is produced though one or more openings in the formation. Preferably, a produced fluid comprises at least one hydrocarbon. More preferably, the produced fluid comprises a plurality of hydrocarbons. In still another preferred embodiment at least one produced fluid displays an increased concentration of at least one hydrocarbon when compared to fluids produced from the same (or a substantially similar) formation not treated with the methods or systems of this invention. Most often, in the methods of invention, a heated fluid provides for both transfer of thermal energy and directional bulk-flow within the formation. Both are important features in this invention. Generally, the bulk-flow direction will be determined at least in part by the proximity and positioning of injection and producing well openings. Other characteristics of the bulk-flow (e.g. thermal-energy content, rate of injection, rate of production and directional biases, and the like) may be modulated in whole or in part by operator intervention. The operator may be a person, a digital or analog operating system, or any other intelligent operating system. To adjust the bulk-flow, fluid production, chemical properties or other aspects of the in situ hydrocarbon production system of this invention, the operator may adjust any a number of variables including but not limited to: rate of injection of fluid into the formation; pattern of injection of the heated fluid; rate and/or method used to heat fluid for injection; one or more injection well pressure(s); one or more producing well pressure(s); one or more producing well temperatures; one or more pressure differentials between openings in the formation; and many others. Often, the flow of produced fluids may be enhanced, modulated and/or controlled by establishing and/or controlling of a net pressure differential between one or more injection openings and one or more production openings.

Fluid(s) injected into the formation for the purpose of transferring thermal energy is referred to as the thermal energy carrier fluid(s) (TECF). Preferably, TECF is used to advantage in the heating of one or more FBCD in a formation (e.g. an FBHF). A TECF also typically provides mobility, directional flow and/or other production-enhancing properties to at least one formation fluid. Preferably, the formation fluid comprises at least one hydrocarbon species. Typically, a TECF is heated to temperatures well above that of a target formation (e.g. to 200-2200 degrees F.; and, preferably, 450-2000 degrees F.; and, more preferably, to 750-1800 degrees F.) prior to injection. The fluid is injected into the formation so as to contact at least a portion of one or more carbonaceous deposits. Contact of the TECF with the FBHF provides for mobilization of hydrocarbon and other materials, at least a portion of which are produced through one or more openings. Direct contact between the TECF and carbonaceous materials present in at least one permeable portion of the formation may facilitate rapid heating of formation materials over a large volumetric surface. Heating expands outward from an initially heated permeable zone, and often expands into less permeable portions of a formation. Under certain conditions, the expansion of heated zone may result in mobilization of theretofore low-mobility materials (from low- and/or high-permeability zones). Such mobilization may be derived in whole or in part by controlling in situ operations sufficiently to facilitate (or impede) certain desired chemical reactions or process chemistry in situ. In certain examples, this in situ chemical processing may be controlled so as to produce a diversity of products, or individual products, that are substantially similar to those derived from one or more ex situ petroleum refining operations. In some cases, the controlled in situ operations mediated by injection of TECF are substantially similar to one or more well-known, ex situ hydrocarbon refining operations such as: thermal cracking, hydrocracking, catalytic cracking (by way of fixed-bed, fluidized-bed, mixed-bed, and other related methods, etc. . . . ), extraction, evaporative distillation, vaporization, condensation, solubilization, retorting, coking, and the like.

The methods of this invention provide for multi-modal heating of the formation. Initially, the heat transfers directly to a selected permeable portion of a formation by direct contact of the TECF with the formation matrix. Carbonaceous materials present in the selected portion may also be heated (and, optionally, mobilized) by the direct contact TECF. Heating continues to expand outward from the initial direct contact zone by both direct and indirect means (e.g. thermal conduction, radiant transfer, etc. . . . ). Typically, the heated zone (or 'hot zone') expands outward by thermal conductivity in a direction roughly perpendicular to the major axis of a material flow-path. For the purposes of this invention, the flowing TECF may be viewed as a direct-contact liquid heating element, having both energy transfer and fluid characteristics (e.g. bulk-flow) necessary for the operation of this invention. The rock and minerals heated by direct contact with the flowing TECF may be viewed as conductive heating elements, transferring heat outward by thermal conductivity from the primary fluid flow axis(es) to the surrounding formation. As such, the mass and volume of the heating interface within a formation may expand progressively while the heating methods of this invention are in operation. This feature allows for rapid, systematic, and potentially, geometric expansion of production volume in certain types of carbonaceous formations. This is particularly achievable in well-defined, vertically-sealed kerogen-, bitumen- and/or lignite-containing formations.

The TECF exhibits a number of properties that may be important to the effective operation of this invention. Typically, the TECF comprises a liquid, vapor, and/or supercritical fluid that can be used to carry thermal energy to and from the formation. In addition, the TECF exhibits fluid properties that allow for reliable flow under formation conditions. For example, a number of physical properties may be important for establishing behavior and control of TECF flow within the formation. This includes, but is not limited to, viscosity, heat capacity, vapor pressure, heat of vaporization, boiling point, critical point, phase behavior, phase transfer properties, solvency, solubility, energy content, fuel value, water miscibility, hydrocarbon miscibility, chemical reactivity, thermal stability, polarity, and adsorption characteristics. A TECF may be selected based on a plurality of these and possibly other physical and chemical parameters. Physical constants that reflect one or more of these properties may be used in selecting a TECF. In some cases, a TECF may comprise a fuel. TECF may comprise a hydrocarbon. In some embodiments, TECF comprises a fluid having a heat capacity, critical point, and/or dielectric constant (e.g. polarity) less-than-or-equal-to that (and/or those) of methane. In preferred embodiments, TECF comprises a fluid having a heat capacity, critical point, and/or dielectric constant (e.g. polarity) greater-than that (and/or those) of methane. In more preferred embodiments, TECF comprises a fluid having a heat capacity, critical point, and/or dielectric constant (e.g. polarity) greater-than-or-equal-to that (and/or those) of ethene. In most preferred embodiments, TECF comprises a fluid having a heat capacity, critical point, and/or dielectric constant (e.g. polarity) greater-than-or-equal-to that (and/or those) of propane. In some examples, combustion of TECF (or components thereof) is used to generate at least a portion of the heat carried into the formation by a TECF. In some examples, a TECF comprises a combustion and/or partial-combustion product. In some examples, a TECF comprises a formation fluid. In other examples, a TECF comprises one or more of the following: an industrial or municipal product, an industrial or municipal waste stream, a waste product, a co-products, and/or the like. A TECF may comprise a homogeneous fluid, a single- or multi-phase liquid, a vapor, a heterogeneous and/or multi-phase fluid, and the like. In some examples, a TECF is water miscible. In others, it is oil miscible, or partially miscible in both water and oil. In some cases, the TECF is selected on the basis of one or more local and/or practical parameters that may include: local availability or abundance, cost, environmental compatibility, recoverability, detectability, biodegradability, human or animal toxicity, condensability, compressibility, and the like.

In this invention, a TECF typically serves a plurality of functions, that includes delivering thermal energy to (or from) one or more portions of a FBHF. Additional functions of the TECF may comprise providing for fluid communication (e.g. an operational linkage) between an injection well(s) and a producing well(s). The TECF may provide additional in situ operational linkage(s) or advantages by serving as: a bulk carrier fluid, a formation-flooding agent, a formation-pressure regulating fluid, a solvent, a phase-transfer agent, a displacing agent, a solubilizing agent, a source of energy or combustible materials (e.g. for subsequent operations), a formation permeability-enhancing agent, a formation porosity-enhancing agent, a condensable or non-condensable produced fluid, and/or a formation-sealing agent. A TECF (including any one or more of its components) may further function to displace, dissolve, solubilize, mobilize, and/or react directly or indirectly with: one or more chemicals, hydrocarbons, carbonaceous materials and/or inorganic minerals in a formation. In many applications, a substantial portion of the injected TECF is later produced from one or more producing wells distributed within the formation. In some embodiments, a majority of the TECF may be produced in substantially diluted form from one or more producing wells. In some embodiments, a portion of the injected TECF may be rendered unrecoverable following injection into the formation. In some embodiments, a portion of the injected TECF may undergo pyrolysis, reactive decomposition and/or combustion following injection.

The methods of this invention allow for the direct heating of a carbonaceous deposit through direct exposure of the carbonaceous deposit to the mobile TECF. This direct effect provides for rapid retorting and hydrocarbon mobilization within a treated portion of a formation. It further enhances local permeability, thus allowing for expansion of the direct contact area beyond the initial TECF contact zone. Conductive and radiant heat transfer from the direct contact zone outward provides a important secondary mode of heating additional portions of the formation to levels sufficient for hydrocarbon mobilization and retorting.

While the methods of the invention may differ slightly depending on the nature of the formation and local geology, the methods described herein are effective for producing one or more hydrocarbon-containing fluids from fixed-bed carbonaceous deposits, the method comprising: 1) providing one or more openings to a substantially permeable formation comprising one or more FBCD, 2) selecting a TECF for injection, 3) heating the TECF, 4) injecting heated TECF into the permeable formation, 5) displacing portions of formation fluids to remote portions of the formation, 6) producing formation fluids through one or more openings in the formation, 7) recovering at least a portion of the produced fluids, and optionally, 8) injecting a portion of produced fluids into a formation containing one or more FBCD. The method may further comprise heating the TECF prior to injection. The method may also further comprise the recovery and/or reuse of the TECF collected from one or more producing well(s). The method may further comprise constructing one or more physical, hydrodynamic and/or biological barriers to limit egress of formation fluids from the selected substantially permeable portion of the formation. Construction of the physical, hydrodynamic and/or biological barriers comprises drilling at least one injection well that is not intended for use as a hot TECF injection well or for producing hot formation fluids from the selected permeable (e.g. treated) portion of the formation.

A variety of carbonaceous deposits may be developed using the methods of this invention. These include, but are not limited to: oil shale; tar/heavy oil sands; lignite; coal (e.g. anthracite, bituminous, sub-bituminous and brown coals); certain liquid petroleum or natural gas formations; heavy oil formations; shale gas and coal bed methane formations; and depleted oil and gas fields. The applications are set forth in a series of examples provided in enabling detail. These examples include:

a. In situ retorting and refining of a selected portion of an oil shale formation—This example illustrates the detailed geology and development of a well-known oil shale formation in Rio Blanco County, Colorado, using the methods of this invention. Particular attention is given to: the injection and producing well designs, depths, spacings and pattern of wells used to develop the formation; water and aquifer control techniques; production volumes per unit area; and the systematic, multi-year scale-up of the entire site. A series of detailed examples are provided that illustrate:

i. The underlying geology of the Piceance Basin oil shale formation along with stratagraphic, depositional and equipment details relevant to drilling and accessing several multiple kerogen-containing layers within the formation, and a systematic plan for developing the Piceance-Basin oil shale formation ii. Design of several down-hole combustion heaters useful for the generating superheated steam and other TECF to be used as part of the kerogen retorting and other applications of this invention.

iii. Detailed methods for introducing and enhancing formation permeability (where needed) through use of controlled fracing and proppant addition.

iv. Detailed descriptions of TECF options and properties, and the application of the present invention to producing a wide range of energy products and other products, with particular attention to the selected site.

b. In situ retorting and refining of a selected portion of a heavy oil and tar sand formation—This example illustrates the detailed geology and progressive development of well-known heavy oil and tar sand site in the Western U.S., Western Canada, and elsewhere. It highlights some important differences between oil shale and tar sands development, it also illustrates the profound similarity in applying the present invention to tar sands and oil shale.

c. In situ retorting and refining of a selected portion of a depleted oil (liquid hydrocarbon) field—This example illustrates use and utility of the present invention as a method for producing high quality fuels and chemicals from a depleted oil field that has already been subjected to secondary recovery operations.

d. In situ retorting and refining of a selected portion of a coal or lignite resource—This examples illustrates the use of the invention in developing a coal or lignite formation using the methods of this invention.

e. Highly effective methods for containing, controlling and directing formation water without the use of refrigerants or the establishment of other solid containment barriers.

f. Production of diverse hydrocarbon and petrochemical products via thermally-directed and/or catalyst-assisted in situ processing of formation fluids Application of this invention to one or more FBCD may result in the production of a diverse set of products, including non-condensable hydrocarbons such as methane, ethane and ethene; condensable hydrocarbons such as saturated and unsaturated hydrocarbons having carbon numbers of 3 to 12 (e.g. C3-C12 hydrocarbons), aromatics, and the like. The C6-C12 fractions may be well-suited for use as liquid fuels for use in air, rail and surface transportation. In some applications, the methods of this invention provide for enhanced levels of C4-C20 alpha and beta olefins. Such compounds have considerable value as industrial chemicals, lubricants, monomers and intermediates. In addition, industrially important aromatic and cyclic hydrocarbons; linear and branched chain olefins; organic acids and alcohols; and heterocyclic compounds may be produced in abundance using the methods of this invention. Important classes of inorganic chemicals also may be produced using the methods of this invention. This includes, but is not limited to, molecular hydrogen, carbon monoxide, carbon dioxide, hydrogen sulfide, and others. Inorganic substances such as minerals, and precious or semi-precious metals may be produced using the methods described in this invention.

These and other objects of the present invention will become apparent to those familiar with the retorting and refining of carbonaceous deposits when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which:

FIG. 1(A) illustrates the relationships between key terms used herein to refer to different modes of hydrocarbon utilization.

FIG. 2*a* represents the fully unitized retort development shown in the center of FIG. 1. Individual rows of Stage A injection (|_____R_____|) and production (|- - - |) wells and hydrodynamic barrier wells (|_____W_____|) are shown. FIG. 2*b* represents the same fully unitized retort development in Stage B (e.g. following reversal injection and production wells).

FIG. 3 shows the thermal energy content (Btu/lb) of oil shale as a function of temperature.

FIG. 4 shows the typical stratigraphic column of the oils shale zones in the Eureka Creek area of Rio Blanco County, Colorado. The left side of the figure shows important lithologic features and their approximate thickness (in feet, in parantheses). On the right, a portion of the formation extending from Zone R-8 to Zone R-6 is shown in greater detail.

FIG. 5*a* illustrates potentiometric surface elevations as a function of bottom hole (B.H.) pressures in the "B-Groove" aquifer. FIG. 5*b* illustrates the potentiometric surface elevations as a function of bottom hole pressures in the "A-Groove" aquifer. FIGS. 5*c* and 5*d* show the equivalent relationships for "A-Frac" and "B-Frac" aquifers, respectively.

FIG. 6*a* illustrates hydrodynamic flow directions and rates in the "B-Groove" in the initial stage (e.g. Stage 1) of an oil shale retort development. Characteristic pressures, porosity, depths and distances are illustrated. FIG. 6*b* shows the hydrodynamic flow directions and rates in the same "B-Groove" retort following the reversal of functions of the injection and production wells (e.g. Stage 2). FIGS. 6*c* and 6*d* show the equivalent hydrodynamic flow directions and rates in the "A-Groove" retort at Stages 1 and 2, respectively.

FIGS. 7*a* and 7*b* illustrate potentiometric gradients and pressure gradients in the "B-Groove" and "B-Frac" at Stages 1 and 2, respectively. FIGS. 7*c* and 7*d* show the equivalent potentiometric gradients and pressure gradients in the "A-Groove" and "A-Frac" at Stages 1 and 2, respectively. The FIG. 7 series use an injection well potentiometric surface elevation of 6600 ft.

FIGS. 8*a*-8*d* are analogous to FIGS. 7*a*-7*d*, except at a potentiometric surface elevation of 6300 feet in the injection wells.

FIG. 9*a* illustrates formation of a hydrodynamic caprock to prevent leakage from R-7 to R-8 and above when producing from "A-Groove" and "A-Frac" and injecting in the "B-Groove" and "B-Frac". FIG. 9*b* illustrates formation of a hydrodynamic caprock to prevent leakage from R-7 to R-8 and above when producing from "B-Groove" and "B-Frac" and injecting in the "A-Groove" and "A-Frac". FIG. 9*c* is analogous to 9*a* except that the injection wells operate at a lower potentiometric surface elevation. FIG. 9*d* is analogous to 9*b* except that the injection wells operate at a lower potentiometric surface elevation.

FIGS. 10*a*-10*d* are analogous to FIGS. 9*a*-9*d*, except are plotted as a function of pressure (PSI) rather potentiometric surface. That is, FIG. 10*a* illustrates formation of a hydrodynamic caprock to prevent leakage from R-7 to R-8 and above when producing from "A-Groove" and "A-Frac" and injecting in the "B-Groove" and "B-Frac". FIG. 10*b* illustrates formation of a hydrodynamic caprock to prevent leakage from R-7 to R-8 and above when producing from "B-Groove" and "B-Frac" and injecting in the "A-Groove" and "A-Frac". FIG. 10*c* is analogous to 10*a*, except that injection wells operate at a lower potentiometric surface elevation. FIG. 10*d* is analogous to 10*b* except that the injection wells operate at a lower potentiometric surface elevation.

FIG. 12*a* shows the heat content (Btu/lb) as a function of temperature for selected TECFs (at constant pressure). FIG. 12*b* shows the heat content (Btu/lb) of steam and combustion air products as a function of temperature. FIG. 12*c* illustrates the heat content (Btu/lb) of a mixture of 20% steam plus 80% combustion air products as a function of temperature. FIG. 12*d* shows heat content (Btu/lb) of a mixture of 40% steam plus combustion air products as a function of temperature.

FIG. 13*a* shows heat content (Btu/lb) of water/steam as a function of pressure and temperature. FIG. 13*b* illustrates the variation of specific volume (i.e. cu ft/lb) of water, steam and super-heated steam as a function of pressure and temperature.

FIG. 14 illustrates boiling points (degree F.) of water and selected hydrocarbons as a function of pressure (PSI).

FIG. 15 is an elevation view of a horizontal well configuration using proppants in a hydraulic fracture in the R-7 zone. In this drawing, the horizontal portion of the well is shown disposed in the R-7 zone and between the A-Groove and the B-Groove.

FIGS. 16*a* and *b* illustrate a single well bore containing injection and production openings, and a flow of thermal energy carrier fluid through a permeable portion of the formation and contacting at least two fixed-bed carbonaceous deposits. (a) and (b) illustrate a well bore in which the outer casing terminates in an upper carbonaceous deposit (hatched area) and the inner casing terminates in a lower deposit. In (a), injection of TECF is through the lower opening. Production is through the upper. In (b), this flow pattern is reversed. In (d), both casings terminate in the lower deposit, but the outer casing is perforated in the upper deposit allowing the perforated segment to serve as the production opening. In (c) and (e) illustrates the outer and inner casings terminate at different points along the well bore, but within the same carbonaceous deposit. In (c) the outer casing terminates before the inner casing. In (e) the outer casing terminates comcommitantly with the inner casing, but is perforated at a point above the inner casing, the perforation serving as a production opening.

FIG. 17*g* illustrates the addition of proppant and/or catalyst material to the fractured region of the formation illustrated in (f).

FIGS. 19*a* and 19*b* illustrate the hydro-mechanical system for the hydro-ICS cycle engine.

DETAILED DESCRIPTION AND EXAMPLES OF THE INVENTION

A. Terms & Definitions

Figure 1:
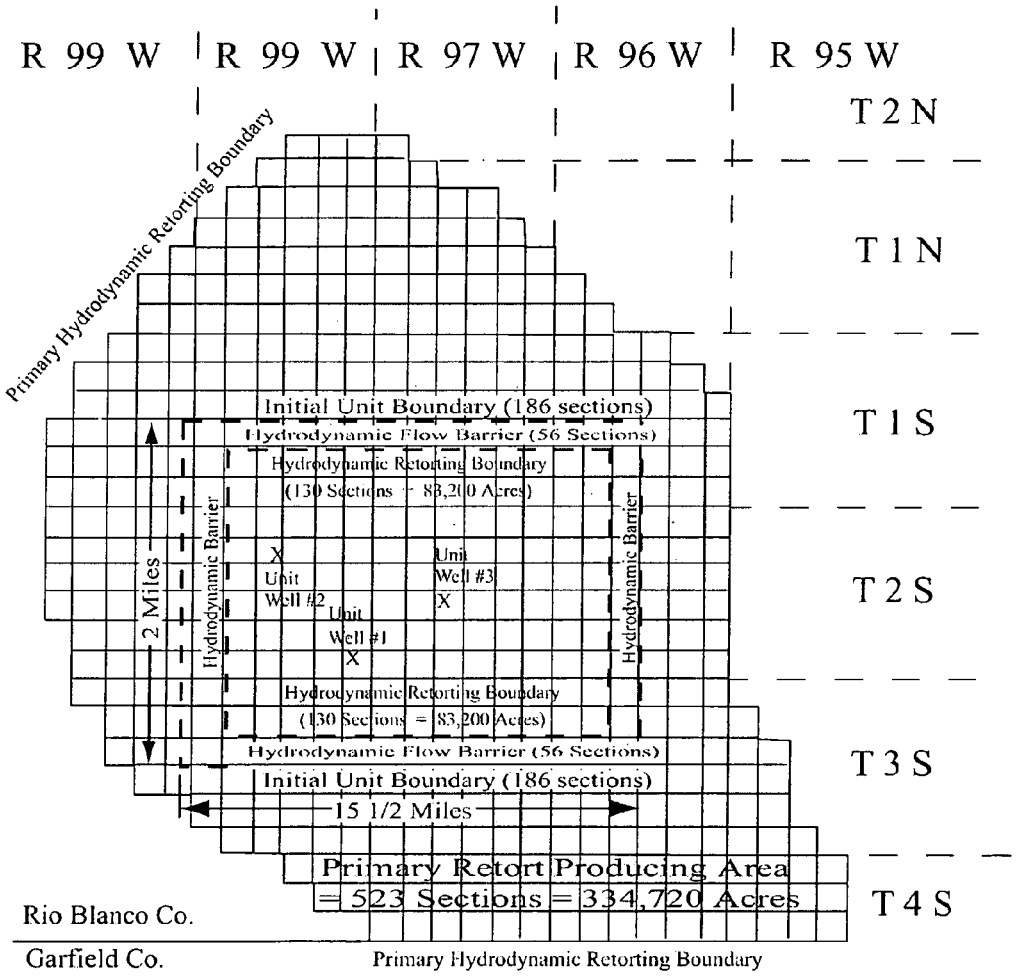
FIG. 1 illustrates a preferred area for the in situ hydrodynamic development of a portion of the Piceance Basin oil shale deposit located in Rio Blanco county in Colorado. The figure illustrates key features of the oil shale development methodologies disclosed and discussed elsewhere in this invention.

Paraffins (alkanes) are saturated, acyclic, aliphatic hydrocarbons having anywhere from one to dozens of carbon atoms. Paraffins have the general formula: $C_nH_{2n+}2$ (n is a whole number). Paraffins may be either straight-chain or branched-chain molecules and may be either liquids or gases at room temperature.

Aromatic chemicals and hydrocarbons are ringed structures having one or more six-carbon rings with alternating single and double bonds between the carbons. A typical formula for a mono-substituted aromatic compound is: $C_6H_5$—Y (where Y may be any number functional groups, but in geological sources, is often found to be an alkyl side-chain having anywhere from 1 to 12 carbons, or even more). Benzene, toluene, xylene and naphthalene represent a few of the many aromatic compounds often found in petroleum formations.

Napthenes or Cycloalkanes are a class of hydrocarbons having the general formula: $C_nH_{2n}$ (where n is a whole number). They are ringed structures with one or more rings containing only single bonds between the carbon atoms. Common examples of naphthenes include: cyclohexane, methyl cyclopentane, and many others. Naphthenic structures comprise a large portion of the carbonaceous material present in some geological deposits such as heavy oils and tars.

Alkenes have the general formula: $C_nH_{2n}$ (n is a whole number). They may be linear or cyclic or branched chain molecules containing one carbon-carbon double bond. Cyclic alkenes have two fewer carbons than linear but are also an important class of materials. Linear alkenes are often, commonly referred to as olefins. Alpha-olefins are those that have a double bond at the first (e.g. terminal) carbon in a linear hydrocarbonaceous backbone structure. Beta-olefins have double bonds that occur within a linear, hydrocarbonaceous backbone in a way that does not involve a terminal carbon atom. Common industrial olefins include: ethylene, propylene, butane, isobutene, and others.

Fixed-bed carbonaceous deposit(s) (FBCD) refers to a range of natural resource formations targeted by the present invention. A fixed-bed resource is characterized by having at least one substantially immobile carbonaceous component under formation conditions. This substantial immobility may arise from a number of physical and/or chemical properties of the material, and is seen in the carbonaceous material being substantially unrecoverable in formation fluids using conventional oil and gas development methods (e.g. at least 25% is left-behind). In simplest form, the FBCD is a solid (e.g. non-diffusing) material, such as kerogen, lignite, coal, and the like. In other forms, the FBCD is a very viscous hydrocarbon(s) such as a heavy oil or very heavy oil. In some forms, the fixed-bed carbonaceous material is a viscous liquid and/or gel form that diffuses slowly under geological conditions. In some forms, the FBCD comprises one or more hydrocarbon fluid (e.g. an oil or gas) that is/are substantially entrained, adsorbed to, or otherwise substantially unrecoverable due to limited mobility under conventional recovery methods (e.g. oil sands, depleted oil or gas fields, etc. . . . ). In the context of the present invention, all such FBCD are mobilized, and produced as hydrocarbonaceous fluids. For this reason, a fixed-bed resource deposit may also be the to comprise fixed-bed hydrocarbons (FBH). A formation comprising a FBCD or FBH may the to be a fixed-bed hydrocarbon formation (FBHF).

Porosity is a measure of pore volume as a function (or percentage) of total bulk volume of a (material) porous rock. Permeability refers to the propensity of a porous rock or matrix mineral to permit flow of fluids. Transmissability refers to the capacity of a fluid of known viscosity to flow through a matrix (e.g. rock) of known permeability and thickness. Transmissability is proportional to the product of permeability and thickness divided by viscosity.

Hydrostatic formation-fluid pressure is the virgin pressure of the fluid within a permeable formation which has not been distorted by fluid injection into or production from such a formation.

Potentiometric surface elevation is the elevation (generally measured in feet or meters above mean sea level) to which formation fluid from a permeable formation would rise in a cased well bore completed for fluid communication with only that single permeable formation.

Potentiometric surface gradient is the slope (generally measured in fee-per-mile or meters-per-kilometer) of the mapped potentiometric surface elevations of a permeable formation. Hydrodynamic gradient in a permeable formation, unless otherwise indicated, is generally the same as a potentiometric surface gradient.

Geostatic rock pressure is averaged gross weight per unit area (generally measured in pounds-per-square-inch or in kilograms-per-square-meter) of the column of rock above a referenced depth which is generally understood to be about 0.9 to 1.1 psi-per-foot.

Mobilization and pyrolysis—The relationships between the closely related terms of mobilization (e.g. mobilize), pyrolysis (e.g. pyrolyze) and cracking are illustrated schematically in FIG. 1(A) and discussed in great detail elsewhere herein.

To summarize, mobilization of carbonaceous materials from geological formation refers to a transition whereby a substantially immobile material becomes substantially more mobile, especially within a fluid hydrocarbon or TECF stream. In the context of the present invention, mobilization of a material may result from any number of in situ physical processes including, but not limited to: a) pyrolysis, b) molecular displacement, c) adsorption or desorption, d)

extraction, e) emulsification, f) solubilization, g) ultrasonic stimulation, h) vibrational stimulation, i) microwave stimulation, j) stimulation with other forms of radiation (e.g. x-ray, gamma, beta, etc), k) a shear (e.g. frictional drag or shearing) force, l) capillary action, m) oxidation, n) chemical activation, o) vaporization, p) chemical decomposition, q) a bulk flow effect, r) reduction or elimination of surface or interfacial tension between at least two formation fluids (or, optionally, between a formation fluid and a formation solid), s) cracking (e.g. thermal, catalytic etc.), and/or r) retorting. Several aspects of mobilization important to the present invention are shown in hierarchical form in FIG. 1(A). As seen here, pyrolysis represents an important subset of mobilization strategies. It refers to the thermally-induced chemical decomposition of organic materials by heating in the absence of oxygen. When applied to a solid material or other substantially immobile resource so as to produce a substantially mobile fluid, a pyrolysis reaction may be referred to as retorting. A thermal "front" at which pyrolytic mobilization is occuring in a formation may be referred to herein as a "retort front". A hydrocarbon pyrolysis reaction occuring within a fluid stream comprising a mobilized hydrocarbon, and serving to reduce molecular weight of at least one species of hydrocarbon present in such a stream is referred to herein as a cracking reaction. A cracking reaction may be a thermal or steam cracking reaction, a catalytic cracking reaction, a hydrocracking reaction, and combination of these and other bone fide cracking reactions. Many different cracking reactions are described herein. Often, a cracking reaction may be assisted by steam, catalysts, hydrogen and other agents.

B. Introduction

The geological environment contains a variety of formations in which high concentrations of carbon and/or hydrocarbon compounds can be found. This invention provides a series of methods that allow fuel and chemical products to be developed from such resources by prior available methods. Often, the expense and complexity required to develop high-carbon resources does not justify doing so. Historically, economically recalcitrant high-carbon formations have included tar and oil sands (e.g. bitumen), oil shale(s) (e.g. kerogen), certain coal formations (e.g. bituminous coal, lignite, etc) and petroleum fields at or beyond their tertiary stage of recovery. These high-organic fields may contain mineralized or liquid carbon compounds, or both, but share the feature that the carbon present in the field is difficult (or impossible) to recover economically using methods known in the art. Whether liquid, gel or solid in form, the entrained carbon materials behave more as fixed-bed, than as flowing resources. For the purposes of the present invention, a resource of this kind is referred to as a fixed-bed hydrocarbon field (FBHF) or fixed-bed hydrocarbon formation (FBHF). In plural form, they may further be designated as FBHFs. The relative immobility of the carbonaceous resource contained in an FBHF maybe referred to generally as recalcitrance (as in a recalcitrant hydrocarbon). A material having such recalcitrance, limited mobility and/or limited fluid recoverability under normal formation conditions, may further be described as being "substantially immobile".

The term hydrocarbon is also used throughout this disclosure to refer to molecular entities comprised primarily of carbon and hydrogen atoms, having a backbone comprised substantially of covalent carbon-carbon bonds (—C—C—). Although some carbon-containing deposits may also contain other elements, such as nitrogen, phosphorous, sulfur, oxygen, and others, these hetero-atoms are typically present in low abundance and have little impact on the bulk properties of the deposit, or of the fluids released upon heating or mobilization of the materials present in the deposit. For this reason, such resource beds may still be referred to generally as "carbonaceous" or as hydrocarbon deposits, or recalcitrant hydrocarbon formations. Likewise, it is recognized that some mineralized organic matter targeted by the methods of this invention, that may be referred to as hydrocarbon deposits (e.g. coal, oil shale, etc. . . . ) may not qualify as hydrocarbons under a strictly technical definition of the term. However, in the context of this invention, it is understood that such deposits, when heated to pyrolysis temperatures, release of a variety of hydrocarbons into the formation fluids. For the purposes of this invention, all such deposits may be referred to as "hydrocarbon" resources, deposits, material or beds, or more generally, as carbonaceous materials or deposits, or other similar terms.

The present invention provides a series of methods and systems useful in mediating, modulating, controlling, collecting and otherwise impacting a distribution of hydrocarbon products produced from a carbonaceous geological formation. Generally, the targeted carbonaceous deposit will be one containing one or more substantially immobile carbonaceous resource deposit, referred to herein variously as a fixed-bed hydrocarbon (FBH) or fixed bed carbonaceous deposit (FBCD). The hydrocarbon products produced using the methods and systems will often be derived, directly or indirectly, by pyrolysis other mobilization events from one or more of these carbonaceous resource deposits. Many of the methods and systems described herein rely in part on injection into a formation of one more specialized heated fluids, referred to as thermal energy carrier fluids (TECF). Typically, a series of wells are introduced into a given formation (e.g containing FBCD). Some wells are used to inject TECF (e.g. injection wells), while others are used to produce formation hydrocarbons and fluids. Still others may be used to modulate pressure and/or potentiometric surface of the formation, to introduce additives, control formation waters, allow for formation monitoring or measurements, and other uses.

The methods apply to a wide variety of FBHFs and FBCD. They apply to coal formations, that can have very high permeability. They apply to oil shale formations, that have traditionally been described as having very low permeability. In addition, we have identified a series of methods to render low permeability formations permeable using fracing technology and hydrodynamics. Also, we describe herein the use of this invention in conjunction with certain zones in an oil shale formation that are naturally permeable. These often occur in association with the more traditional, less permeable oil shale zones. Generally, the methods use natural or artificial permeability to advantage for the mobilization and production of hydrocarbons from carbonaceous deposits.

Unless otherwise used in the context of their use, the term "very high permeability frac" is used to refer to a fracture that provides for permeability of 500-2000 darcy. A "high permeability frac" refers to a fracture that provides a permeability of 10-to-500 darcy. A high permeability rock (or formation) is one exhibiting 0.10-to-10 darcy (or higher) permeability. A medium permeability rock (or formation) is one exhibiting permeability of 0.01-to-0.10 darcy. A low permeability rock (or formation) is one exhibiting permeability of 0.00010-to-0.010 darcy. An impermeable rock (or formation) of <0.00010 darcy. A substantially permeable rock (or formation) generally has at least low permeability. More preferably, it has at least medium permeability. Terms such as permeability, higher permeability, lower permeability, substantial permeability are used primarily for comparative purposes to illustrate important differences in portions of the formation. They do not necessarily indicate that a given portion of the formation qualifies as low, medium, or high permeability.

Permeability suggests that there is or can be fluid transmission or communication between two laterally separated points. In high permeability zones, fluid communication can be established between wells at distances of >100 ft. Preferred formats for the present invention are those in which there is measurable fluid communication between wells positioned at least 50 ft apart within a formation, and more preferably, between wells positioned >100 ft apart and most preferably >500 ft. In situ oil shale retorting, the methods of this invention are preferentially applied across the high permeability portions of the formation. When applied in low-permeability formations, distances between injection and producing wells must be small (e.g. <50 feet, and often <30 feet), allowing for only moderate volumetric productivity for a given well pair. In such situations, well drilling, environmental stabilization and materials costs, can be prohibitive. In preferred embodiments, the methods of this invention are applied to the medium permeability to high permeability formations. In some embodiments, high permeability formations (and/or lithologic layers) are employed to treat adjacent, low permeability formations (and/or lithologic layers).

In the methods and systems of this invention, injection wells play a key role in heating a formation. In some embodiments, super-heated steam or other hot fluid TECFs (including gases) flow from injection wells directly into the permeable zones of a formation as a means of delivering heat energy. A downhole combustion chamber may be used to produce the super-heated mixture that is then released into the formation. In some embodiments, a thermal carrier fluid is heated at the surface or within a subsurface heat exchanger. Heated thermal transfer fluid TECF is introduced into the permeable zones of the FBHF through one or more injection wells. In other embodiments, the thermal energy is generated in direct communication with the thermal carrier agent. In preferred embodiments, the thermal carrier agent is water, which is injected in into the FBHF formation as super-heated steam through one or more injection wells. The most preferred embodiments comprise a downhole (e.g. subsurface) combustion chamber. In another embodiment, heating occurs first through downhole combustion and is followed by injection of a separate mobile phase through the well bore such that the heating and mobility are communicated through different agents. In some cases they are temporarily separate. In other embodiments, different geochemistry is initiated with each distinct heating phase. As a result, the product mix varies with harvest depth (e.g. pressure) or distance from the injection well, depending on whether the injection wells and producing wells are arranged horizontally or vertically with respect to the surface. Chemistry also varies somewhat with formation temperature, residence time and thermal gradient experienced during the course of hydrocarbon mobilization in a given FBHF.

Other preferred embodiments comprise one or more injection wells operating continuously (e.g. continuously meaning heat injection operations are sustained for at least 8 hr per day for at least about 7 days consecutively or at least one interval of 3 days of non-stop operation) at temperatures exceeding 750 degrees F. More preferred embodiments comprise one or more injection wells operating about continuously at temperatures exceeding about 1000 degrees F. Most preferred embodiments comprise one or more injection wells operating continuously at temperatures of 1200-2000 degrees F. depending upon the thermal stability of the inorganic minerals of the rock.

In most preferred embodiments, injected heat energy is used to increase the temperature of a portion of the FBHF so as to create a mobile and expanding retort front. In preferred embodiments, that region of the FBHF surrounding and extending out at least 3 feet from the injection well is heated to temperatures in excess of 450 degrees F., and more preferably, 650 degrees F. In more preferred embodiments a continuous region extending at least 10 feet from the injection well is heated throughout to temperatures in excess of 450 degrees F., and more preferably, 650 degrees F. In yet more preferred embodiments a continuous region extending at least 30 feet from the injection well is heated throughout to temperatures in excess of 450 degrees F., and more preferably, 650 degrees F. In the most preferred embodiments, a continuous region extending >30 feet from the injection well is heated throughout to temperatures in excess of 450 degrees F., and more preferably, 650 degrees F. In other preferred embodiments, a region of the FBHF surrounding and extending at least 10 feet from the injection well is heated to temperatures in excess of 600 degrees F. In yet another preferred embodiment, a continuous region of an FBHF surrounding and extending at least 10 feet from the injection well is heated to temperatures in excess of 700 degrees F.

Numerous embodiments exist for using the invention to liberate fuel and chemical raw materials from oil shale and other FBHFs. This invention discloses a unique combination of methods and strategies by which kerogen, bitumen and other carbonaceous deposits are converted into simple fuel hydrocarbons and/or chemical building blocks.

In one embodiment, hydrocarbons are generated and converted within the formation to a mixture of relatively high quality hydrocarbon products, hydrogen, and/or other products. To enable this conversion(s), one or more heated thermal energy carrier fluids (TECF) may be used to heat a portion of the oil shale formation to temperatures that allow pyrolysis of the hydrocarbons. Saturated and unsaturated hydrocarbons, hydrogen, and other formation fluids may be removed from the formation through one or more production wells. In some embodiments, formation fluids may be removed in a vapor phase. In other embodiments, formation fluids may be removed as liquid, vapor, or a mixture of liquid and vapor phases. Temperature and pressure in at least a portion of the formation may be controlled during pyrolysis to yield improved products from the formation. Condensation of select product fractions may occur at selected points within or in close proximity to the producing well(s).

In an embodiment, one or more thermal carrier fluid injection wells may be installed into a formation to heat the formation by fluid communication between the injection well(s) and one or more producing wells. One or more injection well(s) may also function intermittently as a producing well. One or more producing well(s) also may be installed by drilling openings (well bores) into the formation. In many embodiments, drilling and completing wells and casings may be done using conventional methods, equipment and tools. In some embodiments, openings are formed in the formation using a drill with a steerable downhole motor to create horizontal well bores. Such well bores may be formed in the formation by geo-steered drilling. In still others, an opening may be formed into the formation by sonic drilling. In some embodiments well bores are drilled in an approximately vertical orientation. In preferred embodiments, communication between one or more injection wells and one or more producing wells is established within the boundary of a given carbon-rich seam (e.g. oil shale, etc.), among a plurality of such carbon-rich seams in a given formation. In some embodiments, a plurality of well bores contacting a given carbonaceous seam are drilled in a horizontal or near-horizontal orientation. These and many other approaches and methods for well drilling and well preparation are well known in the art. Other methods for preparing well bores suitable for use in the present invention are also described in one or more of the working examples described in this invention.

In some embodiments, one or more thermal energy carrier fluid injection wells may be placed in a defined pattern within the formation to establish the rate or pattern of heating. Such patterned layout of injection wells may be matched with a corresponding pattern of producing wells. Regular, patterned placement of injection and/or producing wells may be used for a variety of purposes including, but not limited to: controlling the rate and/or pattern of heating; modulating or controlling progression of the retort front; modulating the population of hydrocarbons being produced at one or more of the producing wells within the formation; and the like. For example, in one embodiment, an in situ conversion process for hydrocarbons comprises heating at least a portion of an oil shale formation with an array of heat sources disposed within the formation. In some embodiments, an array or plurality of heat sources can be positioned substantially equidistant from a production well. Certain patterns (e.g., circular or elliptical arrays, triangular arrays, rectangular arrays, hexagonal arrays, or other array patterns) may be more desirable for specific applications. In addition, an array of thermal energy carrier injection wells may be placed such that the distance between them is generally less than about 100 feet (30 m). Preferably, the thermal energy carrier injection wells may be placed such that the distance between them is generally greater than about 100 feet, and, more preferably, the distance between them is greater than about 150 feet. In some most preferred embodiments, the array of thermal energy carrier injection wells may be placed such that the average distance between injection wells within the array is >300 feet. In addition, the in situ conversion process for hydrocarbons may include heating at least a portion of the formation such that the thermal energy injection wells are disposed substantially parallel to a boundary of the hydrocarbons or, when environmentally preferable, to be substantially parallel to the major drainage pattern. Regardless of the arrangement of or distance between these injection wells, in certain embodiments, the ratio of heat sources (e.g. injection wells) to production wells disposed within a formation may be generally less than, or equal to, about 10, 6, 5, 4, 3, 2, or 1. As a general rule, the ideal spacing between heat injection wells is determined by a variety of factors, including the need(s) for: a) effective and controlled heating of the formation, b) sustainable/predictable economic productivity in a selected section of a formation, and c) minimizing the environmental 'footprint' of the operation.

Certain embodiments of this invention comprise designing, or otherwise allowing, heating zones associated with 2 or more thermal energy carrier fluid injection wells (e.g. heating zones) to overlap and thereby create superheated zones within the formation. Such super-positioning of thermal inputs may help to increase the uniformity of heat distribution in the section of the formation selected for treatment. Moreover, superheated zones may be used to enhance production of desired products. For example, in addition to rapidly liberating light olefins and saturated light and liquid hydrocarbons from within these zones, mobile hydrocarbons generated elsewhere in the formation may be conducted transiently through these superheated zones to elicit further chemical conversion (for example, to bring about thermal cracking, chain rearrangement, and other desirable hydrocarbon chemistries). In an embodiment, a portion of a formation may be selected for heating, the portion being disposed between a plurality of injection wells. Heat from a plurality of thermal energy carrier fluid injection wells may thereby combine to bring about the in situ pyrolysis or other desired chemical conversion(s). The in situ conversion process may include heating at least a portion of an oil shale formation above a pyrolyzation temperature of hydrocarbons in the formation. For example, a pyrolyzation temperature may include a temperature of at least about 520 degrees F. Heat may be allowed to transfer from one or more of the formation thermal energy carrier fluid flow paths to the selected section substantially by conduction outward from the fluid heat source. More preferably, substantial heating occurs within the formation by direct transfer from the mobile carrier fluid to the formation rock.

Formation Engineering and Management Aspects of the Invention Methods that could allow an operator to gain control of the physical chemistry of formation fluids may also provide the operator with a degree of compositional control over the hydrocarbons and other chemical compounds that may be produced in the formation fluids. Likewise, gaining a measure of control over the compositions and/or distributions of compositions produced within a formation, may also provide an operator with increased control of the yield, physical chemistry and flow properties of the formation fluids.

In a simple form, the methods of this invention comprise: a) the identification and selection of one or more fixed bed hydrocarbon formations; b) establishing one or more openings, typically, providing at least one functional injection well and at least one functional producing well; c) establishing a pathway of intermediate to high fluid permeability between one or more injection wells and one or more producing wells; d) injecting a thermal energy carrier fluid through an opening in the formation; e) providing for flow of injected fluid such that it flows from the injection opening toward one or more fluid production openings, f) establishing both a fluid heating zone and hydrodynamic communication between the openings; and e) producing liberated hydrocarbon materials from the one or more producing wells. In some optional methods, a single well bore may perform as both an injection and producing well by alternatingly increasing pressure to cause injection of TECF and then reducing pressure to cause production of the TECF and retorted products. The methods of this invention apply to any carbon-rich geological formation, including but not limited to those comprising the following carbonaceous resources: kerogen, bitumen, lignite, coal (including brown, bituminous, sub-bituminous and anthracite coals), liquid petroleum, tar, liquid or gel-phase petroleum, natural gas; shale gas; and the like. While applicable to liquid hydrocarbon formations, preferred applications include those wherein the carbonaceous materials are either mineralized (e.g. largely fixed in position), highly viscous, or rendered substantially immobile by entrainment in soils, sands, tars and other geologic materials. For the purposes of this invention, all of these embodiments are the to represent fixed-bed hydrocarbon formations (FBHFs) and/or fixed bed carbonaceous deposits (FBCD). The carbonaceous material itself may be referred to as a fixed-bed hydrocarbon (FBH) even though it may not exist as a hydrocarbon in its mineralized form (e.g. kerogen). While these FBHFs may be found at any depth, preferred applications of this invention are those in which they occur beneath a substantial surface soil/mineral or oceanic over-burden. In preferred embodiments, the method comprises FBHFs found substantially at depths of >50 ft and <20,000 ft. In more preferred embodiments, the method comprises FBHFs found substantially at depths of >100 ft and <10,000 ft. In the most preferred embodiments, the invention comprises FBHFs found substantially at depths of >100 ft and <3,500 ft.

Some fixed-bed hydrocarbon formations, occur as relatively simple deposits of a single thick seam of carbonaceous material. Often, this may be the case with coal and lignite deposits. Others, are often much more complex in configuration. The methods of this invention are applicable to both simple and complex geologies. An important, thick deposit of simple, uniform deposition stratigraphy and lithology is seen in the oil shale deposits found in Northwestern Colorado, Northeast Utah and Southwestern Wyoming. Application of the methods of this invention to the development of this broadly mappable, uniform depositional lithology is described in detail elsewhere herein. Other specific carbonaceous deposits to which the methods can be applied in detail are also provided in several examples provided elsewhere herein.

Without wishing to be bound by theory, examining the proposed geological history of one important FBHF is instructive in discussing the present invention. Specifically, it appears that at the time of deposition of the oil-shale beds of the Piceance Basin of N.W. Colorado some of the precipitating dolomitic marlstones simultaneously acquired relatively high kerogen content and also relatively high content of soluble sodium minerals, such as nahcolite, dawsonite, trona and halite. In some portions of the Piceance Basin, these water-soluble sodium minerals have been dissolved, resulting in greatly increased porosity and permeability of these oil-shale beds which then become significant and extensive aquifers within the oil-shale zones. The removal of these soluble salts, by water-flow leaching, created large voids or cavities which may collapse, resulting in brecciation of the rock, thereby creating very high permeability (i.e., multi-Darcy) aquifers. In other stratigraphic portions of this extensive, lacustrian deposit such as in the Mahogany Zone, near the top of the oil-shale section, much less soluble minerals were deposited, resulting in fewer beds and thinner beds with lower content of soluble minerals being available for leaching to form such aquifers. Such oil-shale zones, especially the Mahogany Zone, would have very low permeability with very few, if any, significant aquifers. In another example, the oil-shale section of the Uinta Basin in N.E. Utah, displays fewer and thinner carbonaceous resource beds. Geologically, this may imply that, at time of deposition, fewer soluble minerals were deposited with the kerogen, resulting in little subsequent leaching of the deposit and much less development of permeable aquifers in the oil-shale than is seen in the Colorado Piceance Creek area. Both low and high permeability zones are important targets for development under the present invention. Unlike other proposed methods, the preferred methods of this invention beneficially employ—and even create—permeability to be used with advantage in the production of hydrocarbon products from oil-shale and other fixed-bed hydrocarbon formations.

In one embodiment, the methods of this invention comprise the injection of a mobile heat source into a permeable zone of a fixed-bed hydrocarbon formation, releasing mobilized hydrocarbon from the fixed-bed and collecting at least a portion of the mobilized hydrocarbon.

In several important embodiments, the methods of this invention comprise a method for retorting oil shale and related resources. Methods that have been proposed in the art appear to be quite distinct in both implementation and outcome from the methods of this inventions. For example, recent methods proposed by workers at Shell (U.S. Pat. Nos. 6,880,663; 6,485,232, 6,581,684, 6,588,504, 6,591,906, 6,591,907, 6,607,033, 6,609,570, 6,698,515, 6,702,016, 6,708,758, 6,712,135, 6,712,136, 6,712,137, 6,715,546, 6,715,547, 6,715,548, 6,715,549, 6,722,429, 6,722,430, 6,725,920, 6,725,921, 6,725,928, 6,729,395, 6,729,396, 6,729,397, 6,729,401, 6,732,794, 6,732,796, 6,739,393, 6,739,394, 6,742,587, 6,742,588, 6,742,593, 6,745,831, 6,745,837, 6,749,021, 6,752,210, 6,758,268, 6,761,216, 6,769,483, 6,769,485, 6,880,663, 6,915,850, 6,918,442, 6,918,443, 6,923,257, 6,929,067, 6,951,247, 6,991,032, 6,991,033, 6,994,169, 6,997,518, 7,004,247, 7,004,251, 7,013,972, 7,032,660, 7,040,397, 7,040,399, 7,051,811; e.g. the Shell Series) have proposed methods for producing hydrocarbons from oil shale using a system of well bore heaters to heat an oil shale formation. As proposed, these heat source(s) appear to provide heat to the formation primarily by thermal conductivity and/or radiant heat transfer from a well bore-contained heating element. The Shell Series patents propose methods which appear to rely on production of fluid from low permeability and low thermal conductivity formations and appear to require substantial dewatering of all porosity zones and fractures and to require physical, solid-wall containment of a treated portion of the formation. The methods of our present invention differ in these and many other respects from those presented in above-listed patents. By way of example, the methods and systems of our invention provide for producing one or more hydrocarbon products from an oil shale (and other FBCD) formation by a method comprising: heating one or more thermal energy carrier fluid(s) (TECF); injecting the TECF into a permeable portion of an oil shale formation; flowing TECF from at least one injection opening to at least one production opening in the formation, and providing for direct contact of TECF with a portion of formation kerogen; and developing an in situ heating element that is not confined to a well bore, and is capable of providing pyrolysis heat both to formation fluids and to formation solids within the permeable zones and provide pyrolysis heat by thermal conductivity into the adjacent non-permeable and low permeability zones. Moreover, the systems and methods of the present invention do not require prior dewatering or freeze-walling of formations, but rather rely on a plurality of hydrodynamic displacement and containment methods to protect and direct the flow of formation waters. Furthermore, the systems and methods described herein provide for substantially integrated management of surface and sub-surface operations and environments, and provides a means for an integrated, operator-varied production of hydrocarbons and chemical products from a diversity of carbonaceous geological formations.

Methods and systems such as those outlined also differ substantially from methods currently known and/or used in the art of petroleum, natural gas and/or coal extraction. For example, in traditional oil and gas operations, injection of steam and/or other heated fluids is used to advantage to lower viscosity, overcome interfacial tension and elicit changes of phase within of certain formation fluids within a target formation. The heat so applied may elicit one or more changes in the physical properties of formation fluids. As used in the art, however, the injected heat is insufficient to cause hydrocarbon pyrolysis or to consolidate producible hydrocarbons into a single fluid phase. Both modes of hydrocarbon heating and recovery are enabled by the systems and methods of the present invention, such methods generally comprising: injecting very hot TECF (e.g. >450 degrees F., >550 degrees F., or >750 degrees F.) into a formation; flowing the TECF in the formation between at least one injection opening and at least one production opening; creating an in situ permeable zone, high-temperature TECF, extensive area heating element capable or transferring pyrolysis and/or phase-consolidating heat by thermal conductivity to one or more carbonaceous deposits in the formation; and producing a formation fluid having substantially different distribution of hydrocarbons than was produced from the untreated formation. Typically, TECF is heated to a temperature sufficient to cause substantial and/or controllable changes in the chemical identity(ies) of one or more formation fluid or fixed-bed hydrocarbon (e.g. transformations in chemical structures due to one or more intra- or inter-molecular chemical reactions). The present invention provides for beneficial use of natural and man-made formation permeability to elicit substantial alteration in the hydrocarbon composition(s) or population(s) comprising one or more produced formation fluid.

While others have may have proposed the general concept of producing differential hydrocarbon populations from oil shale, and perhaps other fixed-bed hydrocarbon formations, methods known in the art do not provide for integrated systems, methods or modalities for economically producing large volume rates of formation fluids highly enriched in any specific hydrocarbon fraction in response to operator input or instruction. For example, hydrocarbon extraction methods widely used or known in the art provide little or no technical guidance toward producing either substantially different or substantially more defined, natural gas or petroleum products from a formation than would be typical, for example, of a light- or middle distillate petroleum stream. One aspect of the present invention is a method for controlling, directing and/or recovering substantially different and/or defined distributions of hydrocarbon products from oil shale and other FBH formations. In one embodiment, the instant invention provides methods and compositions useful for enriching one or more formation fluids in one or more olefin, paraffin and/or aromatic fractions. More specifically, the present invention provides the methods and systems for enhancing the production from one or more FBCD, of one more saturated hydrocarbon population having carbon numbers ranging from 2 to 14 (e.g. C2-C14), and more specifically enhancing production of one or more saturated hydrocarbon have a carbon number ranging from 2 to 8. In other embodiments, the present invention provides methods and systems for enhancing the production from one or more FBCD, of one or more C2-C12 unsaturated hydrocarbon. More specifically, the invention provides methods and systems for enhancing production of one or more C2-C8 olefin from at least one FBCD.

Among the methods disclosed in this invention are some that provide for differential heating within an FBH formation, and the establishment of a controlled, directional flow of materials through distinct hot-zones established within the formation. Establishing a measure of chemical and process control over the reactive chemistry taking place within the formation is a key feature of the present invention. Discussion of such controlled, in situ chemical processing is largely lacking in the prior art references cited herein, and from the larger body of publicly available literature. The present invention comprises tools and processes mobilizing and transforming hydrocarbons from FBHF sources via a semi-controlled, thermal, catalytic and/or other reactive processes; and then producing the resulting materials through a series of one or more producing wells operationally linked to one or more surface transport pipes, condensors, collection vessels, distillation units, catalytic reactors, separators, compressors, and or related unit operations.

Methods of heating formations through conductive or radiative means are known in the art. Methods for heating formations with steam to reduce viscosity of heavy oils and similar substances are also well known in the art. The present invention discloses methods by which super-heated steam and other thermal energy carrier fluids are used to heat formations to temperatures that allow thermal and/or catalytic pyrolysis to occur within one or more selected portions of a FBHF. A method for heating FBH formations is disclosed wherein the method comprises: providing heat to a FBH formation by contacting a selected segment of the formation with a heated mobile phase comprising a thermal energy carrier fluid (TECF). According to the methods of this invention, the TECF may be heated by any means, but is preferably heated in a surface-based and/or a downhole injection well-based combustor or heater. The method further comprises directing the flow of the injected TECF through one or more permeable portion of the formation and producing at least a portion of the TECF at one or more opening in the formation. The application discloses a series of heating methods including the establishment of a modulated combustion reaction within the well bore, and at or near the exterior casing, the combustion reaction being controlled by at least one agent injected from outside the well (e.g. combustion oxygen or fuel supplied from surface). Preferred embodiments include those comprising injection of natural gas or other modulating fuels, pressurized and non-pressurized air, oxygen, hydrogen, and other fuels or modulators.

Unlike traditional fire floods and/or steam floods, the methods of this invention provide for both temperature and flow control in an actively treated FBHF. Whereas traditional methods rely largely on random fractures and permeability within a target formation, the present methods are directed to substantially permeable formations in which material flow toward one or more producing openings is assisted or enabled, in whole or in part, by the directed flow of bulk phase TECF. In the methods of this invention, it is essentially the flow-rate, temperature, heat capacity, heat transfer and heat exchange properties of the TECF that determine the rate and pattern of heating within the formation. Often, heat transfer from the mobile carrier by contacting at least a first porous or semi-porous portion of the FBHF with a heated TECF provides for the primary heating of the FBH formation. Contacting a high-permeability, rapid-heating zone with at least about one or more additional low permeability zones allows for convective or conductive heat transfer due to the thermal conductivity of the rock. The contact provides a second means of heating the targeted segment of the formation. In such an arrangement the mobile TECF creates a first heated FBHF zone. This first zone may provide the means of supplying thermal energy to a second zone. This secondary heating may be by way of a conductive and/or radiative process, transfer of thermal energy carrier fluid to a second zone, or other transfer methods.

A method proposed in US Patent Application 20040149433 by McQueen defines a single-well kerogen retorting method that proposes flowing heated fluid down a well bore so as to transfer retorting heat to a portion of a formation. In this method, formation fluid is produced through the annulus of the same well bore. The method does not provide for fluid injection into the formation, nor for accessing permeable portions of a formation, or for flowing TECF between two openings in a formation and appears to rely on thermal conductivity for achieving an effective retort of a very limited zone adjacent to the well bore.

A variety of physical-chemical treatments of the aquifer are contemplated as potential additives, catalyzers, enhancers and/or supplemental methods supporting to the basic fixed-bed hydrocarbon retorting and/or pyrolysis process disclosed herein. These supplemental methods may comprise addition of microwave or x-ray radiation; addition of vibrational, acoustic and/or ultrasonic stimulation and/or energy to further enhance heating of a formation and/or the mobilization of one or more fixed-bed hydrocarbons. While nothing in this disclosure prohibits such methods from being used as primary TECF heating methods, they preferably provide only secondary and/or supplemental forms of heating in one or more TECF. In an example, the present invention employs to advantage the use of at least a single source or multiple source microwave or acoustic source signal generators in conjunction with an in situ, TECF-based heating method in selected portions of an oil shale or other FBDC formation to enhance pyrolysis and/or a hydrocarbon producing process. The present invention further provides for the use of natural and synthetic zeolite materials as hydraulic frac proppants and/or catalytic materials within a naturally permeable or fractured FBH formation. Often, such materials contain significant levels of the metal oxides required to sensitize hydrocarbons to microwave energy. It is anticipated that metal oxide proppants and/or catalysts will double as microwave energy sensitizers, thereby providing a powerful additional strategy for driving both kerogen pyrolysis and hydrocarbon cracking in an oil shale or other FBH formation.

Processes that rely on combustion for heating TECF may also generate substantial quantities of carbon dioxide. In an example, carbon dioxide may be directed via one or more pipelines to one or more industrial facilities or operations. Such facilities or operations may employ carbon dioxide to advantage in one or more manufacturing or production processes, such as for producing dry ice, enhancing recovery of liquid or gaseous hydrocarbons from depleted oil fields, enhancing methane release or recovery from coal beds, or generating supercritical fluids for use in industrial cleaning or production operations.

Preferably, a portion of the carbon dioxide produced using the methods of this invention is used to enhance the growth of one or more photosynthetic species. In an example, carbon dioxide from an in situ oil shale (or other FBCD) retorting operation is provided to a pipe. At least a portion of the carbon dioxide carried in the pipe may be delivered to a landscape, forest, farm, garden or other managed agricultural operation so as to enhance growth of one or more photosynthetic species. Preferably, in the example, the species comprises at least one rooted or physically adherent species. Physically adherent refers to root plants, mosses, lichens, agricultural and cultivatable crops, and other photosynthetic species whose natural growth cycle requires attachment to or anchoring into a soil or other surface, without limitation. More preferably, the rooted species would comprise one or more tree, grass, etc. Optionally, the species may comprise at least one unrooted photosynthetic species. Preferably, the unrooted species may comprise an algae, a plankton, a phytoplankton, a diatom, a cyanobacteria, or other species capable of growing in lakes; ponds; other bodies of water; aquifiers; aqueous and semi-aqueous environments, without limitation.

Systems and tubing appropriate for the widespread trickling of water across large areas are well known in the art of lawn, turf and garden care. Substantially similar plastic and/or polymeric tubing systems may be used to distribute one or more effluents comprising process-derived carbon dioxide to one or more surface ponds and/or other wetlands; soil beds and/or surfaces capable of supporting growth of one or more photosynthetic species. Alternatively, large volumes of process carbon dioxide may be vented directly without tubing through one or more soil beds or bodies of water. Preferably, at least a portion of process carbon dioxide is released at, under or very near the surface of a soil comprising one or more grass, tree, weed or other fast-growing, rooted photosynthetic species. It is further preferred that the aerial extent of the surface carbon dioxide treatment area be at least substantially similar to, and preferably, larger than the aerial extent of the subterranean portions of a given FBH formation that is being treated using the methods of this invention. One or more of the photosynthetic species may be selected based on its capacity to undergo increased growth (and/or biomass production) in presence of an increased partial pressure of carbon dioxide. In a particular embodiment, at least one process effluent is used to advantage in one or more commercial crop, turf or landscape production activity, and/or one or more forestation/reforestation operations. In preferred embodiments, the process effluent enhances the growth of one or more grass, tree, fruit, vegetable, grain, flower, ornamental or other plant species. In preferred embodiments, the process effluent comprises carbon dioxide.

In one general form, the present invention employs one or more thermal energy carrier fluid (TECF) for a plurality of purposes. The first and most typical use is in the creation of a mobile, fluid (fluid flux) heating element extending through a region of substantial permeability from at least one point of injection to at least one point of production within a formation. The mineral and carbonaceous materials in direct contact with the flowing heating element provide a secondary conductive and/or radiant heating surface. The materials in close proximity to the principle flux of TECF undergo rapid retorting and/or mobilization such that permeability increases over time, as does the area of direct contact between the TECF and the formation solids. As such, the flux-based, fluid heating element is neither fixed in dimension nor in its maximal effective energy transfer by the distance between the injection well and the retort (or mobilization) front. Moreover, retort efficiency tends to increase with local increases in permeability. Importantly, a given retort (and/or hydrocarbon mobilization) front tends to advance in a direction outward from, and largely perpendicular to, the principal axis(es) of a specific TECF flux vector(s) from which that retort derives. Consequently, except when the injection and producing wells associated with a given retort front are housed in the same well bore.

The methods of this invention provide for the control of formation water using a plurality of barriers. Often, at least one barrier is created by one or more naturally occurring low permeability zones located within close proximity to the region being actively treated (e.g. retorted). Often, at least one barrier comprises establishing one or more hydrodynamic boundaries between one or more actively treated areas and one or more surrounding (e.g. untreated) portions of the formation. In preferred embodiments, the methods of this invention employ a plurality of hydrodynamic barriers and/or methods to establish elevated potentiometric surfaces within the formation surrounding an active retort segment. Such elevated potentiometric surfaces dramatically slow or eliminate egress of formation fluids from the contained zone. In some embodiments, a hydrodynamic containment barrier may comprise the migration of one or more fluids from at least one untreated portion of the formation (e.g. areas outside the containment barrier) into the treatment area. In some embodiments, a hydrodynamic barrier may comprise the injection of water or thermal energy carrier fluid. While the specific methods and well configurations are highly varied, they generally involve establishing local hydrodynamic control of fluids through one or more aquifers.

In some embodiments, an elevated potentiometric surface is established by drilling/developing a series of 'outer' (e.g. distal) water injection wells and one or more series of concentric 'inner' (e.g. proximal) injection and/or producing wells. The wells may be directional in orientation, such that injection occurs in an inward direction. Typically, the outer wells operate at a supra-formation pressure and provide for a net inward flow of aquifer water into the treatment area or the water-producing wells surrounding it. Within the treatment area, bulk flow of thermal energy carrier fluid from injection wells to producing well is substantially higher than the inward flow of formation water such that there is a net 'dragging' of water into the thermal energy carrier fluid stream and little diffusion of hydrocarbon fluids into the surrounding water. What hydrocarbon does diffuse into the treatment aquifer is captured at the inner water-producing wells. Hydrocarbon may be stripped from the produced waters under vacuum, distilled, evaporated, incinerated, bio-treated, or removed using any of the many hydrocarbon removal methods known in the art.

C. Assessment & Development of Target Formations

The systems and methods comprising this invention apply to a diversity of carbonaceous and hydrocarbon deposits. Use of the systems and methods described herein will vary only slightly as one develops different types of fixed-bed carbonaceous deposits. The development of an oil shale formation may differ in retort temperature, well density or other such parameters from development of a tar sand or heavy oil formation. The ensuing discussion and examples illustrate the detailed application of this invention to produce petrochemical and fuel hydrocarbons from a variety of carbonaceous deposits. Type-examples are selected so as to illustrate specific embodiments of the invention, and are not intended to suggest limitations or restrictions on the methods, unless otherwise indicated. In general, by understanding the detailed application of the invention to a geologically simple oil shale formation, one may anticipate reasonable extensions of the methods and systems to the much more complex coal or heavy oil formations, and/or other FBCD.

In several preferred embodiments, the methods of this invention are applied to the development of a carbonaceous formation comprising oil shale. A series of well-characterized oil shale formations exist in North America, and other parts of the world, such as Estonia, Brazil, Australia, China, and other. Several continental U.S. oil shale formations that are well suited for application of the in situ retorting and refining technologies comprising this invention are well known in the geological records.

Identification of Several Oil Shale Resources for Development Using the Systems and Methods of this Invention Hydrodynamically-modulated, in-situ retorting of oil shale may be conducted using the methods of this invention. In an embodiment, successful retorting of an oil shale formation may be accomplished while simultaneously protecting surrounding formation water from leakage of fluids from the retort-treated portion of the formation. In one embodiment, surrounding aquifers may be protected using hydrodynamic-flow barriers. Use of such containment methods are preferred in areas where the natural aquifers' potentiometric surface is at least 200 ft higher than the elevation of the natural aquifers. To this end, preferred, oil-shale-resource areas selected for in situ retorting and/or treatments comprising this invention are those containing high-permeability, natural aquifers through which thermal-energy carrier fluid (TECF) may be easily circulated, as described in this invention. Preferred oil shale resources for treatment using the methods of this invention further comprise such areas in which the natural potentiometric surface is at least 200 ft higher than the elevation of such high-permeability, natural aquifers. In oil-shale-resource areas lacking high-permeability, natural aquifers, man-made, frac-created aquifers may be installed in the formation using methods known in the art and/or otherwise described herein. Man-made fractures may be used for the hydrodynamic in situ retorting and/or petrochemical operations described in this invention. In such formations, less significance is attached to the natural, potentiometric-surface elevation due to the extremely limited leakage potential.

Based on these criteria, some of the most preferred areas for economic development of retortable oil shale are:

1) The Eureka Creek/Piceance-Basin, located primarily in Garfield and Rio Blanco Counties of Colorado;

2) The Uinta-Basin, located primarily in Uinta County, Utah; and

3) The Washakie-Basin formation, located primarily in Southwestern Wyoming.

Each of these areas are well characterized in the geological records.

Example 1

Characterization and Development of a Carbonaceous Oil Shale Formation Exemplified in the Piceance Basin of Colorado In a specific embodiment, the methods of this invention may be applied to the development and in situ retorting of the oil shale formation in the Piceance Basin. As shown in FIG. 1, the most preferred portion of the basin is located substantially within Rio Blanco County Colorado, between coordinates ranging from R 99 W-to-R 95 W, and T 2 N-to-T 4 S. FIG. 1 illustrates an approximately 12 mile by 15% mile segment of this basin representing the core unitized (e.g. target) area for application of this in situ retorting method. As shown in the FIG. 1 (inner-most dashed box), this target area comprises approximately 130 sections, or about 83,200 acres. This propped, unitized, active retort area is surrounded by a hydrodynamic barrier (shown as the outer-most dashed box) comprising about an additional 56 sections, of the resource area. Within the unitized retort area, proposed locations of Unit Wells 1-3 are also shown. FIG. 1 also illustrates the aerial extent of the preferred Piceance Basin oil shale resource (outer-most solid line, containing section boxes), which covers about 523 sections (334,720 acres).

FIGS. 2*a* and 2*b* illustrate, as an important type-example, a most preferred area of about 83,200 acres selected for unitization as the initial development part of an in-situ-retort and refining development of the Piceance Basin using the methods of this invention. In FIG. 2*a*, the letter "R" indicates a row of 16 injection/production wells spaced at roughly equal distances from one another along a 1 mile section of the selected Unitized Area. The letter "W" signifies a row of water and/or other hydrodynamic barrier wells. The thermal-energy carrier fluid (TECF) is injected so as to flow away from each of the 16 wells on each of the 1-mile-long line of wells labeled "R" (i.e., half of the injected volume is flowing to the right and half to the left) and into the corresponding wells on the 1-mile length of 16 producing wells on each side (i.e., right and left) of the "R" lines shown as dotted lines in this FIG. 2*a*. As shown in this FIG. 2*a*, there are 16 TECF injection wells in each of the 130, 1-mile lengths of injection wells, labeled "R," resulting in 2,080 injection (R) wells completed in each of the aquifers being injected with TECF for retorting in the 130 sq miles (i.e., 83,2000 acres) of this unit's retorting operations.

Note that the open space between the lines of TECF injection wells (R) and the line of production wells averages about ½ mile (i.e., 2,640 ft) in FIGS. 2*a* and 2*b*. However, when this pattern is modified to fit the actual drainage pattern of the existing topography, this open-space between lines of wells may range from about ⅜ mile (i.e., 2,000 ft) to over 1 mile (5,280 ft). These lines of retorting, TECF injection wells and the lines of producing wells, and the associated road and pipeline rights-of-way may, preferably, follow the canyon/creek, drainage pattern, and the intermediate lines-of-wells which are approximately parallel thereto. This arrangement provides unoccupied and undisturbed open spaces, ranging from 2,000-ft to over 5,000-ft wide between such adjacent, road/pipeline rights-of-way. Such free-space may be useful in facilitating migration and grazing of cattle and wildlife present in the area. Consequently, only about 5% to 15% of the surface will be disrupted through applications of this development plan, and about 85% to 95% of the natural surface will remain largely undisturbed by the hydrodynamic, in-situ-retorting operations of this invention. This low-level environmental impact represents an important feature of this invention over other proposed methods that would require a more substantial surface footprint.

Periodically, the directional flow of TECF and formation fluids between injection wells and production wells will be reversed as determined by the operator. After a time interval comprising about half a complete cycle, the injection wells (R), shown in FIG. 2*a*, will be changed to production wells, as shown in FIG. 2*b*. Likewise, the production wells in FIG. 2*a* will be changed to injection wells (R), as shown in FIG. 2*b*. At each of the 16 drill sites on each mile of wells, two or more well bores may be drilled with each such well completed into a separate zone of the oil shale formation. Consequently, at each such drill site, one well completed in a lower zone may be used as an injection well, while another well at the same drill site, but completed in a higher zones, may be used as a production well during the same half cycle. Then, on the second half of the time-cycle, the well completed in the lower zone is converted to a production well, and the well completed in the higher zone is converted into an injection well. Consequently, all of the injection equipment and the production equipment, at each drill site, will be continuously used as "injection" and "production" of the 2 zones which are alternatively reversed on a half-cycle-timing basis.

In this proposed-development example, each drill site is equipped with TECF heaters and pressure-injection equipment for injecting about 4 billion Btu/d (i.e., about 167 million Btu/hr) of TECF through one or more injection wells completed into one or more high-permeability, natural aquifer (or frac-created aquifer) for flow through the aquifer to a producing well.

FIG. 3 shows a typical, average plot of the thermal energy required for retorting each pound of 25 gal/ton, oil-shale rock, at increasing temperatures. At an average temperature of 1,000° F., for example, about 330 Btu of thermal energy is required to retort each pound of average, 25 gal/ton, oil-shale rock.

Consequently, in this proposed, unit-operation example, the retorted products of oil, gas, and petrochemicals, mobilized in each such injection well site injecting 4 billion Btu/d, would be over 3,500 barrels of oil-equivalent per day (i.e., 3,500 boe/d). The energy content of this produced, retorted product, created by each injection well, would be about 20 billion Btu/d/4 billion Btu's of energy delivered into the oil-shale formation by injection of TECF into the oil-shale aquifer from each such injection well. This energy-productivity ratio is the production of about 5 Btu of energy and petrochemical products per each Btu of TECF absorbed by the oil-shale rock.

In this type-example, 2,080 wells are completed in a lower zone at the 2,080 drill sites labeled "R" in FIG. 2*a*. Each such well injects TECF into an oil-shale aquifer with the oil-shale rock absorbing about 4 billion Btu/d. Also, another 2,080 wells are completed in a higher zone at the 2,080 drill site labeled "R" in FIG. 2*b*, with the same TECF injection rate and the consequent absorption of about 4 billion Btu/d per well site. If each of these 4,160 TECF injection wells on the 4,160 drill sites causes the retorting and release of the chemical equivalent of 3,500 boe/d, this type-example formation would generate a gross daily production of about 14,500,000 boe/d over the most preferred 83,200-acre, unitized, retortable area. If about 30% of this gross production is used to generate the heat, pressure, and other energy needs for this TECF injection into the oil-shale aquifers, then the net marketable production would be about 10,000,000 boe/d from this 83,200-acre, unitized, in-situ-retortable area.

Operationally, as the oil-shale rocks within or adjacent to the aquifers being injected with high-temperature TECF are gradually depleted of their retortable organic (kerogen) content, the rate of thermal energy absorbable by these aquifers and their adjacent rocks will gradually decline. When the TECF flowing from each such TECF injection well to its corresponding production well has lost less than the designed 4 billion Btu/d of thermal energy, then the rate of TECF injection into that well is decreased. Consequently, the surplus, available TECF is injected into another TECF injection well at the same drill site which is completed in a different, natural or frac-created aquifer.

As the initial, retortable injection zones are gradually depleted of nearby, retortable, organic (kerogen) content, resulting in a decreased rate of thermal-energy absorption, new wells are drilled and completed in new zones for injection of the surplus TECF, thereby maintaining the full utilization of the 4 billion Btu/d, TECF capacity installed at each drill site. This continuing, full utilization of the 4 billion Btu/d, TECF-generating capacity at each drill site will maintain the full 14,500,000 boe/d gross production, or 10,000,000 boe/d of net production, for this 83,200-acre, initial-development unit. This production can be maintained until all of the retortable oil shale, at all depths below this initial 83,200-acre unit area, has been depleted. Current estimates suggest that this level of production may be sustainable for at least 20 years, and perhaps as much as 30 to 50 years from start of full-scale production.

As observed in FIG. 1, this most preferred 83,200-acre, initial, hydrodynamic-retortable, unit area in the Piceance Basin area of N.W. Colorado can be incrementally expanded, as needed, up to about 334,720 acres of preferred retortable area. This optional expansion of the initial unitized area may be used: (a) to expand the oil, gas, and petrochemical net production rate, (b) to extend the production life based on the initial, designed, net-production rate of 10,000,000 boe/d, or (c) to increase both the net-production rate and to extend the production life of the unit. Oil-shale resources present in the Uintah Basin of N.E. Utah and the Washakie Basin of S.W. Wyoming may be similarly unitized and developed for hydrodynamic retorting using approaches substantially similar to that described here for the Piceance Basin. The methods, flow rates, heating rates, developmental footprints and other parameters illustrated in the development of the Piceance Basin resource may be varied substantially without impacting the overall success of the retorting and production processes.

FIG. 4 illustrates the approximate stratigraphic column of the oil-shale zone as typically occurring at locations near the center and deeper portion of the Piceance Basin (i.e., Sect. 36, T2 S, R98W). A cross-section of the formation showing depths and thicknesses of various deposits is shown on the left of FIG. 4. An expanded view of the portion of the formation (e.g. depths of about 590 ft to about 840 ft) containing the A-Groove, B-Groove and R-7 stratigraphic zone is shown on the right. The zones labeled R-8, R-7, R-6, R-5, R-4, R-3, etc. are relatively rich zones containing relatively large quantities of kerogen and relatively small amounts of porous zones or "voids" (open holes) left in the rock after the soluble minerals have been dissolved by hydrodynamically flowing formation water. Consequently, these "R"-designated (i.e., "R-rated"), oil-shale zones have relatively few aquifers, and any existing aquifers are generally very thin and/or of relatively low permeability.

The zones labeled A-Groove, B-Groove, L-5, L-4, L-3, L-2, etc. are relatively lean zones containing somewhat smaller quantities of kerogen and very large percentage amounts of precipitated minerals, both marlstone and/or soluble sodium salts (i.e., nahcolite, trona, halite, et al). Some of these "L-rated" zones may contain significant natural aquifers, and are therefor useful for the injection and flow of large volume rates of thermal-energy carrier fluids (TECF) as used in this invention. In some cases, the natural permeability of some of these "L-rated" zones may have been greatly increased by the collapse of dissolved salt cavities and the resulting brecciation of the adjacent oil-shale rock.

In these L-zone aquifers, the thermal-energy carrier fluids, injected at pressures exceeding the normal, aquifer-formation-water pressure, will flow outward from the injection well bore by displacing the formation water from that portion of the aquifer. Since these permeable aquifers contain very large volumes of water extending over long distances, very large volume rates of thermal-energy carrier fluid can be injected, thereby displacing this formation water outwardly at substantially the normal, formation-water pressure. Consequently, these natural aquifer zones are effectively dewatered by displacement with the injected TECF. In using this invention, the operator evaluates each aquifer encountered, usually in the "L-rated" zones, to determine the fluid-flow characteristics of each such aquifer. From this aquifer, fluid-flow data, the thermal-energy-carrier-fluid injection program for each aquifer can be optimally designed.

In the thick "R-rated" zones, thin man-made aquifers of very high permeability may be created by hydraulic-fracturing of the rock at locations such as indicated by the "A-Frac" and "B-Frac" labels in the R-7 zone as shown along the right edge of FIG. 4, and represented by the dot-dash lines extending. These propped, horizontal, hydraulic fractures, created by a procedure subsequently described herein, will create thin aquifers (i.e., 0.5" to several inches) of very high permeability (i.e., over 1000 Darcys), extending outward over very large areas from each, frac-injection well bore. The injection-program design for injecting this invention's thermal-energy carrier fluid into these thin, very high-permeability hydraulic fractures, extending over large horizontal areas, can provide very effective means of heating large volumes of this oil-shale rock to retorting temperatures for very economic production of oil and gas products.

Subsequent to deposition, these rocks appear to have been structurally deformed by modest horizontal, tectonic forces and by vertical uplift and subsidence forces. This rock deformation has created faults with associated rock fractures. (The width of each such open fracture may typically be less than $1/10^{th}$ inch [i.e., 0.1"]). To one skilled in the art, the regional tectonic forces in the Piceance Basin appear to be in a relaxed state with such faults with associated fractures remaining substantially open to cross formational flow of fluids from one aquifer to another aquifer.

In the Piceance Basin, the natural, hydrodynamic fluid flow of formation water is predominantly along the bedding planes of depositional/leaching porosity within the major aquifer zones (i.e., several feet, or tens of feet in thickness). Even so, sufficient cross-formational leakage along the relaxed, open, narrow (i.e., generally under 0.1" wide) fractures occurs so as to equalize the potentiometric surface elevation between all the aquifer beds. However, when retorting, TECF is injected at an elevated potentiometric-surface elevation (i.e., increased pressure) into one aquifer, and the formation fluid is produced at an decreased potentiometric-surface elevation (i.e., reduced pressure) from another aquifer at the same drill-site location, then, very significant, hydrodynamic, cross-formational flow will be created in these thin, open fractures from the high potentiometric-surface aquifer to the low potentiometric-surface aquifer.

The significance of this cross-formational fracture flow of formation fluid is illustrated in FIGS. 5*a*, 5*b*, 5*c*, 5*d*, 6*a*, 6*b*, 6*c*, 6*d*, 7*a*, 7*b*, 7*c*, and 7*d*. Prior to any fluid injection or production, the pre-existing, natural-state, potentiometric-surface elevation is approximately 6,400 ft in all of these aquifers, as shown in FIGS. 5*a*, 5*b*, 5*c*, and 5*d*. With no potentiometric-surface elevation difference between these aquifers, there will be little to no significant cross-formational fluid flow along the thin, open fractures present in the formation. However, when fluid is injected into the "B-Groove" and "B-Frac" aquifers at a potentiometric-surface elevation of 6,600 ft, as illustrated in FIG. 7*a*, and simultaneously if fluid is produced from another well at the same drill site out of the "A-Groove" and "A-Frac," at a potentiometric-surface elevation of 6,000 ft, as illustrated in FIG. 7*c*, then there will be an 600-ft difference in potentiometric-surface elevation (i.e., hydraulic head) over the vertical distance of 55 ft between the "A-Frac" and "B-Frac" aquifers. This strong, hydrodynamic gradient of 600-ft head difference over 55 ft (i.e., 10.9-ft head/ft distance) will cause fluid flow from the "B-Frac" to the "A-Frac" through any preexisting, tectonically relaxed, open fracture which may exist in this area.

However, if this cross-formational fluid flow through the open (i.e., under $1/10^{th}$" width) natural fracture is a retorting, high-temperature (i.e., 700° to 1,000° F.), thermal-energy carrier fluid (TECF), or even steam at about 500 degree F., then this cross-formational fluid flow will create a thermal expansion of the adjacent rock to close the fracture opening. Also, it will retort the rock walls to create some new porosity and a low-permeability path of about 1 to 10 and for a very shallow depth from the frac wall. This closure of the natural fracture opening and the partial retorting of its walls will stop the high-velocity fluid flow through the prior open fracture and provide only a low-volume-rate flow path through the narrow, low permeability (1 md to 10 md), retorted matrix in the walls of the closed fracture.

During Stage 2 (i.e., the second half of the TECF injection cycle), the wells at this location, completed in the "B-Groove" and "B-Frac" aquifers, are placed on production by reducing their potentiometric-surface elevation to 6,000 ft, as illustrated in FIG. 7*b*. Simultaneously, the wells at this location completed in the "A-Groove" and "A-Frac" aquifers become TECF injection wells with a potentiometric surface of 6,600 ft, as shown in FIG. 7*d*. In this Stage 2, the cross-formational flow through natural fractures will be from the "A-Groove" and "A-Frac" toward the "B-Groove" and "B-Frac." Again, the high-temperature, TECF injection will cause closure of the natural fracture opening and replace it with a narrow, porous, low-permeability (i.e., 1 to 10 md) path along the path of the prior fracture opening.

Such closure of the prior open fracture by the high-temperature, TECF injection will thereby minimizes the cross-formational, TECF flow and consequently cause most of the TECF flow to be through the high-permeability, depositional/leaching, bedding-plane aquifers or the propped frac aquifers. The hydrodynamic gradient, defined by the slope of the potentiometric-surface elevation along the bedding-plane, aquifer flow path, is illustrated in FIGS. 7*a*, 7*b*, 7*c*, and 7*d*. FIG. 6*a* illustrates the linear flow path from one of the injection wells in the long line of injection wells in line "X" to the corresponding production well in the long line of production wells in line "W" and line "Y," respectively. This geometry of injection and production wells creates a dominantly linear flow for the TECF from the line of injection wells to the line of production wells. In this example, illustrated in FIGS. 6*a* and 7*a*, the linear-flow, hydrodynamic gradient is a 600-ft head loss over 2,640 ft, or 0.227 ft/ft, which would be equivalent to 0.098 psi/ft in a horizontal aquifer. In Stage 1, illustrated in FIGS. 6*a* and 7*a*, the hydrodynamic flow in aquifers "B-Groove" and "B-Frac" is linearly away from the injection wells in line "X" and toward the producing wells in lines "W" and "Y." In Stage 2, illustrated in FIGS. 6*b* and 7*b*, the hydrodynamic flow is in the opposite direction from the injection wells in lines "W" and "Y" and toward the production wells in line "X." When averaged over the full cycle, or over several cycles, the average potentiometric-surface elevation would be 6,300 ft. As shown in FIGS. 6*c*, 6*d*, 7*c*, and 7*d*, the hydrodynamic flow in the "A-Groove" and "A-Frac" aquifers is in the opposite direction of the flow in the "B-Groove" and "B-Frac" aquifers, as illustrated in FIGS. 6*a*, 6*b*, 7*a*, and 7*b*, and previously described.

In this example illustrated in FIGS. 7*a*, 7*b*, 7*c*, and 7*d*, the injection head of 6,600 ft is 200 ft above the pre-retorting, normal hydrostatic head of 6,400 ft. However, the hydrodynamic head of 6,300 ft, averaged over the retorting area and averaged over multiple cycles of time, is 100 ft below the normal 6,400-ft hydrostatic head existing over the non-retorted area and in the non-retorted zones. Consequently, averaged over time and area, the direction of hydrodynamic flow along the hydrodynamic-head gradient will be from the perimeter of non-retorted areas and the non-retorted zones inward toward the retorting zones. Thus, the products of this retorting operation will not escape by flowing outward from the retorting zone but will always be flowing inward for production from the retorting zones.

FIGS. 8*a*, 8*b*, 8*c*, and 8*d* illustrate the hydrodynamic flow direction and the potentiometric-surface-elevation gradient when the TECF injection head is 6,300 ft and the production well head is 6,000 ft. This lower injection pressure, lower hydrodynamic-head gradient, and the lower volume rate of TECF flow are the consequence of the diminished rate of absorption of thermal energy (heat) during the time of flow from the injection well to, the production well, which, thereby, decreases the retorting rate. In this example, illustrated in FIGS. 8*a*, 8*b*, 8*c*, and 8*d*, the injection head of 6,300 ft is 100 ft below the pre-retorting, normal, hydrostatic head of 6,400 ft, and the hydrodynamic head of 6,150 ft, averaged over the retorting area, is 250 ft below the normal, hydrostatic head of 6,400 ft existing over the non-retorted area and in the non-retorted zones. Consequently, the products of this retorting operation cannot escape by flowing outward from the retorting zone but will always be flowing inward for production through the producing wells in the retorting zone.

To prevent any of the products of this retorting operation from escaping upward into the groundwater in any of the aquifers above the retorted zones, a hydrodynamic-controlled, leak-proof caprock must be established. This hydrodynamic-controlled, leak-proof caprock can be established by injecting fluids with a higher potentiometric-surface elevation into a natural, permeable aquifer, or into a bedding-plane, propped, hydraulic-frac-created aquifer at a shallower depth above the highest zone being in-situ retorted. FIGS. 9 and 10 show the retorting operations in the R-7 zone (i.e., "A-Groove," "A-Frac," "B-Groove," and "B-Frac") being protected by hydrodynamic, caprock aquifers (i.e., either or both natural aquifers or propped, bedding-plane, hydraulic-frac aquifers) in the R-8 zone. These R-8, caprock aquifers are injected with a hydrodynamic control fluid whose potentiometric head elevation is significantly higher than the potentiometric head elevation of any retorting fluids in the aquifers of the R-7 retorting zone, as shown in FIGS. 9*a*, 9*b*, 9*c*, 9*d*,10*a*,10*b*, 10*c*, and 10*d*.

FIGS. 9*a*, 9*b*, 9*c*, and 9*d* show the vertical profile of the potentiometric-surface values of the formation fluids in the bedding-plane aquifers and in any existing cross-formational fractures between such bedding-plane aquifers. FIGS. 10*a*, 10*b*, 10*c*, and 10*d* show the vertical profile of the formation-fluid pressures under the same hydrodynamic-flow conditions as illustrated in FIGS. 9*a*, 9*b*, 9*c*, and 9*d*.

For example, if the caprock, hydrodynamic control fluid injected into the R-8, caprock aquifers has a potentiometric-surface elevation of about 7,000 ft, then there will be a strong hydrodynamic gradient and fluid flow from the R-8, caprock aquifers downward through any open, natural fractures and into the R-7 retorting zone. This downward hydrodynamic gradient and fluid flow from the R-8 caprock aquifers, downward through rock fractures and into the R-7 retorting aquifers, as illustrated in FIGS. 9*a*, 9*b*, 9*c*, 9*d*, 10*a*, 10*b*, 10*c*, and 10*d* will prevent escape of any retorted products from the R-7 zone upward into the R-8, hydrodynamic-controlled caprock aquifers.

If the hydrodynamic control fluid injected into the R-8 caprock aquifers is steam at about 450° F. to 550° F., then the heat from this steam will create a thermal expansion of the rocks adjacent to any natural fractures which had provided fluid leakage paths away from the R-8 caprock aquifers. This thermal expansion of adjacent rocks will reduce or close the fracture width, thereby reducing, or nearly preventing, any fluid leakage out of these R-8 aquifers through such preexisting fractures. Also, this 450° F. to 550° F. heating of the rock, along the prior, open-fracture path, will create a weakness of the rock's strength, a reduction of the rock's brittleness, and an increase of the rock's plastic deformation (or rock flowage) so as to close the opening of such preexisting rock fractures. Furthermore, if any bedding-plane zone has a very high kerogen content (i.e., possibly about 40 to 60 gal/ton), then at these elevated temperatures of 450° F. to 550° F., this kerogen is softened and may flow by plastic deformation into these fractures, and thereby plug the fractures which would prevent any further leakage. Any remaining, minor, fluid leakage along such natural fracture planes would have a high-hydrodynamic head gradient from the R-8 caprock aquifers toward the R-7 retorting aquifers which would thereby prevent any loss of retorted products out of the retorting R-7 zone and into the R-8 caprock.

Note that this 450° F. to 550° F. steam, or the hot water condensed therefrom, will not cause substantial retorting of any oil-shale kerogen and, therefore, will not introduce any new porosity from retorting along this preexisting-fracture leakage path. The injected steam and the hot water condensed therefrom will flow outward from the injection wells to displace the preexisting formation water within these R-8 caprock aquifers. This condensed hot water may be produced from these R-8 caprock aquifers just beyond the outer perimeter of the retorting R-7 (or deeper) zones. This produced water may be reheated and reinjected into the R-8 caprock aquifers inside the perimeter of the R-7 (or deeper) retorting zones.

The application of the downhole combustion chamber (described elsewhere herein) to the present invention is best seen in reference to a specific set of retorting conditions, such as those seen in the Eureka Creek area of the Piceance Basin. As discussed elsewhere in this disclosure, an approximately 14-ft-thick, "B-groove," permeable zone in the formation is located between 796-ft and 810-ft depths at this location. In this example, a 12¼"-diameter hole is drilled to a depth of about 825 ft, or about 15-ft below the bottom of the "B-groove." Then, a 10.75"-OD×9.85"-ID casing is set to a depth of about 780-ft (i.e., about 16 ft above top of "B-groove") and cemented from there to the surface. The inner casing (i.e., 7"-OD), with the downhole combustion chamber, is run in the hole and hung with the bottom of the combustion chamber about 5 to 15 ft above the bottom of the cemented, 10.75"-OD casing.

With one or more B-groove wells in place, the zone is prepared for initial heating and retorting. Other fixed-bed hydrocarbon zones (e.g. "A-groove", etc. . . . ) are also present in the Eureka area, and can be developed subsequently or in conjunction with B-groove development. In this example, the downhole combustion chamber of this combustion-injection well is flooded with steam, combustion-gas, and air. Compressed air and water are injected so as to establish a combustion-chamber, exit temperature of about 1,000° F. (±200° F.), and a pressure of about 600 psi (1100 psi). This provides a pressure differential of about 250-psi to drive the TECF containing steam plus combustion products into the "B-groove," permeable, porosity zone. After a steady-state injection rate is established by operations, either or both the injection rate or the injection pressure may be adjusted to match the hydrodynamic-performance capability of this "B-groove," injection-well permeability. Under conditions such as those in the B-groove, material flow depends primarily on naturally-occurring matrix-porosity, permeability and thickness.

Under conditions in which the maximum, matrix-porosity injection rate established for a given well is substantially less than the designed, air-compressor rate, the operator may elect either to establish a sand-propped, hydraulic fracture in this porosity zone, increase the formation injection pressure, or drill an adjacent second injection well to split the injection rates between two wells.

After satisfactory injection rates, injection pressures, and hydraulic fracturing, or twin-well procedures, have been established for this "B-groove," permeable reservoir, a field-development, well-drilling/operating pattern may be established. One such pattern of well spacing/locations is illustrated in FIGS. 2*a* and 2*b*.

In further considering the specific and general embodiments of the present invention, a variety of important features can be illustrated and evaluated using diagrams and figures. The following figures draw out additional important and often general features of the present invention as applied to a variety of formations and fixed-bed carbonaceous resources.

FIG. 11 illustrates a typical example of how this procedure can be started and progressively enlarged until it reaches the fully developed status shown in FIGS. 2*a* and 2*b*. A 1-mile-long line of 16 injection wells is drilled, as illustrated by the solid vertical line in FIG. 11-*a*. Then, two 1-mile-long lines of 16 production wells each are drilled approximately parallel to the line of injection wells and located on opposite sides of the injection-well line at a spacing of about ½-mile therefrom. These two lines of production wells are illustrated as dashed lines in FIG. 11-*a*.

After the injection of steam in the line of 16 injection wells, labeled "S" in FIG. 11, has progressed for a sufficient length of time, the operator may choose to progress to the next development stage, illustrated in FIG. 11-*b*, by drilling two additional 1-mile lengths of production wells. Then, the original line of steam-injection wells, labeled "S" in FIG. 11-*a*, is converted into a line of productions wells, and the prior two lines of production wells are converted into steam-injection wells, all as shown in FIG. 11-*b*. When the operator determines it is time to again reverse the function of the injection wells, he can proceed with the next stage of development, illustrated in FIG. 11-*c*.

At the FIG. 11-*c* stage of development, there are 13 1-mile lengths of 16 wells each: 1-line of wells is designated TECF retorting (labeled "R") injection wells, 4-lines of wells are steam (labeled "S") injection wells, and 8 lines of wells are production wells, all as shown in FIG. 11-*c*. If the operator elects to more rapidly expand the development operation, prior to the time he wants to reverse the phase functions of injection and production, he can proceed directly from the FIG. 1-1-*a* stage to the FIG. 11-*c* stage of development without going through the FIG. 11-*b* development stage.

FIGS. 11-*d*, 11-*e*, 11-*f*, and 11-*g* illustrate successively enlarged stages of development. The operator may skip some of these stages for more rapid development of production. Also, this development can proceed to fill in the four corners of FIG. 11-*f* or 11-*g* to complete the full development of a unitized area, such as shown in FIGS. 2-*a* and 2-*b*. The operator can choose many variations of these successive development stages as may be useful in his rate-of-development business plan to fit the opportunities and/or demands for energy-supply market needs.

Several typical examples of TECF components and combinations of components are illustrated in FIGS. 12-*a*, 12-*b*, 12-*c*, and 12-*d*. In FIGS. 12-*a* and 12-*b*, the approximate heat content, as a function of temperature (at constant pressure), is shown for water/steam, oil-liquid/vapor, natural gas (methane), and combustion-air-exhaust products (i.e., nitrogen plus $CO_2$). FIGS. 12-*c* and 12-*d* illustrate heat content as a function of temperature for 2 selected TECF mixtures of combustion-air products (i.e., 80% and 60%), plus water/steam (i.e., 20% and 40%) as may be needed to control the TECF temperature. The water/steam content may be the most useful means to control the TECF temperatures for injection into retorting permeable zones (either natural or created, propped, hydraulic fracs). However, the compressed combustion air also may be modified to produce variations in heat content by selective removal of nitrogen content and/or by selective addition of $CO_2$ or other non-combustion, diluting gases.

Membrane-based (or column-based) molecular-sieve technology may be used to remove portions of the nitrogen content of compressed air to produce an oxygen-enriched air for combustion. The air mixture used for combustion may range from 80% $N_2$/20% $O_2$ to 60% $N_2$/40% $O_2$, and possibly up to 40% $N_2$/60% $O_2$. Alternatively, industrial-grade oxygen (i.e., with very little inert gases) may be used for downhole combustion gas to create a TECF injection product. The heat content of such oxygen, or oxygen-enriched combustion air can be decreased by adding an inert gas, such as $CO_2$, along with water/steam as an additional temperature-control agent.

The addition of $CO_2$ to the TECF will have the additional benefit of increasing the recovery of retorted/refined, shale-oil products by $CO_2$ absorption into the condensed-liquid hydrocarbon products and the creation of a degree of miscible $CO_2$-flood displacement of liquid products in the porous-rock matrix for increased production. Furthermore, the $CO_2$ is easily separated from the combustible-gas products (i.e., methane, ethane, etc.) recovered from the production wells. When nitrogen is a significant component in the non-condensable, combustible-gas products (i.e., methane, ethane, etc.), recovered from the production wells, the selective, nitrogen-molecular-sieve technology may be used to reduce the nitrogen gas content to create useful on-site, combustion-gas fuels and possibly pipeline-marketable fuels.

A TECF combination of selective-nitrogen-sieve reduction of nitrogen to produce a compressed, oxygen-enriched combustion air for a downhole combustion burner, plus a $CO_2$ temperature-reducing dilutant with shale-oil solvent and miscible $CO_2$-flood displacement enhancement, plus water/steam injection for final temperature control, may provide a preferred TECF to optimize shale-oil retorted/refined products. Also, this preferred TECF, as produced back to the surface through production wells, may be treated for separation of $CO_2$ and nitrogen from the non-condensable hydrocarbon gases (i.e., methane, ethane, etc.) of the retorted products so as to maximize the recovered-product value. A multitude of combinations of components in such TECF-tailored-to-accomplish-specific-objectives and the optimization of the retorting/refining/recovery-of-specific-products can be developed by persons skilled in the art.

FIG. 13-*a* illustrates the heat content in Btu/lb of water/steam as a function of pressure and temperature. FIG. 13-*b* shows the specific volume (i.e., cu ft/lb) of water/steam and superheated steam as a function of pressure and temperature. These FIGS. 13-*a* and 13-*b* are useful in selecting the amount of water needed for injection into a TECF to effectively control the resulting TECF temperature for TECF injection into a permeable zone (i.e., either natural or propped-frac-created, permeable zone) for this temperature-controlled, selective retorting/refining operation.

FIG. 14 shows the approximate boiling-point temperature (in ° F.) of water and selected hydrocarbons as a function of pressure. FIG. 14 is useful in understanding this oil-shale-retorting/refining process and in selecting the desired temperatures and pressures to carry out this process.

Example 2

Further Characterization of Unique, Simplistic, Piceance Basin, Oil-Shale Deposition The Uinta Lake evaporational deposition of oil-shale carbonate rocks provide a most unusual, unique, simplistic, uniform, laterally continuous, depositional lithology which can be stratigraphically correlated over distances of 20 to 40 miles or more in the Piceance Basin of Northwestern Colorado and in the Uintah Basin of Northeastern Utah. Post depositional groundwater leaching of soluble mineral deposits in these oil-shale rocks provides fairly uniform, permeable aquifer zones over extensive portions of the Piceance Basin. These extensive laterally continuous aquifers can be used for hydrodynamically controlled flow of injected high temperature thermal energy carrier fluid (TECF) for the in-situ retorting and refining of shale oil from these oil-shale rocks.

Also, a unique natural fracture closure and sealing methodology used prior to applying this invention's hydrodynamically controlled frac extension and frac proppant packing method (technology) provides for newly created, laterally continuous, horizontal, proppant packed, wide hydraulic fracs to serve as high temperature TECF flow aquifers. These high-permeability propped hydraulic fractures may be created at any desired vertical intervals to achieve economic, high volume rates of retorting/refining of shale oil produced from these oil-shale rocks.

This Uinta Lake evaporate depositional environment created a near infinite multiplicity of alternatingly kerogen rich and lean, very thin layers (i.e., a small fraction of an inch in thickness) with consequent very low vertical permeability or vertical continuity. Also, in this unique depositional environment, there is created vertically stacked gross thickness intervals of several tens-of-feet of averagely very kerogen-rich oil-shale deposits (i.e., 30 to 50 gallons per ton) and vertically intermittent zones of averagely moderate kerogen content deposits (i.e., 15 to 30 gallons per ton), plus vertically intermittent zones of averagely lean oil-shale deposits (i.e., 5 to 15 gallons per ton). By this invention, all zones over about 7 to 10 gallons per ton of retortable shale oil will produce enough marketable products to exceed the consumption of product to fuel the retorting process. Consequently, over the 1,000 to 2,000-foot gross-thickness of the oil-shale deposits in the 500+ square mile primary retortable area in the central portion of the Piceance Basin of Colorado this oil-shale resource may have over 90% to 95% of the gross thickness intervals with more than 10 gallons per ton retortable shale oil. Therefore, by this invention the total of 1,000 to 2,000-foot gross thickness can be retorted in a multiplicity of stages without any intervals having to be isolated for non-retorting.

The unique chemical precipitation, depositional process which occurred in this quiescent, low-energy, evaporatic Lake Uinta has resulted in a most unusual, simplistic, laterally continuous sequence of oil-shale lithologies with sufficient vertical gross uniformity of layered variable richness zones to provide a 500+ square mile area by 1,000 to 2,000-foot thickness which can be in-situ retorted as a single massive, oil-shale-resource deposit without significant depositional discontinuity.

The use of these unique, simplistic, laterally continuous natural permeability aquifers, plus the creation of effective, laterally continuous, proppant packed horizontal hydraulic fractures permits the in-situ retorting oil-shale development operator to locate all injection and production wells on widely spaced road/pipeline access rights-of-way along lines parallel to the present day topographic drainage without being limited by any depositional lithology boundaries. This will provide a minimum of surface footprint and a minimum of surface environmental problems.

Example 3

Other Fixed-Bed Carbonaceous Deposit (FBCD), In-Situ, Retorting/Refining Targets In contrast, most other in-situ retorting/refining of tar sands, heavy oil fields, depleted oil fields, new oil fields, coal/lignite beds, and other fixed hydrocarbon deposits will have laterally discontinuous lithologic boundaries of the retortable resource dictating the location of injection and production wells. These laterally discontinuous boundaries dictating the location of these wells prevents placing these wells at strategic topographic/environmental locations. Some of the depositional discontinuities of other FBCD may be briefly described as follows:

1. Typical Oil-Field Sand Reservoirs (Including Tar Sands):
   - (a) Infilling of erosional unconformity valleys=limited width, long length complex orientation of sand bodies.
   - (b) Continental fluvial river channel sands=narrow width (20 to 500-foot width) long length sands multilayer of complex channel sands.

(c) Deltaic distributary channel and mouth bar sands=narrow width (20 to 500-foot width) long length channel sands and fat bar sand pods. Multilayer of complex depositional geometries.

(d) Estuarine complexes of tidal flats, tidal channels, tidal islands, lagoons, sand bars, etc., giving long, narrow complex sand bodies.

(e) Shoreline beach sand deposits of either transgressive or regressive marine or lake shorelines to give apparent continuous blanket sands. Even when these blanket sands appear to be continuous, they have many low-permeability, silty zones or shale breaks which create preferential long shore, high-permeability continuity and perpendicular low-permeability silts or impermeable shale breaks to give preferential linearity of hydrodynamic flow.

2. Typical Oil-Field Carbonate (Limestone/Dolomite) Reservoirs:

(a) Multistage shallow marine carbonate depositional platform with shallowing-upward depositional cycles creating reservoirs of excellent lateral permeability continuity but highly variable vertical permeability continuity.

(b) Deep water platform slope to basin transition with variable permeability discontinuities.

(c) Reef development of high-permeability reef pods surrounded by low-permeability carbonates, silt and shales.

(d) Restricted access shallow marine shoreline, lagoons, and tidal flat settings with some isolated evaporitic basins in the shoreline tidal flats, creating discontinuously permeable reservoirs.

(e) Isolated evaporitic lake deposits creating laterally continuous lithology depositional units with sharp vertical discontinuities.

3. Outline of 5 Typical Examples of Propped-Frac-Transmissibility Effect:

(a) Example 1:

Tar sands (Athabasca, Alberta, Canada): 1-darcy sand permeability with 500±centipoises oil, using 1,000-darcy propped frac for high-transmissible TECF injection (b) Example 2:

Heavy oil sands @ 300-md (millidarcy) sand permeability with 60-centipoises oil using 1,000-darcy propped frac for high-transmissible TECF injection (c) Example 3:

Medium-light-oil field, 50-md sand permeability with 5-centipoises oil using 1,000-darcy propped frac for high-transmissibilities of TECF injection (d) Example 4:

Refining of 3-centipoises, light crude oil, injected into 100-md porous rock through a 1,000-darcy propped frac, to be refined by flow through the 100-md porous rock of progressively higher temperatures in the thermal-conductivity-controlled temperature gradient toward the high-temperature (i.e., 1000° F. to 1800° F.), 1,000-darcy, propped-frac heating element, containing the hydrodynamic flow of high-temperature-injected TECF, plus refined hydrocarbon vapors and gases.

(e) Example 5:

Refining of 30-centipoises, medium/heavy crude oil, injected into 100-md porous rock through a 1,000-darcy propped frac, to be refined by flow through the 100-md porous rock of progressively higher temperatures in the thermal-conductivity-controlled temperature gradient toward the high-temperature (i.e., 1000° F. to 1800° F.), 1,000-darcy, propped-frac heating element, containing the hydrodynamic flow of high-temperature-injected TECF, plus refined hydrocarbon vapors and gases.

Integrated In-Situ Retorting And Refining Tar-Sand, Heavy-Oil, And Conventional-Oil Resources

| | | Example #1 | Example #2 | Example #3 | Example #4 | Example #5 |
|---|---|---|---|---|---|---|
| I | Rock properties: (darcy-ft) | 25 | 7.5 | 1.25 | 2.5 | 2.5 |
| | K = permeability (darcys) | 1 | 0.3 | 0.05 | 0.1 | 0.1 |
| | h = thickness of retorting zone (feet) | 25 | 25 | 25 | 25 | 25 |
| II | Propped frac: K · h in darcy-ft | 500 | 500 | 500 | 500 | 500 |
| | K = permeability (dracys) | 1000 | 1000 | 1000 | 1000 | 1000 |
| | h = thickness in feet (0.04 to 0.5) | 0.5 | 0.5 | 0.5 | 0.5 | 0.5 |
| III | Viscosities: (μ) in centipoises (cp) | | | | | |
| | Crude-oil-resources-μ's (μ in cp) | 500 | 60 | 5 | 3 | 30 |
| | TECF+ vapors-μ's (0.01 to 0.02) | 0.02 | 0.02 | 0.02 | 0.02 | 0.02 |
| | Ratio of μ's (Crude-oil-p/ TECF+ vapors-μ) | 25,000 | 3,000 | 250 | 150 | 1,500 |
| IV | Transmissibility Ratio: K · h/μ | | | | | |
| | TECF-frac-K · h/μ = 500/0.02 | 25,000 | 25,000 | 25,000 | 25,000 | 25,000 |
| | Crude-oil-K · h/μ = variable | 0.05 | 0.125 | 0.25 | 0.833 | 0.083 |
| | Ratio: (TECF-frac-K · h/μ)/ (Crude-oil-K · h/μ) | 500,000 | 200,000 | 100,000 | 30,000 | 300,000 |

Detailed Description of Example #1

Although many of the heavy-oil and tar-sand deposits are located in relatively high-permeability and high-porosity sands, the heavy oil and tar (bitumen) have such high viscosity that their transmissibility through the porous rock is very low. Consequently, this highly viscous heavy oil and tar may be considered immobile and thereby a fixed-bed hydrocarbon deposit. In this condition, a high-transmissibility flow path must be established through the low-transmissibility deposits (i.e., fixed-bed hydrocarbon deposits). This provision will make it possible to deliver high-volume rates of thermal energy into the heavy oil or tar sands by flowing large volumes of TECF through an extensive area of such newly created, high-transmissibility flow paths between injection wells and production wells.

Such high-transmissibility flow paths can be established by the creation of a thick, proppant-packed hydraulic frac with a cold, low-viscosity fluid filling the thick proppant pack in this hydraulic fracture. In a typical example, this proppant may consist of 12 to 20-mesh, or possibly 8 to 12-mesh sand or catalyst, proppant material with a permeability of about 1,000 darcys or more. This proppant pack may range from about ¼inch up to 6 inches or more in thickness. Consequently, the product of frac-proppant permeability (K) times proppant thickness (h) may be about 1,000 darcys times ½-ft, or a K·h factor of about 500 darcy-ft. The tar-sand reservoir rock typically may have an average permeability of about 1 darcy (K) and a thickness between frac zones of about 25 ft (h), resulting in a K·h factor of about 25 darcy-ft, or about 5% of the hydraulic-frac-proppant K·h factor. Even if the frac-proppant thickness is only about % inch, resulting in a frac K·h factor of about 40 darcy-ft, it is still significantly larger than a typical tar-sand-reservoir K·h of 25 darcy-ft.

If the viscosity (p) of the tar or heavy oil is about 500 centipoises, or higher, and the viscosity of the water in the frac proppant is 1 centipoise, then the fluid transmissibility (i.e., K·h/μ) of the water in the frac proppant (i.e., 500 darcy-ft/1-cp for the 6-inch thick, propped, hydraulic frac, or alternatively, 40 darcy-ft/1-cp for the ½-inch thick, propped, hydraulic frac) is about 800 to 10,000 times the fluid transmissibility of heavy oil or tar in the 25 ft of 1-darcy sand (i.e., 25 darcy-ft/500-cp=0.05). After the water in the frac proppant has been displaced by a high-temperature mixture of hot TECF, plus retorted/refined hydrocarbon vapors having viscosities of less than 0.02 cp, the ratios of fluid transmissibility for flow through the frac proppant compared to the fluid transmissibility flowing through the tar sands may range from 40,000 to 500,000 or more. This calculation is based on the thick, propped frac K·h/μ of 500-darcy-ft/0.02-cp=25,000, or alternatively, the thin, propped frac K·h/μ of 40-darcy-ft/0.02-cp=2,000 compared to the tar-sand K·h/μ of 25-darcy-ft/500-cp=0.05 to give a transmissibility ratio ranging from 40,000 to 500,000. If the high-temperature vapor viscosity is 0.01 cp, then the transmissibility ratio would range from 80,000 to 1,000,000. Consequently, the dominant flow of fluid will be through the frac proppant and comparatively little (i.e., negligible) flow through the tar sand.

In one embodiment, as a typical example illustrated in FIG. 1, a line of 16 injection wells along a 1-mile length of road/pipeline right-of-way is used to inject high temperature TECF into the proppant in the hydraulic frac. Two lines of 16 production wells, each line located along a 1-mile length of road/pipeline right-of-way about ½-mile distance from and parallel to the line of injection wells, are used to produce to the surface the TECF plus the high-temperature retorted/refined products from the proppant in the hydraulic frac.

Initially, steam, at about 450 to 550° F., may be injected into the frac proppant to heat the frac-proppant zone up to about the steam temperature and to fill the proppant pore spaces with steam with a low viscosity of about 0.01 to 0.02 cp resulting in a very high frac-proppant fluid transmissibility. Then the TECF may be injected at a selected, preferred, retorting/refining temperature, such as about 1,000° F. to 1,400° F. In some heavy-oil and tar-sand embodiments, this injection temperature may be increased to about 1,500° F. or 1,800° F. to achieve a thermal and hydro-cracking reaction to increase the production of desired lighter-molecular-weight hydrocarbon products plus olefins and hydrogen.

In this heavy-oil and tar-sand retorting/refining procedure, the high temperature TECF flows from the line of injection wells to the line of production wells dominantly through the high-fluid-transmissibility, frac-proppant zones. The hydraulic frac proppant, heated by the hydrodynamic flow of hot TECF, becomes the large areal-extent heating element from which thermal energy will flow by thermal conductivity from this horizontal heating element (i.e., the hot, frac-proppant zone) upward and downward into the adjacent, non-retorted, heavy-oil/tar-sand deposits. This thermal-conductivity heat flow will create retorting fronts advancing upward and downward in directions perpendicular to the horizontal plane of this propped hydraulic frac.

At these advancing retort fronts, the heavy oil/tar is initially heated to reduce its viscosity to create some downward flow by gravity drainage. However, over a relatively short distance, this steep temperature gradient will heat this mobilized oil to retorting/cracking temperatures thereby thermally cracking and hydrocracking this heavy oil into lighter oil (i.e., shorter, smaller, and less-complex molecular structures). This retorting/cracking process will eventually create dominantly hydrocarbon gases and vapors, plus residual, crystallized carbon precipitated onto the pore-space walls. This crystallized carbon, precipitated onto the pore-space walls, will increase the thermal conductivity and thereby increase the rate of thermal-conductivity heat flow and increase the rate of retorting/cracking of the mobilized oil behind the accelerated advance of the retort fronts.

Example 4

Typical Geometries of Many Lignite/Coal Deposits

The depositional environment of many lignite and coal deposits is laterally continuous in one direction and laterally discontinuous in a perpendicular direction. This depositional environment results in a multiplicity of lenticular coal lenses a few hundred feet wide by several hundred to a few thousand feet long. In many coal fields, a vertical stacking of these lenticular coal deposits will be developed with the coal bed thicknesses typically ranging from two to ten feet with intervals of a few feet to tens of feet of barren (not coal) rocks separating these coal beds.

If the coal bed content encountered in a vertical drill hole through such multiplicity of typical coal seams is less than about 50% to 70% of the gross interval, then the non-productive heat loss into the barren rock between coal seams may be excessive for economic operations of retorting the total gross section. In such case, each coal bed to be retorted must be isolated and retorted at a very high rate of hot TECF hydrodynamic flow through either a high natural permeability coal seam or through a very high-permeability propped hydraulic fracture in the coal seam. The objective is to retort each coal seam very rapidly to minimize the time span for losing heat into the adjacent non-productive barren rocks between the coal seams. Then a portion of the residual heat in the retorted coal seam may be rapidly recovered by injecting water to produce steam for energy recovery before very much of this heat is lost to the intervening barren rock.

In some coal fields, some of the coal seams may have thickness ranging from 20 to 50 feet and, in a few exceptional cases, the thick coal seams may range from 50 to 100 feet or more. Furthermore, in some transgressive or regressive depositional conditions, these thick coal beds with relatively thin silt or shale breaks may appear to be a continuous blanket coal seam over a broad area. However, from the perspective of hydrodynamic flow of hot TECF fluids, these apparent continuous thick coal beds will exhibit linear hydrodynamic flow directions parallel to the depositional trends of the silt/shale flow barriers. Consequently, the location of lines of injection wells and production wells must be oriented perpendicular to these natural hydrodynamic flow directions to provide TECF flow between injection wells and production wells in the direction of the continuous permeable path. Therefore, the coal bed depositional pattern will dictate the location and orientation of the line of injection wells and production wells, whereas topographic and surface environmental conditions cannot be used in locating these lines of wells.

Example 5

Detailed Description of Piceance Basin, Oil-Shale Deposition

According to accepted geological models, the rich oil-shale zones in the Piceance Basin in N.W. Colorado and N.E. Utah were geologically deposited in the bottom of Lake Uinta and the oil-shale zones in the Washakie and the Green River Basin in S.W. Wyoming were geologically deposited in the bottom of Lake Gosiute. Lake Uinta and Lake Gosiute both appear to have been evaporative inland lakes with little or no drainage outlets. This evaporative environment appears to have resulted in deposition of micro granular, lacustrine sediments of mostly dolomitic marlstones plus zones with bedded, soluble, evaporative minerals such as nahcolite, dawsonite, halite, trona, shortite, and other salts.

According to the accepted models, periodically, in the geologic history of these stagnant, evaporative lakes, relatively fresh, aerobic water floated across the surface of these lakes on the top of the highly saline, anerobic, evaporative brines covering the bottom of the lakes. Under these conditions, abundant phytoplankton, algae, and other forms of plant and animal life would grow within the layer of aerobic water near the surface of the lake. As this plant and animal life died and sank down through the anerobic, evaporative, brine layer, the organic remains of these plants and animals became buried in the precipitating dolomitic marlstone and other precipitating sediments which were accumulating at the bottom of these lakes. This organic matter, buried in the precipitating dolomitic marlstone, and other minerals at the bottom of these evaporative lakes would undergo some diagenesis and become the organic kerogen matter of these lacustrine, evaporative sediments. Those zones, in which the buried organic matter (kerogen) is a relatively high percentage of the deposited rock volume, are called "oil-shale beds." This appears to be the genesis of this oil-shale rock. The foregoing and following discussions provide insights that are useful in defining other geographical and geological regions and formations that are well suited to the methods of this invention.

According to the present model, at the time of deposition, the precipitating dolomitic marlstones found in the oil-shale beds of the Piceance Basin in N.W. Colorado, simultaneously acquired relatively high kerogen content and also relatively high content of soluble sodium minerals, such as nahcolite, dawsonite, and halite. In some portions of the Piceance Basin, these water-soluble sodium minerals have been dissolved, resulting in greatly increased porosity and permeability of these oil-shale beds which then become significant aquifers within the oil-shale zones. The removal of these soluble salts, by water-flow leaching, created large voids or cavities which may collapse, resulting in brecciation of the rock, thereby creating very high permeability (i.e., multi-darcy) aquifers. In other portions of this basin, such as in the Mahogany Zone, near the top of the oil-shale section, much less soluble minerals were deposited, resulting in fewer beds and thinner beds with lower content of soluble minerals being available for leaching to form such aquifers. Such oil-shale zones, especially the Mahogany Zone, would have relatively low permeability with only a few significant, permeable aquifers. Also, in the oil-shale section of the Uinta Basin in N.E. Utah, fewer beds and thinner beds with lower content of soluble minerals were deposited and subsequently leached, thereby resulting in much less development of permeable aquifers in the oil-shale section of that basin.

Subsequent to the deposition of this oil-shale rock, structural deformation and erosion appears to have created the present configuration of the structural basins, the surface topography, and the hydrodynamic flow of water through the aquifers to cause soluble mineral leaching and further aquifer development. In the Piceance Basin of N.W. Colorado, the hydrodynamic flow of water has been from the high-elevation outcrops on the south and southwest toward the low-elevation outcrops on the north. This northward, hydrodynamic, water flow has dissolved out most of the soluble minerals in most of the oil-shale section in the southern portion of the basin and in the upper portion of the oil-shale section in the northern portion of the basin. A dissolution surface can be identified and mapped as the boundary between the above leached zone in which the soluble minerals have been removed by solution and the below unleached zones in which the soluble minerals have not yet been removed by groundwater-flow solution. This process of leaching out the soluble minerals is continuing to occur at the present time, resulting in saline water flowing to the surface (saline water springs) and into the streams, rivers, and shallow groundwater at the low outcrop elevations on the north rim of the Piceance Basin.

The stratigraphic column of the oil-shale zone typically occurring at locations near the center and deeper portion of the Piceance Basin contain some relatively rich zones labeled R-8, R-7, R-6, R-5, R-4, R-3, etc. containing relatively large quantities of kerogen with relatively small amounts of porous zones or "voids" (open holes) left in the rock after the soluble minerals have been dissolved by hydrodynamically flowing formation water. Consequently, these "R"-designated (i.e., "R-rated"), oil-shale zones have relatively few aquifers, and any existing aquifers are generally very thin and of relatively low permeability.

These "R-rated" zones represent geologic periods when the fresh, aerobic, surface waters supported the growth of abundant plant and animal life whose organic remains, after death, settled to the anaerobic lake bottom for burial in the accumulating, precipitating mineral sediments. Also, in these "R-rated" zones, the inorganic, precipitating minerals were dominantly dolomitic marlstones with relatively little soluble mineral precipitates. Consequently, these "R-rated" zones have relatively low permeability or ability for water flow, and consequently, limited potential for injecting significant volume rates of thermal-energy carrier fluid (TECF) as used in this invention.

The relatively lean zones labeled A-Groove, B-Groove, L-5, L-4, L-3, L-2, etc. contain somewhat smaller quantities of kerogen and very large percentage amounts of precipitated minerals, both marlstone and/or soluble sodium salts (i.e., nahcolite, halite, et al). These "L-rated" zones (i.e., lean zones) represent geologic periods when these lacustrine waters became very saline and were chemically precipitating very large volume rates of dolomitic marlstone and soluble sodium salts (nahcolite, halite, etc.). With this dominance of precipitating minerals, the organic (i.e., kerogen) content becomes relatively lean in volume percent. However, after these soluble minerals have been dissolved, these "L-rated" zones become significant aquifers, which are thereby useful for the injection and flow of large volume rates of thermal-energy carrier fluids (TECF) as used in this invention. The natural permeability of some of these "L-rated" zones may have been greatly increased by the collapse of dissolved salt cavities and the resulting brecciation of the adjacent oil-shale rock.

Example 6

A Brief Summary of Piceance Basin, Oil-Shale Retorting/Refining Operations

In these L-zone aquifers, the thermal-energy carrier fluids, injected at pressures exceeding the normal, aquifer-formation-water pressure, will flow outward from the injection well bore by displacing the formation water from that portion of the aquifer. Since these permeable aquifers contain very large volumes of water extending over long distances, very large volume rates of thermal-energy carrier fluid can be injected, thereby displacing this formation water outwardly at substantially the normal, formation-water pressure. In using this invention, the operator evaluates each aquifer encountered, usually in the "L-rated" zones, to determine the fluid-flow characteristics of each such aquifer. From this aquifer, fluid-flow data, the thermal-energy-carrier-fluid injection program for each aquifer can be optimally designed.

In the thick "R-rated" zones, thin manmade aquifers of very high permeability may be created by propped hydraulic fracturing. These propped, horizontal, hydraulic fractures, created by a procedure subsequently described herein, will create thin aquifers (i.e., 0.5" to several inches) of very high permeability (i.e., over 1,000 darcies), extending outward over very large areas from each, frac-injection well bore. The injection-program design for injecting this invention's thermal-energy carrier fluid into these thin, very high-permeability hydraulic fractures, extending over large horizontal areas, can provide very effective means of heating large volumes of this oil-shale rock to retorting temperatures for very economic production of oil and gas products.

This invention uses either naturally occurring or propped-frac-created aquifers in the retortable oil shale rock for the hydrodynamically controlled flow of selected thermal energy carrier fluids (TECF) at high temperatures from a series of injection wells to a series of production wells. This hot TECF flows through either naturally occurring permeable aquifers or propped-frac-created permeable aquifers and will create high temperature surface areas of very large areal extent per each connected injection well. Along the hydrodynamic flow path from each injection well to a corresponding producing well, the high temperature thermal energy carrier fluid flowing in such aquifer is losing temperature by thermal energy flowing away from the hot aquifer surfaces of large areal extent and into the adjacent energy-resource rock by thermal conduction.

The rate of this heat flow by thermal conduction is dependent on the thermal conductivity of the rock, the square foot area of hot aquifer surfaces per injection well, and the temperature gradient from the hot aquifer into the cool adjacent rock. In typical operational examples, the surface area of the aquifer heated to high temperatures by the hydrodynamically controlled flow of hot thermal energy carrier fluids (TECF) from each injection well bore may be about 1,000 to 2,000 (or more) times the surface area of each such injection well bore surface area in the retorting zone. This very large surface area of hot aquifer rock per each TECF injection well provides for the necessary large heat flow rate, by thermal conductivity, from the hot aquifer into the adjacent retortable-energy-resource rock, such as oil shale.

A typical configuration of TECF injection wells and product production wells may consist of 16 TECF injection wells located at about 330-foot spacing along a 1 mile length of authorized road/pipeline right-of-way. Then, at about % mile spacing on either side of the line of injection wells, a near parallel line of 16 production wells may be located at 330-foot spacing along another authorized road/pipeline right-of-way. Then the hydrodynamic flow path within each permeable zone will be nearly linear from the mile long length of 16 TECF injection wells to the nearby parallel 1 mile length of 16 production wells at a spacing of about ½ mile on either side of the 1 mile long line of 16 injection wells.

Where the temperatures of this aquifer carrying the hot injected TECF is high enough (i.e., typically 750° F. to 1,200° F.), then the retorted products may be refined by thermal cracking into lower molecular weight hydrocarbon products, resulting in deposition of residual carbon on the mineral grains, pore space walls. This thermal cracking resulting in solid carbon deposition in the oil shale rock is a form of underground sequestering of carbon, which is an equivalent of sequestering $CO_2$. This sequestering of carbon is a means for reducing the $CO_2$ pollution of the atmosphere.

Such carbon deposits may be crystallized into higher thermal conductivity crystals, such as graphite, buckey balls, buckey tubes, etc., thereby creating increased heat flow rates through such enhanced thermal conductivity rocks. The consequent thermal conductivities may increase from 1 to 3, 5, or possibly up to 10, in some examples. Also, the high temperature will cause the volatilization of most hydrocarbon products and water to create a single-phase flow of vapors (i.e., gases) with no multiphase flow governed by interfacial tensions and capillary forces. This single-phase fluid flow of vapors (gases) can achieve very high hydrocarbon recoveries compared to the prior methods of production using multiphase fluid flow.

If the product production process results in lowering the temperature in the oil shale aquifer enough so that some of the hydrocarbon products condense from a vapor to a liquid phase in the porous rock, then the less efficient two-phase (i.e., gas/vapor and liquid oil) flow results. Furthermore, if some of the water vapor condenses to create liquid water, in addition to the hydrocarbon liquids, then three-phase (i.e., gas, oil, and water) flow of low efficiency results with consequent large, non-producible, by-passed, residual oil left in the porous aquifer/reservoir rocks. The means of changing from three-phase or two-phase production flow to a single-phase flow is one of the most important components of this invention.

The use of water vapor as a constituent in the thermal energy carrier fluid (TECF) provides water molecules for hydrocracking reactions to increase the more desirable and valuable hydrocarbon product yields. Furthermore, product control granular catalysts may be used in the frac proppant around either or both the injection wells and the production wells to optimize the value of product produced from this in-situ retorting/cracking/refining operation. Also, liquid or volatilized catalysts may be used for these purposes. By controlling the pressure, temperature, and residence time, while using selected catalysts; plus water vapor, the produced products can be optimized for highest value and special needs.

Along the hydrodynamic flow path in these permeable zones, a cooling temperature gradient will exist from about 1,200° F. near the TECF injection wells to about 600° F. to 800° F. near the production wells. In the high temperature areas, near the injection wells, the retorted shale-oil will undergo substantial thermal cracking and hydrocracking to produce an abundance of short chain hydrocarbons in the range from $C_3$ to $C_6$ followed downstream by moderate length $C_6$ to $C_{12}$ hydrocarbon chain products. Further downstream, along this cooling temperature gradient in the hydrodynamic flow path, near the production wells, where the retorting temperature may be about 600° F. to 800° F., much less thermal cracking and hydrocracking will be occurring. In this area, much of the retorted products will be higher molecular weight hydrocarbons, typically over $C_{16}$ in molecular size.

Along this TECF and shale oil retorted product flow path, an effective miscible flood production process is established by the $C_{12}$ to $C_{16}$ fractions diluting the heavy oil products (i.e., $C_{16}$ and heavier), followed by the $C_6$ to $C_{12}$ fractions forming a miscible front pushing the heavier fractions toward the production wells and the abundant upstream high temperature cracked $C_3$ to $C_6$ very volatile light ends completing the miscible flood displacement process. The non-condensable gases of methane, ethane, and some of the TECF products energize this miscible flood production process.

During the early stages of this hot TECF injection into the cold water saturated natural aquifers, complex multi-phase flow will be created with substantial interfingering flow paths producing large by-passed sections in the aquifer. The stratigraphic layering of 1 to 5 darcy high permeability salt leached zones separated by some 50 to 100 md moderate permeability zones and some $1/10^{th}$ md to 10 md low permeability zones, each ranging in thickness from a fraction of an inch to a few inches to a few feet, will create substantial TECF injection by-passed zones. Also, the difference in viscosity of the TECF and the formation water creates an unstable displacement flood front resulting in interfingering flow paths within each separated permeability zone.

However, the thermal conductivity heat flow out from each displacement finger in each TECF invaded zone will create a much more uniform thermal front than the TECF multi-phase fluid flow displacement front. Over these short distances the steep temperature gradient may cause the thermal conductivity heat flow front to advance cross-formationally at rates ranging from several inches per day to a fraction of an inch per day. Within a few weeks or a few months, the thermal conductivity heat flow will increase the temperature of the fluid-flow, by-passed areas and zones to nearly the same temperature as the TECF invaded areas and zones. Consequently, a short distance behind the TECF interfingering fluid displacement front all of the natural aquifer areas and zones will have very little temperature difference between the TECF fluid flow invaded areas and the fluid flow by-passed areas. The advancing thermal front will be far more uniform than the TECF displacement front.

After the thermal front arrives at the production wells, then the TECF injection rate is adjusted until the temperature of the produced TECF, plus retorted product, is stabilized at a desired level. Depending upon the operator's objectives for product value, this production well temperature may be about 300° F. to 600° F. below the injection well TECF temperature of about 1,200° F. After this temperature gradient along the TECF flow path has been stabilized for a period of time, the operator may choose to reverse the flow direction by injecting the TECF into the prior production wells and producing the TECF, plus retorted products, out of the prior injection wells. This reverse flow can continue until the reverse flow temperature gradient along the aquifer flow path has been stabilized at its desired value. Then the flow direction can be reversed back to its original direction. This reversal of flow direction can be repeated as desired by the operator to manage the rate and quality of retorted product produced or until the zone between adjacent aquifer injection zones has been retorted and the production of this resource zone is depleted.

When desired, the high temperature water vapor can be used to react with the residual carbon deposited on the mineral grains pore space walls to produce hydrogen plus CO and $CO_2$. This process may be developed as a major source of low cost hydrogen for the future hydrogen-based economy. After the in-situ retorting/cracking/refining of products has been completed, most of the residual thermal energy stored in the hot retorted rock can be recovered by injecting water to produce steam for utilization by various energy recovery systems at the surface.

Process for Creating Propped, Horizontal, Hydraulic Fractures

In the process of creating a propped hydraulic fracture aquifer, the hydraulic fracture plane will be perpendicular to the least principle stress vector. At the shallow depths, ranging from 500 feet to 2,000 feet for the oil shale deposits in Colorado, Utah, and Wyoming, this least principle stress vector will normally be vertical, resulting in the creation of dominantly horizontal hydraulic fracture growth planes. Where pre-existing, open, vertical fractures occur, the hydraulic frac fluid may leak out of the hydraulic frac plane through such pre-existing vertical fractures and, thereby, prevent the continuing growth of the horizontal hydraulic fracture.

Therefore, to provide means for continuing growth of the desired horizontal hydraulic fracture, this leakage through such pre-existing fractures must be reduced or eliminated. One effective means for reducing or eliminating significant leakage through such pre-existing open fractures is to inject into such fractures steam and/or hot water or other TECF at temperatures of slightly less than initial retorting temperature (i.e., typically about 450° F. to 600° F.) to create thermal expansion of the adjacent rocks. These heated adjacent rocks will expand into the open fracture, thereby reducing the open fracture width and reducing the flow volume rate of frac fluid leakage through the pre-existing fracture. Also, the heat will soften the kerogen in the oil shale rock and cause it to plastically flow from the compressed oil shale rock pore spaces into the reduced width open fractures. This plastic flow of the thermally softened kerogen will further reduce or eliminate any frac fluid leakage through such pre-existing vertical fractures.

To achieve this horizontal hydraulic frac extension objective, the pumped hydraulic frac pad fluid may be hot water and/or steam or other TECF at or slightly above the frac extension pressure (i.e., about 0.9 to 1.1 psi/ft of depth) and at or slightly below the initial primary retorting temperature (i.e., typically about 450° F. to 600° F.). In a typical example of creating this hydraulic fracture, a line of 16 frac injection wells may be spaced about 330 feet apart along a one mile length of an approved road/pipeline right-of-way. Also, two lines of 16 frac fluid production wells in each line, spaced about 330 feet apart along a one mile length of approved road/pipeline right-of-way, with each production well line approximately parallel to and spaced about ½ mile on opposite sides from the line of 16 injection wells. These road/pipeline rights-of-way should be approximately parallel to the local topographic drainage pattern to create minimal environmental impact.

Each frac fluid injection well is completed in a manner to provide maximum fluid injection access to one or more of the thin lithologic zones with the best apparent permeability and porosity at the depth selected for creation of a propped hydraulic fracture aquifer. This fluid injection access may be achieved through (1) a section of uncased open hole, (2) a section of perforated or slotted, uncemented casing over an open-hole interval, (3) a zone of perforated, cemented casing, (4) a multiplicity of abrasa-jet cut slots or (5) other means for creating fluid injection access from the well bore to the selected portion of oil shale formation.

The hydraulic fracture may be initiated in any one of the 16 injection wells in the line of injection wells. This hydraulic fracture can be caused to grow slowly along a frac fluid invaded lithologic bedding plane with some matrix porosity and permeability, whereby the pressurized frac fluid can slowly lift the overburden at a geostatic pressure (i.e., about 0.9 to 1.1 psi/ft of depth). If this injected frac fluid is hot water or steam at a temperature slightly lower than the initial oil shale retorting temperatures (i.e., about 450° f to 600° F.), then any such hot frac fluid leaking from this lithologic frac plane into pre-existing open fractures will cause the closure and effective sealing of such leakage fractures, as previously described herein. Subsequent frac fluid injection will then cause the continuing growth of the hydraulic fracture along the thin, porous, permeable bedding plane as this frac fluid pressure (i.e., at slightly over the geostatic pressure of about 0.9 to 1.1 psi/ft of depth) lifts the overburden at these shallow depths (i.e., usually less than about 2,500-foot depth).

As this hydraulic fracture is propagated outward from the initial injection well, it will intersect the lower pressure adjacent injection wells along the line of injection wells as evidenced by steam or hot water, at frac extension pressures, being produced from those wells. When these adjacent injection wells are intersected by the growing hydraulic fracture, then additional hot water or steam can be injected down these wells to perpetuate or accelerate the continuing growth of this hydraulic fracture.

This process will continue until all 16 injection wells in this injection well line are connected together by this growing hydraulic fracture. Then, hot water/steam frac fluid will continue being injected down all 16 injection wells. Consequently, the hydraulic fracture will continue to grow linearly away from this line of injection wells toward the adjacent approximately parallel lines of production wells spaced about ½ mile away on each side of the line of injection wells. When this growing hydraulic fracture reaches each well in the adjacent lines of production wells, then they will start to produce the hot frac fluid (i.e., hot water or steam) at a back pressure of slightly more than the overburden lifting geostatic pressure of about 0.9 to 1.1 psi/ft depth.

After stabilized hot frac fluid flow has been established between the line of 16 injection wells and the two adjacent parallel lines of 16 production wells each and the leak off through pre-existing fractures has been minimized or eliminated, then proppant ladened frac fluid can be injected through the 16 injection wells to achieve the propping of this hydraulic frac. For this purpose, each of the 16 production wells in each of the two lines of production wells will have been completed with a slotted liner or a wire screen liner over the open-hole interval containing the hydraulic frac. This wire screen or slotted liner will screen out the proppant granules from the frac fluid flow and allow the frac fluid to be produced to the surface at a back pressure sufficient to hold the hydraulic frac open until it is fully packed with proppant granules.

As the proppant-laden frac fluid continues to flow from the line of injection wells toward the two parallel lines of production wells, the proppant granules will be screened out as they reach the edge of the propped frac, but the frac fluid will continue to flow through the propped frac to the producing wells and then up to the surface for frac fluid recovery and recycling. For this purpose, coarse grain proppant granules will be used to achieve a high permeability and a high fluid transmissibility frac-created aquifer. The proppant mesh size may typically be about 12 to 20 mesh or possibly from about 8 to 12 mesh, with permeabilities of about 1,000 darcies or higher.

Although the initial frac-pad fluid may be hot water/steam or another hot thermal energy carrier fluid (TECF) to create the initial hydraulic frac path and to reduce or eliminate leakage through intersecting pre-existing fractures, the subsequent proppant carrying frac fluid may be a conventional frac fluid at near normal temperatures. Throughout the cycle of pumping proppant-laden frac fluid, the injection pressure must be maintained at a pressure greater than the geostatic (i.e., about 0.9 to 1.1 psi/ft depth) frac-extension pressure so that the hydraulic frac width is held open and expanded to achieve the desired thickness of frac proppant pack for the subsequent TECF flow. After the proppant has fully packed the hydraulic frac near the proppant screening production wells, then the production well back-pressure can be gradually reduced to control the continuous hydrodynamic flow of frac fluid, both in the proppant carrying area of the unpacked open hydraulic fracture and in the frac fluid only (i.e., no proppant carrying) flow area of the proppant packed frac. The proppant packed area of this hydraulic fracture will expand away from the line of production wells until the hydraulic fracture is fully proppant-packed, at the desired frac width, all the way from the line of production wells back to the line of injection wells. When this frac proppant packing process is completed, then this propped hydraulic-frac-created aquifer can be used for the hydrodynamic controlled flow of hot thermal energy carrier fluids (TECF) to effectively retort the adjacent oil shale rocks as herein previously described.

This proppant-packed hydraulic fracture can be expanded by sequentially repeating this process for a succession of approximately parallel injection well lines and production well lines. For example, a new line of 16 injection wells can be created about ½ mile from and approximately parallel to the last created line of 16 production wells. Furthermore, another line of 16 production wells can be created about ½ mile from and approximately parallel to this newly created line of 16 injection wells. The previously described process of creating the growing hydraulic fracture along the line of 16 injection wells and then out to the approximately parallel lines of 16 production wells about ½ mile on each side of the line of injection wells can be repeated. Also, the previously described process of proppant packing of this hydraulic fracture can be repeated.

By repeating this process a multiplicity of times, the propped-hydraulic-frac-created high permeability flow paths can be repetitively extended laterally along one dimension as far as desired. Furthermore, a multiplicity of such rows of propped-hydraulic fractures can be created to cause these multiple rows of propped-frac-created flow paths to be extended two dimensionally to cover an expanding areal extent as far as desired in each of the two dimensions. Also, this two-dimensional sheet of propped-frac-created flow paths can be repeated at any desired vertical (i.e., depth) intervals. This procedure will provide a three-dimensional heat flow pattern between the multiple layers of vertically-spaced, horizontal-sheets of high permeability propped-frac-created flow paths for hot TECF retorting fluids interspersed between the naturally occurring permeable aquifer TECF flow paths in the retortable oil shale rock formations.

Typically, the vertical space between all such TECF horizontal flow paths (i.e., the combination of naturally occurring permeable aquifers and the propped-frac-created permeable zones) may range from about 30 feet to 70 feet. This 30-foot to 70-foot vertical space between such TECF flow paths will then be retorted by the heat flow by thermal conductivity from the high temperature TECF flow paths into the adjacent lower temperature, not yet retorted, oil shale rocks. This cross-formational heat flow out of the TECF flow paths results in the gradual decrease of temperature along the flow path of the TECF. Whereas the temperature of the TECF flowing from the injection wells may be about 1,100° F. or 1,200° F., the TECF heat loss along the flow path may result in cooling the TECF to about 600° F. or 800° F. at the production wells.

On a typical installation, if the space between adjacent wells in both the injection well line and the production well line is about 330 feet and the space between the injection well line and production well line is about ½ mile (i.e., 2,640 feet), then the TECF flow aquifer surface area for outward heat flow will be about 2,640 feet×330 feet×2 wings×2 surfaces or about 3,500,000 square feet per each injection well. It is this large 3,500,000 square foot surface area of TECF flow path per injection well available for heat flow by thermal conductivity into the adjacent retortable oil shale rocks that provides for large enough production rates needed for commercial production operations. In other typical examples, the space between wells in each line and also the distance between injection well lines and production well lines may be increased, resulting in even larger square feet of TECF surface area per each injection well and consequent larger production rates and larger TECF injection rates per each well.

Process for Using Parallel Horizontal Well Bores for TECF Injection and Product

By using long horizontal well bores for both injection and production wells instead of the previously described vertical well bores, the spacing between the well-bore lines on authorized road/pipeline rights-of-way may be increased from about ½ mile up to 1 mile or possibly up to 2 miles. For example, these well bores may be drilled from drill sites spaced about 660 feet (i.e., ⅛$^{th}$ mile) apart along a road/pipeline right-of-way. Alternatingly, every second drill site in the line is an injection well and each in-between drill site is a production well. At each drill site location, a 16"-diameter vertical well bore is drilled to a depth of about 300 feet above the zone targeted for in-situ retorting development. Then a 13⅜" O.D. surface casing is set to this depth and cemented back to the surface. Subsequently, a 12⅝"-diameter hole is drilled out from under this 13⅜" O.D. casing. This **12¼"-*diameter*** hole is directionally drilled along a 300-foot turning radius until it reaches horizontal at depth of the targeted zone and then is drilled horizontally for about ½ mile to 1 mile within this retortable targeted zone. This horizontal well bore may be operated as an open-hole completion, if the well-bore walls are mechanically stable. If the formation is mechanically unstable, then a perforated or slotted liner may be inserted for protection against hole collapse.

In the oil shale retorting operation, the TECF is injected through each horizontal injection well at a temperature of about 1,100° F. to 1,200° F. and at a pressure about equal to original virgin pressure of the formation water in the aquifer at that location. This injected TECF will then flow out from the horizontal injection well bore toward the two adjacent near parallel horizontal production well bores located about 660 feet away from and on opposite sides of the injection well bore. The hot TECF will retort, crack, and refine the shale oil retorted from the kerogen within this aquifer. Consequently, there will be a heat flow by thermal conductivity from the surface area of this heated aquifer out into the adjacent unretorted oil-shale rocks to cause their pyrolization/retorting.

The surface area of thermal conductivity, heat losses from this aquifer heated by the hot TECF injected through each injection well bore will be the length of the horizontal well bore (about ½ mile to 1 mile) times the width (i.e., 2×660 feet) between the two adjacent horizontal production well bores, times the two aquifer surfaces (i.e., top and bottom surfaces of the aquifer). This heat-loss aquifer surface area will be about 7,000,000 square feet per horizontal injection well bore of ½ mile length or about 14,000,000 square feet per horizontal injection well bore of 1 mile length. Consequently, this thermal-conductivity heat-loss surface area of the TECF heated aquifer is about 2,000 to 5,000 times the heat-loss surface area of a 1,000-foot-long, heated well-bore wall as used in some in-situ retorting processes. This very large thermal-conductivity, heat-loss surface area provides the means to inject very large volume rates of thermal energy per each TECF injection well and thereby achieve large economic production rates of retorted/cracked/refined shale-oil products.

By using these horizontal injection and production well bores, ranging from ½ mile to 1 mile length, the operator will be able to retort/crack/refine the shale oil from all of the oil-shale rocks between such nearly parallel road/pipeline rights-of-way spaced from 1 mile to 2 miles apart. This will provide a minimum of surface environmental disturbance for this economic production of high value, in-situ, cracked/refined, shale-oil products derived from these in-situ TECF heated aquifer hydrodynamic flow paths.

If a multiplicity of thin, natural aquifers occurs at relatively close vertical spacing of only about 10 or 20 feet apart, they may be collectively treated as a single, complex aquifer for well completion and TECF injection purposes. The resulting hydrodynamic TECF flow pattern may be complex with substantial interfingering of fluids and by-passed zones. However, the thermal conductivity heat flow pattern will cause heat flow across the by-passed zones, resulting in a thermal front advancing much more uniformly than the fluid flow fronts. Such complex fluid flow patterns, modified by the subsequent heat flow patterns, may achieve effective and economic retorting/cracking/refining of the shale oil from the oil-shale rocks to achieve economic production.

To achieve TECF fluid flow injection into a complex multiplicity of these thin aquifers from horizontal well bores, a rocket fuel fracture technology, such as that described in U.S. Pat. No. 5,295,545, may be used to simultaneously create both a horizontal fracture growth perpendicular to the vertical least principle stress vector and also a vertical fracture perpendicular to the intermediate stress vector (i.e., a horizontal stress vector) and possibly some other directional fractures. This combination of fracture planes would provide hydrodynamic flow communication cross-formationally from the horizontal well bore to several of the multiplicity of narrow horizontal permeable aquifers. To prevent these cross-formational fractures from being plugged by thermal expansion of adjacent rock and by plastic flow of heated kerogen, these fractures may be propped open by a coarse frac proppant, such as 12-20 mesh frac sand. Then, each such horizontal well bore will be able to inject into or produce TECF with product flow from each of the several frac connected narrow aquifers in the multiple aquifer zone.

If relatively thick zones of very low permeability oil-shale rocks (i.e., probably exceeding 70 feet in thickness) with no significant permeable aquifers, then a heavily propped horizontal hydraulic fracture can be created to serve as a TECF flow aquifer by the same process as previously described for similar use from vertically drilled well bores. However, a rocket fuel fracturing technique, such as described in U.S. Pat. No. 5,295,545, may be used in the production well bore to provide an effective hydrodynamic flow and hydraulic fracturing growth path from a nearby portion of the major horizontal hydraulic fracture growing outward from the injection well to the nearby horizontal production well. Then the technique previously described for propping such hydraulic fracture from the screen-off in the production well to the enlarging area of proppant pack fracture back to the frac fluid injection well can be used.

Ground Water Pollution Protection by Hydrodynamic Perimeter Ridges and Caprocks

To prevent in-situ retorted hydrocarbon products from detrimentally contaminating the regional ground waters and the river waters draining therefrom, the oil shale in-situ retorted zones are controllably operated as a regional groundwater hydrodynamic sink surrounded by a protective hydrodynamic ridge and covered by a multi-layered protective hydrodynamic cap rock. As an example, if a unitized in-situ retorting area of 130 square miles (i.e., 83,200 acres) is established in the Piceance Basin of Rio Blanco County, Colorado, as the initial, in-situ, unitized, development area, it would be surrounded by a protective hydrodynamic ridge about 1 mile wide covering an area of about 56 square miles (i.e., 35,840 acres). Consequently the protective hydrodynamic barrier of 35,840 acres represents about 30% of the total unit development area and the effective in-situ retorting area of 83,200 acres represents about 70% of the total unit development area. If this unitized in-situ retorting area is expanded to the full primary in-situ retorting producing area in Rio Blanco County, Colorado, of about 335,000 acres, then the effective in-situ retorting area will be about 80% and the protective hydrodynamic barrier area is about 20% of the total unit operational area.

The hydrodynamic flow of groundwater in any aquifer is controlled by the slope of the potentiometric surface from that aquifer. The potentiometric surface elevation at any location in the aquifer is the height above sea level to which water would rise in a well bore completed for production in that aquifer. A hydrodynamic sump area is an area in the aquifer wherein the potentiometric surface slopes inward from all directions toward an area where water is being removed by some mechanism, such as production of water/steam, retorted liquids, and/or vapors, resulting in a depression of the potentiometric surface. In typical examples of this hydrodynamic sump created for environmental protection using this invention, the potentiometric surface depression may be about 200 feet to 500 feet below the regional potentiometric surface. For further environmental protection against hydrocarbon contamination migration in the surrounding groundwater, a hydrodynamic flow barrier, consisting of a potentiometric ridge of about 100 to 300 feet above the pre-existing regional potentiometric surface may be created by water injection all along the perimeter of the production sump. The linear velocity of water flow down the potentiometric surface slope in each aquifer zone from the hydrodynamic barrier into the sump area should be greater than the hydrocarbon contamination molecular diffusion rate in the water.

The retorting hydrodynamic sump area is covered by a multi-layered protective hydrodynamic cap rock created by water injection into both the naturally occurring aquifers and/or the propped-frac created aquifers. The fluid flow leakage along pre-existing vertical fractures through the cap rock zone are substantially reduced by the herein previously described injection of steam or other hot TECF into the fractures. This steam or hot TECF flow into the fractures results in the adjacent rock expanding by thermal expansion to narrow the fracture width. Also, the plastic flowage of the heat softened kerogen into the fractures may achieve substantial plugging of the fractures.

The retorting hydrodynamic sump zones below this hydrodynamic cap rock may have a depressed potentiometric surface about 200 feet to 500 feet below the normal pre-existing regional potentiometric surfaces in the cap-rock aquifers. For further environmental protection against possible leakage of any hydrocarbon contaminants into the groundwater of the aquifers above the cap rock, additional pressurized water can be injected into some of the cap-rock aquifers. Typically, this water injection is designed to increase the potentiometric surface elevation of these cap-rock aquifers to about 100 to 300 feet above the pre-existing normal regional potentiometric surface elevation of the water in these cap-rock aquifers. Consequently, essentially no water soluble hydrocarbon contaminants will be able to leak through this hydrodynamically controlled cap rock covering the potentiometric surface sump area of the in-situ retorting operation using this invention.

Example 7

Increasing Thermal Conductivity of FBH Formations by Pyrolytic Carbon Deposition This example illustrates the coordinated benefits of formation heating and pyrolytic carbon deposition that may be achieved using the methods of this invention.

After a pyrolization front has moved some distance (e.g. about 10 to 15 ft) away from the hydraulic frac or naturally permeable aquifer, the operator may elect to increase the temperature of the frac-injected TECF, to a higher temperature, ultimately possibly up to about 1,100° F. to 1,300° F. This higher temperature can increase the average temperature gradient by a factor of 2 or 3 times. This provides for immediate increased production of retorted/pyrolyzed fluids. It also provides an important long-term benefit by causing the deposition of crystallized carbon in the rock pore spaces of the formation. These crystallized carbon deposits significantly increase the thermal conductivity of FBHF rocks, allowing even more rapid subsequent heating and thermal transfer. These deposits arise from the typically unwanted residuals encountered during high temperature thermal cracking of hydrocarbon vapors.

The carbon created by thermal cracking of entrained organic matter, at progressively higher temperatures along the fluid-flow paths in these rocks, will precipitate as solid, carbon crystals of varying crystallographic geometries which adhere to the pore-space walls. These crystallized-carbon particles have much higher thermal conductivity and electrical conductivity. Probably a wide variety of crystallographic geometries of carbon may be precipitated including some in a graphite-crystal lattice and others in a buckminsterfullerene crystal lattice (i.e., both buckeyballs and buckeytube fibers), plus other geometries. The coating of these carbon, crystallographic, solid precipitates on the walls of the rock pore spaces will substantially increase the overall thermal conductivity of the oil-shale rocks from its original value of K=1 Btu/hr/ft$^2$/1° F./ft up to values of K=2, 3, 5, 7, 10, or higher.

The enhanced thermal conductivity, created by this invention at any specific location, appears to increase with (1) temperature of thermal cracking, (2) residence time of fluid flow at the higher, thermal-cracking temperatures, (3) accumulative volume of carbon precipitated from thermal cracking, (4) increasing temperature and residence time of the precipitated-carbon deposits resulting in progressive recrystallization as this process continues.

Ahead of the advancing retort front, portions of the pore space in the oil shale are filled with immobile kerogen, resulting in comparatively low permeability of these rocks. Behind the advancing retort front, the pyrolysis has converted the solid kerogen to mobile liquid and vapor fluid, resulting in significantly increased rock permeability. The pyrolysis conversion of solid kerogen to liquid and gaseous-vapor fluids results in a substantial increase in fluid volume which greatly increases the fluid pressure creating a pressure gradient from the pyrolization front toward the vented, hydraulic fracture or natural permeable aquifer through which these fluids are produced and ultimately recovered at the surface.

The direction of thermal-conductivity heat flow will be from the high-temperature (1,000° F. to 1,200° F.), propped, hydraulic fractures or natural aquifer toward the moderate-temperature (450° F. to 650° F.) pyrolization front without regard to the fluid-flow pressure gradient. Conversely, the pyrolized-product fluid flow will always be in the direction of the fluid-pressure gradient from the pressurized pyrolization front (i.e., where major, organic, fluid volume increases are created) toward the fluid-producing, lower-pressured, hydraulic fracture or natural aquifer, without regard to the direction of heat-flow temperature gradient. In this configuration, the volatilized-product fluid flow along the fluid-pressure gradient is directly opposite to the direction of the thermal-conductivity heat flow along the temperature gradient.

As the volatile-product fluids flow from the moderate-temperature pyrolization front (i.e., about 450° F. to 650° F.) along a flow path of increasing temperature, endothermic (i.e., heat absorbing) thermal cracking will occur, resulting in further increases in product flow volume. Along this product flow path, additional carbon, created by the thermal cracking, will be forming and growing additional, crystallized-carbon structures, adhering to the pore-space walls, thereby creating increased thermal conductivity.

The highest thermal conductivity will be where the greatest volume of crystallized carbon is deposited with the highest temperature and the longest residence time and where the best thermal-conductivity, carbon-crystal-geometry has been developed. This highest thermal conductivity (i.e., K=2, 3, 5, 7, 10, etc.) will be located near the high-temperature (i.e., 1,000° F. to 1,200° F.) walls of the hydraulic fracture or natural aquifer.

The lowest thermal conductivity (i.e., K=0.6 to 0.8) will generally be located just behind the pyrolysis front where liquid and gaseous hydrocarbons fill the pore spaces, and the crystallized carbon from thermal cracking has not yet been created and deposited. Ahead of the pyrolysis front, the normal oil-shale, thermal conductivity of about K=1 will prevail.

When the pyrolization front progresses to a distance of about 25 ft downward from one high-temperature, hydraulic fracture and another pyrolization front progresses upward about 25 ft from the next lower, hydraulic fracture in the vertically stacked multiplicity of horizontal, hydraulic fractures, then these two pyrolization fronts come together, resulting in depletion of the pyrolyzable kerogen within that portion of the oil-shale reservoir. Additional portions of the oil-shale reservoir are developed at such a rate as needed to replace the production from the portions of the reservoir being depleted, plus the increase of production rate desired by the operator.

Ultimately, the crystallized carbon, deposited on the pore-space walls may be converted to CO and $CO_2$, plus $H_2$, by injection of high-temperature steam into the retorted rocks. Finally, the residual heat energy stored in the rock can be recovered by injection of cold water which is converted to steam to drive steam-turbine electric generators or other energy recovery processes.

Example 8

Retorting of a Piceance Basin Oil Shale Formation Using Horizontal Well Bores In previous examples, the development and retorting of Eureka Creek B-Groove oil shale zone used vertical well bores. In this example, well bores are drilled horizontally through the permeable zone prior to initiating retort operations. Horizontal well drilling has become well established in the drilling and petroleum field development art. As used here, the term refers to a series of horizontal wells drilled through a formation of interest after first reaching the target by way of a vertical or near-vertical well bore. In the methods of this invention, horizontal well bores allow for a much higher rate of injecting thermal energy carrier fluid into a fixed-bed hydrocarbon formation.

In this example, horizontal wells are used to increase rate of super-heated steam injection or other TECF injection into the B-groove oil shale zone described above. To develop the horizontal retorting configuration in the "B-groove" permeable zone in the Eureka Creek project, a vertical well is drilled to a depth of about 500 ft and then deviated in a 300-ft radius curve to become horizontal at a depth of about 800-ft depth near the middle of this "B-groove," permeable zone. The drilling of this well can be continued horizontally within the "B-groove" for a distance of ¼ mile, ½ mile, or possible 1 mile, or more. The TECF is injected into the formation along the length of such horizontal well bore and into the permeable-oil-shale zone. In so doing, it is possible to inject thermal energy at a higher rate and into a larger cross-section of the formation than is practical using a vertical well bore penetrating the comparatively short thickness of such zone.

Example 9

Other Preferred Fixed-Bed Carbonaceous Resources Suitable for Development Using the Methods and Systems of this Invention Criteria and methodologies similar to those in the previous, detailed examples may be used in developing formations comprising a wide range of so-called fixed-bed carbonaceous deposits (FBCD), including but not limited to deposits comprising: oil shale; shale gas; tar sands; heavy oil; coal (including, without limitation, brown, bituminous, sub-bituminous coals); lignite; undeveloped or depleted petroleum and natural gas deposits. Generally, the systems and methods of this invention provide for the hydrodynamically-controlled, in-situ-retorting of a formation by a means comprising the injection of thermal-energy carrier fluid (TECF) into and through either natural, high-permeability aquifers, and/or frac-created aquifers. Other specific, preferred areas amenable to treatment using the methods of this invention include, but are not limited to:

a) The Tar and Oil Sands found in many parts of Alberta, Canada, with a particularly preferred area(s) comprising the Athabasca Tar/Oil-Sands;

b) Coalbed formations found in many areas of the North America that have been geologically mapped or characterized, with a particular preference for those in the Powder River formation of Northern Wyoming. Other preferred coalbed deposits include any coalbed comprising substantial quantities of coalbed methane. Particularly preferred U.S. coalbed formations comprise all Or part of any of the following resource basins: Black Warrior Basin (Northern Mississippi and Alabama), San Juan Basin (Northwestern New Mexico and Southwestern Colorado), Central Appalachian Basin (Western Pennsylvania, West Virginia, New York; Eastern Kentucky, Ohio, Tennessee, etc), Uinta Basin (Central Utah), Raton Basin (Southern Colorado and Northern New Mexico), Piceance Basin (Western Colorado), Arkoma Basin (Eastern Oklahoma and Western Arkansas), Forest City and Cherokee Basins (Iowa, Missouri, Nebraska, Kansas, Oklahoma, etc.), Greater Green River Basin (Southwestern Wyoming), Illinois Basin (Illinois and Western Indiana);

c) The lignite-resource beds that have been geologically mapped or characterized in North America. In preferred embodiments, the methods of this invention are applied to the development of one or more lignite beds located substantially in North Dakota, and/or South Dakota, and/or Montana in the Northern U.S.

d) The North American tight gas sandstone formations that have been geologically mapped and characterized, including at least the following: Central Appalachian Basin (Western Pennsylvania, West Virginia, New York; Eastern Kentucky, Ohio, Tennessee, etc), Green River Basin (Southwest Wyoming), San Juan Basin (Southwestern Colorado and Northwestern New Mexico), Wind River Basin (Central Wyoming), Uinta Basin (Central Utah), Piceance Basin (Western Colorado), Denver Basin (Northeast Colorado), East Texas Basin (East Texas), Arkoma Basin (Eastern Oklahoma and Western Arkansas), Texas Gulf Coast region, Anadarko (Western Kansas and Oklahoma), Permian and Val Verde Basins (West Texas)

e) The North American gas shale formations that have been geologically mapped or characterized, including at least the following deposits: Devonian shale of the Appalachian Basin, Antrim shale of the Michigan Basin (Lower Penninsula of Michigan), Barnett shale of the Fort Worth Basin (Northeast Texas), Bakken shale formation (Northeastern Montana and Northwestern South Dakota), Woodford shale (Southcentral Oklahoma), Mancos shale (Northwestern New Mexico), Cane Creek shale and Green River shale (both in Western Colorado and Eastern Utah), Monterey and McClure shale (both in Southern California). Preferred gas shale formations may also comprise any gas shale formation having substantial quantities of kerogen, petroleum, heavy oil or tar, and/or shale gas.

D. Heating of Formation Using the Methods of this Invention

An important aspect of the present invention is the use of both natural and artificially induced permeability within a formation to develop an in situ heating zone. In a simple embodiment of the invention, it comprises a method in which heated TECF is provided to a permeable portion of a geological formation that contains one or more substantially immobile carbon-based materials. The flow of TECF from an injection opening to a production opening provides for contact between the TECF and the formation amd defines an area over which thermal energy is transferred from TECF to the formation. As such, the permeability of the carbon-rich and carbon-lean zones of the formation play an important role in the effective operation of the invention. For this reason, it is often important to assess the depositional layering, carbon density patterns and variable permeability present within a geological formation. Where natural permeability is lacking (e.g., within a given depositional layer), the methods of this invention provide for the introduction of permeability by way of formation fracturing, and/or other methods. The following examples and discussions provide both enabling details and operational principles that may apply to the invention in a variety of operational settings.

Example 10

Use of Formation Stratigraphic Information and Formation Permeability Features to Develop a Selected Oil Shale Formation FIG. 4 illustrates the approximate stratigraphic column of the oil-shale zone as typically occurring at locations near the center and deeper portion of the Piceance Basin (i.e., Sect. 2, T3S, R98W), a formation described in greater detail elsewhere in this invention. The zones labeled R-8, R-7, R-6, R-5, R-4, R-3, etc. are relatively rich zones containing relatively large quantities of kerogen and relatively small amounts of porous zones of "voids" (open holes) left in the rock after the soluble minerals have been dissolved by hydrodynamically flowing formation water. Consequently, these "R"-designated (i.e., "R-rated"), oil-shale zones have relatively few aquifers, and any existing aquifers are generally very thin and of relatively low permeability.

Geologically, "R-rated" zones are believed to represent geologic periods of robust growth of plants and animals that were followed by periods of large-scale death and anaerobic decomposition in a marine environment rich in the dolomitic marlstones, having little soluble (e.g. leechable) minerals. Consequently, today, these "R-rated" zones have very little permeability or ability for water flow, and are unattractive for injecting significant volumes of thermal-energy carrier fluid as used in this invention.

The zones labeled A-Groove, B-Groove, L-5, L-4, L-3, L-2, etc. are relatively lean zones containing relatively small quantities of kerogen and very large percentage amounts of precipitated minerals, both marlstone and/or soluble sodium salts (i.e., nahcolite, halite, et al). These "L-rated" zones (i.e., lean zones; L-zones) may represent geologic periods when these lacustrine waters became very saline and were chemically precipitating very large volume rates of dolomitic marlstone and soluble sodium salts (nahcolite, halite, etc.). The organic (i.e., kerogen) content of the L-zones is relatively lean in volume percent. However, the L-zones comprise significant aquifers. These aquifers are useful for the injection and flow of large volume rates of thermal-energy carrier fluids as used in this invention.

When injected into L-zone aquifers at pressures exceeding the normal, aquifer-formation-water pressure, the thermal-energy carrier fluids tend to flow outward from the injection well bore by displacing the formation water from that portion of the aquifer. Since these permeable aquifers contain very large volumes of water extending over long distances, very large volume rates of thermal-energy carrier fluid can be injected, thereby displacing this formation water outwardly at a pressure substantially similar to the normal, formation-water pressure. In using this invention, the operator may evaluate the fluid-flow characteristics of one or more aquifer encountered along a stratigraphic column or other lithologic record. This aquifer, fluid-flow data may be used to advantage in designing and/or optimizing a thermal-energy-carrier-fluid injection program for the relevant aquifer(s).

Example 11

Additional Methods for Treating Low-Permeability Formations

In the thick "R-rated" zones, thin man-made aquifers of very high permeability may be created by hydraulic fracturing of the rock at locations such as indicated by the "A-Frac" and "B-Frac" labels in the R-7 zone, as shown along the right edge of FIG. 11. These propped, horizontal, hydraulic fractures, may be created by one or more procedures described herein or by other methods known in the art. Fracturing of an R-zone will often create thin aquifers (i.e., 0.5" to several inches) of very high permeability (i.e., >1000 Darcys), extending outward-over-very large areas from each, frac-penetrating well bore. The methods of this invention provide for the injection of large volumes of thermal energy carrier fluid into these thin, high-permeability hydraulic fractures so as to provide an effective means of heating large volumes of this oil-shale rock to retorting temperatures. Such heating and retorting provides an economical means of producing of oil, gas and chemical products from a formation, even when natural permeability would otherwise limit the use of the present invention.

This example further illustrates the retorting of a low-permeability zone, and is applicable to retorting any FBCD that is adjacent to one or more high permeability zones. As such, it illustrates an important benefit provided by first heating a formation by means of thermal energy carrier fluid injection into a permeable oil shale or other FBCD deposit prior to retorting less permeable zones. This heat flow by thermal conductivity is perpendicularly away from the relatively flat, planar surface of the bedding-plane contact between the high-permeability zone and the low-permeability zone. The high-permeability zone is heated and sustained at a temperature of about 1,000° F. to 1,400° F. by the dynamic fluid flow of a thermal-energy carrier fluid through this porous, reservoir rock as previously described. Consequently, the cross-formational, thermal-conductivity flow of thermal energy will create a temperature gradient behind an advancing retort front.

This low-permeability, matrix associated with certain oil-shale and other FBCD formations will become much more permeable (i.e., possibly from 1 to 30 md) behind the advancing retort front. This retort-created, porous, moderately permeable, retorted rock then provides a flow path for the retorted liquids, vapors, and gases to flow cross-formationally along a pressure gradient from the retorting front to the adjacent, high-temperature (i.e., 1,000° F. to 1,400° F.), retorted, high-permeability zone.

The flow path for retorted liquids, vapors, and gases is from the moderate temperature (i.e., 600° F. to 800° F.) of the retort area to the progressively higher temperatures encountered along the flow path (i.e., up to 1,000° F. to 1,400° F.). One of skill will notice that the pressure-gradient-controlled, fluid-flow path is about opposite to the temperature-gradient, heat-flow direction. This retorted-product flow will undergo thermal cracking along this flow path resulting in the deposition of carbon. With increasing residence time (i.e., several weeks to several months) and increasing temperature, this carbon deposited on the pore-space walls may undergo a metamorphosis change into some of the high thermal conductivity forms of carbon crystals such as graphite, and other carbon structures (i.e., buckeyballs, buckeytubes, buckminsterfullerenes, carbon fibers, carbon tubes), etc. Consequently, the thermal conductivity of this oil-shale rock may increase from about one for the unretorted oil shale to about two to four in the 800° F. to 1,100° F. zone just behind the advancing retorting zone. At 1,200° F. to 1,400° F. temperatures with a longer (i.e., several months) residence time at a greater distance from the active retorting zone, the enhanced thermal conductivity may increase up to about four to eight times the conductivity of the unretorted oil shale.

By this means, the low-permeability zones of 10, 20, 30, 40, 60 or 80-ft thickness, or more, can be retorted on an economic basis using the cross-formational, thermal-conductivity heat flow from the large surface areas bounding the multiplicity of high-permeability zones which have been retorted and heated to high temperatures by the injection flow of large volumes of thermal-energy carrier fluids at high temperatures (i.e., 1,000° F. to 1,400° F.).

This retorting of an adjacent, impermeable zone(s) provides for a substantial increase in production volume but also results in a substantial loss of thermal energy from the TECF flowing through the operationally-affiliated permeable zone(s). Generally, this will reduce the rate of advance of the retorting front through the affiliated permeable zone(s). However, the productivity of thermal-energy injection may be about the same regardless of whether the thermal energy is directed into the retort front that is advancing away from the well bore through the high-permeability zone or directed by the cross-formational, thermal-conductivity heat loss into one or more adjacent, low-permeability, oil-shale or other FBCD zones.

In areas or zones where the thick, oil-shale section is almost all of very low permeability (i.e., impermeable), then the operator may elect to use large, aerial extent, shallow-depth (i.e., less than 2,500-ft depth), horizontal, hydraulic fractures to create horizontal or bedding-plane, hydraulic-fracture paths for flow of high temperature, thermal-energy carrier fluid. In one example, a 200-ft-thick gross interval is completed for injection/production from a simple, isolated well bore using 10 high-volume-rate, horizontal, hydraulic fractures completed with 12 to 20-mesh, 1000 and propping agent. In this example, the fracs are spaced at intervals of about 20 ft. A high-temperature, TECF comprising superheated TECF is pressure injected and allowed to flow out through each frac to a radius of about 500 ft. At this point, the frac surface area for cross-formational, thermal-conduction heat flow from the fractures into adjacent impermeable rock is about 15,000,000 sq ft. In this example, the cross-formational, thermal-conduction flow of heat causes the retorting front to advance about 1/10 inch per day into these impermeable zones adjacent to the frac. When the well bore pressures are reduced, the retorted fluids are produced through the injection/production well bore. At this point, under ideal operating conditions, the approximate volume of rock being retorted by the heat lost through the 10 horizontal fractions is about 125,000 $ft^3$/d, or about 8,775 tons/d. If these zones contain an average of 25 gal/ton of retortable kerogen or other FBCD, this volume of retorted rock may, on average, yield a hydrocarbon production volume of about 5,000 bbls/d, The cross-formational, thermal-conductivity heat flow into these low-permeability rocks, and the retorted products therefrom, will be substantially the same whether the heat flow is coming from the surface contact area of the hydraulic fracture with this low-permeability zone or coming from the heated-and-retorted, high-permeability-zone, surface-contact area with this low-permeability zone.

In the low permeability, Nahcolite-salt and oil-shale zones, these large, bedding-plane hydraulic fractures provide a means for either:

(a) dissolving (i.e. solution mining) the Nahcolite salt out of the adjacent, oil-shale pore spaces by water circulation to create a high permeability zone adjacent to the hydraulic-fracture plane for use as a permeable conduit for retorting the oil shale as previously described in this invention, or (b) simultaneously retort the oil shale and the Nahcolite salt crystals by the cross-formational heat flow of thermal conductivity from the 1,000° F. to 1,400° F., thermal-energy carrier fluid flowing through the hydraulic fracture or into and out of the hydraulic fracture from an injection/production well bore.

When simultaneously retorting both an oil-shale kerogen and the Nahcolite-salt crystals, the Nahcolite ($NaHCO_3$) decomposes into sodium hydroxide (NaOH), plus $CO_2$, at relatively low temperatures. Then, at moderate temperature, the sodium hydroxide (NaOH) melts into a liquid, and at higher temperature, it may vaporize. The NaOH liquid and/or vapors can then be produced along with the oil-shale, retorted, hydrocarbon liquids, vapors, and gases through the hydraulic fractures and up to the surface through the producing wells. Upon cooling in the distillation column, the NaOH liquids and crystallized solids can separate from the hydrocarbon products to be marketed as a separate by-product of value.

In a similar manner, a mineral in the oil shale called Dawsonite ($NaAl(OH)_2CO_3$) (or $Na_3Al(CO_3)_3.2Al(OH)_3$) may undergo partial decomposition into liquid and/or vapor fractions in the 1,000° F. to 1,400° F.-temperature, cross-formational heat flow. These Dawsonite, thermal-decomposition products may be recovered through the hydraulic fractures along with the oil-shale-retorted, hydrocarbon liquids, vapors, and gases. This recovery of Dawsonite decomposition products, containing aluminum, may provide additional by-products of value.

Example 12

Methods for Measuring and Enhancing Permeability of FBCD Formations (e.g. FBHF)

a) Naturally occurring, moderate-to-high-permeability, porous or fractured aquifer zones in an oil shale section and their aerial extent can be identified by mapping such aquifers' natural, potentiometric, surface gradients, and/or hydrodynamic pressure transients injected into such aquifers. When an aquifer with desired, high, natural permeability over a large area has been identified and selected for injection of high-volume rates of TECF, then one or more injection wells can be drilled and completed in a manner to create a high-injectivity capacity from such well bores into such completed aquifers. If desired, the injectivity capacity can be increased by any reservoir-completion technology, including but not limited to, creating hydraulic fractures, explosive fractures, rocket-fuel fractures, any or all of which may be filled with proppant material(s). Also, one or more production wells can be drilled and completed with appropriate reservoir stimulation for high-productivity capacity from such selected aquifers.

Hydrodynamic, fluid-flow mapping and analysis can be used to establish the fluid flow paths between one or more injection wells and one or more production wells to provide the distribution of the high-temperature, thermal energy carrier fluid over a large aerial extent, which may range from about tens of thousands of square feet to about hundreds of thousands of square feet and, optimally, to about several million square feet.

The thermal energy carrier fluids injected-into and flowing through such a selected, permeable aquifer will retort both:

i. The kerogen present within the permeable aquifer's pore spaces as the moderate-to-high temperature retorting front of the thermal energy carrier fluid passes through the aquifer's pore space containing such unretorted kerogen; and ii. The kerogen present in low-permeability, oil shale rock(s), adjacent to the high-temperature rock of this permeable aquifer, by the heat loss or heat transfer from the permeable aquifer's hot rocks to the non-retorted, adjacent, low-permeability, oil shale rocks by means of the rock's thermal conductivity. Although the thermal-conductivity heat flow per square foot of contact area, between the retorted aquifer's hot rocks and the adjacent, non-retorted, low permeability rocks, is very low, the cumulative, heat-flow volume from the retorted aquifer area to the non-retorted adjacent rocks becomes quite substantial when the contact area between the two is increased to several hundred-thousands to several million square feet. The significance of this cross-formational, thermal-conductivity heat flow from the large (i.e., about 100,000 to about 5,000,000 sq ft) contact area between the hot-rock retorted aquifer to the adjacent, unretorted, low-permeability, oil shale rocks is illustrated by typical, field-operational examples described herein. These are given by way of illustration only, and not intended to limit the scope or utility of the present invention. Many other embodiments will be apparent to one of skill in the art.

(b) In those stratigraphic portions of the oil shale formation where little or no suitable permeable aquifer exists for high-volume-rate TECF over a broad aerial extent, one or more horizontal (or bedding plane, or near-bedding plane) hydraulic fractures may be created and propped open. In one example, high-permeability, large-grain-size, proppant granules are used to maintain the fracture in an open configuration. By way of example, hydraulic fractures applicable to the present invention may be created at vertical spacing intervals of about 15 ft to about 100 ft. Preferably, the hydraulic fractures are created at spacing intervals of about 20 ft to about 80 ft; and more preferably, about 30 ft to about 60 ft. These propped hydraulic fractures create substantial permeability allowing the formation to sustain high rates of injection of thermal energy carrier fluids into each such propped hydraulic fracture.

One or more thermal energy carrier fluids may be injected into the specially designed, operator-installed fractures using methods described elsewhere herein. Following injection, the contact area between a high-temperature TECF, flowing through the propped fractures, and the adjacent, unretorted, low-permeability rock(s) may range, for example, from about a hundred thousand (or a few hundred thousand) square feet to about several million square feet. Consequently, these frac-injected, selected thermal energy carrier fluids may deliver very large-volume rates of thermal energy to the formation through the hydraulic fractures covering large areas. The thermal energy may elicit retorting and/or pyrolysis within a formation by means of direct contact with one or more carbonaceous materials or by indirect transference (e.g. by thermal conductivity) across the very large contact area (i.e., 100,000 sq ft to 5,000,000 sq ft) between the high-temperature, propped, hydraulic-frac and the one or more adjacent, unretorted, low-permeability, formation rock(s) containing one or more substantially immobile carbonaceous material (e. such as oil shale or other FBCD).

The significance of thermal-conductivity based heat flow is described in other examples contained herein. Moreover, numerous formation fracturing and propping techniques are known in the art. One field-typical example of a method used for creating propped, horizontal, hydraulic fracture patterns comprises:

Drilling a sequence of 2,000 ft long, parallel, horizontal well bores, as alternating injection and production well bores at a spacing of 330 ft, at a depth sufficient to allow direct contact with an oil shale zone that is to be retorted;

Using the rocket-fuel-fracturing technique, disclosed and claimed under the U.S. Pat. No. 5,295,545 (which is incorporated in its entirety herein by reference), and/or variations of or improvements thereto, one may create a plurality of rocket-fuel-induced, short, multi-directional fractures along the horizontal length of each injection well bore. Typically, these are created sequentially. Optionally, one may repeat the fracturing process along a plurality of production well bores present in a treatment area. In certain preferred embodiments each production well bore in a selected portion of a formation is treated using the methods of this example. Typically, fracturing is accomplished by placing a sequence of about 10 ft long, rocket-fuel generators, separated by about 10 ft long spacers along each such horizontal, producing well bore, or engineered design variations thereof. Generally, upon sequential ignition of these spaced, rocket-fuel generators, fractures are created to propagate primarily in a direction perpendicular to a short-duration, compressional, least-principal stress vector provided to the formation as a result of firing one or more rocket-fuel generators. Secondarily, the fracture may propagate in a direction perpendicular thereto. In a typical FBCD formation, frac-created rubble and rock displacement provide for transient, narrowly spaced, self-propping of the induced, compressional-stress fractures. These initially short, rocket-fuel-induced fractures may be designed to extend multi-directionally, for about up to 10 ft, 20 ft, or 30 ft, or more from their source in the horizontal well bore(s) designated for production.

Providing a nearly horizontal, hydraulic fracture, extending from one or more nearly horizontal injection well so as to intersect (e.g establish fluid communication) with some of the rocket-fuel fractures extending out from one or more of the adjacent production wells. Preferably each horizontal injection well is connected with one or more such hydraulic fractures. In an embodiment, a hydraulic fracture is created or extended by injecting frac-pad, gelled water into such selected injection well at sufficient pressure to exceed the rock fracture breakdown pressure (i.e., equal to or exceeding the rock-overburden-weight's geostatic pressure of about 1 psi/ft of depth) while allowing water to flow to the surface out of one or more adjacent, rocket-fuel fractured producing wells at normal hydraulic pressure. Likewise, water may fill the rocket-fuel fractures surrounding each adjacent, horizontal production well, providing for a return of the frac-pad water up the one or more production wells, to the surface.

After achieving this desired circulation down the injection well(s) and up the adjacent production well(s) at sufficient volume rate and accumulated volume to assure the extension of this hydraulic fracture along the full, horizontal length of these wells, then a selected frac-proppant slurry can be pumped down the injection well to pack this hydraulic fracture with the frac proppant. In an embodiment, the proppant in this slurry is pumped through one or more injection well until a portion of it reaches one or more production well. This may be accomplished by keeping the bottom hole pressure in the horizontal production well at nearly geostatic pressure (i.e., about 0.9 to 1.1 psi/ft of depth). At such a pressure, the slurry may flow down the injection well and into the horizontal fracture held open by hydraulic pressure. A proppant-screen-out process may be achieved by a mechanical wire mesh screen in the producing well that provides for the packing of one or more wide-open horizontal hydraulic fractures with a thick layer of proppant. This hydraulic-fracture proppant pack may also be created by the collapsed, narrow, rocket-fuel fractures, surrounding the production well(s). This proppant pack will grow from the production well screen out area and progress backward toward the injection well until the total hydraulic fracture is propped open with this screened-out proppant.

In this method, the casing-liner screen should have wire mesh openings somewhat less than the smaller grain size of the frac proppant.

In this example, proppant having a mesh ranging from 12 to 20 (i.e. >1000 darcy) are preferred, although many size mesh may be advantageously applied The proppant mesh size may typically be about 12 to 20 mesh, or larger. Alternatively, the proppant may be about 8 to 12 mesh. Preferably, proppant exhibits a permeability of about 1000 darcies or higher.

c) Frac-assisted Retorting of FBDC in Low-Permeabilty Formations

In an example, a method substantially similar to that disclosed in U.S. Pat. No. 6,929,066 may be used to extend one or more hydraulic fractures along and/or between adjacent well bores each of which may contain a friction-fluid-loss permeable annulus. In short, these methods provide for outward and upward growth of a hydraulic fracture along a well bore sandpacked annulus. The invention is incorporated herein by reference, for all purposes.

The methods of this invention provide for significantly different frac-growth patterns as a function of formation depth. In this example, the following features provide for distinct hydraulic fracture characteristics at different depth:

i. From 0 to about 2,500 ft, the vertical stress normally is the least principal stress in the natural-stress field,
ii. From about 2,500 ft to about 3,500 ft, the vertical stress field may be the least, or the intermediate, or the greatest principal stress in the natural stress field,
iii. From about 3,500 ft to greater depths, the vertical stress normally is not the least principal stress in the natural stress field.

At shallow depths, ranging from 0 to about 2,500 ft, the vertical stress field is normally the least principal stress in the earth's natural stress field resulting in the hydraulic-frac growth being preferentially and controllably directed in a horizontal plane. For example, a well bore drilled horizontally in this shallow-depth range and equipped with a permeable annulus, probably an annulus sand pack, to provide a controllably moveable, cylindrical stress field, can generate a horizontal hydraulic fracture for the length of the well-bore-annulus sand pack and extending sidewise out from such a well bore for substantial distances.

Such a large, horizontal frac, from a horizontal well bore extending several thousand feet in well bore length by several hundred feet in width, provides an extremely large surface area to achieve either increased production from, or fluid injection into, a moderate-permeability, or low-permeability, reservoir-rock formation. Furthermore, a multiplicity of vertically stacked horizontal wells, each with a sand-packed, permeable annulus, can be drilled with a vertical spacing ranging from a few tens-of-feet to a few hundred feet (i.e., possibly 50-ft to 100-ft vertical spacing). Then, such a large horizontal frac can be created for the length of each such sand-packed, permeable, well-bore annulus and extending out horizontally for a distance of several hundred feet from each such well bore to provide greatly increased reservoir drainage or fluid-injection capability.

In some applications, it is desirable to create a high-fluid-transmissibility, propped, hydraulic fracture extending continuously from one horizontal well bore to another, parallel, horizontal well bore with a spacing of several hundred feet between these two parallel, horizontal wells. For example, high-temperature steam, combustion gases, or other hot TECF fluids may be injected to flow through such a high-transmissibility, propped, hydraulic fracture from a horizontal-injection well bore to a parallel, horizontal, production-well-bore. Then, heat (i.e., thermal energy) will flow from the high-temperature, propped, fracture walls out into the adjacent formation so as to provide the desired, thermodynamic reaction as temperature is increased by the induced heat flow.

By way of example, a multiplicity of such large, propped, horizontal fractures, extending from hot-fluid-injection, horizontal well bores to parallel-horizontal, production well bores, can be created at a desired, predetermined, vertical spacing (i.e., possibly, 50 ft). Then, high-temperature steam, combustion gases, or other hot TECF fluids can be caused to flow along each of the vertically stacked, propped, horizontal fractures thereby heating the rock formation adjacent to each such fracture. Consequently, thermal energy (i.e., heat) will flow away from each such high-temperature fracture and toward the cooler rock in the center of the space (i.e., possibly, 50±ft) between such adjacent, parallel, horizontal fractures. This thermal energy can then pyrolize, or thermally alter, the kerogen, coal, asphalt, heavy oil, or other carbonaceous matter, contained in the pore spaces of a formation between such high-temperature, adjacent, and approximately parallel and horizontal fractures.

The methods of this example may be adapted to effectively and economically accomplish the in-situ retorting, and/or pyroliysis of many carbonaceous materials found in geological formations. In preferred embodiments, the direction of heat flow (i.e., thermal energy) is from the high-temperature, propped, fracture walls toward the cooler center of the formation interval between such high-temperature, fracture walls. The mass flow of volatile and/or liquid products produced by the in-situ retorting, or pyrolization of kerogen, or other carbonaceous matter, will be from the pyrolization fronts advancing into the inner portion of the space between frac surfaces and toward the high-temperature frac surfaces. This mass flow of volatile or liquid products is directly opposite to the direction of heat flow. Particularly preferred embodiments of this invention comprise retorting of: (1) kerogen deposits similar to those found in certain oil-shale-resource deposits (i.e., in Colorado, Utah, Wyoming, etc.), (2) the asphalt or tar residue in some of the asphalt or tar sands (i.e., Athabasca tar sands, etc.), (3) some of the heavy, oil-sand deposits, (4) some of the volatile coal and lignite deposits, (5) other rock formations containing pyrolyzable, organic material, and (6) other rock formations containing certain organic and/or inorganic material which can undergo limited pyrolysis and/or thermal cracking reactions at elevated temperatures.

In a further embodiment, it is advantageous to create a direct connection between two horizontally directed well bores. For a hydraulic-fracture, propagating horizontally outward from a horizontal-well-bore-annulus sand pack (i.e., the first well bore), to reliably make an intersection and direct connection with another parallel, horizontal well bore (i.e., the second well bore), an operator may intervene in such a way as to create a negative (i.e., reduced), cylindrical, stress field around such a second well bore so as to direct the frac growth through the negative stress field to directly intersect and connect with the second well bore. In this example, the second well bore is drilled parallel to and at the same stratigraphic or lithologic-equivalent depth as the first well bore. Such negative (i.e., reduced) stress field around the second well bore may be created by any means. In a preferred method, the negative pressure stress is created by a method comprising, pumping formation fluid out from the second well bore to draw down the pressure of the fluid in the surrounding formation.

To increase the effective radius of a formation-pressure drawdown in a reservoir rock surrounding the second well bore, an ultra-high-volume-rate, frac-fluid injection can be used to create simultaneously both a primary, horizontal frac (i.e., perpendicular to the vertical, least-principal stress), plus a secondary, vertical frac along the axis of the line-source-generated, frac-injected fluid, that coincides with the axis of the second well bore. A method such as the rocket-fuel combustion method described elsewhere herein may be suitable for providing such ultra-high-volume-rate frac-fluid injection.

When one or more horizontal, primary fracs, and one or more well-bore-axis-oriented, vertical, secondary fracs have been created (e.g. such as in the second well, above), then the fluid can be pumped out of the second well bore to provide an enlarged, pressure-drawdown-created, negative stress field. Then the negative stress field will cause the subsequent, horizontal, hydraulic frac, growing outward from the first well bore toward the second well bore, to be deviated and caused to grow inward in the pressure-drawdown-created, negative stress field until it intersects either the second well bore or one of the then-existing, rocket-fuel-created hydraulic fractures previously generated from the second well bore. When the frac fluid flows into the annulus sand pack around the second well, the proppant will be screened out in the frac, and only the frac fluid, minus the screened-out proppant, will flow through the second-well-bore sand pack and then exit to the surface through the second well bore. In this process of the proppant being screened out by the frac fluid flowing into the second-well-bore-annulus sand pack and subsequently being screened out by frac fluid flowing through the frac proppant, accumulating in the hydraulic fracture, the hydraulic fracture is being held open to its maximum width. This fracture-propping process will continue until all of the hydraulic fracture is filled with proppant to its maximum capacity. Such fully propped, horizontal, hydraulic fracture, extending from the first horizontal well bore to the second horizontal well bore, will provide a very high-fluid-transmissibility path from the first well bore to the second well bore.

Subsequently, very large volumes of high-temperature steam, combustion gases, or other TECF fluids can be caused to flow at high rates from the first well bore to the second well bore along the high-fluid-transmissibility, fully propped, -hydraulic-fracture path. The formation walls of the fractures can thereby be heated to the high temperatures of the fluid flowing through the propped, hydraulic fracture. Consequently, a heat flow will be created by thermal conductivity from the high-temperature walls of the fracture into the adjacent, lower-temperature formation. A thermal gradient will be established vertically along the heat-flow path directed perpendicularly from the high-temperature walls of the propped, hydraulic frac and into the adjacent, lower-temperature formation both above and below the hydraulic fracture.

A multiplicity of the horizontal, hydraulic fractures can be created from a multiplicity of vertically stacked, first horizontal well bores to a multiplicity of vertically stacked, second horizontal well bores. The vertical spacing between such vertically stacked well bores may range from about 25 ft to about 150 ft, and averagely, may be about 50 ft. The horizontal spacing between such vertically stacked, first horizontal wells and such vertically stacked, second horizontal wells may range from about 300 ft to 1,000 ft, and averagely, may be about $1/8^{th}$ of a mile (i.e., about 660 ft). The length of the horizontal well bores may range from about 1,000 ft to over 10,000 ft, and averagely, may be about 1 mile (i.e., 5,280 ft).

As an example based on this average spacing, each horizontal-hydraulic-fracture segment may be about 5,280-ft long, 660-ft wide, 0.25-inch to several inches propped-frac thickness with a spacing between such vertically stacked, horizontal, hydraulic fractures of about 50 ft. If this hydraulic-fracture technology is applied to the in-situ pyrolization of oil shale, and the walls of the hydraulic fracture are heated to a temperature of about 700° F., then a pyrolization front will be formed and start to move away from the high-temperature walls of the fracture and toward the low-temperature, unretorted, interior portion of the space between these 50-ft, vertically spaced, horizontal fractures. The volatile liquid, vapor, and gaseous products, generated at and behind the advancing, pyrolization front, will flow-toward the high-temperature fracture where they will be commingled with the high-temperature steam, or other hot TECFs, and thereafter flow with such fluids along the high-transmissibility, propped fracture and toward the production well.

A thermal gradient will be established between the high-temperature walls of the hydraulic fracture (i.e., averagely about 700° F.) and the temperature required for pyrolization (i.e., about 450° F.) at the moving pyrolization front. For example, when the pyrolization front has moved to about 10 ft from the 700° F., hydraulic-fracture surface, the thermal gradient would averagely be about 25° F./ft. In this moderate-frac-temperature configuration (i.e., averagely, about 700° F.), condensable hydrocarbons (i.e., pipe-lineable, liquid products) may be dominant with a lesser amount of non-condensable gases (i.e., pipe-lineable, gaseous products) as marketable products extracted from the oil shale and other FBCD formations.

Optional Adjustments and Further Embodiments of the System

In some embodiments, the heating rate of the formation may be slowly increased through the pyrolysis temperature range. In some embodiments, the heating rate of a retort-treated (e.g. heated to temperatures of >480 degree F.) formation may remain substantially constant throughout an retorting process. In other embodiments, a rate of heating may be increased, or decreased during an in situ retorting process. In one example, an in situ retorting process applied to at least a portion of an oil shale formation is conducted by increasing an average temperature of the selected portion of the formation above about 480 degree F. by a rate less than a selected amount (e.g., about 50 degree F., 25 degree F., 10 degree F., 5 degree F., 3 degree F., 1 degree F., 0.5 degree F., or 0.1 degree F. (per day). In a further embodiment, the portion may be heated such that an average temperature of the selected segment may be less than about 700 degree F. or, in some embodiments, less than about 850 degree F. In a further embodiment, a portion may be heated such that an average temperature of the selected segment may be greater than about 850 degree F.

In preferred embodiments, the invention comprises heating one or more thermal energy carrier fluid to temperatures of at least 450 degree F. prior to, or concomitant with, injection into the formation. More preferred embodiments comprise one or more thermal energy carrier fluid(s) heated to temperatures of at least 520 degree F prior to, or concomitant with, injecting the heated fluid into the formation. Other preferred embodiments comprise one or more thermal energy carrier fluid heated to temperatures of at least 700 degree F. prior to, or concomitant with, injecting the heated fluid(s) into the formation. Other preferred embodiments comprise one or more thermal energy carrier fluid(s) heated to temperatures of at least 1000 degree F., and possibly greater than 1200 degree F., prior to, or concomitant with, injecting the heated fluid into the formation.

In an embodiment, a temperature of a portion of an actively retorting deposit may be monitored through a test well disposed in a formation. For example, the test well may be positioned in a formation between a first heat injection site and a second heat injection site. Certain systems and methods may include controlling the heating or TECF injection rate at the first thermal energy carrier injection site and/or the second thermal energy carrier fluid injection site (and, optionally, further injection sites) to raise a monitored temperature at the test well at a rate of less than about a selected amount per day. Alternatively, a monitoring well may be positioned between at least one injection well and at least one producing well. Also, a temperature of the portion may be monitored at a production well. An in situ conversion process for hydrocarbons may include controlling the heat from a first heat injection site and/or a second heat injection site to raise the monitored temperature in the formation or at the production well at a rate of less than a selected amount per day.

An embodiment of an in situ method of measuring a temperature within a well bore may include providing a pressure wave from a pressure wave source into the well bore. The well bore may include a plurality of discontinuities along a length of the well bore. The method further includes measuring a reflection signal of the pressure wave and using the reflection signal to assess at least one temperature between at least two discontinuities. Other embodiments comprise measuring temperature within a formation at one or more points located between an injection well and a producing well. The method includes measuring temperature by any direct or indirect means, including but not limited to those listed above. The method further comprises measuring temperature for the purpose of monitoring, adjusting, analyzing, assessing and/or otherwise approximating the efficacy of hydrocarbon mobilization from within a formation. The method also comprises measuring temperatures of aquifer(s), rock(s), soil and mineral(s) in sections of the formation that lay outside the one or more actively retorting and/or thermal cracking zones of the formation.

Certain embodiments may include heating a selected volume of an oil shale or other FBCD formation. Heat may be provided to the selected volume by injecting heated thermal energy carrier fluid. Under idealized circumstances, the power (defined as heating energy per day; Pwr) required to heat the selected volume of an oil shale or other FBCD formation is defined by EQN 1:

$$\text{Pwr}=h*\text{V}*\text{C.sub.}v*\text{.rho..sub.}B. \quad (1),$$

where h is the desired heating rate (in units of, for example, degrees C./day) in a selected volume (V) of an oil shale or other FBCD formation, an average heat capacity of the formation (C.sub.v) and an average bulk density of the formation (.rho..sub.B) may be estimated or determined using one or more samples taken from the oil shale formation.

Certain embodiments may include raising, lowering and/or maintaining a pressure and/or potentiometric surface(s) in an FBCD formation and/or in one or more aquifer layers with which the FBCD formation has direct contact. A formation pressure may be, for example, controlled within a range of about 30 psi absolute to about 300 psi absolute. For example, a preferred process comprises controlling at least one pressure and/or potentiomentric surface(s) within a substantial portion of a selected formation subjected to a retorting and/or other pyrolysis process. In an example, the controlled pressure and/or potentiometric surface is maintained at a level of greater than about 30 psi absolute during a pyrolysis treatment. In an alternate embodiment, an in situ conversion process for hydrocarbons may include raising and maintaining the pressure in the formation within a range of about 300 psi absolute to about 600 psi absolute. In some embodiments, hydrostatic or geostatic pressure differences (e.g. differentials)—such as between injection wells and production wells—are applied beneficially to influence or direct a flow of one or more sub-surface fluids through the formation. In preferred embodiments, at least one formation pressure differential is under the control of an operator or intelligent operating system. In preferred embodiments, an operator uses one or more pressure differentials between wells to advantage in a selected portion of a formation to enhance production of a formation fluid, and/or to conduct the flow of at least one hydrocarbon, TECF or other formation fluid to desired location(s), and/or to contain formation fluids within a selected portion of a formation. When pressure differentials are used to control material flow, a pressure difference of at least 5 psi or higher may be used to establish flow rates and/or direction. In preferred embodiments and examples, pressure differentials of greater than 5 psi, 10 psi, or 20 psi, 30 psi, 100 psi, 300 psi, 500 psi, or higher may be used to advantage to establish a rate, direction or pressure of flow of one or more formation fluids.

Treating an oil shale or other FBCD formation with a TECF may result in mobilization of hydrocarbons in the formation by any number of means. In an embodiment, the mobilization results from displacement or extraction of adsorbed material from the subterranean strata. In a preferred embodiment a displaced or extracted material may comprise adsorbed methane and/or other hydrocarbons, and may be produced from the formation. In another embodiment, the mobilization is by a method comprising pyrolysis of one or more carbonaceous materials found within the formation. In another embodiment, a method of treating a formation may include injecting a thermal energy carrier fluid into a formation, conducting the flow of the carrier fluid in the formation such that heat from the TECF is dynamically transferred to one or more selected first segment(s) of the formation. The method(s) furthermore comprises use of the heat energy to mobilize and pyrolyze at least some of the kerogen and/or other carbon-based oil shale materials found within the selected first segment of a FBCD formation. In an embodiment, the method for treating the formation comprises the production of mobile (e.g. flowable) hydrocarbons from one or more solid phase, carbon-based materials, the method comprising pyrolysis. In an embodiment, the method for treating the formation comprises the further in situ cracking, and/or pyrolysis, and/or chemical modification of mobile hydrocarbons generated within the formation. In preferred embodiments, the invention provides an in situ method for synthesizing (e.g. by decomposition of a carbonaceous material) and/or transforming hydrocarbons within a carbonaceous geological formation, the method comprising, contacting (directly or indirectly) in situ the carbonaceous geological material with heat provided by any means through an opening in the formation, subjecting a portion of the carbonaceous material in the formation to at least a plurality of pyrolytic decomposition steps that provide one or more hydrocarbons having an average carbon number of <20, and preferably, <12, and producing at least a portion of the synthesized hydrocarbon through an opening in the formation. In other preferred embodiments, at least two of the pyrolysis reactions occur at physically distinct locations within the formation. In further preferred embodiments, at least one of the pyrolysis reactions occurs in a fluid phase comprising formation fluids and/or a thermal energy carrier fluid. In a further preferred embodiment, carbonaceous materials within the formation are subjected to pyrolysis conditions, first in their substantially immobile state, and again, following mobilization (e.g. as hydrocarbons). For the purposes of this invention, a first pyrolysis reaction may be viewed as a reaction that releases a mobile (e.g. a fluid, liquid, vapor and/or other supercritical fluid) carbonaceous species from a solid-phase or otherwise substantially immobile carbonaceous material. Due to the high temperature, highly fluid in situ environment a newly released mobile carbonaceous species moves rapidly from its point of mobilization. Therefore, subsequent pyrolysis reaction(s) involving the released species is understood to occur at a location distinct from the first. Typically, a second location is considered distinct from a first location when it is separated from a first location by at least about 10 ft. Alternatively, a second location is considered from a first location when they are separated by a distance greater than the average distance a mobile hydrocarbon would move in one second under then-prevailing conditions. The latter definition is most relevant when one or more hydrocarbon residence times, flow rates, or other such dynamic parameters is monitored and/or controlled within a formation. Finally, a second pyrolysis location may be considered distinct from a first when the first and second reactions occur in distinct physical phases (e.g. solid vs. fluid; gas vs. liquid) or two fluid phases differing substantially in viscosity or mobility under formation conditions (e.g. a viscous gel vs. a low viscosity fluid). Typically, the lower viscosity phase will exhibit a mobility that is at least double the higher viscosity phase in such applications. Substantial differences in mobility and viscosity may either measured or calculated from known formation conditions and the physical characteristics of the carbonaceous deposits within the formation.

In most cases, a first pyrolysis reaction releases one or more mobile species comprised largely of carbon and hydrogen (e.g, hydrocarbon(s)) into one or more fluid phases. However, some of the species released into a fluid phase may comprise other elements. For example, carbonaceous geological deposits often contain certain quantities of sulfur, nitrogen, oxygen, and other elements. As such, molecular species comprising these elements may be generated and/or liberated by means of a first pyrolysis reaction Thermal energy sufficient to cause pyrolysis of at least one carbonaceous material within a formation may be referred to herein in as pyrolysis heat. In the systems and methods of this invention, pyrolysis heat may be delivered directly to (or, optionally, from) a carbonaceous material present in a formation by direct contact of the carbonaceous material with a TECF (e.g. within a permeable portion of the formation) at a temperature exceeding a pyrolysis temperature of one or more carbonaceous species found in the carbonaceous material. In addition, pyrolysis heat may derive from an in situ heating element.

In the methods of this invention, an in situ heating element comprises a substantially heated portion of a geological formation containing at least one selected permeable zone through which heated TECF flows, (or may flow, or has previously flowed) between at least about one injection opening and at least about one production opening. Alternatively, an in situ heating element may comprise a single injection opening with a plurality of production openings and a plurality of injection openings with a single production opening. In some cases an approximately parallel series of injection and production openings (e.g. wherein each pair used initially to create an in situ heating element) may function in concert, so as to provide the effect of a single very large in situ heating element network. In some cases, in situ heating elements may overlap one another to created super-heated zones. In most embodiments, the openings (e.g. inlet, outlet, etc.) comprise wells. Typically, the wells are introduced into the formation using conventional drilling, casing and well completion operations. In a typical embodiment, an in situ heating element provides a means of storing heat delivered to a formation by a means comprising injection of one or more TECF.

This storage may be very long-term (e.g. from months or years). The heat stored in the in situ heating element is useful for conducting physical and chemical work both underground and above-ground.

By way of example, a typical in situ heating element comprises a selected permeable zone of a geological formation that is bounded at two ends by an injection inlet and a production outlet, and generally bounded on at least one side by a portion of the selected geological formation having substantially lower permeability than the selected permeable zone. Often, the in situ heating element is bounded on at least two sides (e.g. above and below) by portions of the geological formation having substantially lower permeability than the selected permeable zone. The in situ heating element is typically supplied with heat by flowing heated thermal energy fluid through the permeable zone from an inlet to an outlet in the selected permeable zone. Heated TECF flows through the selected permeable zone so as to transfer thermal energy to one or more mineral components of the formation. Therefore, an in situ heating also typically comprises a heated TECF in the permeable zone between the inlet and outlet and lower permeability boundaries. Often, an opening in an in situ heating element may serve as either an inlet, an outlet, or interchangeably, as both. Most often the inlet and outlets comprise a well or well bore opening. Due to its volume and stability, the in situ heating elements does not require a continuous feed of energy (e.g. flow of heated TECF) to remain functional as a heating element. Moreover, its outer dimensions and/or volume tend to expand with increased injection of heated TECF due to a gradual increase in porosity or permeability of the formation that may occur near its edges. This occurs, for example, when the in situ heating element is positioned next to a lower permeability portion of the formation, the lower permeability portion containing one or more carbonaceous materials. Over time, using the methods described elsewhere herein, hydrocarbons (and, perhaps, other materials) are mobilized from the lower permeability portion, often causing an increase in its permeability. This may allow a portion of the formation not initially contained in an in situ heating element to be assimilated into a heating element. Thus, an in situ heating element is not fixed by the presence of a well casing or well bore annulus, but tends to expand or contract in response to the rate and temperature of TECF injection and production. Thermodynamic and kinetic properties of the TECF also play a substantial role in permitting or restricting release of thermal energy to (or, optionally, from) an in situ heating element. The flowing of TECF in an in situ heating element, therefore, also provides a means of conducting heat sufficient to pyrolyze or mobilize hydrocarbons within the formation. The parameters that allow an operator to adjust the heating, hydrodynamic and flow properties of a TECF flowing in an in situ heating element may also provide a means by which the operator controls hydrocarbon mobilization, pyrolysis and cracking operations across a portion of the formation that is substantially larger than the in situ heating element itself. Adjustments and controls of various systems are discussed elsewhere herein and are may apply interchangeably to an in situ heating element as well as other embodiments of the present invention.

A heating element may further be generated by a method comprising contacting and pyrolyzing at least one carbonaceous material found in the permeable zone with heated TECF (e.g. using the methods of this invention). At least a portion of an in situ heating element may exhibit a temperature above a pyrolysis temperature of at least one carbonaceous material found in the formation. In some embodiments of the invention, pyrolysis heat is delivered by transferring thermal energy from an in situ heating element.

In addition to storing thermal energy, the in situ heating element provides a means of supplying heat sufficient to mobilize hydrocarbons from other portions of a formation, In some examples, these additional portions of the formation are adjacent to (e.g. contacting) the in situ heating element. In other examples, the additional portions of the formation may be separated from the in situ heating element by some distance. In some examples, heat is transferred from the in situ heating element by thermal conductivity. In other examples, heat is transferred from the in situ heating element by fluid means (e.g. movement of one or more TECF, formation fluids, etc.).

Often, an in situ heating element is developed using certain geological information related to local depositional patterns and permeabilities. Such information is often readily available from local or national databases; public and/or university libraries; and regional or national repositories of geological records. Such records often describe permeability and depositional characteristics of a formation, as well as information related to depth, local outcroppings, aerial extent, drainage patterns, and other characteristics of a formation that are useful in the present invention. Where such records are not available, the information is readily obtainable using methods well known in the art of geology.

In a preferred embodiment, the invention comprises an in situ fluid hydrocarbon synthesis system, the system comprising: a) a permeable portion of a geological formation comprising at least one substantially immobile carbonaceous material or FBCD, b) a source of pyrolysis heat, c) a means to deliver pyrolysis heat from a first location in the formation to at least a second location in the formation, d) a means to deliver hydrocarbon fluids synthesized (e.g. via pyrolysis) at or near the second location to a third location, and/or to the first location, and e) an outlet for producing fluids from the formation. The system may further comprise establishing fluid communication between the first and second locations, and, optionally, between the second location and the third location and/or the outlet. In an embodiment of the system, the means to deliver pyrolysis heat from the first location in the formation to the second location in the formation, and, optionally, to the third location and, optionally, to the production outlet comprises a thermal energy carrier fluid. In a further embodiment, the means to deliver hydrocarbon fluids synthesized at or near the second location to the first or third locations comprises a thermal energy carrier fluid. In a particularly preferred embodiment, operational linkages between the first location, the second location, the optional third location and the outlet may be by means of one or more TECF. In a further embodiment, at least one fluid flow parameter, one heating parameter and/or one production parameter is under the control of an operator or intelligent operating system. Alterations in such parameters may be communicated to the system by any means, but preferably by a fluid means and, more preferably by a means comprising the heating, cooling, pressurization, depressurization, or the increasing or decreasing of a flow rate of a fluid flowing into, or being produced from an in situ heating element. In some embodiments, an operator or intelligent operating system modifies the output of at least one hydrocarbon by modifying a temperature, a pressure, an injection rate, or a flow rate in the system. An operator or intelligent operating system may further modify output by modifying a plurality of these, and/or other parameters.

Many variations of the system are possible within the scope of this invention. For example, the geological formation may comprise one or more of the preferred locations or formations described in this disclosure.

In an embodiment, pyrolysis heat is provided by a plurality of heat sources. In some examples, at least one pyrolysis heat source is found on the surface. In many preferred examples, at least one pyrolysis heat source is located in a well bore. An example of a well bore heat source is a downhole combustion chamber. In this, and many other examples, pyrolysis heat is provided at least in part by a combustion-device that is supplied with at least one hydrocarbon source and one oxidant (e.g. air, oxygen-enriched air, oxygen, and others). Other classes of heaters may also be used to supply pyrolysis heat.

The means to deliver pyrolysis heat may comprise-an-adjustable injection pressure, well or production well pressure. The means to deliver pyrolysis heat may comprise a device (or other means) that provides for at least one adjustable in situ pressure differential, an adjustable in situ fluid temperature, an adjustable in situ fluid flow rate, an adjustable in situ direction of fluid flow, or any combination of these.

In this system, pyrolysis heat may be delivered to a carbonaceous material by direct contact, indirect transfer, or a combination of both. In an embodiment, a heated injection fluid delivers pyrolysis heat directly from a first location in the formation to at least a second location in the formation. In an embodiment, heated injection fluid delivers pyrolysis heat directly from a first location in the formation to at least one carbonaceous material present at a second location in the formation. A heated injection fluid may further deliver pyrolysis heat indirectly from a first location in the formation to at least one carbonaceous material present at a second location in the formation. A preferred indirect means of delivery may comprise thermal conduction. A preferred means of delivering pyrolysis heat from a second location to at least a third location in the formation comprises conduction.

In certain embodiments, the means to deliver hydrocarbon fluids synthesized (e.g. via pyrolysis) at or near the second location to a third location, and/or to the first location, and/or to the surface of the formation, comprises movement of one or more formation fluids. Further, the delivery of hydrocarbon fluids may comprise movement of one or more pyrolysis products from a second location to another location (e.g. a first, third, surface location, etc. . . . ). The means to deliver fluids in these embodiments may comprise an adjustable injection pressure, well or production well pressure. The means to deliver fluids may comprise a device (or other means) that provides for at least one adjustable in situ pressure differential, an adjustable in situ fluid temperature, an adjustable in situ fluid flow rate, an adjustable in situ direction of fluid flow, or any combination of these.

In another preferred embodiment, the invention comprises an in situ fluid hydrocarbon production system, the system comprising: a) a barrier surrounding a portion of a geological formation comprising at least one substantially immobile carbonaceous material, b) a substantially permeable portion of the formation, c) a fluid inlet (e.g. to supply fluid to the formation), d) an in situ heating element, e) a means for conducting heat from in situ heating element to a substantially immobile carbonaceous material in the formation, and f) an outlet for producing fluids from the formation.

In a further embodiment, at least one injection parameter, fluid flow parameter, one heating parameter and/or one production parameter is under the control of an operator or intelligent operating system. In some embodiments, an operator or intelligent operating system modifies the output of at least one produced hydrocarbon by modifying a temperature, a pressure, an injection rate or a flow rate in the system. In some embodiments, the operator or intelligent operating system modifies the output of at least one produced hydrocarbon by modifying a plurality of such parameters. In some examples, these modifications may be communicated to the in situ system by a means comprising injection and/or production of TECF.

In an embodiment, at least one substantially immobile carbonaceous material comprises a fixed-bed carbonaceous deposit (e.g. FBCD). In a further embodiment, the FBCD comprises at least one of the following: heavy oil, tar (e.g. tar sands), bitumen, lignite, coal, liquid petroleum, natural gas, kerogen or oil shale. In most preferred embodiments, at least one substantially immobile carbonaceous material comprises oil shale and/or kerogen.

The system provides for a variety of means to conduct heat from an in situ heating element to carbonaceous materials in the formation. In an embodiment, the means of conducting heat from an in situ heating element to a substantially immobile carbonaceous material comprises a fluid. The means may further comprise the transfer of fluid by means of a pressure, pressure differential, flow rate, flow direction or similar dynamic adjustments that are under the control of an operator or intelligent operating system.

In other embodiments, the means of conducting heat from an in situ heating element to a carbonaceous material comprises thermal conduction (e.g. conductivity through a mineral matrix). In still other embodiments, the means of conducting heat from an in situ heating element comprises both a fluid and thermal conduction.

In a further embodiment, the method for treating a formation comprises in situ cracking, and/or pyrolysis, and/or modification of mobile hydrocarbons (e.g. created through a first pyrolysis reaction), in a fluid phase within the formation. In a further embodiment, the method for treating the formation comprises in situ cracking, and/or pyrolysis, and/or modification, of the mobile hydrocarbons in a fluid phase in, at, or near one or more producing well, within the formation. Often, a first pyrolysis reaction results in mobilization of at least one hydrocarbon (e.g. or hydrocarbon species) from a substantially immobile carbonaceous deposit. For some carbonaceous deposits, such as oil shale and coal, the first pyrolysis reaction may comprise retorting. A second pyrolysis reaction may enhance mobility, producibility or other physical or chemical characteristics of one or more products from a first pyrolysis reaction. In addition, a third pyrolysis reaction may further enhance or modify the products of a second pyrolysis reaction, and so forth. When the first, second, or third pyrolysis reaction occurs in a fluid phase, the pyrolysis reaction may comprise a hydrocarbon cracking reaction.

In a further embodiment, the method for treating the formation comprises the in situ cracking, and/or pyrolysis, and/or modification of mobilized hydrocarbons in a surface or sub-surface facility that is in close proximity to, and/or operationally linked to, one or more producing wells. In a further embodiment, the method for treating the formation comprises cracking, and/or pyrolysis, and/or modification of mobilized hydrocarbons in a surface or sub-surface facility that is in direct, fluid communication with one or more producing wells. In a further embodiment, the method for treating the formation comprises cracking, and/or pyrolysis, and/or modification of mobilized hydrocarbons in a surface or subsurface facility that is in semi-continuous fluid communication with one or more producing wells. In an embodiment, at least a portion of the hydrocarbons mobilized in a first location (e.g. within a formation) flow to a selected second location (e.g. in the formation), wherein at least a portion of the mobilized hydrocarbons undergo pyrolysis. Optionally, additional locations may be selected (e.g. third, fourth, fifth . . . selected locations . . . ) for subsequent hydrocarbon pyrolysis and/or cracking and/or modification chemistries. Heat supplied by thermal energy carrier fluid, or by other means, may be used beneficially to cause pyrolysis of a portion of the hydrocarbons at or near the selected second location. At least a portion of the hydrocarbons from the selected second (and, optionally, the third, fourth, fifth, . . . ) selected locations are produced from the formation. Preferably, a gas or liquid mixture may be produced from the formation. Preferably, a mixture of gas(es) and liquid(s) is produced from the formation. More preferably, a gas-phase mixture may be produced from the formation. The gas-phase mixture may comprise any combination of vapors and/or supercritical fluids. Preferably, the produced hydrocarbons comprise both saturated and unsaturated hydrocarbons. More preferably, a proportion of at least one unsaturated hydrocarbon species (e.g. one or more C2-C20 olefin, and the like) is beneficially increased or decreased by one or more in situ cracking, and/or pyrolysis, and/or modification chemistries contained herein.

A method of this invention comprises treating a formation with a heated TECF by a method comprising generating a moving TECF front having substantially continuous fluid and thermal communication with at least one TECF injection opening and at least one production opening in the formation. The area of substantially continuous fluid communication is referred to as a treated zone. The movement of a TECF front through a formation increases the size of a treated zone. The method further comprises using a treated zone to mobilize hydrocarbons in a formation, and producing the hydrocarbons from at least one opening in the formation. In preferred embodiments, the treated zone provides for mobilization of hydrocarbons at the TECF front (i.e. the edge of a treated zone). In other preferred embodiments, the treated zone provides for mobilization of hydrocarbon from a second portion of the formation (e.g. outside the treated zone). In some embodiments, the treated zone provides for mobilization of hydrocarbons from the treated zone itself. In certain preferred embodiments, mobilization of hydrocarbon occurs by means of a method comprising pyrolysis. In some embodiments, the treated zone provides pyrolysis heat to a TECF front. In some embodiments, the treated zone provides pyrolysis heat to a second portion of the formation. In a further embodiment, a treated zone may comprise an in situ heating element. Conversely, an in situ heating element, or in situ heating element network, may comprise one or more treated zones.

In a related method, the expansion of the treated zone may be slowed or terminated by a method comprising one or more of the following: a) suspending injection of a TECF through at least one injection opening in the treated zone, b) reducing the rate or temperature of TECF supplied to the treated zone through at least one injection opening, c) increasing a rate of injection of a TECF having a temperature lower than about the average temperature of the treated zone, d) increasing a rate of production of hot formation fluids from the treated zone, e) decreasing a rate of production of cooler formation fluids from at least one production opening.

Example 12

Selection and Use of a Thermal Energy-Carrier Fluid (TECF)

Although any injectable fluid capable of delivering thermal energy to (or from) a formation may serve as a TECF, the TECF exhibits a number of properties that may be important to the effective operation of this invention. Typically, the TECF comprises a liquid, vapor, and/or supercritical fluid that can be used to carry thermal energy to and from the formation. In addition, the TECF exhibits fluid properties that allow for reliable flow under formation conditions. For example, a number of physical properties may be important for establishing behavior and control of TECF flow within the formation. This includes, but is not limited to, viscosity, heat capacity, vapor pressure, heat of vaporization, boiling point, critical point, phase behavior, phase transfer properties, solvency, solubility, energy content, fuel value, water miscibility, hydrocarbon miscibility, chemical reactivity, thermal stability, polarity, and adsorption characteristics. A TECF may be selected based on either one, or a plurality of these physical and chemical properties. Where a physical or chemical property may be represented by one or more physical constants (e.g that is reflective of one or more of these properties), such constants may be used in selecting a TECF.

A TECF may be selected based on other properties as well. For example, in some embodiments, a TECF may comprise a fuel. In some examples, combustion of TECF (or components thereof) is used to generate at least a portion of the heat carried into the formation by a TECF. A TECF may comprise a combustion product, or a partial-combustion product. In some examples, a TECF comprises a formation fluid, such as water, steam, methane and/or other hydrocarbons. In other examples, a TECF may comprise: an industrial or municipal product; an industrial or municipal waste stream; one or more waste products; one or more co-products; and the like. A TECF may be water miscible, oil miscible, or only partially miscible in both water and oil. In some embodiments, the TECF is a homogeneous, single-phase fluid. In other cases, it is a heterogeneous or multi-phase fluid. In some cases, the selection of one or more of the constituents of a TECF (e.g. one or more molecular entities comprising a TECF) is based on one or more local, regional and/or practical parameters that may include, without limitation: local availability or abundance; cost; environmental compatibility and/or regulations; recoverability; detectability; biodegradability; human or animal toxicity; condensability; compressibility; and the like.

In this invention, the TECF may serve a plurality of functions including but not limited to heating one or more portions of a formation containing one or more carbonaceous deposits. The TECF may also provide operational linkage between one or more injecting wells and one or more producing wells. For example, the TECF may provide in situ operational linkage(s) by acting as: a bulk carrier fluid, a formation-flooding agent, a formation-pressure regulating fluid, a solvent, a phase-transfer agent, a displacing agent, a solubilizing agent, a source of energy or combustible materials (e.g. for subsequent operations), a formation permeability-enhancing agent, a formation porosity-enhancing agent, a condensable or non-condensable produced fluid, and/or a formation-sealing agent. Optionally, a TECF may function to displace, dissolve, solubilize, mobilize, and/or react directly with one or more chemicals, hydrocarbons or carbonaceous materials in a formation. In many applications, most of the injected TECF is later produced from one or more producing wells distributed within the formation. In some embodiments, a majority of the TECF may be produced in substantially diluted form from one or more producing wells. In some embodiments, a portion of the injected TECF may be rendered unrecoverable following injection into the formation. In some embodiments, a portion of the injected TECF may undergo pyrolysis, reactive decomposition and/or combustion following injection.

a) Characterization and Use of a Hydrocarbon-Containing TECF in the Retorting of a FBCD In one example, the constituents of a mixed component thermal energy carrier fluids are selected on the basis of having a graphic slope of their Btu/lb vs. temperature curves (FIG. 12*a*) at nearly constant hydrodynamic reservoir pressure. The components are selected such that the TECF exhibits a slope (on a Btu/lb vs temperature plot analogous to that in FIG. 12*a*) equal to or greater then a 3-to-4-fold multiple of the slope of the oil-shale-rock retorting requirement as plotted on a Btu/lb vs. temperature curve (FIG. 3). As observed in FIG. 3, for typical, permeable, 25±gal/ton, oil-shale rock, retorted to a temperature of 900° F., about 30% of the total thermal energy is used in preheating the rock up to a temperature of about 480° F., needed to start the retorting process, and about 70% of the total thermal energy is used in the retorting operation from 480° F. to about 900° F. Consequently, the thermal-energy carrier fluid, flowing through the in-situ, permeable, oil-shale retorting zone at nearly constant pressure, may deliver at least about 70% or more of its thermal energy to the oil-shale rock while cooling down from the temperature of 1,100° F. to 480° F., and then deliver less than 30% of the thermal energy in the preheat, fluid-flow zone while cooling down from 480° F. to normal reservoir temperature of about 80° F.

FIG. 12*a* illustrates an example of such a thermal energy carrier fluid selected for in-situ retorting of a typical, 25±gal/ton, permeable, oil-shale rock on the basis of its Btu/lb vs temperature plot. This figure shows a hypothetical example of a TECF heated to 1,100° F. such that the preheat comprises about 29%, and the retorting-heat comprises about 71% of the total Btu injected into the formation via the TECF. When heated to 1,400° F., the preheat is about 23% and the retorting-heat is about 77% of the total Btu, thermal-energy injection. The hypothetical curve illustrated in FIG. 3 may be created by a mixture of $C_{12}$ to $C_{24}$ hydrocarbon fractions, plus the combustion exhaust products (i.e., $CO_2$, $H_2O$, and $N_2$, if compressed air is used) from a downhole combustion heater.

The $C_{12}$-to-$C_{24}$-hydrocarbon mixture, used as a thermal-energy carrier fluid used in this example, may be extracted from the oil-shale-production flow stream. When this selected mixture of heavy, hydrocarbon oils (i.e., $C_{12}$ to $C_{24}$) flows through the permeable, retorted, oil-shale rocks at temperatures of about 1,000° F., 1,100° F., or higher, (i.e., up to 1,400° F.) they may be subjected to these elevated temperatures for relatively long periods of time (i.e., several weeks to several months). Under such circumstances, they may undergo substantial thermal cracking, resulting in deposition of carbonaceous 'coke' in various carbon-crystalline forms. This deposition of carbon in the oil-shale-rock pore space may create substantially increased thermal conductivity as described herein.

A plot of the critical temperatures and/or critical pressures for each of several hydrocarbon fluids may also be developed and used to select or design a hydrocarbon or combination of hydrocarbons for use in (or as) a thermal energy carrier fluid. In this invention, the pressure of the retorting operation in high-permeability, oil-shale rocks may be nearly constant, and maintained at a level slightly above that of the initial, formation fluid pressure at the drill-site location. Likewise, the pressure at the retorting-operation depth may be maintained at a level substantially similar to the initial pressure. Consequently, the operating pressure is not a variable subject to operator control or selection under most circumstances. In one example, the operating pressure is a near-constant value of about 430 psi at a 1,000-ft depth and about 650 psi when operating at a 1,500-ft depth. These operating pressures are much greater (i.e., 2 to 6 times greater) than the critical pressures of any of the hydrocarbon fluids in the $C_{12}$ to $C_{24}$ range. Therefore, the retorting operating pressures are substantially higher than the critical pressures of any of the $C_{12}$ to $C_{24}$ hydrocarbon fluids.

The upper curves in FIGS. 12*a* and 12*b* illustrate the Btu/lb of steam as a function of temperature. A very large change in thermal energy (e.g. in Btu's/lb) is observed when superheated steam flows through permeable, oil-shale rocks and undergoes a phase-change condensation at about 480° F. and a reservoir pressure of about 480 psi. At this temperature, the Btu/lb-vs.-temperature profile makes it less attractive than other agents as a TECF for an oil-shale and or FBCD retorting purpose, since only about 75% of the thermal energy is delivered at preheat temperatures and only 25% of the thermal energy is delivered at the necessary retorting temperatures. Despite its disadvantages, however, water (e.g. steam) often comprises at least a portion of the thermal-energy carrier fluid. In some examples, water/steam provides for a substantial preheating of one or more selected permeable zones with a formation comprising an FBCD, particularly oil shale. Preheating to temperatures of greater than about 480$^{\pm o}$ F., for example, results in a preheated zone of permeable rock that advances in front of an advancing retorting front. This 480° F., condensed-hot-water zone, advancing in front of the higher-temperature retorting zone, may prevent some or all of the higher-molecular-weight (i.e., $C_{16}$ to $C_{24}$, and higher) hydrocarbons from condensing in the 80° F., cold-formation rocks to create a high-viscosity, low-mobility, flow barrier to restrict the advance of the retorting front. These retorted, heavy hydrocarbons, flowing into the advancing, 480° F., preheated zone, will have a low enough viscosity to maintain high mobility to readily flow in advance of or within the retorting zone and not restrict its advance.

Behind the advancing retorting zone of this example, the permeable rock, through which the TECF has flowed, may maintain a near-constant temperature approaching that of the carrier fluid. In some examples, the TECF is injected at temperatures of about 750° F. to about 2200° F., and more preferably, about 1,100° F. to 1,400° F. in the carbonate rock. In the retorting zone, thermal energy is consumed from the carrier fluid to increase the temperature of the oil-shale rock and to pyrolize some of the kerogen in the rock. This loss of thermal energy in the carrier fluid lowers the temperature of the carrier fluid. This lower temperature TECF, with lower thermal energy content (e.g. Btu/lb), flows into the adjacent cooler and less retorted oil-shale rock. There, it loses more heat resulting in a further heating of the rock and the FBCD; so as to pyrolize at least a portion of a carbonaceous deposition. In the preferred embodiments of this example, the FBCD comprises kerogen. In this example, the step-wise process of losing thermal energy (e.g. measured in Btu/lb, for example) Continues until the carrier fluid reaches a temperature substantially similar to the preheat temperature, or a temperature of about 480° F. to 500$^{\pm o}$ F. In most cases, an expanding retort zone is created. The zone extends over some distance behind which the temperature is a near-constant high temperature (i.e., about 1,100° F. to 1,400° F.). In front of the retorting zone, the rock temperature may be near constant at the condensed, hot-water (and other fluids) temperature at about 480° F. to 500° F.

As illustrated in this example, numerous chemical and physical considerations may apply to the selection of a thermal energy carrier fluid. In some cases, a TECF is selected, even though it is less-than-ideal, simply because it is available locally in abundance. Superheated steam, natural gas, fluid hydrocarbons, carbon dioxide, nitrogen, and combustion vapors are often attractive for use as or in a TECF due to local availability., and physical and chemical properties such as those discussed earlier in this example. A TECF may comprise many discrete fluid constituents, such as hydrocarbons of various lengths. Moreover, a TECF may comprise a plurality of organic and/or a plurality of inorganic molecular species.

The pressure may be substantially constant within a given retort, treatment or hydrolysis zone, or even within a local geological formation. However, as one movies between permeable zones within formation, or between different formations, the pressure may vary widely. A TECF can be reevaluated for appropriateness in a given deposit or location by considering the change in its specific heat (e.g. or BTU/lb) as a function of pressure. FIGS. 13*a* and 13*b* illustrate the changes in specific volume and specific heat for water and superheated steam at various pressures.

Favorable combinations to be used in describing this type-example may consist of selected mixtures of hydrocarbon products in the molecular-size range from $C_1$ to $C_{40}$, or more preferably from $C_6$ to $C_{30}$, or most preferably from $C_{12}$ to $C_{24}$, or, in some applications, most optimally from $C_{14}$ to $C_{20}$. In some examples, these selected mixtures of hydrocarbon products are derived from (a) a petroleum or crude-oil production process, (b) from a petroleum refining process, (c) from an oil-shale retorting process, or (d) from other hydrocarbon or kerogen-processing operations. The fluids produced from heating these various hydrocarbon-related products can be mixed, for example, with the combustion exhaust products from a downhole combustion heater to provide the thermal energy carrying fluid to be injected into the oil-shale, permeable zones to achieve in-situ retorting of the kerogen content of these oil-shale rocks. These same, selected hydrocarbon products may further be used as fuel to be burned in a surface or a downhole combustion heater.

Example 13

Use of Superheated Steam as a Thermal Energy Carrier Fluid (TECF)

In this example superheated steam is selected as a thermal energy carrier fluid to be injected into the formation at or near the bottom of an injection well bore.

In some applications, it is desirable to generate high temperature injection steam at or near the bottom of the well bore. In these examples, fuel and air or oxygen-enriched air which are separately injected with a measured volume of injected water are combined in a down-hole combustion chamber to create a controlled flame temperature and a consequent fluid mixture comprising combustion products and steam having a temperature similar to the controlled-temperature flame. In this example, the fluid mixture comprises superheated steam and serves as TECF to be injected into the permeable formation and/or formation fractures.

In this example, the fuel is injected from a combustion nozzle near the bottom of the tubing. An air or oxygen-enriched air mixture is fed down the annulus between the tubing and the casing. Water (steam, and/or other TECFs) in volumes needed to control the temperature may be mixed with either the fuel flowing down the tubing or the air/oxygen flowing down the annulus or both. Mixing of these streams near the bottom of the casing creates a flame with a controlled temperature ranging from about 750° F. to 1400° F., in an open area or casing herein referred to as a chamber (e.g. combustion chamber). Many other designs for downhole combustion chambers are known in the art and discussed elsewhere herein.

In the present example, a volume of hot water (e.g., 450° F.) is mixed with either the air or oxygen-enriched air in the annulus or the fuel in the tubing, the water being used operationally to control the desired flame temperature and to provide the mass flow of steam (plus combustion gases) as a means for carrying this thermal energy into and through the natural or propped frac aquifer in the oil-shale rock formations. This mass flow of hot steam, plus combustion gases, provides the TECF transport of thermal energy at a selected temperature for retorting the kerogen and other carbonaceous deposits located in these permeable and/or propped-frac zones to create the desired oil/gas products for production.

In an embodiment, the methods of this example are applied to retorting of an oil shale formation. The rate of thermal-energy flow through these natural permeable aquifers or propped-frac in the oil shale zones of the Piceance Basin is almost directly proportional to the rate of mass flow of this hot steam and combustion gases and is essentially independent of the thermal conductivity of the rocks. However, in the impermeable or low-permeability, oil-shale zones, there is little observable mass flow of hot steam and combustion gases. Consequently, the thermal-energy flow into these low-permeability zones is directly proportional to the thermal conductivity of these oil-shale rocks and also proportional to the area of contact between the high-temperature, retorted, permeable zones and the low-temperature, unretorted, low-permeability zones. In some applications, a moderate-to-high permeability zone (e.g. having high rate of mass flow) with flowing hot TECF may serve as a conductive heating element with respect to the low-permeability zones adjacent to it, or otherwise operationally linked to it. In some embodiments, the present invention is a hydrocarbon production system, the system comprising: a) a formation having one of more FBCD, b) a TECF, c) a means of transferring TECF into a formation, and an a production opening that provides flow of one or more hydrocarbons products to a surface.

The geometric configuration of rapidly pumping large volumes of thermal energy into the permeable, oil-shale zones by steam/combustion-gas in a single isolated well mass flow rapidly results in very large contact areas between the retorted, hot-rock permeable zones and the unretorted, cold-rock impermeable zones. For example, by the time the injected steam/combustion gas has retorted the permeable rocks out to an area having an average radius of 100 ft, the contact area between these retorted hot rocks and the adjacent, unretorted, cold, low-permeability rock may be about 31,416 sq ft (e.g. 30,000 sq ft) for each boundary or 62,832 sq ft (e.g. about 60,000 sq ft) for the sum of upper, plus the lower, boundaries of each retorted permeable zone. If there are 10 such retorted, permeable zones in a 400-ft, vertical interval of an open hole, into which the steam/combustion gas is injected, then there may be about 628,320 sq ft (about 600,000 sq ft) of such boundary contact area between such retorted hot rocks and unretorted cold rocks. To further illustrate, when the thermal conductivity of these oil-shale rocks causes the retort front to advance at the rate of about 0.2 in/d, then about 10,472 cubic ft/d, or about 607 tons/d, of these low-permeability, oil-shale rocks will be retorted to produce about 506 bbls/d of retorted oil while absorbing about $2.4\times10^8$ Btu/d of thermal energy from the adjacent, retorted, hot-rock zones. Furthermore, after the radii of retorted hot rocks in the permeable zones has expanded out to an average radius of about 300 ft, this contact area between retorted hot rocks and unretorted, cold, low-permeability zones will be about 5,655,000 sq ft to create a retorting of about 4,550 bbls/d of oil equivalent products from such low-permeability zones by thermal-conductivity, cross-formational heat flow out of the high permeability aquifers.

Tables 1 and 2 below illustrates idealized (e.g. with superheated steam) example of the progressive expansion of the steam/combustion-gas, displacement-bubble radius (Column 1) as it expands into an unretorted hot-rock-to-cold-rock contact area. Column 2 displays the increase in contact area that may result under each radius of expansion. The contact area may increase due to cross-formational flow, thermal-conductivity enhanced heat flow rate, and other rmeans. Column 3 shows the thermal energy injection rate at each radius Column 4 displays the consequent rock mass being retorted at each bubble radius. Column 5 shows the approximate oil-equivalent production rate of oil, gas and petrochemical hydrocarbon products that are, theoretically, producible within each bubble radius under ideal conditions. In an actual retort operation, observed oil-equivalent production rates may be substantially similar to, or less than, these production values.

TABLE 1

Thermal-Conductivity Retorting Rate @ 750° F. of Low-Permeability, Rich (e.g., 35 g/t), Oil-Shale Zones

| (1) Retorted, Hot-Rock, Bubble Radius | (2) Unretorted, Hot-Rock, Contact Area | (3) Thermal-Energy Conduction Rate | (4) Conductivity, Retorted, Impermeable Rock Mass | (5) Conductivity, Retorted, Oil-Equivalent Production |
|---|---|---|---|---|
| 50-ft | 157,080 $ft^2$ | $0.06 \times 10^9$ Btu/d | 152 tons/d | 126 bbls/d |
| 100-ft | 628,320 $ft^2$ | $0.24 \times 10^9$ Btu/d | 607 tons/d | 506 bbls/d |
| 300-ft | 5,654,880 $ft^2$ | $2.16 \times 10^9$ Btu/d | 5,460 tons/d | 4,550 bbls/d |
| 500-ft | 15,708,000 $ft^2$ | $6.0 \times 10^9$ Btu/d | 15,175 tons/d | 12,650 bbls/d |

TABLE 2

Comparative, Thermal-Retorting Rates @ 1,000° F., for High-Permeability (e.g., 20 g/t) Oil Shale Zones

| (1) Retorted, Hot-Rock, Bubble Radius | (2) Thermal-Energy Injection Rate | (3) Total Thermal-Retorted, Oil-Equivalent Production | (4) Permeable-Retorted-Zone-Oil-Equivalent Production | (5) Impermeable-Retorted-Zone-Oil-Equivalent Production |
|---|---|---|---|---|
| 50-ft | $10 \times 10^9$ Btu/d | 9,157 bbls/d | 9,031 bbls/d | 126 bbls/d |
| 100-ft | $10 \times 10^9$ Btu/d | 9,157 bbls/d | 8,651 bbls/d | 506 bbls/d |
| 300-ft | $10 \times 10^9$ Btu/d | 9,157 bbls/d | 4,607 bbls/d | 4,550 bbls/d |
| 500-ft | $10 \times 10^9$ Btu/d | 9,157 bbls/d | 0 bbls/d | 9,157 bbls/d |

In a preferred embodiment, this example of an in situ retorting operation using a TECF comprising superheated steam exhibits a three-stage oil shale heating operation that may be described and/or implemented as follows:

Stage I: In this stage, the formation is preheated by injecting hot water and/or steam (e.g., 450° F.) at about 700 psi down both the annulus and the tubing until the permeable oil-shale zones have been heated, out to a desired radius of about 350 ft. In early stage(s) of heating, substantial quantities of fuel gases, such as methane and ethane may be derived from the formation. This gas may be produced in one or more producing well and captured, marketed, or used as fuel for heating of thermal energy carrier fluid, etc. . . . . This stage may comprise the Vaporization and Desorption phase described elsewhere herein.

Stage II: This stage represents a low-temperature (e.g., 800° F.) retort operation, and is enabled in this example by injecting natural gas plus water down the tubing and compressed air or oxygen plus water (e.g., 450° F.) down the annulus to provide for downhole combustion, and the release of superheated steam, plus combustion products, at about 800° F. At about this temperature, the system is capable of delivering thermal energy by mass flow through the permeable, oil-shale zones at a rate of about 10 billion Btu/d, using the following operational injection rates:

(a) 10 mmcf/d of natural gas @ 1,000 Btu/$ft^3$ (b) 23.7 mmcf/d ($O_2$=1,000 tons/d)

(c) 90,000 b/d water & misc. @ 450° F. & 700 psi

Under idealized conditions, this may result in production of products (@ 135 Btu/lb, 13.2 gal/ton) equivalent to a production rate of about 12,000 boe/day. In practice the rate of production may be substantially similar to or less-than this value for a retort area (or volume) similar to that described in this example. This stage of formation heating may be viewed as a Pyrolytic Demineralization stage according to the terminology described elsewhere herein.

Stage III: This stage is seen as the high-temperature phase of the retort operation and operates at temperatures of about 1,000-1200° F., after completion of Stage II's low-temperature retort operation. It is enabled in this example by continuing injection of natural gas, oil or other fuel, plus water down the tubing and oxygen plus hot water (lesser volumes than in Stage II) down the annulus to provide for downhole combustion, and the release of superheated steam, plus combustion products at temperatures of about 1,000-1200° F. At about this temperature, the system is capable of delivering thermal energy by mass flow through the permeable, oil-shale zones at a rate of 10 billion Btu's/d, using the following injection rates:

(a) 10 mmcf/d of natural gas @ 1,000 Btu/$ft^3$, $5/mcf (b) 23.7 mmcf/d ($O_2$=1,000 tons/d)

(c) _____b/d water & misc @ 450° F. & 700 psi

Under idealized conditions, this may result in production of retorted products (@ 110 Btu/lb, 11.8 g/t) equivalent to 13000 boe/day. In practice, the rate of production may be substantially equivalent to or less-than this value for a retort area (or volume) similar to that described in this example. This stage of formation heating may be viewed as a Fluid (Thermal) Cracking stage according of the terminology described elsewhere herein.

In a particularly preferred embodiment, an operating procedure that may be used in this example, involves using two adjacent wells (i.e., well "A" and well "B") spaced about 660 ft (i.e., ⅛$^{th}$ mile) apart. Each well is first used in Stage I to inject 450° F. hot water to provide about $6.34 \times 10^{11}$ Btu's of thermal energy into each well. This thermal energy of 80 Btu's/lb of rock will preheat the permeable oil zones up to a temperature of about 450° F. out to a radius of about 350 ft around each well.

In Stage II, the water-injected, temperature-controlled, downhole combustion will inject about 10 billion Btu's/d of thermal energy down well-bore "A" for 30 days (totaling 300 billion Btu's/mo) at 750° F. Then, this injection of natural gas, compressed air or oxygen, and hot water will be transferred to well-bore "B" for the downhole combustion in well "B" to deliver about 10 billion Btu's/d, or 300 billion Btu's/mo, at 750° F., into the permeable zones around well "B." While this thermal energy is being delivered down well-bore "B," the shale oil previously retorted from the oil-shale permeable zones around well-bore "A" will be produced at reduced pressure up well-bore "A" to the surface.

The retorting thermal energy required to elevate the retorting rock temperature from 450° F. up to 750° F. by mass flow through the permeable zones will be about 135 Btu/lb (i.e., 215 Btu/lb @ 750° F.-80 Btu/lb @ 450° F.). Consequently, the 300 billion Btu's/mo of thermal energy, delivered by mass flow through the permeable oil-shale zones surrounding well-bore "A," will cause the retorting of about 11,685 bbls/d, or about 350,550 bbls/mo, of oil-equivalent oil and gas products. By alternating the injection down well "B," while producing up well "A" for 30 days and then reversing to inject down well "A" while producing up well "B" for the next 30 days, will result in near-continuous use of the fuel/oxygen, water-injection facilities and the near-continuous production of about 350,550 bbls/mo oil equivalent of marketable-oil-and-gas, retorted-shale-oil products.

These methods provide for a substantially positive per well yield of energy and/or chemical product basis at both small-scale (e.g. one or a few operating wells) and large-scale (e.g. using many, area-unitized wells) operations. While the magnitude of the difference will vary somewhat with product mix and market conditions, generally, the net effect of the method is the production of a higher volume of energy from the producing well(s) than is consumed in heating of the formation.

Other Diverse Modes of Heating May be Used in Conjunction with this Invention

The previous example described one mode of heating a formation comprising FBCD using superheated steam and a downhole combustor. Many other modes of heating water and/or other thermal energy carrier fluids are known in the art. For example, a natural distributed combustor system and method may heat the water or other thermal energy carrier fluid contained in at least a portion of an oil shale or other FBCD formation. In some of the systems and methods illustrated here first include heating a first portion of the thermal energy carrier fluid to a temperature sufficient to support oxidation of at least some of the hydrocarbons therein. In some of the systems and methods of this example, a spark or other ignition source may be provided directly to a mixture of hydrocarbon fuel and oxidizer present within a combustion zone (e.g., including without limitation, a chamber). One or more conduits may be disposed within one or more openings in a formation so as to provide TECF, fuel, oxidizer, and/or other agents to a combustion zone. One or more of the conduits may provide an oxidizing fluid from an oxidizing fluid source into an opening in the formation. The oxidizing fluid may oxidize at least a portion of the hydrocarbons at a combustion zone substantially within a well bore casing and/or well bore annulus. The oxidation process may oxidize a portion of hydrocarbons within the formation. Oxidation may generate heat at the combustion zone. The generated heat may transfer from the combustion zone to a pyrolysis zone in the formation. The heat may transfer by fluid permeation and contact with formation materials, or by outward conduction, radiation, and/or convection from the flowing thermal energy carrier fluid tributaries(s) established in the formation through the methods disclosed herein. Typically, heat may transfer to the formation by a combination of these transfer processes. A heated portion of the formation may include a combustion zone, a pyrolysis zone a permeable TECF flow zone, and other areas in direct or substantial indirect contact with heated TECF. The heated portion may also be located adjacent to the opening. One or more of the conduits may remove one or more oxidation products from one or more reaction zones and/or heated portions of the formation. Alternatively, additional conduits may remove one or more oxidation products from the reaction zone, a retorting zone and/or other heated portions of a formation.

In certain embodiments, the flow of oxidizing fluid may be controlled along at least a portion of the length of the reaction zone. In some embodiments, hydrogen may be allowed to transfer into a reaction zone, a retorting zone, and/or heated portions of the formation, such that it contacts in situ hydrocarbonaceous formation fluids. Generally, at least a portion of the hydrocarbons are derived from at least one retorting zone within a formation (e.g. they are the to be formation-derived). An in situ process for cracking hydrocarbons comprises contacting, in situ, formation-derived hydrocarbon(s) with molecular hydrogen in the presence of a thermal energy carrier fluid, and producing at least one formation fluid enriched in at least one hydrocarbon cracking product.

In another embodiment, a system and a method of this invention may include an opening in the formation extending from a first location on the surface of the earth to a second location on the surface of the earth. For example, the opening may be substantially U-shaped. Well bores drilled with this shape provide a number of advantages. First, they may operate either as injection wells or producing wells. As a thermal energy exchange system, this configuration may allow for confinement and recycling of on an initial TECF, and for efficient heat exchange between a confined thermal carrier and a thermal energy carrier fluid extrinsic to the well bore, and that may contact the formation. As a fluid injection well, the U-shaped configuration may allow for rapid injection of heated thermal energy carrier fluid at a plurality of points within the formation (e.g. through perforations in the wall of the U-well at various points). As a producing well, the U-shaped well bore may provide for rapid and/or multi-point egress of hydrocarbon products from the formation. Moreover, a single U-shaped producing well, may have the capacity to produce product from a plurality of thermal energy carrier fluid injection wells.

In some embodiments, heat is transferred from one or more first TECF to one or more second TECF, the second being physically separated and/or chemically distinct from the first. Transfer of heat between a first and a second TECF may be enabled by any number of heat exchange systems, methods and solvents known in the art. For example, a conduit may be positioned in the opening extending from a first location to a second location. In an embodiment, a thermal energy carrier fluid may be made to flow through the conduit (or, alternatively, to fill the conduit) such that it provides heat to the conduit. Transfer of the heat through the walls of the conduit may provide heat to the same or other thermal energy carrier fluids positioned outside the conduit wall. Heat so transferred may then be used to heat a selected section of an oil shale or other FBH formation. Typically, this is done by subjecting the secondary thermal energy carrier fluid to one or more forces and/or hydrodynamic gradients. In some embodiments, an annulus is formed between a wall of the opening and a wall of the conduit placed within the opening extending from a first location to a second location. Thermal energy carrier fluid may be placed (or otherwise made to flow) proximate to and/or in the annulus to provide heat to a portion the opening. The provided heat may transfer through the annulus to a selected section of the formation.

In an embodiment, a system and method for heating TECF used to heat a FBCD within a formation (e.g. oil shale, etc) may include one or more insulated conductors. In some embodiments, the insulated conductor may include a copper-nickel alloy. In some embodiments, the insulated conductor may be electrically coupled to two additional insulated conductors in a 3-phase Y configuration. Many other insulated conductor systems and materials are known in the art and may be employed to advantage in this invention.

An embodiment of a system and method for heating TECF used to heat an oil shale or other FBCD formation may include a conductor placed within a vessel or conduit (e.g., a conductor-in-conduit heat source) containing the thermal energy carrier fluid. The vessel or conduit may be positioned on the surface or sub-terrestrially. An electric current may be applied to the conductor to provide heat to the carrier fluid. The system may allow heat to transfer from the conductor to a thermal energy carrier fluid, and subsequently, to a section of the formation. In some embodiments, atmospheric or industrial oxidizing agents may be placed proximate to a heating vessel, conduit containing thermal energy carrier fluid, or an opening in the formation through which there is communication with one or more thermal energy carrier injection fluids. The oxidizing agent may provide oxidant to oxidizable hydrocarbons also present in the vicinity. In one embodiment, a spark or other ignition source is supplied through electrical, mechanical, chemical or other means to initiate rapid oxidation of the hydrocarbon with concomitant heating of the carrier fluid. When positioned at or near an opening of the formation, oxidant and hydrocarbon may be supplied with sufficient flow rates to allow rapid superheating (and propulsive vaporization) of water or other formation thermal carrier fluids. In this model the injection pressure is generated chemically through rapid super heating at or near the well opening.

In an embodiment, this invention comprises heating a thermal energy carrier fluid by any means. Such means of heating include, but are not limited to, methods that generate heat directly or indirectly through use of: electrical energy; solar energy; geothermal energy; nuclear energy; energy released through compression or expansion; and combustion. The combustion may be of any oxidizeable liquid, gas or solid including, but not limited to: hydrocarbons; hydrocarbon-based fuels; coal, lignite, kerogen, bitumen and petroleum products (e.g. gasoline, natural gas, propane, butane, diesel fuel, fuel oil, kerosene, tar(s), distillates, mixed distillates, etc. . . . ); wood, tree products and byproducts (leaves, bark, pulp, mulch, etc), other biomass (e.g. plant, animal, microbiological, terrestrial, and or marine biomass, and the like), biomass-derived chemicals (e.g. polysaccharides, cellulose, alcohols, fatty acids, paper, fiber-board, etc) and or fermentation-derived products (e.g. methanol, ethanol, propanol, propane-diol(s), acetic acid; lactic acid, tartaric acid, citric acid, gluconic acids, propionic acid, and other alcohols, acids, esters, carbohydrates, etc). Other fuels and energy sources will be apparent to one skilled in the art.

The methods and systems of this invention comprise a mobile, fluid heat source contacting a carbon-rich geological deposit, comprising an oil shale formation. The methods further comprise a process for liberating substantially mobile hydrocarbons from the deposits; the processes comprising injection of thermal energy into the formation, with preferred methods using heat carried substantially by thermal energy carrier fluid(s). The methods further comprise recovering a plurality of substantially mobile hydrocarbon species (including hydrocarbon-derived co-products such as hydrogen, carbon monoxide, methane, and other energy products or intermediates) from the deposit. The methods further comprise the in situ chemical modification of liberated hydrocarbons to other hydrocarbon and chemical intermediates.

In contrast to other proposed methods, the methods and systems comprising this invention allow one to substantially decouple the physical locations of: a) a primary heat source (e.g. such as a burner or combustor) b) an operator, and c) the location of the one or more injection wells used to inject heated TECF into a formation, the TECF having received heat from the primary heat source. In effect the TECF represents an operational linkage between unit operations that may occur at substantially distinct spatial locations. Although the heating of the thermal energy carrier fluid may occur in close proximity to one or more injection wells, a given TECF heater need not be dedicated to a single injection well, nor even be in close proximity to an injection well. This is distinct from methods proposed by other inventors wherein intimate physical linkage between a heater and a formation and/or heat injection location is required for effective operation of the invention. In many cases, a separate heater is required for each operational injection well. In some proposed methods, for example, individual electric heaters are placed directly in and dedicated to an individual injection well, to drive a convection, or conduction-based heating of the surrounding formation. Such operations present important limitations because of the direct relationship between the physical location of the heater and the effectiveness of the restoring operation being performed. In this invention, a heated thermal energy carrier fluid may carry heat, directly or indirectly, to a pyrolysis zone. The TECF may further transfer heat from one heated portion of a formation to another portion of a formation. Heat from one pyrolysis zone, for example, my be used to pyrolyze hydrocarbons in a second pyrolysis zone by means of transferring one or more TECF from the first to the second pyrolysis zone.

An embodiment of a method and system for heating an oil shale or other FBCD formation may include providing oxidizing fluid to a first oxidizer placed in an opening in the formation. Fuel may be provided to the first oxidizer and at least some fuel may be oxidized in the first oxidizer. The method may further include allowing heat from oxidation of fuel to transfer to a portion of the formation and allowing heat to transfer from a heater placed in the opening to a portion of the formation. Preferably, some or all of this transfer is mediated by one or more TECFs.

In an embodiment, a system and method for heating an oil shale or other FBCD formation may include oxidizing a fuel fluid in a heater. The method may further include providing at least a portion of the oxidized fuel fluid into a conduit disposed in an opening in the formation. In addition, additional heat may be transferred from an electric heater disposed in the opening to the section of the formation. Heat may be allowed to transfer uniformly along a length of the opening.

Energy input costs may be reduced in some embodiments of systems and methods described above. For example, an energy input cost may be reduced by heating a portion of the TECF used to heat an oil shale deposit or other FBHF by oxidation in combination with heating a portion of the fluid with an electric heater (e.g. insulated conductor, etc. . . . ). The electric heater may be turned down and/or off when the oxidation reaction begins to provide sufficient heat to the formation. Electrical energy costs associated with heating at least a portion of a formation with an electric heater may be reduced. Thus, a more economical process may be provided for heating an oil shale formation in comparison to heating by a conventional method. In addition, the oxidation reaction may be propagated slowly through a greater portion of the formation such that fewer heat sources may be required to heat such a greater portion in comparison to heating by a conventional method.

Example 14a-b

Development and Operation of Downhole Combustion Chambers in this Invention (a) In this invention, the injection of TECF into permeable portions of one or more geological formations results in development of an in situ, expandable heating element, that extends from at least one point of injection to at least one point of production. Generally, the in situ heating element comprises a mobile TECF having substantial thermal energy content and formation rock having a temperature substantially similar to that of the average temperature of the TECF between a point of injection and a point production. Moreover, the formation typically comprises at least one carbonaceous deposit. In numerous preferred embodiments, the in situ heating element is employed to advantage in the pyrolysis of one or more carbonaceous species. Preferably, one more the carbonaceous species' is substantially immobile within the formation. Preferably, at least one carbonaceous species comprises a hydrocarbon, and/or other fixed bed carbonaceous deposit. More preferably, the carbonaceous deposit comprises: oil shale; shale gas; tar sands; heavy oil; coal (including, without limitation, brown, bituminous, sub-bituminous coals); lignite; undeveloped and/or depleted petroleum and natural gas deposits.

Preferred methods of the invention comprise injecting a heated TECF into a formation comprising at least one FBCD. The TECF may be heated using any surface or downhole methods known in the art, and involve one or a plurality of heating steps. In certain preferred methods, TECF is preheated in a surface vessel using combustion, electrical energy or any other form of available energy (including; without limitation, geothermal, nuclear, wind, solar, biological, fuel cells and other sources). In certain preferred embodiments, a downhole combustion chamber is used accomplish a least one TECF heating step.

A variety of methods using utilize downhole combustion heaters are known in the art. For example, U.S. Pat. No. 2,634,961 to Ljungstrom, U.S. Pat. No. 2,732,195 to Ljungstrom, U.S. Pat. No. 2,780,450 to Ljungstrom, U.S. Pat. No. 2,789,805 to Ljungstrom, U.S. Pat. No. 2,923,535 to Ljungstrom U.S. Pat. No. 4,397,356, to Retallick, U.S. Pat. No. 4,442,898 to Wyatt, and U.S. Pat. No. 4,886,118 to Van Meurs et al. each illustrate design and/or use of at least one downhole combustion chamber. Each of these patents is hereby incorporated by reference, as if fully set forth herein. Together, these disclosure represent important, advantageous aspects of the use and design of certain of downhole combustion heaters.

One example of a downhole combustion heater suitable for use in this invention is a combustion chamber containing about seven combustion fire-tubes (i.e., 2⅜" OD×1.995" ID), that are evenly and symmetrically spaced inside a 10¾"-OD× 9.85"-ID outer casing which is cemented in place inside a 12¼" drill hole. Compressed combustion air, compressed combustion oxygen, or a mixture of compressed air and oxygen plus water, is pumped down through these seven combustion fire-tubes. The thermal-energy carrier fluid, consisting of a selected mixture of hydrocarbon-related products plus water, is pumped down the annular space between the outer 10¾"-OD casing and the seven combustion fire-tubes.

In this example, the six outer fire tubes may be formed to spiral clockwise around the central fire tube with a spiral pitch of about 30±ft. Spacing and position anchors to hold each spiral fire tube in place may be located at about 10±-ft intervals. The six outer fire tubes may be formed from 90-ft lengths of continuous2⅜"-OD×1.995"-ID coiled tubing, transported to the well site on 10-ft-diameter, coiled-tubing spools. Each of six such 90-ft lengths of 10-ft-diameter coiled tubing can then be stretched out to a 90-ft-length, 8"-diameter, spiral coil, with a 30-ft-pitch, symmetrically assembled at 60°-spacing around a jointed, straight, 2⅞"-OD×2.065"-ID, central fire tube using tube-positioning anchors at about 10±-ft spacing to hold all fire tubes in proper alignment and position.

In one possible example, the thermal-energy carrier fluid is caused to flow downward in a 30° to 60°, counterclockwise spiral across the clockwise spiral of 2⅜"-OD fire tubes. This 30° to 60°, counterclockwise, downward flow of the thermal-energy carrier fluid is controlled by two 180°-spaced, counterclockwise, spiral vanes extending radially outward from the rigid, straight, center fire tube and encompassing the six, clockwise, spiral fire tubes. The objective is to create turbulent flow of this fluid across the fire tubes to maximize the heat-transfer rate through the fire-tube walls. Many variations of this fire-tube, combustion heater and heat exchanger may be used to accomplish the objectives of this invention.

A small portion of this thermal-energy carrier fluid can be forced, by differential pressure, through a multiplicity of orifices, properly spaced along the length of each of the2⅜"-OD fire-tubes, to inject combustion fuel plus water into and distributed along the axis of each of the fire-tubes. The heat of compression, plus additional heat, may be supplied to the compressed air and/or compressed oxygen to achieve auto-ignition, or partially facilitate the auto-ignition of this fuel injected into the seven fire-tubes. A hot wire, glow plug or spark may be used to facilitate fuel ignition when needed.

In the upper portion of each fire-tube, the fuel-injection rate will be limited to provide a very lean burn with a temperature held below the temperature at which $NO_x$ is created (i.e., probable flame temperatures between 1,200° F. and 2,200° F.). Downstream in each fire-tube, these combustion gases will be transferring thermal energy through the fire-tube walls and into the surrounding thermal-energy carrier fluid. Along the length of each fire-tube, additional orifices in the tube wall are provided to inject the fuel volume at the rate needed to replace the thermal energy transferred through the tube wall to the carrier fluid and thereby maintain a temperature inside the fire-tube of about 1,200° F. to 2,200° F. These fire-tubes may be manufactured from high-temperature steel or alloys to have the necessary burst, collapse, and tensile strength when subjected to internal-combustion temperatures of about 1,200° F. to 2,200° F., or other temperatures selected for this combustion-heater application. Alternatively, ceramic and other materials may be used for the manufacture of these fire-tubles.

When the total volume of injected fuel reaches the stoichiometric mixture to consume essentially all of the oxygen in the fire-tube, then no additional fuel will be injected into the fire-tube. The balance of the fire-tube length will then serve as a heat exchanger for the transfer of the thermal energy from the combustion exhaust gases inside the fire-tubes to the surrounding thermal-energy carrier fluid. When the temperature difference between the fluids inside and outside the fire-tube walls is no greater than about 300° F. to 600° F., then the fire-tube length is terminated and the combustion gases are commingled and mixed with thermal-energy carrier fluids. After these fluids are thoroughly mixed, they are injected into the 12¼"-dia., open well bore below the bottom of the 10¾"-OD, cemented casing and then into the permeable oil-shale zones in communication with this open well bore.

In another embodiment, a first chamber, operating at a high combustion temperature (e.g. >1500 degree F., and preferably >1800 degree F.) is operationally linked, within a well bore, to a second chamber in which cooler fluids (e.g. <1800 degree F., and preferably, <1500 degree F.) comprising TECF are commingled with combustion vapors to bring temperature down to a level desired for injection. In preferred methods, the TECF is preheated to a temperature of >250 degree F., or preferably, >350 degree F. or >450 degree F., prior to dispensing into the second chamber. In a particularly preferred method, a TECF comprising steam is preheated to a temperature of at least 450 degree F. prior to co-mingling with combustion vapors (e.g. in the second chamber). In other preferred embodiments, the temperature of one or both chambers is under the control of an operator or intelligent operating system. In an embodiment the flow rates of at least one fuel, and/or oxidizer, and/or TECF into at least one chamber is under the control of an operator or intelligent operating system.

Operationally, it may be further desirable, but not essential, to design the downhole combustion heater so as to generate thermal energy at the rate of between 2 billion and 10 billion Btu's/d, and preferably, at least 5 billion Btu's/d, or closer to 10 billion Btu's/d.

In one example, a combustion heater is attached to the bottom of a6⅝"-OD, 28#, N-80 casing (or alternatively, a5½" or 7"-OD casing) to convey the compressed air or compressed oxygen from the surface to the downhole combustion heater located near the bottom of the 10¾"-OD outer casing. Many variations of this configuration may be used to accomplish the objectives of this invention.

In one example, a combustion chamber is supplied with compressed oxygen (instead of compressed air) as a source. In this example, the compressed oxygen provides for a substantial increase in the capacity of the downhole heater to produce thermal energy, and also avoids dilution of the retorted hydrocarbon products with nitrogen. Therefore, compressed oxygen may be preferred by the operator for many applications. For comparison, compressed air may provide a savings of about 20% to 25% in operating costs but would result in reduced, thermal-energy-producing capacity and a dilution of the retorted gaseous products (i.e., methane) with difficult-to-remove nitrogen gas. However, if the operator has effective use of such non-marketable, low-Btu, methane gas diluted with nitrogen for onsite combustion, then such cost savings, using compressed air, may be beneficial over using compressed oxygen. In certain embodiments (i.e. when using compressed air and other nitrogen-rich fluids), removal of nitrogen from one or more TECF or produced fluid may be desired. In such cases, reduction of nitrogen content may be accomplished with a method comprising one or more nitrogen-selective membranes or membrane-based filters; or a nitrogen separating column.

b) Variations and Principles Related to Use a Downhole Combustion Chamber in an In Situ Retorting Operation In this example a variety of fuel-water mixes are burned in a downhole combustion chamber to generate, near the bottom of the hole, a superheated steam, or other thermal-energy carrier fluids, plus combustion products for injection into either natural, permeable zones or hydraulic fractures in organic-rich rocks. Fuel mixes useful in this example include: a coal/water slurry, an oil/water emulsion, a natural-gas/water foam, and other similar mixtures. In this example, steam may serve as the thermal energy carrier fluid. However, many other thermal carriers may be used. In this example, the temperature and/or flow of thermal-energy carrier/fluid, containing combustion products, are controlled to provide a selected temperature ranging from about 500° F. to about 2,000° F. and a bottom-hole controlled pressure which may range from about 250 psi to about 2,500 psi, depending upon depth and mode of operation. The operating psi is determined in part by: (a) the depth of the formation being injected with steam, (b) the fluid injection mode, whether through the formation's permeable matrix or through hydraulic induced fractures, and (c) the desired, hydrodynamic pressure gradient from the injection well to the producing well (to achieve the desired, fluid-flow rate and thermal-energy-injection rate). When (a) the formation injection depth, (b) the operating mode of permeable, matrix injection, or open, hydraulic-fracture injection, and (c) the desired hydrodynamic fluid pressure gradient are established, then the injection pressure is substantially a constant value and not subject to further variation by the operator. However, the operator may, optionally, vary the selected operating temperature over a very wide range (i.e., from 500° F. to 2,000° F.) to optimize the desired production product(s) and rates.

A primary objective of this invention is to transport a high-volume rate of thermal energy by fluid-flow injection of superheated steam, or other thermal-energy carrier fluid, through each injection well bore and either out into a permeable formation or out into one or more horizontal-created hydraulic fracture, held open by adequate proppant or fluid-injection pressure. In a preferred example, thermal energy is carried out into a large area of a selected, retort-developed formation by a TECF comprising superheated steam. In the example, the superheated steam is injected at high-volume, fluid-flow rates into one or more permeable portion of the formation and/or one or more propped hydraulic fractures in the formation. In this example, and many others disclosed herein, fluid-flow, thermal-energy transport into a formation is not dependent upon the thermal conductivity of the formation. This feature is an important distinction from other art related to development of FBCD formations.

In the present example, a retorting surface area ranging from 500,000 sq ft to over 5,000,000 sq ft. may be developed by injection of hot thermal energy carrier fluid into: a) a permeable formation, b) a propped open, hydraulically fractured formation, or c) a formation having both natural and artificially induced permeability. The transport rate of the thermal energy being conducted by thermal conductivity into the adjacent rocks is very large because of this very large area invaded by this superheated steam.

Other methods in the art propose the heating of an oil shale formation by conduction of heat from a series of vertical well bores. In contrast with the efficiency of the present invention, these other proposed methods appear inefficient. For example, a thermal conducting area from a 12"-dia, vertical well bore, 300 ft long, is only about 1,000 sq ft which is only about 0.0002 to 0.002 fraction of the thermal conducting area of the thermal-energy-carrier-fluid-invaded permeable formation or propped hydraulic fracture. This suggests that the thermal-energy transport rate through each well bore by delivery of thermal-energy-carrier fluid-invaded permeable formation, or the hydraulic fracture, may range from 500 to 5,000 times the thermal-energy transport rate achievable through conduction through the walls of a 1 ft-dia, vertical well bore, completed through 300 ft of retortable formation.

In the present example, a typical well bore may be prepared for injection of superheated steam or other TECF into a permeable formation, or a hydraulic fracture as follows: A 12¼"-dia hole is drilled through the zone to be completed for either permeable-zone injection or hydraulic-fracture injection. A 10.75"-OD×9.85"-ID casing is set and cemented into position just above the zones to be superheated-steam injected. Then, an inner string of either 6⅝"-OD or 5½"-OD casing is hung in the hole with a specially designed combustion chamber attached to the bottom of this casing string and positioned just above the zone to be steam or other TECF injected.

In some examples, the combustion chamber consists of a steel alloy capable of withstanding temperatures of up to 2,500° F. The combustion chamber diameter may range from about5½"-OD up to 7"-OD, and its length may range from about 45 ft up to about 90 ft, or longer, if needed. The top 5-to-10 ft is a solid-wall tube below which this combustion chamber has a large multiplicity of shop-drilled ⅛" to 3/16" holes. The accumulative total area of these holes collectively should be approximately equal to about 50% to 200% of the cross sectional area of the annulus between this combustion chamber and the outer casing (i.e., 9.85"-ID). The bottom 5-to-10 ft of this combustion chamber has several sequential layers of baffle plates or cement pedal baskets to partially restrict fluid flow downward through this part of the annulus to the area below the combustion chamber. This inner casing, with attached combustion chamber, is lowered to a position at which the bottom of the combustion chamber will be at a depth of about 5 to 20 ft above the bottom of the outer casing, resulting in this superheated steam TECF and combustion products being injected into the zone to be retorted.

During combustion operation, compressed air or compressed oxygen is pumped down the inner casing at such pressure as required for the bottom-hole pressure below the combustion chamber to be the pressure required for injection into the matrix porosity or into the open, hydraulic fracture as desired for this operation. Simultaneously, a coal/water slurry, or an oil/water emulsion, is pumped down the annulus between the inner casing and the outer casing at a pressure as needed to have a pressure at the combustion-chamber location sufficiently higher than the air or oxygen pressure inside the inner casing to provide an injection of this slurry or emulsion at a rate to achieve the desired combustion rate to create the superheated steam and combustion products at the rate desired for injection into the zone completed for injection.

If desired, this slurry or emulsion can be preheated in an above-ground water heater, prior to injection, up to a temperature of about 50° F. below the boiling point of this water at the injection pressure (i.e., 450° F. @ 700 psi, 500° F. @1,000 psi, 550° F. @ 1,600 psi). The ratio of fuel-(i.e., coal or oil)-to-water in the slurry or emulsion is adjusted to create the desired temperature of the superheated steam and combustion products injected into the injection zone or fracture. The rate of injection of oxygen or air and the rate of injection of fuel (i.e., coal or oil) is adjusted to establish approximately a stoichiometric fuel/oxygen ratio for combustion to raise the temperature of the hot water to superheated steam at the desired temperature. The temperature of the superheated fluids injected into the injection zone or fracture can thereby be controlled to produce the type of production products desired from this operation. However, this temperature should not exceed the temperature at which the minerals in the formation disintegrate or become fused, semi-liquid, or clinkered.

Note that in this combustion heater, all of the superheated steam and combustion products are commingled, and no heat transfer through a large area of tubular walls is required. All of the combustion heat is delivered into the injection zone, resulting in nearly 100% steam-conversion, thermal efficiency.

Optionally, a continuous coiled tubing may be injected inside the inner casing to deliver some lower-temperature combustion fuel, such as natural gas, propane or butane, to initiate combustion. An electric-heater glow plug or an electrical spark on the end of an electric wireline, extending through and below the coiled tubing, may be used to initiate combustion of this fuel in the compressed air or oxygen which then initiates combustion of the coal or oil fuel in the water slurry or emulsion injected through the ⅛" to 3/16" holes in this combustion-chamber wall. By this means, superheated steam, with entrained combustion products, containing nearly all of the thermal energy of fuel combustion in the downhole combustion chamber, can be injected into the resource formation at the desired temperature and pressure.

If desired, the TECF used in this example may comprise: a water slurry or emulsion; one or more hydrocarbon; one or more constituent of air (e.g. oxygen, carbon dioxide, nitrogen, etc. . . . ); one or more combustion products; or other injectable fluids. The TECF may be preheated on the surface before injection down the annulus, or it may be injected down the annulus at any convenient, ambient, surface temperature (i.e., 50° F. to 90° F.). The injection down the annulus of this TECF at cool, ambient, surface temperatures results in the least thermal losses but also requires a longer, downhole, combustion chamber and an increased volume of compressed air or compressed oxygen injected down the inner casing to the downhole combustion chamber. Therefore, the operator has the option of selecting either the cool TECF injection or the TECF injection into the downhole combustion chamber. Each specific operation is evaluated according the local conditions and required injection parameters to determine the preferable option.

In a preferred embodiment of this example, the TECF comprises a water slurry or emulsion. Following heating of the aqueous TECF in the downhole combustion chamber, superheated steam is injected into the formation where it commingles with the retorted, hydrocarbon products in the reservoir rock. In certain embodiments, this comingling provides and effective steam- or hydro-cracking environment in which one or refinery-like operations (e.g. cracking, etc) may proceed. In some examples, thermal-, hydro- or catalytic cracking reaction occurs during passage of formation fluids through the matrix porosity or hydraulic fractures comprising an in-situ retorting operation. In other examples, a thermal-, hydro- or catalytic cracking reaction occurs at or substantially near one or more producing wells.

In this example, compressed air injected down the 7"-OD, inner casing to the downhole combustion burner may be compressed with just sufficient water injection to control the bottom-hole temperature of the compressed air to a desired combustion temperature ranging from about 900° F. to 1,200° F. This compression may be achieved by a combination of near-isothermal compression with water injection, to control temperature, plus a near-adiabatic compression with no further water injection.

Certain embodiments as described herein may provide a low cost systems and methods for heating an oil shale formation. For example, certain embodiments may more uniformly transfer heat along a length of a heater. The heater may thus uniformly heat thermal energy carrier fluid along a substantial length of pipe. Such a length of a heater may be greater than about 10 ft, or possibly greater than 100 ft. In vertical heater or injection well configurations, these length is typically <900 ft. In certain embodiments (e.g. thick carbonaceous deposits, horizontal injection/heating wells in narrow deposits, etc), the heater or heat injection ports along an injection well may be at least about 900 ft or possibly greater than about 1500 ft. In addition, in certain embodiments, heat may be provided to the formation more efficiently by radiation. Furthermore, certain embodiments of systems may have a substantially longer lifetime than presently available systems.

In certain embodiments, the invention comprises an in situ, fluid-operational system for pyrolyzing petroleum and/or hydrocarbon materials. In certain preferred embodiments, the invention comprises an in situ, fluid-operational system or reactor for conducting petroleum and/or hydrocarbon cracking operations. In more preferred embodiments, the system or reactor comprises fluid TECF co-mingled with fluid hydrocarbon under conditions compatible with hydrocarbon cracking. In further embodiments, the conditions within the in situ reactor or system compatible with hydrocarbon cracking comprise; one or more temperatures of >750 degree F.; one or more petroleum cracking catalyst; and/or one or more zones of excess hydrogen.

Example 15 a-j

Further Applications of Downhole Combustion Generator(s) and TECF Injection into Carbonaceous Geological Deposits Downhole, combustion generators and other methods for providing hot TECF to carbonaceous geological formations may be used in a variety of applications. In this set of examples, superheated steam or other thermal-energy carrier fluids, are injected with combustion products (e.g. from a downhole combustor) are injected into a series of formations using methods described elsewhere herein. In these examples, the injected fluid provides heat to one or more portions of a selected formation to advantage for the production of one or more hydrocarbon species. Preferably, a plurality of hydrocarbon species are produced at one or, preferably, a plurality of producing wells distributed within the formation. Preferably, at least a portion of produced hydrocarbons constitute products of in situ retorting, pyrolysis, cracking and/or petrochemical refining operations. In certain preferred methods, the retorting, pyrolysis, cracking and/or petrochemical refining operations employ in situ, one or more catalysts. In certain preferred methods, the retorting, pyrolysis, cracking and/or petrochemical refining operations comprise one or more in situ chemical reactions that provide on average hydrocarbon products having on average a lower carbon number than the reactants. In certain preferred examples, the retorting, pyrolysis, cracking and/or petrochemical refining operations provide for one or more in situ of the following physical transformations of at least one hydrocarbon product: a phase change, an extraction, a mobilization, a desaturation reaction, and/or a chemical decomposition reaction. These methods for treating and/or producing hydrocarbon from a geological formation may be applied in substantially similar ways to a wide variety of formations exemplified by following operational examples:

(A) Injection of superheated steam, or other thermal-energy carrier fluid, plus combustion products, into oil-shale zones having significant matrix permeability, and thereby:

(1) In-situ retorting/refining of the kerogen within the permeable, matrix zone penetrated by the superheated steam, and (2) In-situ retorting/refining of the kerogen in the adjacent, lower-permeability, oil-shale zone by the heat transferred by thermal conductivity from the superheated-steam-invaded, permeable-matrix zones to the adjacent non-invaded, lower-permeability, oil-shale zone.

(B) Injection of superheated steam, or other thermal-energy carrier fluid, plus combustion products, into a large, open, horizontal, hydraulic fracture (hydraulically created and held open in the thicker, impermeable, or low-permeability, oil-shale zones), and thereby in-situ retort/refine the kerogen in the adjacent, impermeable, oil-shale zone by the heat transferred by thermal conductivity from the superheated-steam-invaded, open, hydraulic fracture into the adjacent, non-invaded, impermeable, oil-shale zones.

(C) Injection of superheated steam, or other thermal-energy carrier fluid, plus combustion products, into the porous and permeable matrix zone created by the prior retorting and removal of the kerogen from the previously impermeable, oil-shale zone, adjacent to the previously held-open hydraulic fracture through which superheated steam previously had been injected. By reducing the steam-injection pressure, this hydraulic fracture closes, resulting in the superheated steam being injected into and flowing through the prior, retort-created, permeable, matrix path, adjacent to the now-closed hydraulic fracture.

(D) Injection of superheated steam, or other thermal-energy carrier fluid, plus combustion products, into heavy oil/tar sands (i.e., Athabasca, Alberta oil sands) having significant matrix permeability and fluid-flow transmissibility, and thereby:

(a) In-situ retorting and transformation of the heavy oil (bitumen) in the permeable matrix zone, penetrated by the TECF plus combustion products, and (b) In-situ retorting and transformation of the heavy oil (bitumen) in the adjacent, impermeable (low fluid transmissibility), heavy oil (bitumen) sands by the heat transferred by thermal conductivity from the TECF plus combustion products-invaded, permeable matrix zone to the adjacent, non-invaded, impermeable, heavy-oil (bitumen) zone.

(E) Injection of superheated steam, or other thermal-energy carrier fluid, plus combustion products, into large, open, horizontal, hydraulic fractures, hydraulically created and held open in the low-fluid-transmissibility (low permeability), heavy-oil (bitumen) sands and thereby thermodynamically retort or transform the bitumen in the adjacent sands using the heat transferred by thermal conductivity from the TECF plus combustion products-invaded, open, hydraulic fracture into the adjacent, non-invaded, heavy-oil (bitumen) sands.

(F) Injection of superheated steam, or other thermal-energy carrier fluid, plus combustion products, into the matrix porosity and permeability zone created by the prior retorting and removal of the bitumen from the previously low-fluid-transmissibility, heavy-oil (bitumen) sands adjacent to the previously held-open hydraulic fracture through which superheated steam previously had been injected. By reducing the steam-injection pressure, this hydraulic fracture closes, resulting in the TECF and combustion products being injected into and flowing through the prior, retorting-created, permeable, matrix path adjacent to the now-closed, hydraulic fracture.

(G) Injection of superheated steam, or other thermal-energy carrier fluid p[us combustion products, into coal, or lignite beds, having significant matrix permeability and fluid transmissibility, and thereby:

(1) In-situ retorting and transformation of the organic matter within the coal/lignite, permeable, matrix zone penetrated by the TECF and combustion products, and, (2) In-situ retorting and transformation of the organic matter in the adjacent, lower-permeability, coal/lignite beds by the heat transferred by the thermal conductivity from the TECF plus combustion-invaded, most-permeable zones to the adjacent, non-invaded, lower permeability zones.

(H) Injection of superheated steam, or other thermal-energy carrier fluid, plus combustion products, into a large, open, horizontal, hydraulic fracture, hydraulically created and held open in the coal or lignite zone, and thereby in-situ retort and transform the coal/lignite in the adjacent coal/lignite bed by the heat transferred by thermal conductivity from the TECF plus combustion product-invaded, open, hydraulic fracture into the adjacent coal/lignite bed.

(I) In some coal/lignite beds, it may be possible to create a sufficiently step thermal gradient from the hydraulic-fracture surface into the adjacent coal/lignite bed to volatilize the organic matter and water at a sufficiently rapid rate to create a steep, fluid-pressure gradient to explosively fragment the coal/lignite bed, and thereby blow the coal/lignite fragments into the high-velocity, superheated-steam jet stream flowing through the open fracture. These coal/lignite fragments would react with the high-temperature steam to create both combustible fuel products plus petrochemical-feedstock products. The coal/lignite-bed ash would be produced along with these fuel and petrochemical products through the open fracture and the production wells.

(J) In many coal/lignite beds, from 60% to 90% of the coal/lignite-bed mass may be effectively retorted and transformed into producible fluid products, resulting in substantial, excavated, void space, which will collapse, thereby creating a rubblized zone of collapsed coal/lignite beds and/or other collapsed rocks. If this rubblized zone is dominantly coal/lignite rubble, then this rubblized coal/lignite bed provides a very high permeability zone for the future injection and flow of superheated steam to retort and transform this rubblized coal/lignite into useful fuel and petrochemical products, producible through the rubblized zone and up through the production wells.

While not exhaustive, this list described 10 typical applications of the downhole combustor toward heating and retorting of fixed-bed hydrocarbons formations.

E. Hydrocarbon Production & Formation Operations

Example 16 a-d

Stages of Heating in FBCD Retorting Process

According to the methods and systems of this invention, geological formations containing fixed-bed carbonaceous deposits (FBCD) may be treated in a wide variety of ways so as to produce mobile hydrocarbon materials (e.g. hydrocarbon-containing fluids). While the operating parameters may vary slightly depending on the embodiment, the formation heating, retorting and refining process may be viewed as occurring in four distinct phases each of which may be subdivided further into any number of other sub-phases. The four primary phases of formation heating are: 1) Vaporization and Desorption; 2) Pyrolytic Mobilization; 3) Fluid (Thermal) Cracking; 4) Post-Pyrolysis The temperature line dividing these stages are approximate, and will vary somewhat depending on depth, permeability, heat transfer efficiency and other aspects of a specific formation.

a) Vaporization and Desorption Phase

This phase encompasses the heating of a selected segment of a formation from ambient temperature to temperatures approaching pyrolysis temperature for paraffins, kerogen, and other predominantly saturated long-chain hydrocarbons or carbonaceous mineral deposits rich in carbon-carbon bond structure(s). Under formation conditions, at least about 25%, and preferably at least about 50% of the pore volume of the formation may be occupied by water. Upon vaporization, some or all of this water may serve as a thermal energy carrier fluid for later stages of heating and retorting of the formation. A substantial fraction (e.g. >5%) of the pore volume in the oil shale formation may be occupied by methane and other adsorbed hydrocarbons. Phase 1 heating provides for the desorption and mobilization of these hydrocarbons from the formation. Upon desorption, some or all of these mobilized hydrocarbons may serve as thermal energy carrier fluids in later stages of heating and retorting. Methane, for example, exhibits nearly ideal thermal properties as a TECF for early stages of formation heating.

The temperature of desorption and/or vaporization of entrapped formation fluids will depend, in part, on the overall depth and permeability of the formation. However, water vaporization temperatures between 485 degrees F. and 535 degrees F. may be typical for many of the preferred formations and depths described herein. This means that at temperatures below about 450-480 degrees F., entrained formation hydrocarbons may be produced in a vapor phase (e.g. separated) apart from liquid water. Indeed, water may provide an ideal thermal energy carrier or this phase of formation heating. For the purposes of this invention, the vaporization and desorption phase generally terminates as formation waters vaporize and thermal conditions approach a point at which retorting of at least a portion of one or more FBCD present in the formation may begin. For oil shale retorting, this will typically be at temperatures of 400-500 degrees F. For shallower tar sands, however, water may vaporize at temperatures of 200-300 degrees F., but pyrolysis may not begin for another one to two hundred degrees. In this stage, formation fluids and hydrocarbons may be produced without pyrolysis. In some examples, this stage provides for the non-pyrolytic production of substantial quantities of oil and natural gas. For deep carbonaceous deposits (e.g. some coal formations, etc.) the transition point may be at a higher temperature. This invention describes the beneficial use of water and formation-derived hydrocarbons and other fluids as thermal energy carriers for advancing the retort process.

b) Pyrolytic Mobilization—

The methods of this invention provide for the use of in situ, limited pyrolysis to release and/or chemically process entrained, entrapped, and otherwise substantially immobile carbonaceous materials present in geological formations that may comprise fixed-bed hydrocarbon deposits. The methods of this invention also apply to producing formation fluids from conventional and depleted oil and gas formations. In such embodiments, a selected portion of a formation containing a carbonaceous deposit is heated to temperatures that are pyrolytic toward at least one constituent hydrocarbon or carbonaceous material found in such deposits. The present invention further addresses the production of such pyrolysis-mobilized materials as fluids (e.g. flowable) comprising one or more hydrocarbons. For certain carbonaceous deposits (e.g. kerogen), this pyrolysis results in conversion of an inorganic mineral into a population of mobile, organic hydrocarbon species. For other heavy materials, this stage may simply release a more mobile hydrocarbon species from a less mobile hydrocarbon material. Of the four phases listed in this example, it is in the pyrolytic mobilization phase that thermal energy released by a TECF is used to pyrolyze (e.g. retort or thermally "crack") one or more substantially immobile hydrocarbons.

The range of pyrolysis temperatures will vary widely depending on the type and configuration of the oil shale (or other FBCD) formation. Even so, it is expected that pyrolysis of easily accessible, vibrationally sensitive materials will begin at temperatures of about 480 degrees F. Often, the first materials to pyrolyze will be those derived from the permeable portions of a formation, and particularly, from those areas that are in direct contact with the flowing TECF.

The rate and range of materials subject to in situ pyrolysis reaction(s) is expected to increase with temperature, up to a temperature of about 1800 degrees F. At the higher temperatures (e.g. in excess of ~900 degrees F.) pyrolysis activity begins to act efficiently on both entrained and/or mineralized carbonaceous materials as well as the mobile hydrocarbons mobilized within the formation by any means. Pyrolysis chemistry occurring in a substantially fluid phase and directed toward a hydrocarbon present in at least one formation fluid is referred to herein as a hydrocarbon "cracking" reaction. The pyrolytic demineralization phase, therefore, may span a range of thermal conditions that are sufficient for both hydrocarbon mobilization and thermal cracking. For oil shale, the pyrolytic demineralization phase is seen as covering the heating of the formation from temperatures of about 450 degree F. to about 900 degree F. As with the first stage of heating, the range and efficiency of pyrolysis will vary somewhat with the permeability, depth and other features of the formation.

In an example, at least one selected segment(s) of geological formation comprising a FBCD is heated with a thermal energy carrier fluid so as to provide heat sufficient for pyrolytically mobilizing a FBCD material present in the formation. In a preferred embodiment, the FBCD comprises oil shale. In this example, any number of thermal energy carrier fluid injection wells may provide heated TECF to a selected portion of a formation.

c) Fluid (Pyrolytic) Cracking—

In this stage, mobile phase cracking of mobilized hydrocarbons becomes substantial, resulting in a controllable shift of produced hydrocarbons from longer to shorter chain products, and, under some conditions, from saturated to unsaturated products. The yield of hydrogen may also increase in this stage. Whereas, this phase provides for a wide range of products, the population of hydrocarbons produced by the formation may be modified by both thermal and catalytic means. For example, the injection of certain cracking catalysts into the formation, or incorporation of such agents in the process flow stream at or near the producing well may be used to substantially adjust product composition. While fluid phase cracking may be observed at temperatures as low as 450-500 F, its major utility in the context of this invention is in shifting composition of produced fluids, first, from high to low viscosity, then, from low viscosity (e.g. C8-C12) hydrocarbons to low molecular weight alkenes and alkanes (e.g. C1-C6, and preferably, C1-C4). The efficiency of the latter reactions become high only as temperatures exceed about 750 degrees F., and more preferably, 900 degrees F. High efficiency cracking may continue to provide beneficial alterations in produced fluid composition up to temperatures of about 2200 degrees F., and preferably 2000 degrees F., more preferably 1800 degrees F., and most preferably, 1500 degrees F. Addition of catalyst may alter the composition and/or thermal requirements for certain desirable transformations. In general, once the Fluid Cracking phase begins, increasing temperatures within the formation result in decreasing levels of condensable hydrocarbon. As temperatures exceed about 1600-1800 degrees F., methane, ethane, ethylene and/or hydrogen may predominate.

Whereas the present invention addresses the mobilization and production of hydrocarbon materials from oil shale formations, it is understood that a wide variety of non-hydrocarbon products can be or will be produced as a result of the chemistry operating within the formation(s). For example, hydrogen may be produced as a co-product of thermal or catalytic cracking, and by other means described herein. Nitrogen, nitrates, ammonia and other nitrogen-containing compounds may be produced. Hydrogen sulfide, sulfates, sulfites, and other sulfur-containing materials may be produced. Likewise, soda, sodium hydroxide, various sodium and potassium salts, carbonates, bicarbonates and other inorganic compounds may be produced from the treated formations.

d) Post-Pyrolysis Phase—

In this phase, the formation may be employed to a number of beneficial ends. The formation may or may not still contain large quantities of carbon. Regardless, it does contain large amounts of heat energy. The formation heat may recovered as turbine power (e.g. for electrical energy generation) or compressive energy (e.g. for steam engine or steam compressor operation) for an extended period after completion of hydrocarbon production. If substantial carbon deposits remain in the formation, the post-pyrolysis formation may be used in any number of applications, including but not limited to: large-scale, carbon-based aquifer purification, synthesis gas production, hydrogen production, methane production. While these methods are discussed elsewhere in this invention, the use of the residual carbon matrix for producing synthesis gas is instructive. As the formation cools to temperatures of about 800-2000 degree F., purification, a synthesis gas generating fluid may be introduced into the formation. The synthesis gas may then be generated using the heat and residue within the formation. The synthesis gas may be produced through a producing well.

In certain FBCD retorting and refining operations, one or more of these heating phases may be missing or consolidated with another. For example, in oil and tar sands, thermal cracking and pyrolytic demineralization may be coincident or otherwise indistinguishable, since substantial mobility is achieved as the first phase of heating is completed. Moreover, temperatures required for maximal hydrocarbon recovery may be lower than those required for kerogen, lignite, coal and other carbon deposits.

Example 17

Heating Strategies May Differ at Varying Stages of Development of an In Situ Retorting, Refining and/or Hydrocarbon Mobilization in a FBCD Formation a) Early Stage Heating In the early stages of an in-situ, oil-shale or other FBCD retorting, refining or mobilization operation in permeable formations, the operator may choose to alternately inject the thermal-energy carrier fluid into one well-bore for a period of time (e.g., possibly for about one month, more or less) and then produce the resulting products back through that same well bore over the next incremental period of time. During the production cycle of that well, the compressed oxygen or air can be injected down another well. Consequently, the two wells can be operated in coordination by injecting into well "A" while producing product out of well "B", and then alternating by injecting into well "B" while producing product out of well "A". Other combinations, using two or three sets of compressed-oxygen or compressed-air equipment tied into a network of three or four wells on alternating injection/production cycles of varying time duration, may be designed to optimize the effective use of equipment.

A dual-function, single-well may also be used for the heating of a formation, in certain cases, such as at the start of a retort and refining heating process. Where a single well is used, the same well may be used for both initial heating of the formation, and then for the production of formation fluids.

The one or more selected sections are heated through the vaporization and desorption phase and then heated through the pyrolysis range. The rate of heating may be determined by the temperature and properties of one or more thermal energy carrier fluids, the heat transfer property of the formation, volumetric productivity considerations, and the like. Where deposition of mineralized carbon within the formation is desirable (such as for increasing the thermal conductivity of the formation, for example, near an injection or producing well, or for constructing an aquifer purification matrix) a rapid heating cycle may be selected. Rapid, early-stage heating may provide lower hydrocarbon yield in the early stages but provide for more rapid scale-up to production. Conversely, where maximal per ton hydrocarbon yield is desired, a slower temperature ramp-up may be selected.

A single well method and system can be provided by placement of concentric casings within offset openings within a single well bore. In these systems and the affiliated methods, a heated TECF is injected into a geological formation comprising a fixed-bed carbonaceous deposit (FBCD). The TECF is injected through an opening that is offset linearly from a separate production opening positioned at some distance from the injection opening along the length of the same well-bore casing. The pairing of injection and production openings along the same well bore is enabled by providing to the well bore a concentric, tube-in-tube construct. Typically, the outer casing will terminate (or perforate) along the well bore axis prior to the inner casing. This allows for a substantial linear separation between the two openings.

Using methods analogous to those described elsewhere in this invention, heated TECF is injected into the formation and made to flow in the direction of the production opening. Typically, a small pressure differential may be established between the injection and production openings so as to enhance bulk flow of injected TECF and mobilized formation fluids toward the production opening.

In some embodiments, the injection opening occurs at or near the terminus of the well-bore. In these embodiments, TECF to be injected may be provided via a casing that is internal to at least one outer casing, the outer casing opening to the formation at a point substantial prior to the injection terminus. In some embodiments, the outer casing terminates at the production opening. In other embodiments, the opening in outer casing is created by perforation at one or more defined points.

In some embodiments, the production opening occurs at or near the terminus of the well bore within in the formation. In these embodiments, TECF to be injected may be supplied to an outer casing, the casing terminating at a point substantially prior to the production (and well bore) terminus. In some embodiments, TECF injection into the formation is enabled by perforations in one or more outer casings.

Using methods described elsewhere in this invention, TECF may be heated, injected into one or more targeted segments of one or more FBCD, and allowed to migrate through the formation toward one or more production openings along the linear axis of the well-bore. In the course of migration, the TECF may facilitate the heating, mobilization, retorting, cracking and/or refining of one or more carbonaceous materials comprising the formation, as discussed elsewhere in this invention.

The flow of TECF and formation fluids from the injection opening to the production opening creates a retort (and/or hydrocarbon mobilization) front progressing radially outward along a retort front that is largely co-linear with the well bores axis. Moreover, the flux of heated TECF and formation fluids from injection to production opening creates a multi-functional linear heater. This single well-bore, flowing "heater", delivers heat to the formation first by direct contact of heated TECF and formation fluids with one or more carbonaceous deposits found within the formation, and secondly, through radiative and conductive processes directed radially perpendicular to that portion of the well-bore axis that separates the injection and production openings.

In certain embodiments, the injection and production openings are offset by >25 feet. In other embodiments, the injection and production openings are offset by >50 feet. In some embodiments, the injection and production are offset by >100 feet.

In some embodiments, the offset between injection and production openings occurs within vertically or horizontally distinct carbonaceous layers within a formation.

In some embodiments, the injection and production openings occur within vertically and/or horizontally contiguous deposits within a formation.

In some embodiments the inner casing comprises one or more thermally insulating materials, to reduce the transfer of heat from the fluid to be injected to the produced fluids. In other related embodiments, and double casing may separate the producing tube from the injection tube. The interspersing layer may be optionally evacuated, filled with cooling agent or other materials to reduce the rate of heat transfer from injection to production fluids.

Drawings illustrating 5 embodiments of this invention are shown below.

FIGS. 16*a* & *b* illustrate a well bore in which the outer casing terminates in an upper carbonaceous deposit (hatched area) and the inner casing terminates, in a lower deposit. In (a), injection of TECF is through the lower opening. Production is through the upper. In (b), this flow pattern is reversed. In FIG. 16*d*, both casings terminate in the lower deposit, but the outer casing is perforated in the upper deposit allowing the perforated segment to serve as the production opening.

FIG. 16*c* illustrates the outer and inner casings terminating at different points along the well bore, but within the same carbonaceous deposit. The invention also contemplates horizontally displaced termini that would facilitate lateral flow (e.g. with subsequent retort and/or hydrocarbon mobilization) within a contiguous deposit. In FIG. 16*e*, the concept is similar except that perforation rather than early termination of the outer casing is used to create the production opening within the single-well bore injection-production well.

Many more will be apparent to one of skill in the art.

b) An Intermediate Stage Heating Strategy

The preceeding example (a) illustrated one method for early-stage heating or a formation by performing both injection and production through a single well bore. The method is also useful for later-stage heating, but not optimal.

In intermediate stages of development, injection may occur continuously into well "A" with continuous flow of injected, thermal-energy carrier fluid and co-mingled, retorted-product flow from injection-well "A" to production-well "B". The spacing between such wells "A" and "B" may be about $1/8^{th}$ mile, or possibly up to ¼ mile. After a period of several months of flow from well "A" to well "B", the flow may be reversed to flow from well "B" to well "A". The operator may find it desirable to establish a line of many wells (i.e., wells "A", "B", "C", "D", "E", "F", etc.), possibly on a line along a topographic-drainage-valley floor.

At a later time, in a more mature stage of development, the operator may use a development plan for continuous flow from a line of injection wells (i.e., wells "A", "B", "C", "D", "E", "F", "G", "H", etc.) to another line of production wells (i.e., wells "S", "T", "U", "V", "W", "X", "Y", "Z", etc.) with a spacing between such lines of wells ranging from about ½ mile up to possibly 2 miles or more depending upon reservoir permeability and operational objectives. For environmental considerations, such lines of wells should approximately follow the existing topographic-drainage patterns. If major, permeable, reservoir barriers are encountered, such well-alignment patterns may be changed to avoid permeability barrier problems or to take advantage of major, fault/fracture permeability lineaments.

Example 18 A-J

Methods and Considerations for Control of In Situ Retorting and/or Refining Operations The foregoing examples illustrate the details of the invention that are particularly useful for liberating and fueling raw materials from oil shale and other carbon-rich geological formations. Together, these examples embody a wide variety of drilling, well development, engineering, and thermo-kinetic extraction methods for producing fuel hydrocarbons from otherwise low-productivity formations. Surprisingly, we have found that the methods described herein may also be beneficially employed to conduct a degree of in situ hydrocarbon refining to yield petrochemical products. The methods illustrated in this set of examples address the surprisingly broad utility of these methods in producing industrially important olefins and other related petrochemicals in association with in situ thermal mobilization of fixed-bed hydrocarbon.

(A) Methods for Injecting Heat into the Formation. Use of a Downhole Combustion Chamber to Generate Superheated Steam.

Whether in liquid or sold form, coal, oil shale and other hydrocarbon-rich deposits tend to occur in concentrated seams within distinct geological formations. At present, the tools for predicting location and depth of such seams are limited in utility. Even as increasingly useful predictive tools develop, it is unlikely that seam depth or interstitial pressure will likely become a well-controlled or well-regulated parameters. For this reason, one seeking to produce fuel and petrochemical products with predictable distributions and physicochemical properties must allow for the fact that formation pressure will vary considerably both within and between FBHFs. This methods of this invention anticipate the varying pressure profile of an FBHF and offers a way to vary the product generated from any FBHF by modulating the environment through which mobilized hydrocarbons pass in such a way as to adjust composition of product obtained at the designated producing well(s).

Using the methods of this invention one may modulate product recovery rates and product hydrocarbon distributions by establishing thermal control of the FBHF seam at the point of liquification or volatilization. More specifically, the method comprises a hydrocarbon and petrochemical recovery process in which heat is injected into an FBHF seam by way of any externally-modulated, and actively-controlled heat injection modality.

A wide range of methods for injecting heat into a formation are known in the art. They include both electrical and combustion-driven heaters, and methods that apply heat directly to the formation, and those that use a transfer fluid or transfer fluid. In one example, a downhole combustion chamber is established using tools, equipment and well-bore configurations that are widely used in the drilling and petroleum recovery industry. The chamber is established using methods described elsewhere in this group of incorporated inventions. It produces super-heated steam directly into the well, and then allows that steam to escape into the formation. In preferred versions of this embodiment, control is established over the combustion chamber: for example, by means of an initiator (or initiating element) that can be placed at or near the FBHF to ignite a sustained or pulsatile combustion process within the well bore. Most typically, the combustion will occur in close proximity to a defined FBHF seam from which product is to be recovered. Whether the FBHF contains coal, gas, liquid petroleum, oil sands or even oil shale, the heat-injection process remains very similar, varying largely in terms of the operating pressures, temperatures and depths rather than in design. In one embodiment, heat is supplied by way of superheated steam or other thermal carrier fluid that is generated outside the well bore, but in close proximity to the FBHF extraction point. In other preferred embodiments, heat is injected by establishing a controlled low-grade combustion process within the formation itself. In the most preferred embodiments, heat is supplied by way of a sustained combustion reaction that occurs within one or more well bores in or impinging upon the target FBHF seam.

In these embodiments, the temperature and heat content of the well bore combustion chamber is modulated in temperature and heat profile by controlling the rate of addition (e.g. the flow) of one or more externally supplied agents. Typically, these are added to the chamber from outside the FBHF seam. The most frequently used external-modulation agents fall into three categories, including:

1. moisture (H2O, superheated H2O, etc.),
2. carbon-based fuel (in the form of coal, natural gas, or other hydrocarbons) and
3. oxidant (in the form of injected oxygen, compressed air, etc.).

In one embodiment, the invention comprises an intelligent feedback loop that allows physical and chemical readings to be taken at or near the combustion site to direct the modulation of the injection rate of one or more these externally-derived agents. In one example, the pressure, temperature and other physical parameters in the combustion chamber is monitored remotely and used to adjust fuel, steam and/or oxidant flow rates. In another example, the flow of moisture, fuel, oxidant or other mobile agents are modulated in response to: a) a predetermined ramp-up program, or b) physical or chemical conditions detected within the formation, or well assembly.

In another downhole heat combustion chamber example, liquid hydrocarbon fuel (e.g., a C8-C12 distillate) is injected into the downhole combustion chamber in the presence of air and steam. The steam flow rate is modulated in response to the temperature of the super-heated steam entering the formation. For example, when temperature increases to levels over 2000 degrees F., additional moisture (e.g. steam) is added to the combustion chamber. When temperature falls below 750 degrees F., additional air and/or fuel are supplied to the chamber.

(B) Using Formation Flow to Expose to Mobilized Hydrocarbons to One or More Additional High-Temperature Zones For the purpose of this example, an injection well coupled to one or more producing wells is the to have formed a developed zone or heating zone within the formation. Within a localized heating zone of an FBHF seam, temperature and pressure limits and gradients can be well controlled using methods of this invention. This control, in turn, can be used to develop a plurality of localized, in situ fluid recovery (e.g. flow) paths that allow formation fluids to encounter differing degrees of thermal exposure prior to their production at one or more producing wells. Simply illustrated, a diffusible hydrocarbon mobilized by retorting of a FBHF hydrocarbon seam at or near a heat injection well "A" may be produced at a producing well (say, "B") that is closely paired with well A. Alternatively, local conditions may be established in the formation, such that the mobilized hydrocarbon migrates through a longer path, encountering a second heating zone (e.g., surrounding well "C") prior to being produced at production well "D" (which is, e.g., paired with injection well C. The material retorted near well A and produced at well D will exhibit a substantially different thermodynamic history than the material produced at well B. If heating zones encountered by the mobilized hydrocarbons operate at temperatures sufficient to modify hydrocarbon chemistry, then the produced material will reflect this thermal exposure in their composition. In this example, mobilized hydrocarbons are passed through at least one zone in which hydrocarbon cracking conditions exist.

Mobilized hydrocarbons generated in the well A-B heating zone may be caused to migrate preferentially through the well C-D heating zone by a number of means. The first of these is the establishment of a pressure differential between producing wells B and D, such that well D is maintained at a lower pressure than well B. Typically, this differential will be in excess or 10 psi, or in some cases greater than 20 psi, or in some cases greater than 30 psi, or in some cases greater than 50 psi. In some more extreme cases, the difference may be in excess of 100 psi. A second method for favoring migration across heating zones is the creation of differential injection pressures between wells A and C. For the example described here, a higher injection pressure at well A can be used to drive a portion of the well A-B retort fluids to bleed into the well C-D production stream. A combination of low pressure at well D and high injection pressure at well A allows even greater cross-over flow.

Differential thermal histories may also be imposed by creating superheated retort zones, such as occur when two or more heating zones overlap. The ease of developing of such overlapping heating zones is determined by a variety of factors, such: a) the well bore pattern used in developing the formation, b) the average distances, and uniformity of distances between injection wells and producing wells within a given zone, c) presence or absence of asymmetry within the pattern of injection and producing wells, and d) the temporal staging of the retort operation at various injection wells within a developed zone. Often, delaying the retort process at one or more injection wells within a developed zone is used to introduce thermal asymmetry within the zone that is sufficient to allow variation in product chemistries.

While occurring within a predominantly open formation, establishing high pressure and low-pressure zones (e.g. by modulating pressure of injection and producing wells) within an open formation provides the operator with a high degree of local containment and control of the diffusible materials present within a developed zone of the formation. For this reason, any local heat injection-product recovery loop can be viewed as operating in a fixed pressure environment.

While the overall FBHF may be viewed as an open system, it is possible to separate nearby injection and recovery wells at such a distance that they operate independent of one another in terms of heat flow and fluid communication. Likewise, it is possible to connect neighboring heating-and-product-recovery loops into a larger network of heat sources and production wells that work together to achieve yield targets and desired product distributions across a formation. In such a network, material generated in one heating zone may be directed to a neighboring or more distant producing well depending on the needs of the operator.

Product ranges and options differ in the two scenarios above. In the case of the low well-to-well, zone-to-zone communication, the kinetic and thermodynamic properties of the loop will approximate an enclosed petrochemical reaction chamber (contaminated to some extent by clays, rock particles and water). In such systems, reaction rates and product distributions become increasingly predictable, and even controllable, especially when one has the capacity to add chemical catalysts into the system. However, the quantitative and qualitative options for product distribution are largely defined by the prevailing temperature, gradient and flow rates within that single closed loop. In the networked series of injection and production wells, material can be passed through localized heating zones that differ in thermal content, material flow and reactants, so that a broader range of products, or a higher degree of cracking can be achieved. The present invention thus provides the first description of a method that can be used to establish localized process and product control over an otherwise "open" hydrocarbon and petrochemical recovery operation. Whether using the localized closed loop scenario or the networked process flow scenario, the overall formation remains highly contained and highly controlled in terms of hydrocarbon generation.

In one example, a hydrocarbon stream mobilized at well A has an average carbon number of 10-12. Using a 50 psi pressure differential between producing wells B and D (e.g. at lower pressure), a portion of the hydrocarbon mobilized at well A passes into a heating zone near well C and is produced at well D. In the transit from well A the hydrocarbon retorted at well A is exposed to temperatures in excess of 750 degrees F. for an extended period resulting in progressive thermal cracking of the well A hydrocarbons. The increased time and temperature of exposure results in a well D product that is enriched in C6-C12 saturates and C2-C4 olefins when compared to the products produced at well B.

(C) Establishing High-Temperature (900-2000 Degrees F.) Cracking Zones while Minimizing Risk of Complete Pyrolysis or Structural Collapse In the most preferred embodiments, injection of thermal energy carrier fluid results in a progressive retort front moving outward from the injection well toward one or more producing wells. The retort front is defined as the point at which the average kinetic energy of the FBHF exceeds that required to initiate pyrolysis of carbon-carbon bonds found within the fixed-bed carbonaceous material(s). While the temperature will differ somewhat depending on the heat transfer, reaction quenching and other features of the FBHF matrix, pyrolysis will generally begin when hydrocarbon temperature exceeds about 450-500 degrees F. The rate of retorting and hydrocarbon cracking will continue to increase with temperature until, the complete pyrolysis occurs, at or near about 2200 degrees F. In this example, injection well temperatures are maintained at or below about 2000 degrees F. In most cases, this prevents conditions in the surrounding formation heating zone from reaching complete pyrolysis. When using a downhole combustion heater, such modulation is achieved by adjusting steam, oxidant and fuel feed in the heating chamber. For surface combustors, the same strategy can be used. However, when a boiler system is employed, it is more typical to maintain a fixed furnace temperature and then modulate the temperature of the injection steam temperature by blending with a lower temperature feed. Similar adjustments can be made when surface and downhole heaters are operated by electrical power.

In some situations, maximal temperatures are determined by the characteristics of the FBHF matrix. For example, high-permeability oil shale formations (such as B-groove of the Eureka Creek formation) are typically comprised of a nahcolite matrix that will decompose at temperatures in excess of 1400-1500 degrees F. Likewise, certain coal and lignite formations are highly porous and/or undergo degradation or collapse when thermal injection occurs too rapidly or otherwise results in local heating to temperatures above about 1500 degrees F. In these systems, maximal injection temperature is maintained is about 1400-1500 degrees F.

As the retort front progresses outward from the injection well, formation temperature near the well injection points will approach that of the injection well fire tube (in the case of a downhole combustor). The thermal gradient between the injection well and the retort front is an important aspect of this invention. It is in this region that much of the thermocracking chemistry required for industrial chemical production is achieved. It is also in this region that it is possible to deposit a layer of completely pyrolizes carbon. This locks in the porosity and thermal conductivity of the rock near the injection wells. At a later point, it is possible to reverse the injection and producing wells. The previous carbonization of the surfaces near the former injection well allows for unimpeded flow into what is now the producing well.

In this example, a portion of the hydrocarbon mobilized by retorting at well A is made to pass through at least one heating zone having a temperature in excess of 900 degrees F. The resulting formation fluid is enriched in dry gas, hydrogen and C2-C4 olefins.

(D) Coupled Heat Injection and Production Wells Allow Undifferentiated Recovery of Liquid and Mineral Hydrocarbon Secondary and tertiary oil recovery is often seen as a means of recovering low-grade product at low efficiency and high cost. As one establishes control over a given FBHF comprising oil sands or oil shale, one establishes a formation infrastructure through which both volatilization (e.g. of entrained crude petroleum components) and chemical conversion can be managed through the same thermo-kinetic network. In the early stages of secondary or tertiary oil recovery, the systems of this invention may simply allow the low-cost injection of superheated groundwater into a petroleum or natural gas bed to enhance recovery rates and pressures. As the easily extractable product dissipates from the FBHF, the heat content of the injection well is increased (e.g. through any means). In the 450-500 degrees F. range (and preferably, 650 degrees F.), the environment begins to shift from a primarily volatilizing and extracting environment, to a reactive chemistry (free radical generating) environment. At these temperatures, high molecular weight carbon compounds begin to undergo thermal cracking to generate lower molecular weight compounds with greater mobility, greater recoverability, and greater utility as petrochemicals or chemical feedstocks.

While often viewed as distinct fuel and chemical recovery problems, the methods of this invention allow the operator to view entrapped or imbibed petroleum (such as tars, waxes and other heavy petroleum fractions) and more mineral-like materials such as coal and oil shale in a similar light. Regardless of their geological state or origin, each of these tend to decompose into increasingly mobile, lower molecular weight species (and often more oxidized states, where conditions allow) as the temperature of the formation is increased. The examples and methods of this invention provide for the controlled heating, in situ chemical conversion and collection processes required for commercial production. Through these novel interventions, hydrocarbons of virtually any geological origin are rendered recoverable in commercially relevant forms.

Given the wide variation in thermal stability found in different FBHF-derived materials, it is thus surprisingly easy to establish conditions in a local FBHF at which known mixtures of fuel and chemical products can be sustainably liberated from a deposit over a period of months or years (depending largely on the size of the deposit and the dimensions of the local product recovery unit operation(s)). A stably productive FBHF cracking regime requires temperatures in excess of 450 degrees F. along a substantial portion of the flow path encountered by formation fluid as they move from their point of mobilization to the point of production. The mobilized hydrocarbons will encounter a sufficiently intense thermal environment to undergo additional cracking. As a guideline, conditions should be sufficiently harsh to allow an average extent of at least one chain scission event per 18 carbon paraffin. Ideally, conditions are established to provide a produced fluids having an average carbon number of less than 10, and preferably less than or equal to 8. Moreover, the thermally enhanced formation fluids will, on average, exhibit an increase in olefins when compared to formation hydrocarbons generated without the additional thermal exposure.

Although some cracking can be observed at lower temperatures, high efficiency thermal cracking is observed when at least a substantial portion of the thermal treatment zone (i.e. the mobilized hydrocarbon flow path) sustains temperatures of >650 degrees F. Under such conditions, thermocracking becomes an increasingly favored reaction, especially for hydrocarbons with carbon numbers in excess of 12. At temperatures of 750-1800 degrees F. cracking becomes increasingly effective, providing an increasing abundance of low molecular weight aliphatic and olefinic hydrocarbons.

Only brief (e.g. seconds to minutes) exposure to the highest temperatures can be tolerated by the mobilized hydrocarbons before yield is lost to coking and complete pyrolysis ("carbonization"). Therefore, an operator's decision to ramp up to these temperatures will depend largely on the degree of control he has over the material flow within the zone of interest. In preferred embodiments, flowing hydrocarbons encounter a time-integrated average temperature of <1700 degrees F., and more preferably, <1500 degrees F. Preferred operating conditions are those in which >50% of the actively retorting areas in a producing zone, are maintained at temperatures of 550-1800 F, and more preferably 650-1700 F, and most preferably between 750 degrees F. and 1600 degrees F. Higher temperatures, however, are preferred when the process objective shifts from olefin and alkane production to sealing of a zone for future environmental restoration or hydrogen production. This is discussed in a later example.

(E): Production of Chemical Products from Independently Controlled and Coordinated Heating and Producing Zones.

This invention discloses a series of methods and strategies for releasing volatile and fluid hydrocarbons from solid or otherwise difficult-to-recover sources. These so-called fixed-bed hydrocarbon fields (FBHFs) include oil shale; oil and tar sands; lignite and coal formations. They also comprise any combination of these or any other similarly recalcitrant high-carbon mineral deposit, such as that contained in a crude petroleum reservoir following primary or secondary recovery operations. The methods of this invention (illustrated in other examples and descriptions) allow for the development of controlled-dimension, high-temperature zones within a formation. Typically, at least about one heat injection well is coupled with one or more producing wells. In some embodiments, the number of producing wells equals or exceeds the number of injection wells. In other embodiments, the number of injection wells exceeds the number of producing wells. The area of active heating and material flow within associated injection and producing wells is generally referred to as a "zone" or "heating zone" within the formation. Each zone may be independently controlled, or it may be operated as part of a larger domain within the formation, comprising two or more zones. Coordinated operation of two or more zones can allow one to maximize the yield, utility or product value of the formation, while minimizing the adverse impact of its development. For example, the heating of some mobilized hydrocarbons to temperatures in excess of 1500 degrees F. may be necessary to achieve the desired level of cracking (e.g. to achieve desired product mixtures). Yet, achieving that level of thermal cracking throughout a formation requires excessive btu investment (e.g. unnecessary environmental and financial cost), and might possibly create local ground warming. In contrast, heating only one or a few zones up to this level in a given development, and then directing the mobilized hydrocarbons into the super-heated zone reduces this risk, and provides enhanced process flexibility and cost-effectiveness.

In one illustrative example, a stream enriched in C8-C12 hydrocarbon is generated in a first zone (say, zone AB), operating at an average temperature of 650 degrees F. A neighboring zone CD operates at an average temperature of 900 degrees F. Using producing well differential pressures, the material from zone AB is redirected to zone CD where it encounters increased temperatures and undergoes thermal cracking to produce a product stream with increased levels of light hydrocarbons and C2-C4 olefins.

(F) Development of Stable In-Situ Heated Rock Thermal Cracking Unit

In this example, the heating zone surrounding a thermal energy carrier injection well is developed into a single-column pass-through reactor characterized in terms of the minimal temperature encountered by fluids passing through the column. Typically, the "columns" are considered to be that segment of heated rock present within a developed seam extending outward 30-210 ft perpendicularly from the principal axis of the injection well (and extending about 5 feet to either side of the uppermost and lowermost injection ports along the injection well) within the injection column for lateral distance from the heating injection ports within the target deposit. While the shape is not strictly cylindrical, it approximates a cylinder with bulging end-caps.

In this example, the area surrounding the injection well (e.g., near well "W") is progressively heated to temperatures in excess of 450 degrees F. by injection of thermal energy carrier fluid at temperatures of 1000-1500 degrees F. Retorted and/or recoverable materials are produced at a producing well at least 300 ft from the injection well. This process continues until the formation attains a continuous temperature in excess of 1000 within a 150 feet radius of the injection ports. Following heating, the zone is maintained in this configuration for a sufficient time to allow formation fluids produced from at least one neighboring heating zone to contact the heated zone surrounding well W. The formation fluids produced from one or more neighboring wells undergo substantial thermocracking in transit through the well W heat zone. Once heated to temperature, the in situ cracker can be used to enhance the degree of cracking in formation fluid developed from any other heating zone within fluid communication with well W.

Preferred embodiments of the present method are those comprising one or more zones with at least about 1000 cu ft of contiguous, in situ formation rock heated to temperatures of >450 degrees F. More preferred embodiments comprise one or more zones having at least 1000 cu ft of contiguous, in situ formation rock heated to temperatures of >500 degrees F. Most preferred embodiments comprise one or more zones having at least about 1000 cu ft of contiguous, in situ formation rock heated to a temperatures of >650 degrees F. Ideally, the zone(s) is maintained at these temperatures for a time sufficient to initiate retorting and/or mobilization of recalcitrant hydrocarbon found within that zone. In preferred embodiments, these target temperature ranges are met or exceeded continuously for at least 7 days in a given month. In preferred embodiments, these temperatures are met or exceeded continuously for a period of at least 30 days.

Optionally, catalytic materials may be added to the in situ cracking unit by way of injection into natural or man-made fractures. Alternatively, catalyst may be incorporated at any point on the flow path from the point of retorting to the producing wells, or within the producing well itself. In some embodiments, wells containing regeneratable catalysts are positioned at one or more locations along a controlled formation fluid flow-path.

(F) Use of Formation Permeability to Determine Well Distances

The methods of this invention apply to both permeable and impermeable fixed-bed hydrocarbon formations. Because they apply to high permeability formations (as well as the more typical low permeability formations), fluid and heat communication over a very large volume can be achieved with these methods. For this reason, some preferable embodiments are those comprising one or more zones with at least about 10,000 cu ft of contiguous, in situ formation rock heated to temperatures of >450 degrees F., and most preferably >650 degrees F. Yet more preferred embodiments comprise one or more zones having at least one 50,000 cu ft volume of contiguous, in situ formation rock heated to temperatures of >450 degrees F., and more preferably, >650 degrees F. Most preferred embodiments comprise one 85,000 cu ft of contiguous, in situ formation rock heated to temperatures of >450 degrees F., and more preferably, >650 degrees F. In all preferred embodiments, it is intended that an active retorting and cracking environment be established such that volumetric productivity and product chemistry falls under the control of the operator. In general, longer residence times in a dilute hydrocarbon, or high moisture, environment will decrease the average molecular weight and average level of saturation of the products generated within a zone or series of zones.

Preferably, the temperature of the reservoir (except inside and immediately surrounding the fire tube or other heating source) ranges from ambient formation temperature (e.g. about 80 degrees F.) to a temperature below the total pyrolysis temperature of the carbon-carbon bond (e.g. about 2200 degrees F.; 1190 degrees C.). More preferably, one or more thermal gradients are established within the reservoir are accessible to the hydrocarbon material flowing within the formation. In the most preferred methods, the flow of mobilized hydrocarbon materials can be influenced, and even controlled through a variety of modifications made in the formation made by way of drilling, fracing, heating, and other human operations. In the specific application of this invention to high permeability kerogen formations, upper temperatures will fall below <1500 degrees F., and more preferably <1400 degrees F., due to decomposition of the interstitial matrix.

(F) Other Adjustments of Composition Through Temperature and Flow Rate

Establishing external control of the material flow and thermal environment in the formation allows the operator to conduct a series of refinery-like operations underground. Such modifications may include thermal and/or catalytic cracking (as described above), partial oxidation, reduction, and other chemical modifications such as adsorption, extraction, reformation, and the like. In preferred embodiments, the mobilized carbon materials flow in such a manner as to encounter sustained temperatures in excess of 450 degrees F., and thereby undergo chain cleavage and subsequent dehydrogenation to generate products with increased levels of desaturation. In the most preferred methods, the concentration of low molecular weight olefins generated by in situ thermal processing is increased by at least 10% over ambient production levels by controlling the temperature, flow path or residence time, or any combination of these, within the zone or overall formation. In such embodiments, preferred low molecular olefins comprise industrially important raw materials and intermediates such as ethylene, propylene, butylenes, and functionalized derivatives of these, as well as C2-C4 aliphatic hydrocarbons. In preferred embodiments, ethene or propene olefins comprise at least about 2% of the hydrocarbon produced at a producing well. More preferably, this minimal yield applies to a plurality of contiguous operating zones within a developed formation. In more preferred embodiments, unsaturated hydrocarbons comprise 5-15% of hydrocarbons produced at one or more producing wells in a FHB formation. More preferably, this minimal yield applies to a plurality of contiguous operating zones within a developed formation. In most preferred embodiments, unsaturated hydrocarbons comprise >15% of the hydrocarbon material delivered to a producing well. More preferably, this minimal yield applies to a plurality of contiguous operating zones within a developed formation. In other most preferred embodiments, the total olefin yield may be adjusted from less than about 1% of total hydrocarbon to at least 5% through external modifications of the flow path and residence time. Most preferably, the total yield of ethene and propene exceeds 2% of the total chemical production from the formation.

The methods of this invention, other referenced inventions, and methods otherwise known in the art allow one to establish in situ temperatures that are sufficient to allow chain cleavage and dehydrogenation through incomplete pyrolysis of the hydrocarbon material in conjunction with or following its mobilization from the stationery FBHF (but prior to egress from the formation at or near the surface). This is regulated both by thermal environment at or near to the point of carbon mobilization (e.g. from kerogen, bitumen, etc. . . . ) and by the cracking temperature established at the designated in situ cracking zone encountered by the newly mobilized carbon and hydrocarbon compounds. At about 750 degrees F. hydrocarbon chains are preferentially cracked near the center. As temperature increases, the preferred positions are closer to the ends of the carbon skeletons, resulting in lower molecular weight olefin products. These observations may be employed to advantage to produce chemical and fuel products. One or more zones exhibiting temperatures of substantially greater than 750 degrees F. may be used to develop a stream enriched in lighter olefins (e.g. C2-C4)

In addition to temperature, hydrocarbon cracking is managed by adjusting the residence time, the time the hydrocarbons and olefin products spend at or near cracking temperatures and pressures. Finally, extent of cracking is highly influenced by the partial pressures of the hydrocarbons in the mixture (reaction chamber). As cracking becomes a preferred reaction, the molar concentration of hydrocarbon gases increases with each chain splitting. Left unchecked, this increase in concentration will also result in an increase in partial pressure and reactivity of the shorter chain species. To counteract this tendency and decrease the partial pressure of the shorter-chain molecules another inert or nonreactive gas may be added to the combustion chamber.

(G) Use of Thermal Carrier Fluid to Deliver Heat

The methods of this invention comprise liberating highly mobile short-chain hydrocarbons (e.g. C2-C4 aliphatics, olefins, etc) from otherwise recalcitrant deposits of coals, kerogen, tar and oil sands, etc. . . . . In several preferred embodiments, the heat is injected in the formation by way of downhole combustion generators, supplied optionally with a fuel source and oxidant from surface storage facilities. In other embodiments, the fuel source, oxidant, or other helpful agents (such as catalysts, surface active agents, etc) are supplied from sources in or near the subsurface formation. In some preferred embodiments, the thermal energy and/or thermal energy carrier are injected in from surface sources following one or more preheating operations.

In the most preferred embodiments the thermal energy carrier comprises superheated steam. The injection of the steam into the high permeability FBHF allows for substantial heating of the bed matrix, and also allows substantial conductive heating of the surrounding low permeability zones. Moreover, the aqueous nature of the thermal carrier allows rapid establishment of a sustainable material flow and heat flow through the operational portion of the formation. Establishment of a predictable, low resistance flow path for the thermal carrier and for the mobilized carbon fractions represents an important feature of the present invention.

Establishment of flow pattern may be done in almost any configuration that allows fluid communication between the heat injection bore and one or more surrounding well bores. This flow allows for the systematic, controllable heating of that portion of the formation immediately surrounding the flow path. The rate of energy transfer to the formation decreases as a function of the distance from the injection bore. Meanwhile, the most highly active retorting occurs at or near the heat front as the temperature achieves, then exceeds about 480 degrees F. As the hydrocarbons and other carbon compounds are mobilized [e.g. by partial pyrolysis of the kerogen (bitumen, tar or oil sand materials, etc. . . . )], they will flow in a direction that is opposite to the direction of the heat flow. This means that high molecular weight product rendered mobile through cracking from the kerogen mineral source begins to flow from lower temperature to higher temperature portions of the formation. This tendency can be overcome by under-pressuring the producing well (e.g. with negative relative pressure to the rest of the formation). In this example, the operator has control of several parameters that determine the chemical fate of the mobilized carbon compounds. These include one or more of the following:

a) the temperature gradient, e.g. the range of temperatures to which the compounds will be exposed as they pass from the point of mobilization to the harvest bore b) the pressure, indirectly, through establishment of a horizontal or partially vertical flow path (the shallow depths equating to lower pressures)

c) the residence time of the mobilized carbon compounds through control of the overall material flux through the engineered portion of the FBHF.

d) Through a combination of: the kinetic energy of the injected thermal energy carrier (whether generated in downhole combustor) or a surface boiler.

Any of these may also be adjusted to modify the flow rate or direction moreover, adjustments described elsewhere herein may be available to the operator for the purpose of controlling and/or biasing flow of hydrocarbons and TECF through a selected portion of a formation (e.g. a particularly high temperature zone).

Often, a heated zone useful in the cracking and/or refining of a hydrocarbon stream may comprise an in situ heating element. Conversely, an in situ heating element may comprise such a zone. In either case, the in situ heating element is employed to advantage in producing desired hydrocarbons from a formation comprising one of more carbonaceous deposits. Adjustments and options available to control an in situ heating element are also relevant to controlling the thermal history of a hydrocarbon product stream in the present example.

Because the thermal injection rate, materials flow rate, and material flow path (and potentially pressure) are largely within the control of the operator, the operator has a surprising level of control over the nature and distribution of the products. In one example, after the formation has reached a temperature of ≥500 degrees F. within 10 feet of the injection bore the operator adjusts the system (e.g.) to maximize thermal injection rate, while minimizing mobilized carbon harvest rate. The result is that the mobilized carbon materials experience prolonged exposure to temperatures in excess of 500 degrees F. This results in progressive cracking of the mobilized carbon compounds, shifting the distribution of products from C13-C24 paraffins and heavy oils toward lighter C2-C12 hydrocarbon species.

(H) Enhanced Olefin Production Through Externally-Controlled Formation Temperature and Pressure Gradients The methods of this invention comprise an array of methods for mobilizing carbon-containing compounds from fixed-bed hydrocarbon fields using combustion and other heat injection strategies. As hydrocarbon (and other mobile carbon species) are mobilized using the methods of this invention, they begin to move through a formation according to the pressure, temperature and overall bulk flow properties prevailing in that local region of the formation. Controlling migration of saturated and unsaturated mobilized compounds proves a surprisingly effective means of generating preferred distributions of olefins and other hydrocarbons having substantial fuel and petrochemical value.

In one example of formation flow control, a negative relative pressure is established in or around one or more producing wells. The greater the negative differential is between this (or these) producing well and other (ambient pressure) producing wells, the greater will be the draw of the low pressure well on the material flow. As such, it will begin to provide an attractive path of egress even for hydrocarbon materials liberated by heat from non-neighboring injection wells. Carbon compounds migrating from non-neighboring injection wells will, of necessity, encounter multiple high temperature zones in making the trek to the pressure sink. This increased temperature and residence time will serve to increase both the extent of thermocracking within such populations. As a result, the production of lower molecular weight aliphatics and olefins will increases in such wells in comparison to that seen in the "normal" injection well-to-neighboring producing well schemata.

By overpressuring some potential production well and underpressuring only a fraction of the producing wells present in a formation also enhances thermocracking and the overall production of lower molecular weight aliphatic and olefinic hydrocarbons.

In the present invention, carbon compounds are mobilized by retorting of kerogen, bitumen, coal, lignite beds or other similar FBHFs. Chemically, this mobilization occurs when organic matter found within these natural resource mineral beds undergoes partial pyrolization to liberate hydrocarbons or related compounds. As hydrocarbon is mobilized it begins an often arduous molecular path from the retort site toward the production well. In preferred embodiments, the retort front is established within the formation as the point in the heat front (or overlapping heat front at which the temperature first exceeds about 480 degrees F. It is at this point that pyrolysis begins in abundance. As the heat front continues to propagate toward an equilibrium overlap with other heat fronts, the active retort zone (positioned between the retort front and the injection well) continues to heat, often reaching temperatures in excess of 900 degrees F. in the process of localized. As the temperature approaches 2200 degrees F. organic matter begins to undergo complete pyrolysis.

It is well known in the hydrocarbon cracking art that higher olefins can be obtained readily through steam-based thermal cracking of higher molecular weight paraffin fractions. For example, high wax (C20-C30) fractions are often employed in the industrial production of alpha-olefins. The so-called wax cracking process is carried out at temperatures from about 500 degrees to 600 degrees C. at ambient or slightly elevated pressures and extended residence times (of seconds to minutes). In this process, thermal cracking of the higher molecular weight species can occur at any point in the carbon-carbon backbone. Moreover, by maintaining conversion rates below 50%, preferably below 40%, and most preferably, below 35%, the zero order kinetics of an intra-molecular reaction will be favored over the higher order kinetics of multi-reactant chemistry. Therefore, linear olefins are the predominant products. Moreover, the lower conversion rates also favor the formation of the double bond at the site of C—C bond cleavage, i.e. the alpha position of the daughter hydrocarbons. In the FBHF refining operations described here, the operator may shift toward lower molecular weight products by increasing the integrated time and temperature history of the hydrocarbon population. This is done by decreasing the product egress rate (increasing residence time) and/or by rapid heating of formation flow-path to expose the average mobilized carbon species to temperatures in excess of >480 degrees F., and preferably to temperatures of in excess of 500 degrees F., and more preferably to temperatures in excess of 600 degrees F.

(I) Development and Utility of Complete Pyrolysis Domains within a Formation

Development of a highly carbonized and/or complete-pyrolysis zone of a formation can be used for a variety of two beneficial purposes. Such zones comprise an abundance of carbonaceous coke, and in extreme cases may begin to develop graphite-like and carbon fiber structures. In the present invention such high-coke deposits may be employed to advantage. First, it can be used to create a high thermal conductivity region in the formation that allows subsequent retrograde processing (or well reversal) to proceed at a dramatically enhanced rate. Second, it is used to transform potentially leachable natural hydrocarbons into a stable ground state structure with no known environmental liabilities. As such, high temperature pyrolysis of spent FBHF provides one of the most promising and persistent vehicles for aquifer protection and restoration yet encountered in the field of mining and mineral resource recovery. It constitutes a high-volume, high-capacity adsorption matrix. Over time, this matrix may be used to eliminate both residual chemicals and hydrocarbons from both in situ production systems and, perhaps, contaminated water from other sources.

In one embodiment, a highly carbonized pyrolysis zone comprises an in situ heating element. In a further embodiment, very high temperatures and pressures are applied to such a zone to produce crystalline carbon structures. In a specific embodiment, the carbon structures comprise diamond, graphite and/or fibers.

Following mobilization, the hydrocarbon materials may encounter a variety of physical conditions ranging from the torturous, high-temperature migration path, in which maximal temperatures in excess of 1000 degrees F. are encountered and time-average temperatures in excess of, e.g. 700 degrees F., are encountered for a period of days or weeks. While this pathway results in a high rate of complete pyrolysis, it also generates a disproportionate abundance of low molecular aliphatics and olefins owing to the nearly complete pyrolysis of higher molecular weight materials.

(J): Formation Temperature, Permeability and Other Properties to Modify Product Mix The methods of this invention contemplate a variety of time-temperature exposure regimens available for the control and production of fuel and petrochemical raw materials from FBHFs. Among these are several important temperature ranges between which occurs a dramatic change in the nature of raw materials that are migrating through the formation and the nature of the products generated at the producing wells. It is important to note that each cracking (e.g. pyrolysis) reaction results in a molar increase in hydrocarbons, and a commensurate increase in hydrocarbon partial pressure. Left unchecked this can lead to an unwanted abundance of polymerization and condensation reactions. As the temperatures increase within the formation, and cracking becomes increasingly favored, this can become a particular concern. Under these conditions, the operator may elect to counteract the unwanted reactions by decreasing the partial pressure of hydrocarbons. This can be done in a variety of ways without a decrease in temperature. Such methods include, but are not limited to the addition of another foreign (usually nonreactive) gas such as steam, nitrogen, argon, air or the like. Without seeking to limit the application of the present invention, we offer here a set of examples illustrating the use of formation temperature to modulate the production of various hydrocarbon and petrochemical products. To do so, we describe the operation of the formation-based refinery under four discrete temperature regimes. Many other possibilities will be evident to one of ordinary skill in the art.

Example 18 (J)1

T<480 degrees F. (235 degrees C.): At these formation temperatures, hydrocarbon mobilization occurs primarily for that fraction already present in liquid form within the formation. The temperatures are insufficient to induce significant cracking of mineralized organic compounds such as comprise kerogens, bitumens, heavy paraffins coals and the like. This heating step can be used to purge existing hydrocarbon from the formation, increasing formation permeability and establishing hydrodynamic control of the developed portion of the formation. Typical products include, but are not limited to, natural gas and light petroleum products.

Example 18(J)2

480 degrees F. (235 degrees C.)≤T≤610 degrees F. (305 degrees C.): In this temperature range, active retorting of kerogen and other high molecular weight hydrocarbon and petrochemical precursors can occur, but at modest rates. Moreover, these temperatures fall below the critical temperatures of the industrially important C2-C4 aliphatic and olefinic hydrocarbons. Without external modulation of formation pressures, much of the highly desirable C2-C12 hydrocarbon fractions will remain in liquid form. In contrast, temperatures across this range exceed the critical temperature of methane (191 degrees C.). Therefore, conditions can be established that allow for the selective cracking and rearrangement of hydrocarbons to release a highly enriched C1 volatile product stream (with some presence of C2). More importantly, the temperature range discussed in this example allows the operator to establish a stable, flowing environment within the formation that allows for slow, but progressive cracking of liquid phase hydrocarbons. Since this cracking occurs in the context of a highly concentrated liquid environment, the olefins produced are available for a wide range of rearrangement, polymerization and reformation reactions. Such reactions can provide either alternative targets for subsequent cracking reactions (e.g. result in no-yield), or a variety of paraffins, aromatics and olefins of modest length (carbons numbers of 6-20).

Example 18(J)3

610 degrees F. (305 degrees C.)<T<815 degrees F. (420 degrees C.): These conditions favor very high retorting activity, and the ongoing pyrolysis (cracking) of hydrocarbon and related products present within the mobile vapor and fluid phases. The high-level sustained cracking environment favors the production of hydrocarbons with decreasing size and increasing mobility. This temperature range lies above the critical temperature of most C2-C4 (at modest formation pressures) fuel and petrochemical products allowing efficient egress and production of these important gases. Depending on formation conditions, including permeability, state of development and the degree of over-pressuring or under-pressuring of producing wells, production can be modulated to favor production of the saturated and unsaturated C2-C4 gases. For example, at atmospheric pressure, an average temperature of greater than 698 degrees F. (370 degrees C.; the critical temperature of propane) but less than about 797 degrees F. (425 degrees C.; critical temperature of butane) will favor rapid production of the C2-C3 hydrocarbons and butene, but produce less of the saturated C4 products due to a large portion of C4's remaining in the liquid state (e.g. with other higher molecular weight products). As the formation temperatures exceed 800 degree F., butane is also fully volatilized. At about 880 degree F. (470 degree C.), butenes and pentanes begin to become completely volatilized as well. At actual formation pressures, these boiling points increase substantially. Well controlled thermal ramp-up of formation temperature and material flow thus allows one to define product composition to substantial degree. At the temperature described here, thermocracking is highly favored and hydrocarbons of greater than C12 are rapidly reduced in molecular weight to lower molecular weight products, so that there is a general shift from high-molecular, high viscosity liquid hydrocarbons, toward lower molecular weight, increasingly volatile species.

Example 18(J)4

T>815 degrees F. (420 degrees C.): These are high cracking conditions in which high yield of low molecular weight olefins and low molecular weight aliphatics can occur on an ongoing basis. Light paraffin and olefin yield continue to increase, and deposition of coke and carbon filaments occurs in abundance in this range.

(K) Type Examples Using Producing Well Differentials to Modify Product Mix

The present invention provides methods for modulating the thermal exposure of hydrocarbons generated from a variety of FBHFs. In a first set of examples (above), the modulation of product mix was controlled primarily through the average temperature present within a given operating zone (e.g. a localized coupling of one or more injection wells with one or more affiliated producing wells). In another embodiment, this invention comprises controlling the time-temperature exposure history of a subsurface hydrocarbon stream mobilized from one or more FBHFs by conducting the flow of the material across multiple operating zones within a formation. For example, a mobilized hydrocarbon stream generated by the retorting of a kerogen deposit (e.g. "zone A") locally associated with an injection well described here as well I(A) would normally flow to deliver product at an associated producing well P(A). By closing or over-pressuring P(A), or under-pressuring a more distant producing well, however, an operator may conduct the material generated in formation domain A through additional high temperature zones (associated, e.g., with injection wells, B, C, D, etc. . . . ). The result will be an increase in the overall level of modification or pyrolysis even though the average temperature associated with zone A has not changed substantially. Controlling the material flow path can be done through manual, automated, computer or clock-controlled interventions. Product recovery and flow decisions can also be interactively based on the absence or presence of desirable product mix within a given zone. As a category of intervention, we refer to this strategy for modulating product mix by use of alternative producing wells as "directed product migration" or DPM.

In one embodiment, directed product migration is used to increase residence time of a material to a relatively constant set of thermal and reactive conditions. In another embodiment, DPM is used to direct materials through more of a series of increasing reactive thermal or chemical environments. In yet another embodiment, DPM is used to expose flowing material to a brief, but extreme set of reactive or thermal conditions. For example, brief exposures to temperatures in excess of 900 degrees F. (~468 degrees C.) are used industrially to conduct high severity cracking of linear and aromatic hydrocarbons. Within a formation, DPM may be used to conduct a mobilized hydrocarbon stream through one or more high temperature (e.g. >900 degree F.) zones, such as might be associated with an injection well that is either older or running at higher btu than I(A). Such strategies mean that extreme conditions maintained in one portion (e.g. zone) of the formation are available to material streams originating in other zones within the formation. Moreover, the entire formation need not be heated to extreme levels simply because one zone is depleted of retortable material.

These examples are used purely as illustrations of the use of the present invention. They are not intended in any way to limit the application or breadth of the invention. Many more examples of effective use of the invention will be evident to one of ordinary skill in the art.

Example 19

In Situ Refining of Ex Situ Hydrocarbons

In one example, hydrocarbons such as oil or tar and/or heavy paraffins (all referred to in this example as "heavy hydrocarbon") are delivered to an ex situ cracking or refining operation. The delivery of the material to the surface near the in situ operation is typically by pipeline, rail tanker or tanker truck. From a surface pipe or vessel, the ex situ hydrocarbon is injected into a formation so as to contact an in situ heating element and/or undergo at least one cracking reaction in situ, following which the cracked ex situ hydrocarbon fluid is produced from the formation through at least one opening.

Example 20

The Role of Differential or Directional Heating in the Operation of the Invention In an embodiment, the present invention provides an in situ hydrocarbon mobilization and conversion system and/or method comprising at least about one substantially heated portion of a permeable formation, at least about one substantially less heated portion of a permeable formation, and at least one operator-controlled fluid phase in fluid communication with both the heated and the less heated portions. The substantially less heated portion may provide structural strength to the formation and/or confinement/isolation to certain regions of the formation. A processed oil shale or FBCD formation may have alternating heated and substantially unheated portions arranged in a pattern that may, in some embodiments, resemble a checkerboard pattern, or a pattern of alternating areas (e.g., strips) of heated and unheated portions. In certain embodiments, an unheated or less heated portion of the formation provides: a location for in situ condensation, a location for storing certain formation fluids and hydrocarbons, and/or a hydrodynamic or hydro-stationary diffusion barrier for certain formation fluids.

In an embodiment, a heat source or heated TECF stream may advantageously heat only along a selected portion or selected portions of an otherwise substantially developed section of a formation. For example, a formation may include several carbon-rich (e.g. hydrocarbons) layers. One or more of the carbon-containing layers may be separated by layers containing little or no carbon materials. A heated thermal energy carrier fluid may be injected from an injection well into a plurality of discrete carbon-rich layers found within a formation (for example, while avoiding the lower carbon zones). This creates a plurality of high heating zones that may be separated by low heating zones. In an embodiment the high heating-zones may be disposed adjacent to hydrocarbon (or carbon) containing layers such that the layers may be heated from the periphery inward. In these embodiments, a substantial portion of the heating occurs by way of conduction or convection from the periphery into the hydrocarbon deposit. More preferably, the thermal energy carrier fluid passes through at least a portion of the hydrocarbon layer such that a substantial portion of the heating occurs by way of direct transfer from the thermal energy carrier fluid to the hydrocarbon deposit.

In a further embodiment, TECF flows through a high permeability aquifer (and/or zone and/or stratigraphic layer) adjacent to a low permeability, carbon-rich layer. Heating of the low permeability carbon-rich layer may be by direct contact of hot TECF with the carbonaceous material in the carbon-rich layer, or by indirect contact (e.g by thermal conductivity). In one preferred embodiment, a method of heating the carbon-rich, low permeability layer comprises contacting one or more edges of the low permeability, carbon-rich layer with heated, formation injected TECF. In another preferred embodiment, a method for heating a low permeability carbon-rich layer adjacent to a high permeability zone comprises heating an adjacent high permeability zone (e.g. by injection of hot TECF) to temperatures sufficient to allow thermal conductivity heat transfer and subsequent retorting or mobilization of one or more carbonaceous materials found in the carbon-rich zone. In an embodiment, the invention is a method of rendering permeable a layer or zone previously regarded as non-permeable or as having low permeability by a means comprising retorting materials in the low permeable zone substantially by thermal conduction from one or more adjacent high permeability zones. In an example, thermal conductivity retorting may proceed from the edges of the carbon-rich layer inward. A substantially impermeable layer may be subjected to formation fracturing as described elsewhere herein so as to enhance conversion of a low permeability zone to high permeability.

Figure 17A:
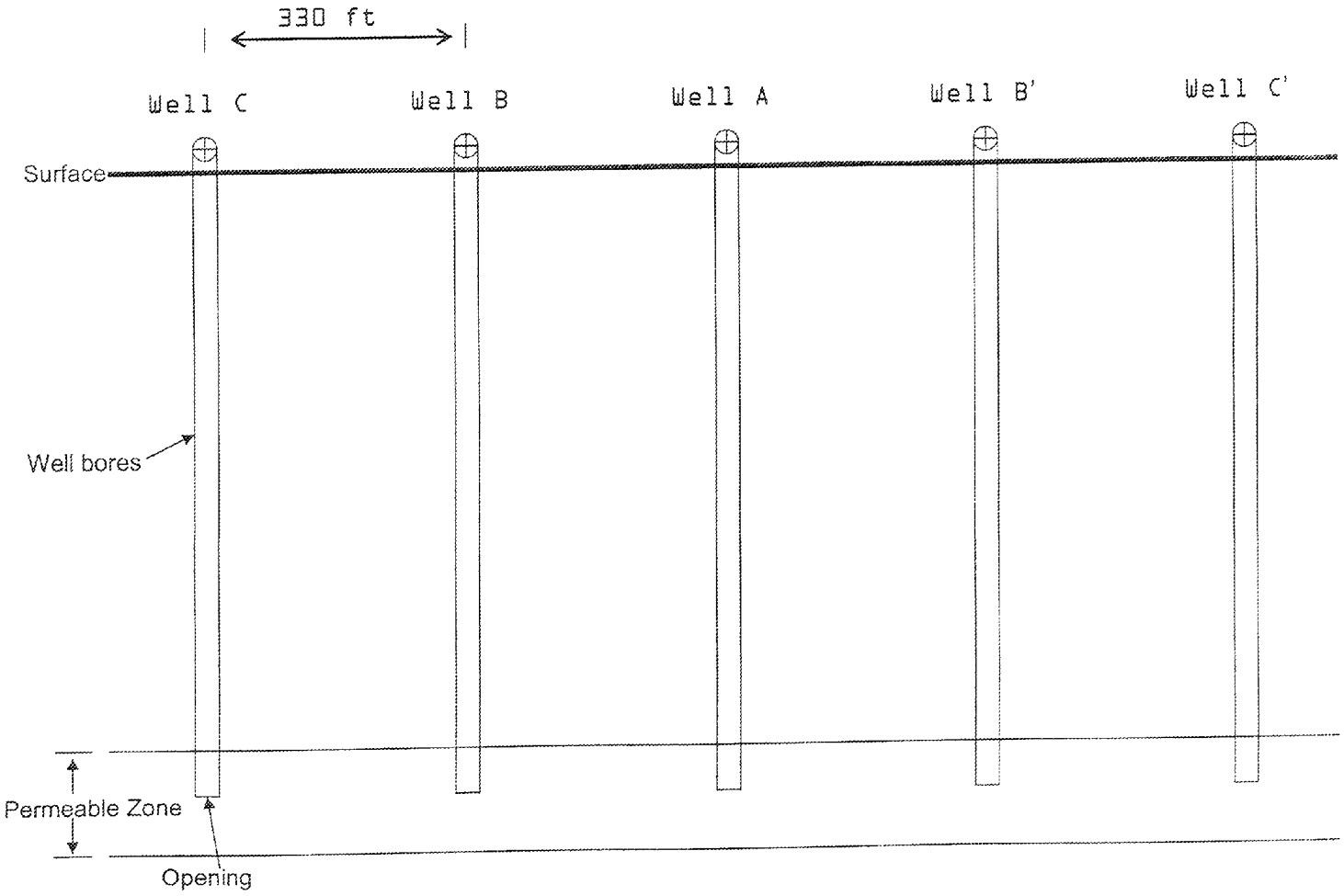
FIGS. 17*a*-17*g* are a series of side-view illustrations showing one example of the development of a fractured, propped and hydrocracking or catalytic cracking zone in a formation. In (a) a series of wells (e.g. A, A', B, B', C are drilled into a formation so as to form a series of openings in a permeable zone of the formation. In (b) a series of treated zones (shaded ovals) are shown, the zones being heated using the methods of this invention. In (c), TECF is injected into the selected permeable zone of the formation through the well bore of Well A and produced, optionally with formation fluids, from Wells C and C'. In the cross-sectional views, the arrows show the prevailing flow of TECF through the formation. The hatched areas surrounding the opening of well bores B and B' indicate lower permeability portions of the formation (or, optionally, carbon-rich, or intermediate access points for addition of material). In (d) hydrogen and/or other reductants is supplied to the formation by injection through the openings of Wells B and B' in the hatched portion of the heated zones. In (e) an alternative embodiment is illustrated in which a plurality of hydraulic fractures (jagged line segments in the portion of the heated zone near the Well B and Well B' openings). In (f), the fractured zones prepared in (e) are shown with the TECF flow vectors also illustrated.
Figure 17B:
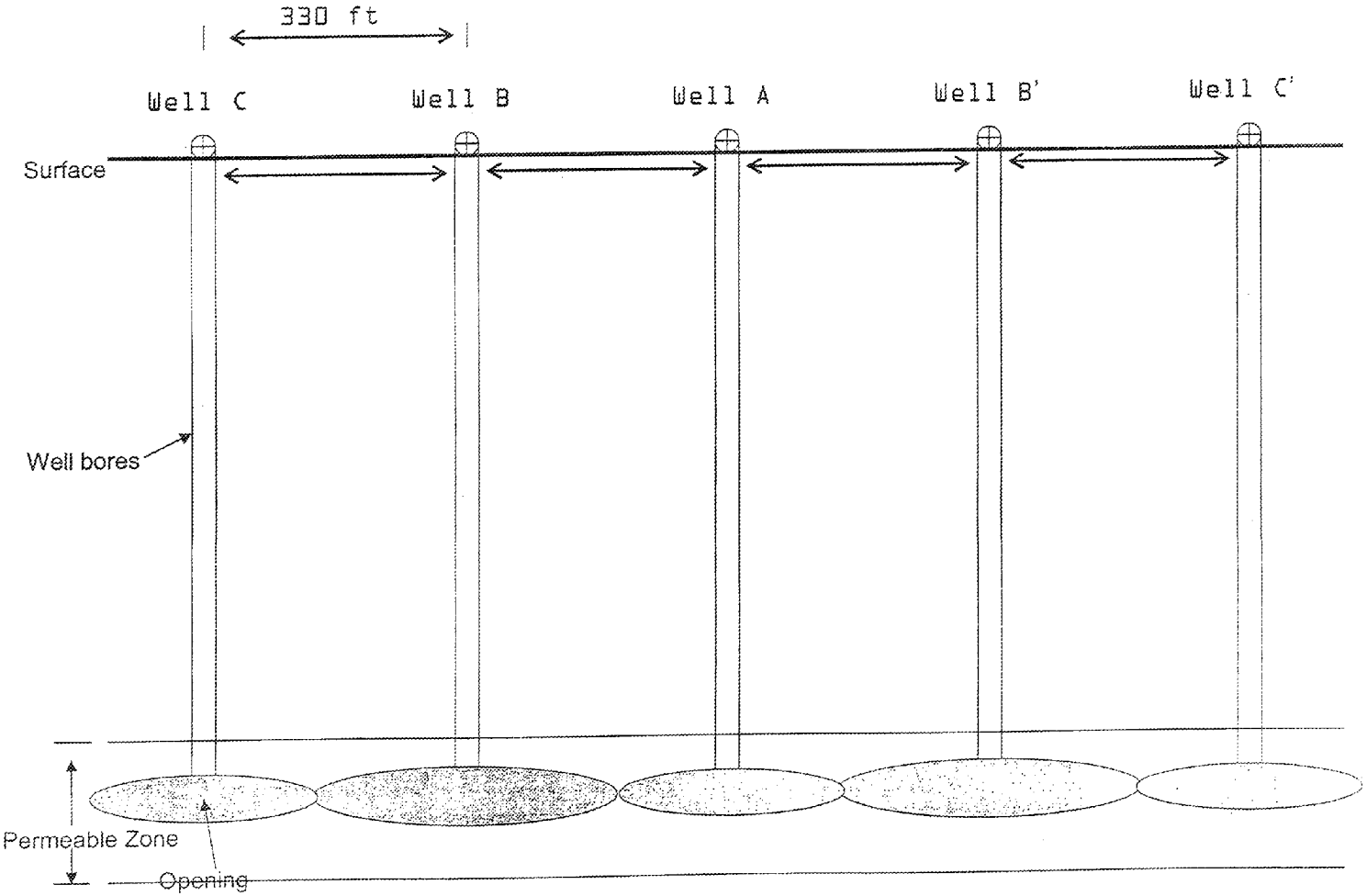
Figure 17C:
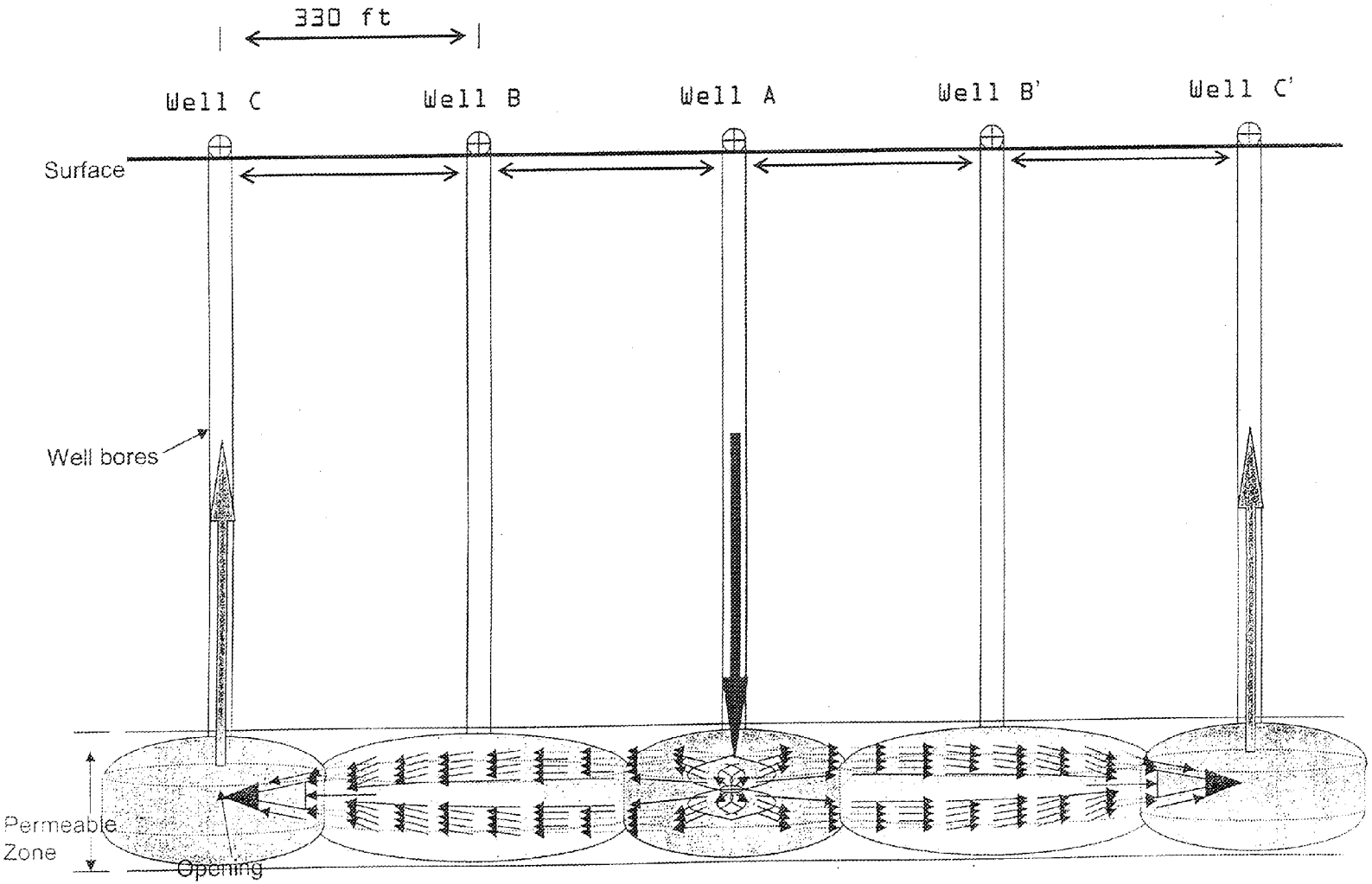
Figure 17D:
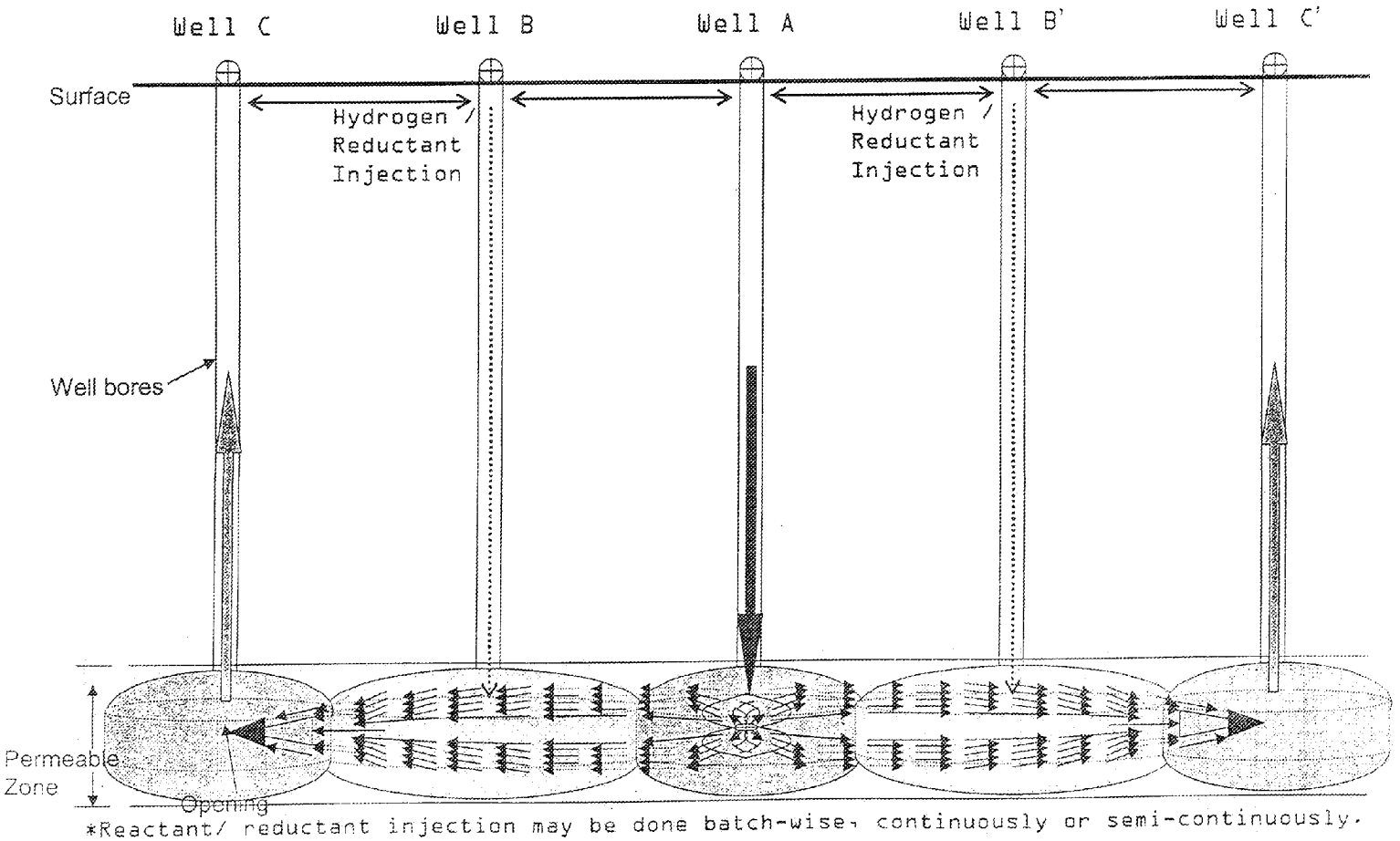
Figure 17E:
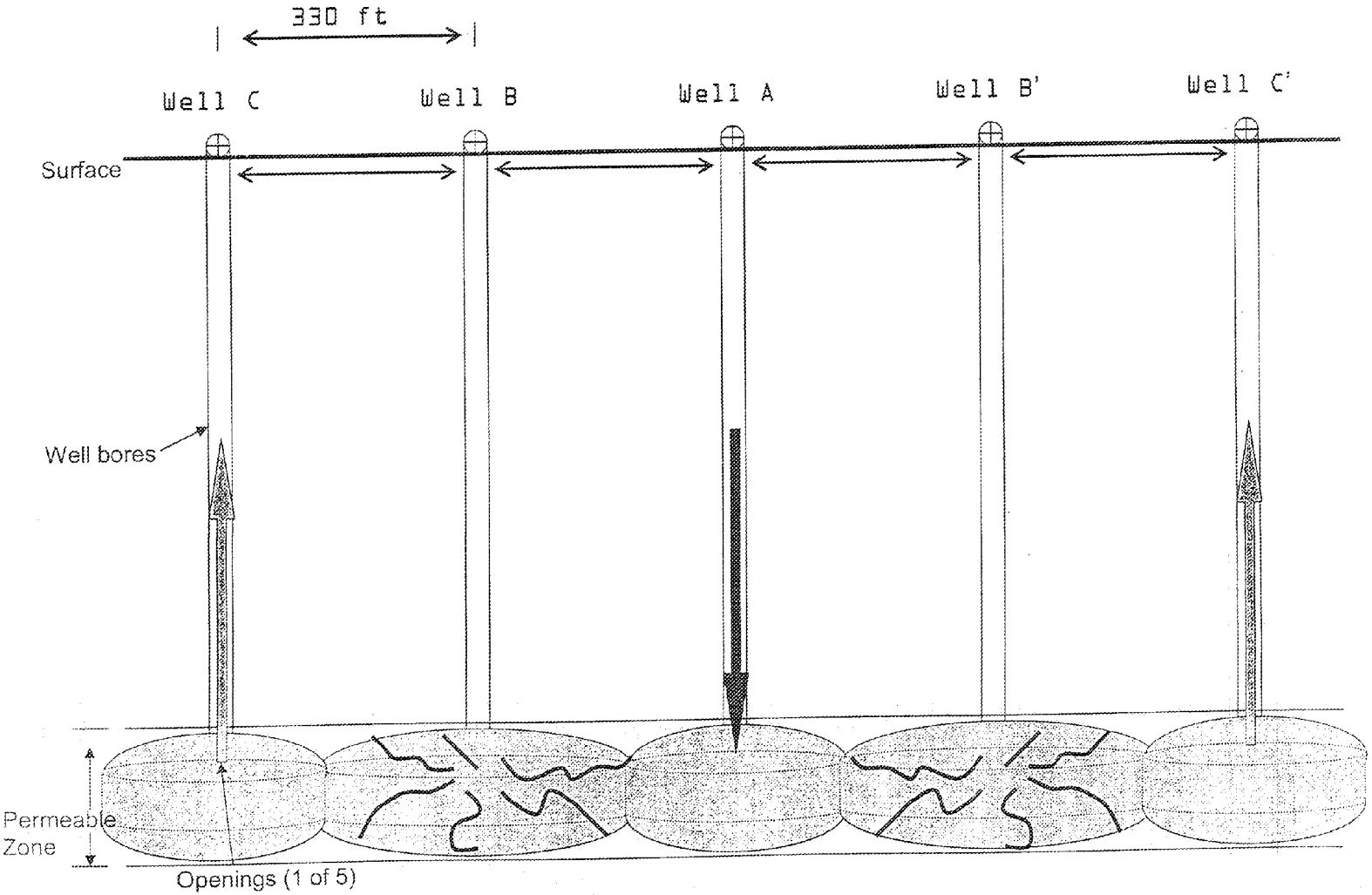
Figure 17F:
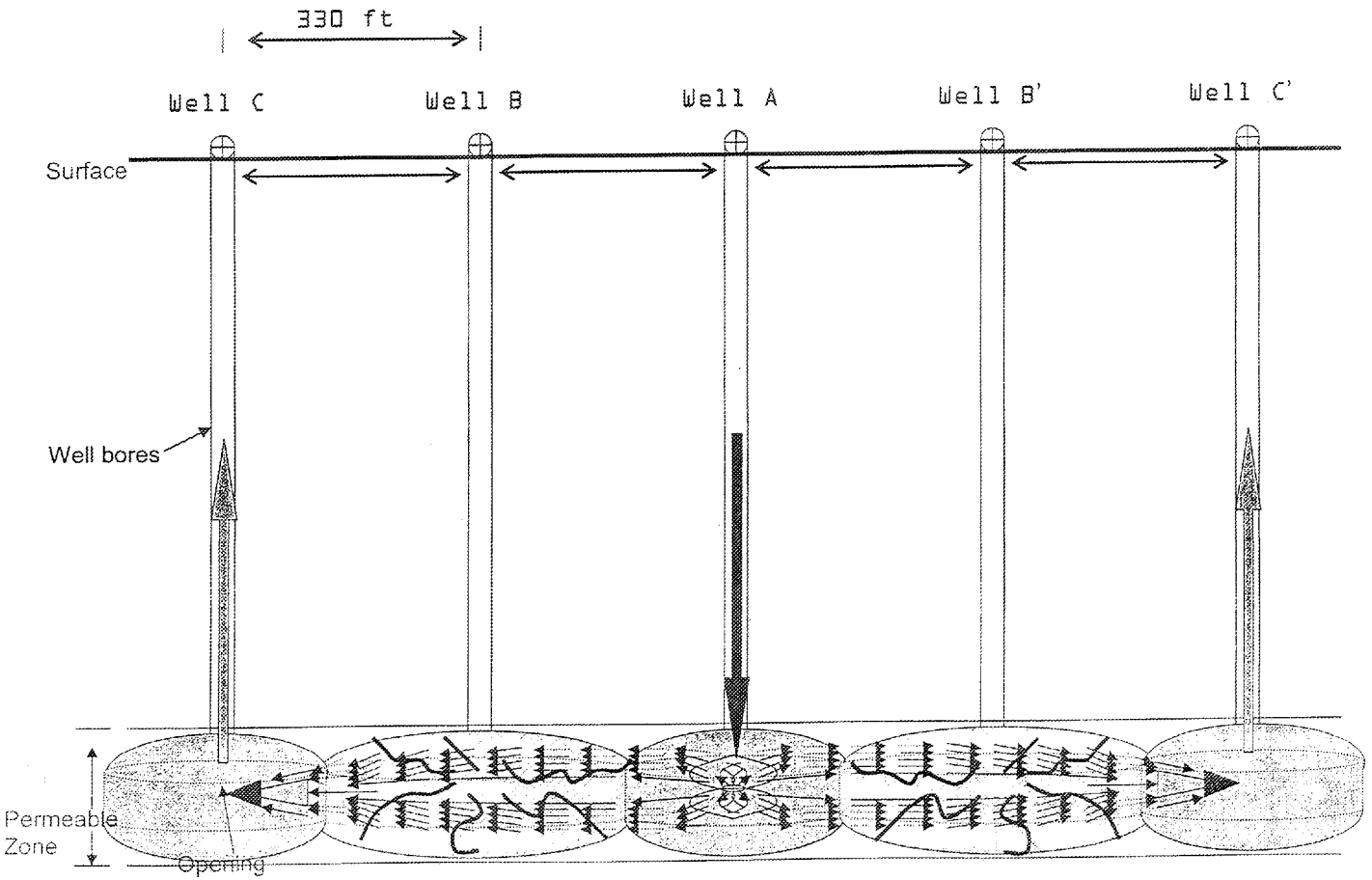
Figure 17G:
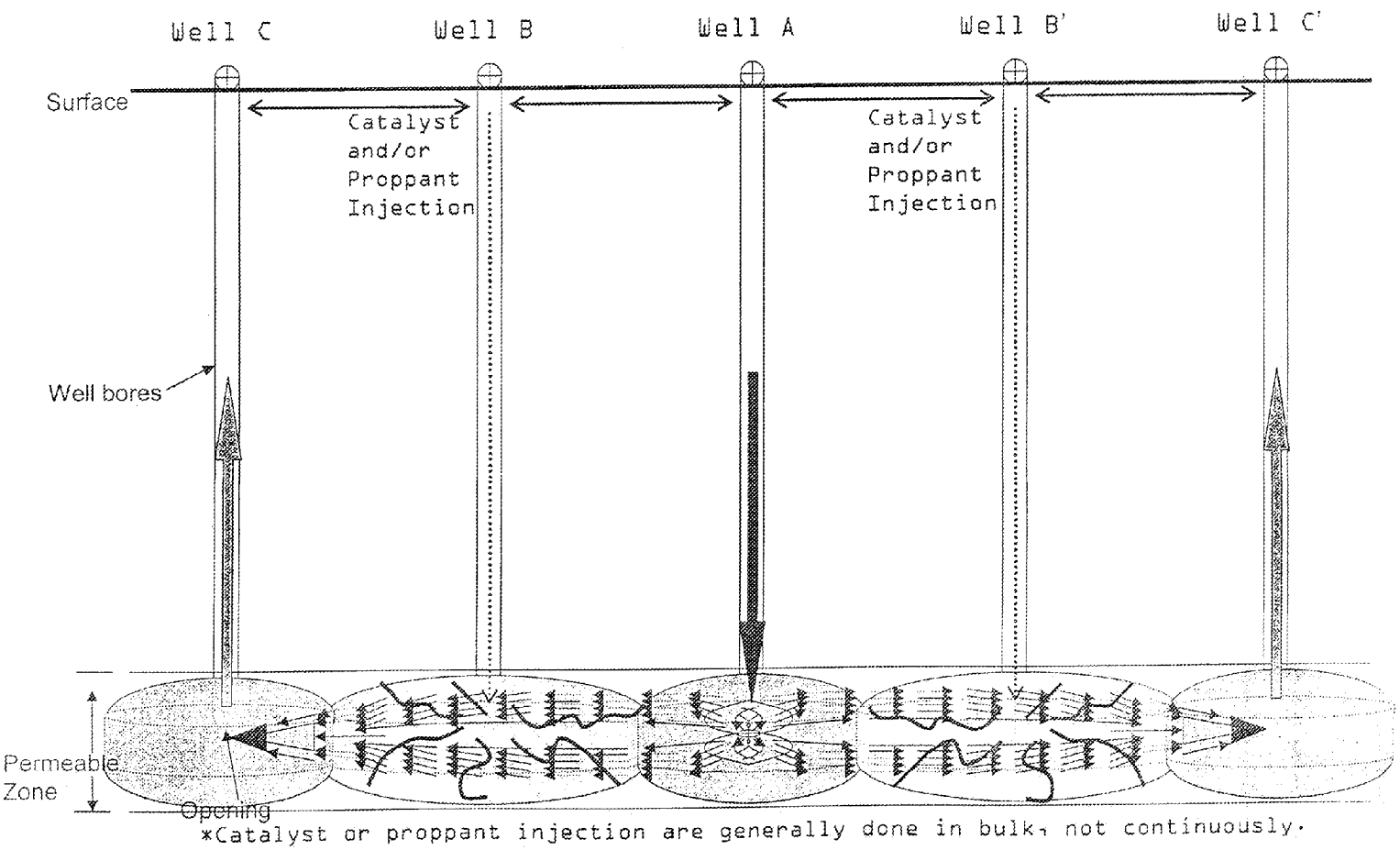

FIGS. 17*a*-17*g* are a series of side-view illustrations showing one example of the development of a fractured, propped and hydrocracking (d) zone or catalytic cracking (g) zone in a formation. In (a) a series of wells (e.g. A, A', B, B', C are drilled into a formation so as to form a series of openings in a permeable zone of the formation. In (b) a series of treated zones (shaded ovals) are shown, the zones being heated using the methods of this invention. In one example, each heated zone comprises an in situ heating element. In (c), thermal energy carrier fluid is injected into the selected permeable zone of the formation through the well bore of Well A and produced, optionally with formation fluids, from Wells C and C'. In this cross-sectional view, the arrows show the prevailing flow of TECF through the formation encountering the openings of well bores B and B' in transit from Injection Well A to Injection Wells C and C', respectively. The hatched area surrounding the opening of well bores B and B' indicate lower permeability (or, optionally, carbon-rich) portions of the formations to be fractured and treated with at least one additive. In (d) hydrogen and/or other reductants is supplied to the formation by injection through the openings of Wells B and B' in the hatched portion of the heated zones. In (e) an alternative embodiment is illustrated in which a plurality of hydraulic fractures (jagged line segments in the portion of the heated zone near the Well B and Well B' openings). In (f), the fractured zones prepared in (e) are shown with the TECF flow vectors also illustrated. FIG. 17*g* illustrates the addition of proppant and/or catalyst material to the fractured region of the formation illustrated in (f). In other examples, additional heated TECF may be injected into Wells B and B' so as to make the heated zones surrounding the formation openings surrounding well bores B and B' super-heated zones. Mobilized hydrocarbons flowing through the additive-enhanced zones surrounding the formation openings of well bores B and B' (e.g the hatched areas) shown in (d) and (g) undergo modification based in part on the nature of the additives supplied to those portions of the formation. When cracking catalysts, supplemental hydrogen or additional heat are added to these zones, they become increasing active as cracking and refining zones.

Figure 18:
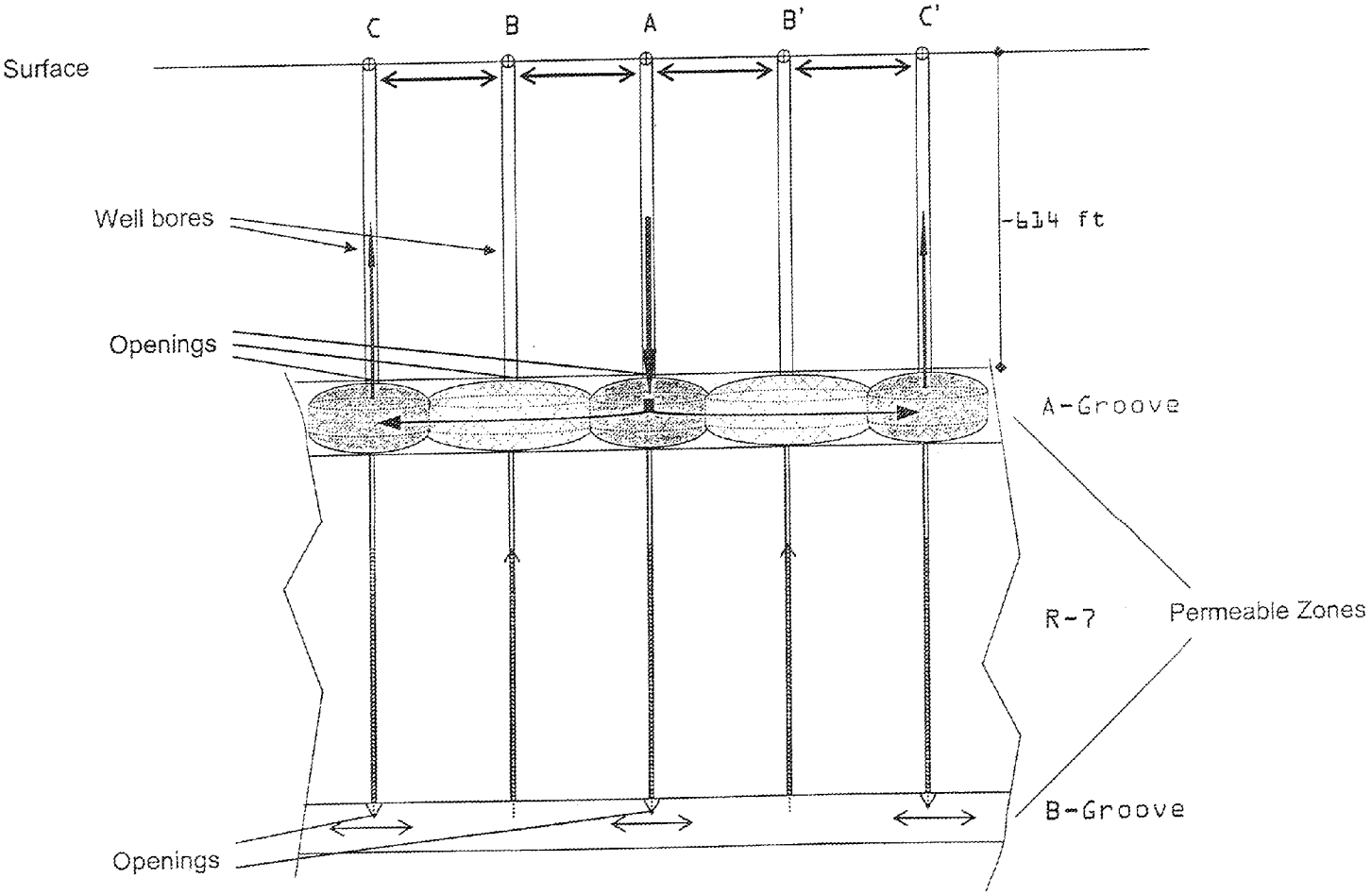
FIG. 18 illustrates an operation such as that shown in FIG. 17*d* or 17*g* being conducted in a permeable A-Groove of FBHF with simultaneous treatment of another (lower, B-Groove) portion of the formation.

FIG. 18 illustrates an operation such as that shown in FIG. 17*d* or 17*g* being conducted in a permeable A-Groove of FBHF with simultaneous treatment of another (lower, B-Groove) portion of the formation.

Example 21

Influencing and/or Controlling In Situ Hydrocarbon Chemistry and Subsequent Hydrocarbon Production Through Operational Adjustments and Additions The methods of this invention provide for a high level of operator control over an integrated in situ retorting, refining and/or hydrocarbon mobilization operation. Some elements of control are exercised at the design and development stage. Others become significant only once an active retorting and/or refining has begun. Many of the methods comprising this invention allow an operator to influence chemical transformations that occur substantially in situ. Previous examples illustrate thermodynamic control an operator may exercise over a formation developed using the methods herein. In this example, we describe additional strategies by which an operator may exercise increasing levels of control over the product generated by the in situ retorting and refining systems of this invention.

While formation interstitial pressure is largely independent of operator intervention (e.g. determined by formation depth), injection pressure and producing well pressure can be adjusted to help direct flow of material within a developed segment (e.g. a zone) of a formation so as to control and/or modulate the potentiometric surface experienced by diffusible agents present and migrating within the formation. In addition, elevated temperatures and controllable thermal gradients can be established and adjusted within hydrocarbon-rich formations using external decision-making and input functions. As such, a high degree of temperature control exists within the hydrocarbon-rich formation. In this invention, temperature typically is adjusted upward over an extended ramp-up period that may last weeks, months or even years. In some preferred embodiments, this ramp-up continues until >75% of the retortable material has been removed. In other preferred embodiments, the ramp-up continues until total pyrolysis of residual hydrocarbon has occurred in at least a majority portion (>50%) of one or more heating zones.

One objective of the temperature ramp-up is to create a stable and expanding retort front capable of releasing an abundance of mobile, high-molecular weight hydrocarbon (e.g. hydrocarbon structures having skeletons comprising about 5-5000 carbon atoms). Ramping slowly prevents over-pyrolysis of entrained or otherwise formation-bound carbon compounds. In these methods, heat is injected into the formation by any number of means, including but not limited to the injection of a preheated carrier fluid or vapor, the development of a downhole combustion process within the formation, and/or other methods. In preferred methods, steam, combustion gases and, optionally, oxidants are fed into one or more subsurface heating chambers and used to achieve temperatures in the chamber exceeding at least about 750 degrees F.

Establishment of an effective retort zone within the formation generally requires sustained temperatures in excess of 450 degrees F., although temperatures of >500 degrees F. are preferred. In general, the injected heat source (e.g. carrier fluid) will be at least 200 degrees F. greater in temperature than the desired target temperature. More preferably, it will be at least 400 degrees F. greater than the necessary retort temperature. With additional heat being supplied to and through the injection well, the temperature near the injection well will increase to well above the retort temperature, and the retort front will expand outward from the well. The zone between the injection well and retort front will rapidly reach temperatures well in excess of 500 degrees F. Given sufficient time and heating, it will exceed temperatures of >650 degrees F. At this level hydrocarbon cracking is a thermodynamically preferred reaction, and it affects any class of hydrocarbon compound entrained in flowing through, or otherwise contacting the heated zone. The present invention describes the use of such "hot zones" (e.g. such as those between the injection well and retort front; also referred to herein as secondary heating zones) to produce low molecular hydrocarbons and petrochemicals. The mobile hydrocarbons encountering such hot zones may derive from materials retorted nearby (e.g. within that specific heated zone) or from elsewhere in the formation, having been conducted through the hot zone by one or more formation flow patterns established by any intelligent means (e.g. automated or human). Generally differential pressures and potentiometric surfaces operating within a selected segment of a formation are under the control of an operator or intelligent system and are used to modulate flow of formation fluids. In these examples, formation hydrocarbons contacting a secondary heating zone are often derived from a primary heating zone (and retort front) associated with a different injection well than the one associated with the secondary heating zone.

Economically recalcitrant organic deposits may include tar and oil sands (e.g. bitumen); oil shale(s) (e.g. kerogen); coal and/or lignite formations; and petroleum fields at or beyond their tertiary stage of recovery. These high-organic fields may contain mineralized or liquid carbon compounds, or both, but share the feature that the carbon present in the field is difficult (or impossible) to recover economically using methods known in the art. Whether it is found in liquid or solid form, the entrained carbon materials found in these formations behave more as a fixed-bed, than as a flowing resource. For the purposes of the present invention, a resource of this kind is referred to as a fixed-bed hydrocarbon field (FBHF).

The term retort is used here to denote the thermally induced mobilization of a recalcitrant, immobilized, or otherwise previously low-mobility carbonaceous material. Generally, retorting of a formation results in the partial pyrolysis of mineralized or entrained hydrocarbons, or other carbonaceous geological deposits (such as coal, kerogen, lignite, bitumen, and the like). Typically, fixed-bed hydrocarbons are recognizable as fast- or slow-burning fuels under ambient temperature, pressure and atmospheric conditions. For some, such as oil shale, its fuel value is low but measurable. Note that certain, carbon crystal compounds, such as diamonds, do not qualify as fixed-bed hydrocarbons due to tremendous thermodynamic stability. In this invention, it is this partial pyrolysis of otherwise immobile materials that generates the higher-mobility molecular species that are produced using the methods of this invention. Retorting, therefore, comprises any heat or pyrolysis-induced liberation (e.g. mobilization) of lower molecular weight hydrocarbons from higher molecular weight, mineralized and/or geologically immobilized materials. For the purposes of this invention, a carbonaceous material is considered immobile or immobilized if it exists in the formation in a form that is largely immobile, either due to high viscosity (e.g. bitumen), entrainment, precipitation, crystallization, or the like.

Low molecular weight hydrocarbon gases (such as methane, ethane, propane), and C2-C4 olefins are among the most basic of commodity chemicals. Together, they enjoy a wide range of uses across a wide range of industries. Light olefins have value as chemical intermediates for materials and chemicals manufacture, and as additives or intermediates in the rearrangement and reformation of liquid fuels. Likewise, the aliphatic hydrocarbons (CH4, C2H6, C3H8, etc) are useful in generating olefins and in fuel modification. Although these and other petrochemicals consume only a small portion of global petroleum feedstock output, they add enormous downstream value and utility to the petroleum product stream. Economical production of petrochemicals typically requires huge capital investments and large scale operations. As such, low-cost production alternatives are essential. The methods of this invention provide a series of low-capital petrochemical production alternatives.

Higher molecular weight olefins also have substantial value as monomers and chemical intermediates. Six to twelve carbon olefins (e.g. C6-C12 olefins), for example, are widely used in the generation of high value nylon and polyester materials. While secondary to building block olefins (e.g. C2-05), their production using the methods described herein is of considerable economic importance. Specifically, long chain alpha-olefins have proven value in a variety of polymer, elastomer and synthetic fiber applications. Efficient, low-cost production of such compounds is made possible through the methods described herein.

In this invention, in situ hydrocarbon pyrolysis is used in various forms to modulate the chemistry of fluids produced from a formation. Thermal cracking of hydrocarbons is discussed thoroughly in both the background and certain examples contained herein. Catalytic cracking strategies may also be used.

In the present invention, hydrocarbon cracking may occur either in an active heating zone within an FBH formation, at or near a well bore, or, alternatively, within a reactor following recovery of product at producing wells. Catalyst may be supplied to the formations through exogenous means or endogenously (e.g. via materials found within the formation itself). Addition of zeolite materials as propping agents to a fractured formation comprises one means of adding catalyst to a formation. Although catalyst-mediated cracking may be unnecessary in developing most FBHF zones, it can play a role in FBHF development in some. Moreover, it is of considerable value in further processing the materials produced from the formation. For in-formation, thermal processing (e.g. unassisted by catalysts other than those naturally present within certain formations) accounts for the vast majority of the chain-breaking activity. Even so, the in situ process can be run either as a mild, vice-breaking operation (e.g. for producing fuel oil grade product) or as a more extensive cracking operation (due to long residences times and temperatures that are substantially higher than 650 F) in which high levels of low molecular aliphatics and olefins are generated from the previously higher molecular weight species.

As discussed above, olefins are almost completely absent from fossil fuels sources and tend to be generated during cracking or oxidation processes. Conventional petrochemical cracking operations use one of three methodologies to convert petroleum feedstocks to olefins and lighter molecular weight saturated hydrocarbons. Modern refineries use catalytically-driven hydrocarbon cracking.

The methods of this invention provide for both thermal cracking of formation-derived carbonaceous materials using either catalytic or non-catalytic means. Typically, a catalyst may be used to alter the distribution of products produced at one or more production wells within a formation.

Early in the in situ hydrocarbon cracking processes of this invention, fluid hydrocarbons having a very broad distribution of carbon numbers may be generated in situ and produced from a formation. As cracking conditions increase in extremity (such as by elevating temperature or residence time), however, the average carbon number (or chain length) of formation-derived hydrocarbons begins to decrease progressively. This is observed as a shift toward production of formation fluids having increased levels of non-condensable and condensable light hydrocarbons (e.g. those conventionally referred to as early and middle distillate products). As the average carbon number of a formation-produced fluid from an in situ pyrolytic process continues to fall, the mixed-phase production fluids become progressively consolidated into a substantially single phase production fluid. This consolidation of produced fluids into a substantially single-phase production fluid represents an important embodiment of the present invention. Under thermal cracking conditions, this consolidation of phases may become apparent as the average carbon number of the produced fluids approaches a carbon number of about 2-14, and more preferably 2-10. Under typical operating conditions (e.g. average retort and cracking conditions >>500 degrees F.), formation fluids are produced under conditions in which a substantial majority of the condensable and non-condensable hydrocarbons having carbon numbers of less than 12 co-migrate substantially as single fluid vapor phase. As the average carbon number of the hydrocarbons falls to less-than 10, and preferably less-than-or-equal-to 8, a progressively larger fraction of produced hydrocarbons are produced as a substantially single-phase fluid. Moreover, as retorting and pyrolytic cracking continues in intensity, produced fluids may comprise increased abundance of light-chain olefins, dry gas, wet gas, octane (e.g. gasoline) and other condensable and non-condensable products. This gradual coalescing of product populations during extended in situ retorting and cracking provides an important motivation for the present invention. In its more thermally intense applications, the invention provides for the efficient conversion of nearly any carbonaceous geological and/or other fixed-bed hydrocarbons into simple, low-molecular weight (e.g. C2, C3 and/or C4) paraffins and olefins. These products are among the most basic, broadly used materials produced in the petroleum refining and petrochemical industries. As a group, they find a wide array of uses as fuels; liquid fuel precursors and additives; chemicals, intermediates and polymerizable monomers; and the like.

For thermal (catalyst-free) cracking, the degree of cracking of a product stream may be altered by adjusting any one or more of the following parameters: the average temperature experienced by an average hydrocarbon molecule (or product stream) between its point of mobilization and its point of production from the formation; the average residence time of an average hydrocarbon molecule (or product stream) from its point of mobilization to its point of production from the formation of a given product stream; the integrated time-temperature experience of an average hydrocarbon molecule (or product stream) from its point of mobilization to its point of production from the formation of a given product stream; the maximal temperature encountered by an average hydrocarbon molecule (or product stream) between its point of mobilization and its point of production from the formation; the average or maximal level of moisture encountered by an average hydrocarbon molecule (or product stream) from its point of mobilization to its point of production from the formation; the average or maximal partial pressure of hydrogen encountered by an average hydrocarbon molecule (or product stream) from its point of mobilization to its point of production from the formation.

The in situ equivalent of conventional catalytic cracking may be useful for enhancing the levels of saturated linear and branched chain paraffins, naphthenes and aromatics in the present invention. Typically, the in situ version of catalytic cracking operates by contacting in situ (e.g. including in one or more injection or producing wells) one or more formation fluid with a one or more cracking catalysts. Preferably, the formation fluids comprise at least one hydrocarbon, and more preferably, at least one hydrocarbon of carbon number 2 or greater. Typically, the catalyst comprises a material comprising one or more amorphous aluminum silicates and/or comprising one or more crystalline aluminum silicates (e.g, zeolites). Other less common catalysts, such as the manganese-based Houdry catalyst may also be used. Generally, catalysts most fitting for this application will be zeolite catalysts containing rare earth cations. Optionally, these catalysts may contain one or more rare earth cations. Optionally, the catalysts may contain one or more stabilizers. In certain embodiments, one or more rare earth cations maybe present as a catalyst stabilizer.

Often, catalytic cracking catalysts such as those described in the previous paragraph may undergo inactivation by coking or other processes. For this reason, preferred embodiments provide one or more methods for recovering catalyst from in situ cracking operations. In preferred embodiments, cracking catalyst is retained substantially in one or more well bores. In other preferred embodiments, catalyst is supplied as a flowable powder or suspension. In further embodiments, regeneration may be facilitated by recovering a slurry or powder comprising catalyst material from one or more well bore. Typically, regeneration may require heating catalyst to temperatures in excess of 1000 degree F., and, optionally, in the presence of steam or other additives. Typically, regeneration comprises heating catalyst to temperatures in excess of the average temperature of the formation fluids being produced at or near the well bore from which catalyst was withdrawn. Often, catalyst may comprise platinum, or otherwise contact platinum during regeneration, to assist with the conversion of carbon deposits to carbon dioxide during regeneration. In catalytic cracking operations, hydrocarbons are generally brought into contact with such catalysts at temperatures of >840-930 degrees F. within a fluidized-bed catalytic cracker or a catalyst riser reactor. Similar temperatures and geometries may be established at or near one or more producing wells containing cracking catalyst.

In some embodiments, catalysts may be injected directly into one or more formations. Catalyst recovery and regeneration may be more difficult, and even impossible, under such circumstances. However, the methods of this invention further provide brief injections of very high temperature steam, combustion gases and/or other vapors for the purpose of decoking and/or regenerating in situ catalysts. Such brief exposures to high temperature agents may occur by intermittent pulsing, fire or super-heated steam "flashing" or any other method that achieves a very high level of heating along the high-permeability zones (e.g. propped fractures) without substantially altering the course of heating and producing formation fluids from the portion of the formation so treated. The methods of this invention comprise introducing dual-function materials into one or more FBHF. For example, certain zeolites may function both as catalysts and/or as propping agents within a fractured formation. In general, many zeolites, other crystalline materials, metal particles and other high-strength materials, cements, fibers, and the like may provide both a physical utility (e.g. as a propping or well bore reinforcing agent) and a reactive chemistry utility (e.g. such as a cracking, polymerization catalyst, adhesion surface, etc.). In one embodiment, the present invention is a system comprising: at least about one FBCD, at least one opening to the FBCD; at least about one additive capable of enhancing composition of fluid produced from such FBCD; operationally linked through means of one or more TECF. In preferred embodiments, the additive comprises one or more of the following: a catalyst, a zeolite, a crystalline particle, or a metallic particle.

The present invention contemplates addition of certain substances and additives to enhance production of at least one hydrocarbon from a FBHF. Many others will be apparent to those of skill in the art. The methods of the present invention allow an operator to flow hydrocarbons and other materials produced from a substantially immobile carbonaceous deposit so as to contact one or more catalytically active material, provided that the catalytically active material is in fluid communication with the carbonaceous deposit. The present invention allows for any catalyst that was added to one part of the formation, later to be regenerated, as that region becomes subject to the high temperatures (similar to those needed for regeneration). One aspect of this comprises the selective heating of one portion of a formation and contacting the selectively heated portion with material mobilized from a different portion (i.e. zone) of the formation.

Hydrocracking represents a different chemical approach to hydrocarbon pyrolysis, and relies on the presence of hydrogen in the cracking reactor (or environment). As with catalytic cracking, conventional hydrocracking is primarily used to partially pyrolize high boiling distillates into lower boiling products. Modern hydrocracking uses bifunctional metallic hydrogenation-dehydrogenation catalysts (e.g. Pd, Pt, C0-Mo) and acidic cracking components such as zeolites containing Al2O3-SiO2. The processes tend to run at temperatures of about 520 to 930 degrees F. and about 1150-2900 psi, and require substantial capital investment both for hydrogen production and for the hydrocracking operation. While the product streams from a hydrocracking unit operation contain little to no olefins, they do tend to contain isobutane, naphtha, as well as fuel oil and gasoline components. For this reason, it can be used to produce material for other cracking and petrochemical operations linked to the in situ FBHF processes described here.

Hydrocracking provides an important means of diversifying the product mixtures generated from an FBH formation. For example, a fraction enriched in liquefied petroleum gas (LPG) components can be optimized for production of gasoline, isobutane, naphtha and fuel oil. By using a bi-functional metallic hydrogenation-dehydrogenation catalyst (such as cobalt-molybdenum, or palladium, platinum based materials) and acidic cracking components, in the presence of hydrogen, high efficiency cracking can be accomplished. Although hydrogenation introduces several layers of complexity, the present invention comprises the use of downhole hydrogenation in conjunction with thermal treatment of FBHF to generate industrial materials. In the context of the present invention hydrocracking is most easily applied at or near the producing well(s) or upon recovery of initial surface recovery of products. For in-formation applications, the method is used primarily under conditions in which prevailing FBHF temperatures are above about 520 degrees F. and below about 2000 degrees F., and sometimes below 1500 degrees F.

The hydrogen required in the process may be co-manufactured at or near the treatment site. Although the distinct hydrogen production train is typical, the methods of this invention also comprise the production of hydrogen and carbon monoxide through oxidation of highly pyrolized zones developed from an FBHF. In the present invention, such carbonized zones are generated via prolonged exposure to high-intensity retorting and/or thermocracking conditions.

In situ thermocracking provides the methodological backbone for in situ production of petrochemicals from FBHF. It is most useful in the pressurized, high heat subsurface FBHF environments developed using the methods of this invention. Thermocracking relies on the free-radical based cleavage of hydrocarbon C—C bonds that begins to occur at temperatures of about 450-500 degrees F. In thermocracking, the homolysis of a C—C bond generates two free radicals. This occurs at elevated temperatures without addition of catalyst. In industrial processes, cracking of hydrocarbons does not become a preferred reaction until temperatures reach 650 degrees F. and above. The activated (free-radical containing) carbon skeleton can participate in a variety of distinct reactions depending on the overall conditions and reactant availability. First, each radical can abstract a hydrogen atom from another hydrocarbon to form molecular hydrogen (H2) and an olefin. The process results in both a change in the carbon skeleton and a change in H2 content. In addition to C-chain homolysis, other important reaction paths available to the free radical hydrocarbons include isomerization, cyclization, dehydrogenation, and H2-transfer. Polymerization and alkylation reactions may also be observed. While each of these occur at some frequency, adjusting of process conditions and material flow dynamics can allow the operator to establish substantial control over the reactions that predominate in situ.

The present invention consists of methods for in situ retorting of oil shale, oil sands, and other FBHFs. In a simple form, the method comprises: a) the drilling of one or more well bores into a FBH deposit, b) contacting the deposit with thermal energy source (preferably, in the form of a thermal energy carrier fluid) heated to a temperature sufficient to cause pyrolysis (e.g. retorting) of entrained carbonaceous material (e.g. kerogen, bitumen and the like), c) producing one or more hydrocarbon fuels or chemicals at the surface. The method may be further modified to contain any number of additional limitations such as allowing or requiring: that the thermal energy carrier comprise one or more formation-derived fluids; that the thermal energy carrier comprise one or more pipeline-derived carrier fluids; that the energy source used to heat the thermal energy carrier fluid comprise at least one formation-derived fluid; that the energy source used to heat the thermal energy carrier fluid comprise at least one pipeline-derived fuel hydrocarbon; that a specific energy source (combustion, electrical, geothermal, nuclear, solar, etc. . . . ) be used to drive heating and/or production; that a catalyst be added to the process so as to modulate rate and/or chemical composition of the materials produced; that a method or system be installed for aquifer containment and/or for limiting diffusion of formation fluids; that one or more physical modifiers (such as acoustic oscillators; electrical and/or, microwave energy sources; etc. . . . ) be used to enhance production; that one or more chemical modifiers (such as surfactants, solvents, acids, etc. . . . ) be added so as to enhance production; that one or more physical or biological diffusion barriers be employed (e.g. for purposes of groundwater treatment, management, control, etc. . . . ); that one or more selective condensor(s) be located at or near the producing well; establishment of at least a plurality of injection wells; that methods comprise at least about one producing well; that thermal energy carrier fluids be injected at temperatures in excess of 450 degrees F., and preferably, in excess of 750 degrees F., and more preferably, in excess of 1000 degrees F.; that one or more proppant materials be added to the formation; and the like.

The invention describes a series of methods that allow for in situ production of petrochemical hydrocarbons from oil shale, coal, and other carbon-containing geological formations. The methods of the invention provide a surprisingly efficient and low-capital means of petrochemical production from low cost, abundant raw materials. The methods of the present invention also provide the means for converting active petroleum and other carbon-rich fields into environmentally stable formations following completion of hydrocarbon recovery operations. The methods and examples provided herein are for illustration purposes only, and not intended to limit the invention in any specific respect. Many other applications, illustrations and embodiments will be apparent to one of skill in the art.

Example 22 a-f

In Situ Production and Processing of Hydrocarbons and Other Chemicals Using the Catalyst Installation and Other Methods of this Invention—In Situ Refining a) Product Chemistries and Compositions—Condensable hydrocarbons produced from a formation using the methods of this invention typically comprise long- and short-chain paraffins, (e.g. alkanes of C3 or higher), cycloalkanes, linear olefins (e.g. some C2 plus C3 and higher), cyclic olefins, aromatics (such as mono-aromatics, di-aromatics and others). Such condensable hydrocarbons may also include many other components such as tri-aromatics, etc.

In an embodiment, the methods of this invention provide a means of producing a formation fluid comprising hydrocarbons in which the hydrocarbons in the fluid have an average carbon number (e.g., represented, optionally, herein as C1, C2, C3, etc.) that is less than about 18 (e.g. C18). In more preferred embodiments, the produced fluid comprising hydrocarbons contains hydrocarbons having an average carbon number of less than about 14. In most preferred embodiments, the produced, fluid comprising hydrocarbons contains hydrocarbons having an average carbon number of less than about 12. In another most preferred embodiment, the produced fluid contains comprising hydrocarbons contains hydrocarbons having an average carbon number of less than or equal to about 8. Alternatively, the methods of this invention provide for production of a formation fluid in which less than about 15 weight % of the hydrocarbons in the produced fluid may have a carbon number greater than about 18. In other embodiments, less than about 5 weight % of the hydrocarbons in the produced fluid have a carbon number greater than about 18. In preferred embodiments, less than about 25 weight % of the hydrocarbons in the fluid have a carbon number greater than about 14. In other preferred embodiments, less than about 25 weight % of the produced hydrocarbons have a carbon number greater than about 8. In other embodiments, produced fluids have a weight ratio of hydrocarbons having carbon numbers from 2 through 8, to methane (e.g. mass of C2-C8 hydrocarbons: mass of methane), of greater than approximately 2. In preferred embodiments, fluid produced may have a weight ratio of hydrocarbons having carbon numbers from 2 through 4, to methane, of greater than approximately 2. The non-condensable hydrocarbons may include, but are not limited to, hydrocarbons having carbon numbers less than 5.

In certain embodiments, fluid produced from a formation may include oxygenated hydrocarbons. In an example, the condensable hydrocarbons may include an amount of oxygenated hydrocarbons greater than about 5 weight % of the condensable hydrocarbons.

Condensable hydrocarbons of a produced fluid may also include olefins. For example, the olefin content of the condensable hydrocarbons may be from about 0.1 weight % to about 40 weight %. In preferred embodiments, the olefin content of the condensable hydrocarbons is from about 1.0% to about 40%. In other preferred embodiments, the olefin content of the condensable hydrocarbons is from about 2.5 weight % to about 40 weight % or, and in some embodiments, greater than about 5 weight %. In another preferred example, the olefin content of one or more formation hydrocarbon is increased within the formation through the operation of the methods and systems of this invention.

Non-condensable hydrocarbons of a produced fluid may also include olefins. For example, the olefin content of the non-condensable hydrocarbons may be gauged using the ethene/ethane molar ratio. In certain embodiments, the ethene/ethane molar ratio may range from about 0.01 to about 4.0. In a preferred embodiment, the ethene/ethane ratio ranges from 0.01-4.0. In more preferred embodiments, the ethene/ethane molar ratio ranges from about 0.05 to about 4.0. In most preferred embodiments, the ethene/ethane molar ratio may range from about 0.15 to about 4.0.

Fluid produced from a formation according to the methods of this invention may include aromatic compounds. For example, the condensable hydrocarbons may include an amount of aromatic compounds less than about 25 weight % or about 20 weight % of the condensable hydrocarbons. The condensable hydrocarbons may also include an amount of aromatic compounds less than about 15 weight % or about 10% of the condensable hydrocarbons. The condensable hydrocarbons may also include relatively low amounts of compounds with more than two rings in them (e.g., tri-aromatics or above). For example, the condensable hydrocarbons may include less than about 0.1 weight %, 0.5 weight %, 1 weight %, 2 weight %, or about 5 weight % of tri-aromatics or above in the condensable hydrocarbons.

In certain embodiments, asphaltenes (i.e., large multi-ring aromatics that are substantially insoluble in hydrocarbons) make up less than about 0.01 weight %, or less than about 0.1 weight % of the condensable hydrocarbons. For example, the condensable hydrocarbons may include an asphaltene component of from about 0.0 weight % to about 0.01 weight % or, in some embodiments, about 0.1% to less than about 0.3 weight %.

Condensable hydrocarbons of a produced fluid may also include relatively large amounts of cycloalkanes. For example, the condensable hydrocarbons may include a cycloalkane component of less than 1 weight % to about 30 weight % of the condensable hydrocarbons.

In certain embodiments, the condensable hydrocarbons of the fluid produced from a formation may include compounds containing nitrogen. For example, less than about 1 weight % (when calculated on an elemental basis) of the condensable hydrocarbons is nitrogen (e.g., typically the nitrogen is in nitrogen containing compounds such as pyridines, amines, amides, etc.). In other embodiments, nitrogen content of condensed hydrocarbons may exceed 1 weight %, but be less than 5 weight %. When air injection is use to supply oxidant to a downhole combustor or fire-flood, nitrogen content of the produced fluids may exceed 5 weight %. In this situation, the majority of produced nitrogen will be molecular nitrogen (e.g. $N_2$).

In certain embodiments, the condensable hydrocarbons of the fluid produced from a formation may include compounds containing oxygen. For example, in certain embodiments (e.g., for oil shale), less than about 1 weight % (when calculated on an elemental basis) of the condensable hydrocarbons is oxygen (e.g., typically the oxygen is in oxygen containing compounds such as alcohols, ethers, phenols, substituted phenols, ketones, etc.). In some instances, certain compounds containing oxygen (e.g., phenols) may be valuable and, as such, may be economically separated from the produced fluid. In other embodiments, the oxygen content of the produced fluids may be greater than 1 weight %. In still other embodiments, the oxygen content of produced fluids is modified in the formation by reacting with oxidant. In preferred embodiments, the oxidant is added to the formation through one or more injection wells. In other optional embodiments, oxidant addition is regulated by an operator or intelligent system.

In certain embodiments, the condensable hydrocarbons of the fluid produced from a formation may include compounds containing sulfur. For example, less than about 1 weight % (when calculated on an elemental basis) of the condensable hydrocarbons is sulfur (e.g., typically the sulfur is in sulfur containing compounds such as thiophenes, mercaptans, etc.). In other embodiments, sulfur content of condensed hydrocarbons may exceed 1 weight %, but be less than 5 weight %. When the methods of this invention are applied to high sulfur FBHFs, sulfur content in the produced fluids may exceed 2 weight %.

The fluid produced from a FBDC formation may include ammonia (typically the ammonia condenses with the water, if any, produced from the formation). For example, the fluid produced from the formation may in certain embodiments include about 0.05 weight % or more of ammonia. Certain formations may produce larger amounts of ammonia (e.g., up to about 10 weight % of the total fluid produced may be ammonia).

A produced fluid from the formation may also include molecular hydrogen (H.sub.2), water, carbon dioxide, hydrogen sulfide, etc. For example, the fluid may include a H.sub.2 content between about 1 volume % and about 90 volume % of the non-condensable hydrocarbons. Preferably, H.sub.2 content is between 5 volume % and 50 volume %.

Certain embodiments may include heating to mobilize at least about 1 weight % per year (or in any continuous 12 month period) of a total organic carbon content of at least one portion of a substantially immobile carbonaceous material (e.g. oil shale) found in a geological formation that is operationally active under the methods of this invention. In some embodiments, the at least one portion of the formation comprises at least heat source plus one injection well that is in fluid communication with at least one producing well. In other embodiments, at least about 10 weight % of the total carbon content of at least one portion of a FBH formation is retorted per year (or in any continuous 12 month period).

An embodiment further comprises recovering at least 50% of mobilized hydrocarbon from produced fluids. Other embodiments comprise the in situ heating of at least one portion of an oil shale formation so as to remove at least 10% of the total organic carbon over a period of time. Preferred embodiments comprise the in situ heating of at least one portion of an oil shale or other FBH formation so as to remove at least 20, 40, 60 and/or 80 weight % of the total organic carbon over a period of time.

In an embodiment, an in situ conversion process for treating an oil shale formation may include providing heated thermal energy carrier fluid to a section of the formation to yield greater than about 20, 40, 60 and 80 weight % of the potential hydrocarbon products and hydrogen, as measured by the Fischer Assay.

In certain embodiments, heating of the selected segment of the formation may be controlled to pyrolyze at least about 1 weight % (or in some embodiments about 2 weight %) of the hydrocarbons within the selected section of the formation over any period of not more than 12 months. In an embodiment, heating of one or more selected sections of the formation may be controlled to pyrolize an average of at least about 1 weight % per year (or in some embodiments at least about 2 weight % per year) of the hydrocarbons within the selected section, the average measured over any multi-year period.

Formation fluids produced from a segment of the formation may contain one or more components that may be separated from the formation fluids. In addition, conditions within the formation may be controlled to increase production of a desired component.

b) A System for Cracking Formation Hydrocarbons—As discussed elsewhere in this disclosure, the invention provides a method and an in situ system for cracking formation-derived, fluid-phase hydrocarbons, and producing at least a portion of the cracked hydrocarbons through one or more openings in a carbonaceous geological formation. In another embodiment, the present invention comprises an in situ hydrocarbon processing system directed toward hydrocarbon and other carbonaceous deposits present in geological formations, the system comprising: at least one fixed-bed hydrocarbon source; at least one mobile phase in fluid communication with the fixed-bed hydrocarbon source; a heat source capable of directly or indirectly heating hydrocarbons within the hydrocarbon source to temperatures exceeding hydrocarbon cracking temperatures; a device, method or force capable of facilitating (or imposing) the directional flow of mobilized (e.g. product) hydrocarbons; and an opening in the formation that allows for collection of mobilized hydrocarbons. The system further comprises the use of a thermal energy carrier fluid as an operation linkage (e.g. means of heat delivery and product collection) between surface and formation components of the system. Optionally, the system may comprise one or more additional heaters and/or heated cracking zones. In another embodiment, the invention comprises an in situ hydrocarbon processing system, comprising: one or more surface-mounted catalytic cracking reactors, condensors, separators, distillation columns or other hydrocarbon fractionating units in operational linkage to one or more in situ hydrocarbon sources heated to thermal cracking temperatures. In another embodiment, the invention comprises an in situ hydrocarbon processing system, comprising: one or more surface-mounted catalytic cracking reactors, condensors or other hydrocarbon fractionating units in operational linkage to one or more in situ hydrocarbon sources heated to thermal cracking temperatures, and one or more thermal energy carrier fluid(s), the thermal energy carrier fluid(s) providing a fluid linkage between in situ cracking component and linked surface operations. A related method comprises contacting within a formation the in situ mobilized hydrocarbons with one or more heated regions within a formation so as to bring about thermal cracking of the mobilized hydrocarbons. A further related method comprises contacting previously cracked or pyrolyzed hydrocarbons with one or more thermal or catalytic environments sufficient to bring about additional cracking.

c) Catalyst Installation and Sample Use—The methods of this invention comprise the addition of exogenous catalysts and reactants to a geological formation for the purpose of producing one or more desired products.

In preferred embodiments, one or more cracking (and/or pyrolysis) catalysts is added to a geological formation and used to advantage in situ in producing from the formation one or more desired hydrocarbon product(s. In a preferred embodiment, an in situ catalyst is positioned in close proximity to one or more producing wells. In one another preferred embodiment, catalyst is added to the formation by injection into the formation through one or more intermediate injection wells positioned between at least one thermal energy carrier fluid injection well and at least one producing well that is operationally in linkage (e.g. in fluid communication with) to the TECF injection well. In another preferred embodiment, catalyst comprises a slurry or flowable powder.

In one particular example, in situ catalyst is provided to a formation using a sand-packed annulus such as that disclosed in U.S. Pat. No. 6,929,066. This system is particularly useful for injection and recovery of catalyst, such as may be required for regeneration. Moreover, the catalyst may be supplied in fixed-bed form as part of a sand-packed annulus.

In an embodiment, in situ catalyst is provided by injection into one or more natural fractures within a formation In another embodiment, the catalyst is injected into one or more fractures (e.g. fracs) created in the formation by human intervention, using any methods known in the art and/or described herein.

In an example, a catalyst formulation is installed in the formation within a fluid-permeable vessel. The vessel is provided to the formation at a depth sufficient to allow substantial contact with a producible formation fluid. In this example, the vessel is located at a well bottom positioned at a depth similar to that of a nearby producing well (e.g. positioned less than <100 ft from vessel, for example). In the example, the vessel comprises a well bore annulus and casing through which a catalyst powder or slurry is added and/or removed. A portion of a formation fluid in transit from a retorting or pyrolysis zone to a producing well contacts the catalyst, resulting in a beneficial alteration of hydrocarbon populations comprising the formation fluid. The beneficially altered formation fluid is produced at the nearby producing well. Many variations on the theme of catalyst addition will be apparent to one of skill in petroleum and/or petrochemical processing. For example, modifications in distance, depth, construction, position and composition and catalyst properties are a few of the features that may be beneficially altered by a skilled operator.

In another particularly preferred example, catalyst is added to the bottom a producing well, where it provides for beneficial alteration of the fluids from that well. Occasionally, it is of benefit to introduce catalyst into an injection well. In one such example, an injection well is a perimeter water injection well. Catalyst may be added to the formation through such a system for a variety of purposes including, but not limited to, the catalytic transformation, activation, inactivation, decomposition and/or adsorption of one or more formation hydrocarbons. entering the compositing.

Attrition and coking resistance are very important features in some catalyst operations. In some cases, the methods of this invention provide for the recovery and ex situ regeneration of catalyst. In other applications and operations, the catalyst may be an integral component of one or more systems provided for in this invention. In these and other cases, recovery may neither be desirable nor possible. In one example, a proppant comprises at least one zeolite cracking catalyst. Propping of a fractured formation by a material comprising a zeolite-based cracking catalysts serves to lock the catalyst into a location within the formation. Catalysts provided in this manner, may be more evenly distributed within the formation, and therefore, provide certain operational advantages over those contained within sub-surface vessels. For these reasons, highly stabilized zeolite-based (and/or other crystalline) catalysts are preferred in the open-field fluid catalytic cracking operations disclosed herein. Typically, FCC conversions run at about 930° F. to about 1200° F., preferably from about 970° F. to about 1100° F., and most preferably from about 985° F. to about 105.0° F. This is well in alignment with the operating conditions disclosed in this and its affiliated applications. In reactor-based FCC, catalyst/oil weight ratio of from about 3 to about 12, is preferable, and most preferably from about 5 to about 10. In reactors, residence times of from about 0.5 to about 15 seconds are typical. In carbonaceous formation-based applications, the residence times are substantially higher (minutes, to tens-of-minutes, to hours), and the water activity is also higher. For this reason, the catalyst to mobile-phase hydrocarbon ratio within a catalytically active in situ zone may be much broader range a reactor-based system on a localized basis. Over the entire reactive zone, however, the active catalyst/oil weight ratio may range from 2 to 20,000, generally progressing from low to high as fresh catalyst is added over the productive lifetime of the given reactive zone. At any given time, the catalytically active in situ zone will have a measurable flux of hydrocarbon reactants and an effective (e.g. "reactor") volume that can be approximated by a number of means. For example, accessibility of the reactive zone to proppant materials will be directly related to its capacity to distribute catalyst effectively. Likewise, pulse-chase experiments (such as by injecting detectable, signal materials into the reactive zone by means of one or more injections wells) can provide useful information for both flow and reactor volume calculations. Other methods, such as 2-dimensional and 3-dimensional acoustic analysis and seismic imaging; infrared detection and imaging; electrical and hydraulic resistance measurements and many others are well known in the art of petroleum and geological engineering. While not wishing to be constrained by any single theory, we propose that the reactive zone can be represented in most situations as a fixed-bed catalytic cracking surface over which reactants flow. The catalyst contact time and surface area are primary determinants in conversion efficiency, and have a direct effect on both product mix and catalyst lifetime.

d) Catalyst Chemistry and Synthesis—Catalysts useful in enhancing the thermal cracking efficiency in the processes described herein fall into several categories. Preferred catalysts are those containing zeolite or similar crystalline materials capable of fulfilling a proppant or proppant-like role in the context of a fractured formation. Essentially all FCC catalysts, for example, contain zeolite materials. While zeolites alone embody important catalytic features of value in the present invention, FCC catalysts are typically assembled from three primary components—zeolite, active matrix, and clay—plus a binding agent (e.g. binder). Each of these components improve one or more aspects of catalyst performance. The components may be formulated into a single particle. Alternatively, they can be provided by blending individual particles, each adding distinct function to the final blend. In either mode, modern cracking catalysts operate as complex, multi-component systems.

The zeolite component is a key component of the catalyst, providing both activity and selectivity. Essentially all modern cracking catalysts employ zeolites. Most often the zeolite of choice is selected from the large faujasite group of crystalline materials. Faujasite is a three-dimensional aluminosilicate crystal with pores of 8-9 Angstroms, and a substantial ion exchange capacity. While faujasite and other zeolites occur naturally, they are scarce. Therefore, commercial synthesis is often the more cost-effective and reliable supply modality. Faujasite is synthesized in the sodium form (e.g. standard-Y) by co-crystallizing sodium aluminate and sodium silicate. The resulting crystal contains tetrahedral structural units in which one silicon atom is surrounded by four oxygen atoms. Likewise, each aluminum atom is surrounded by four oxygen atoms. Each is tetrahedral in crystal form. The dual tetrahedra form a truncated octahedral repeating unit (e.g. sodalite) that link together by means of interspersed hexagonal prisms. Each repeat unit (e.g. unit cell) contains four 8-9 Angstrom openings, each surrounded by 12 oxygen atoms.

The catalytic performance of faujasite materials in the cracking process is determined, in part, by their method of manufacture. By way of example, the Standard-Y (HY, REY) zeolite represents one distinct performance category. The Ultrastable-Y (USY, REUSY) zeolite represents another. The two zeolites differ in their degree of modification following initial crystallization. Standard-Y is the result of simple crystallization as described above, followed by a series of washing steps. Its manufacturing cost and complexity are lower than USY. Even so, USY is the more widely used zeolite in fluid cracking processes due to its increased stability. This enhanced stability is achieved by dealumination of HY using either steam calcination or chemical treatment(s). This step extracts aluminum from the zeolite and repairs the breach with silicon, without collapsing the framework structure. The primary mode of degradation of the Standard-Y zeolite is the thermodynamically-driven expulsion of aluminum atoms from the zeolite framework at high temperatures. The controlled dealumination of the framework used in generating USY provides a controlled, non-destructive path to replacing the vulnerable aluminum atoms. In addition, the process decreases sodium content of the zeolite. This also is believed to impart enhanced stability.

The method of dealumination also has an impact on catalyst properties beyond just stability. For example, hydrothermal treatment of HY results in incomplete replacement of framework aluminum atoms by silicon. This creates large, stable 30-60 Angstroms "holes" in the zeolite structure referred to as mesopores. These mesopores appear to enhance the diffusion of reactants and products within the zeolite.

While HY and USY faujasites provide the backbone of fluid cracking catalyst technology, other zeolites are also known to exhibit important properties as catalysts, additives or framework agents. One such example is the ZSM-5 series of zeolite materials. ZSM-5 is discussed in greater detail elsewhere herein.

Zeolites such as Standard-Y and USY contain substantial quantities of framework-entrained sodium. As such, they exhibit cation-exchange behavior when exposed to other metals, such as the rare earths. Replacement of sodium with rare earth cations results in a zeolite with increased activity and greater resistance to crystal destruction upon dealumination. Rare earth exchange is widely known and practiced in the art of cracking catalyst production.

The clay and binder components of the cracking catalyst provide little or no activity, but contribute mechanical strength, density and other physical and processing attributes to the catalyst formulation. The clay serves as a heat sink during the cracking reaction. It also serves as a sink for sodium and other ions that might otherwise poison the catalyst. As its name suggests, the binder serves to hold all the catalyst components together, and contributes greatly to the physical integrity of the catalyst. Binders useful in the methods of this invention include but are not limited to alumina polymers, specialized clays and ceramic materials, inorganic adhesives, and the like.

In the present invention, both the clay and binder components provide for substantial control and enhancement of catalyst performance within an in situ retort and cracking system. For example, the flow properties of the catalyst may be enhanced in such a way as to allow increased access to fractures within the formation. Adjusting clay or binder composition also provides an important means of enhancing the proppant properties of the catalyst formulation (e.g. by increasing its flowability, size, crush resistance, rigidity, etc. . . . ). Methods for modifying the physical properties of catalysts through modified zeolite, clay and binders are well known by those of skill in the art.

In one embodiment, the present invention comprises a method for producing hydrocarbon products, the method comprising: mobilizing hydrocarbon from a geological formation by means of heating, contacting the hydrocarbons in situ with one or more (injected) catalytic substances capable of enhancing the conversion of the hydrocarbons to modified hydrocarbons in situ, and collecting at least a portion of the modified hydrocarbons through one or more openings in the formation. In a further embodiment, the catalytic substance comprises at least one zeolite. In a further embodiment, the catalytic substance comprises at least two or more of the following components: zeolite, active matrix, clay, binder, rare earth cations. In a further embodiment, the geological formation comprises a fixed-bed hydrocarbon source. In yet another embodiment, the heating comprises injection of heat through one or more well bores, into the formation. In a further embodiment, the heating comprises injection of heated thermal energy carrier fluid through one or more well bores, into the formation. In yet another embodiment, the modified hydrocarbons are derived at least in part by catalytic cracking of the mobilized hydrocarbons. In a further embodiment, the modified hydrocarbons are on average lower in molecular weight (size) than the mobilized hydrocarbons.

In yet another embodiment, the method comprises: mobilizing hydrocarbon from a geological formation by means of heating, subjecting mobilized hydrocarbons in situ to one or more directional forces so as to cause a portion of the hydrocarbons to contact one or more catalytic substances capable of enhancing the conversion of the hydrocarbons to modified hydrocarbons, and collecting at least a portion of the modified hydrocarbons one or more openings in the formation. In a further embodiment, the directional force(s) is applied by means of a method comprising fluid injection through one or more well bores. In a further embodiment, the directional force is applied by a method comprising bulk flow toward one or more producing wells. In a further embodiment, the directional force(s) is applied by a method comprising a thermal gradient within the geological formation. In a further embodiment, the directional force is applied by a method comprising monitoring and/or adjusting potentiometric surfaces within the formation. In a further embodiment, the catalytic substance comprises at least one zeolite. In a further embodiment, the catalytic substance comprises at least two or more of the following components: zeolite, active matrix, clay, binder, rare earth cations. In a further embodiment, the geological formation comprises a fixed-bed hydrocarbon source. In yet another embodiment, the heating comprises injection of heat through one or more well bores, into the formation. In a further embodiment, the heating comprises injection of heated thermal energy carrier fluid through one or more well bores, into the formation. In yet another embodiment, the modified hydrocarbons are derived at least in part by catalytic cracking of the mobilized hydrocarbons. In a further embodiment, the modified hydrocarbons are on average lower in molecular weight (size) than the mobilized hydrocarbons.

In another embodiment, the present invention comprises a hydrocarbon production system, the system comprising: a fixed-bed hydrocarbon formation, a fixed-bed derived hydrocarbon fluid, an in situ fluid flow path capable of facilitating directional flow of the fluid hydrocarbon, a catalyst and/or secondary heated zone (e.g. a hot zone distinct from the zone in which the hydrocarbon was mobilized), a zone in which the fluid hydrocarbon may contact the catalyst or secondary heated zone, and an opening in the formation by which hydrocarbon fluids may be produced following contact with the catalyst or secondary heated zone. The system may further comprise one or more opening(s) in the formation for use in establishing directional flow within the formation. The system may also further comprise a thermal energy carrier fluid. The system may further comprise any number of surface separation modules, compression and/or formation pressure regulating elements, and/or refining operations.

e) Examples of Catalyst Materials and Physical Parameters—Catalyst particle size is important in both reactor-based and in situ methods of hydrocarbon cracking. In FCC processes, for example, catalysts are provided as fine grain, porous, silicon- and aluminum oxide powders. The aluminum is believed to contribute functionality to important Lewis or Bronsted acid sites within the crystalline structure. These sites are believed to accelerate the intermediate carbonation reactions that play an important role in the chain scission process. The catalyst powders consist of a range of small spherical particles and are characterized as fine, medium or coarse grades base on the average particle sizes (APS). For FCC catalysts, the APS typically ranges between 50 and 100 microns. More typically, the fine, medium and coarse grades correspond to APS of 58±3, 64±3, and 72±4 microns, respectively. For hydrocracking and other cracking operations, catalysts are used in pelleted form, typically having APS of well over 100 microns, and preferably over 200 microns. Typically, catalyst pellets are provided as particles with APS of 0.2-5 millimeters. The methods of this invention provide for use of cracking catalyst of any size. However, the preferred dimensions of the catalyst particles are related, in part, to their mode of use. For example, when injecting catalyst into a formation, the potential and desirable distribution of the catalyst may be addressed. The capacity of a catalyst to be distributed and retained in a network of fractures located within a given formation is determined by its relative size vs the average width of the fractures that are in fluid communication with the catalyst injection opening. When widespread distribution within these fractures is desired, preferred catalysts may have average particle sizes of less than about 25% of the average fracture width, and more preferably less than about 10% of the average fracture width. When more restricted distribution of catalyst is desired, preferred catalysts may comprise formulations with average particle size in excess of 25% of the average fracture width. When catalyst particles are used as proppant, the stabilized fracture width will be similar to the average particle size of the catalyst. However, effective distribution of the catalyst into the fractures will require that the fractures be expanded to a width that is substantially greater than the average particle size of the catalyst prior to delivery of catalyst-proppant into the fracture. A variety of means of establishing or expanding formation fractures are well known in the art. Most commonly, expansion of fractures is done by means of hydraulic pressure.

Often, cracking catalysts are large pore materials having pore openings of greater than about 7 Angstroms in effective diameter. The catalyst disclosed in U.S. Pat. No. 6,916,757 (incorporated herein by reference) is one that is suitable as a stand-alone catalyst, or as an additive to cracking processes which employ conventional large-pore molecular sieve component. Other effective, conventional large-pore molecular sieves include zeolite X (U.S. Pat. No. 2,882,442); REX; zeolite Y (U.S. Pat. No. 3,130,007); Ultrastable Y (USY) (U.S. Pat. No. 3,449,070); Rare Earth exchanged Y (REY) (U.S. Pat. No. 4,415,438); Rare Earth exchanged USY (REUSY); Dealuminated Y (DeAl Y) (U.S. Pat. Nos. 3,442,792 and 4,331,694); Ultrahydrophobic Y (UHPY) (U.S. Pat. No. 4,401,556); and/or dealuminated silicon-enriched zeolites, e.g., LZ-210 (U.S. Pat. No. 4,678,765). Preferred are higher silica forms of zeolite Y. ZSM-20 (U.S. Pat. No. 3,972,983); zeolite Beta (U.S. Pat. No. 3,308,069); zeolite L (U.S. Pat. Nos. 3,216,789 and 4,701,315); and naturally occurring zeolites such as faujasite, mordenite and the like may also be used (with all patents above in parentheses incorporated herein by reference). These materials may be subjected to conventional catalyst treatments that are well known in the art. These processes include impregnation, ion exchange with rare earths and other modifications. The preferred molecular sieve of those listed above is a zeolite Y, more preferably an REY, USY or REUSY. Supernova™ D Catalyst from Grace Davison is a particularly suitable large pore catalyst. Methods for making these zeolite-based catalysts are known in the art.

Other large-pore crystalline molecular sieves useful in the present invention include pillared silicates and/or clays; aluminophosphates, e.g., $ALPO_4$-5, $ALPO_4$-8, VPI-5; silicoaluminophosphates, e.g., SAPO-5, SAPO-37, SAPO-40, MCM-9; and other metal aluminophosphates. Mesoporous crystalline material for use as the molecular sieve includes MCM-41. These are variously described in U.S. Pat. Nos. 4,310,440; 4,440,871; 4,554,143; 4,567,029; 4,666,875; 4,742,033; 4,880,611; 4,859,314; 4,791,083; 5,102,643; and 5,098,684, each incorporated herein by reference.

As seen in some of these catalyst examples, the large-pore molecular sieve catalyst component may also include phosphorus or a phosphorus compound. These may be used to alter or improve a number of features of the catalyst, including, but not limited to: attrition resistance, stability, metals passivation, and coke sensitivity or selectivity.

From a catalyst preparation standpoint, it has been discovered that using 10% or less by weight of added alumina allows one to prepare attrition resistant and active catalyst particles comprising high content zeolite (i.e., 30-85%). A variety of inventive catalysts—like those described in U.S. Pat. No. 6,916,757—exhibit increased selectivity for ethylene without compromising yield of total light olefins, e.g., propylene. Catalysts and additives being used commercially to this end often containing about 25% ZSM-5. In certain embodiments illustrated below, the olefin yield of the invention as measured by propylene yield was equal (on a ZSM-5 basis) to that of conventional phosphorus stabilized ZSM-5 catalysts. Indeed, ZSM-5 based additives and catalysts are an important source of catalysts and formulations that may be used to as process or compositional components of this invention.

The foregoing methods and formulations provide a means for converting retort/pyrolysis fluids into enriched light hydrocarbons, including paraffins, olefins and, possibly, other products. A further embodiment may include separating olefins from fluids produced from a formation.

f) Application of the In Situ Reactor and Catalyst Systems to Produce Certain Chemical, Energy and Hydrocarbon Products In an embodiment, a method of enhancing phenol production from an in situ oil shale and other FBH formations may include controlling at least one condition within at least a portion of the formation to enhance production of phenols in formation fluid. In other embodiments, production of phenols from FBH formation may be controlled by converting at least a portion of formation fluid into phenols. Furthermore, phenols may be separated from fluids produced from an in situ FBH formation.

An embodiment of a method of enhancing BTEX compounds (i.e., benzene, toluene, ethylbenzene, and xylene compounds) produced in situ in an FBH (e.g. oil shale) formation may include controlling at least one condition within a portion of the formation to enhance production of BTEX compounds in formation fluid. In another embodiment, a method may include separating at least a portion of the BTEX compounds from the formation fluid. In addition, the BTEX compounds may be separated from the formation fluids after the formation fluids are produced. In other embodiments, at least a portion of the produced formation fluids may be converted into BTEX compounds.

In one embodiment, a method of enhancing naphthalene production from an in situ FBH formation may include controlling at least one condition within at least a portion of the formation to enhance production of naphthalene in formation fluid. In another embodiment, naphthalene may be separated from produced formation fluids.

Certain embodiments of a method of enhancing anthracene production from an in situ FBH formation may include controlling at least one condition within at least a portion of the formation to enhance production of anthracene in formation fluid. In an embodiment, anthracene may be separated from produced formation fluids.

In one embodiment, a method of separating ammonia from fluids produced from an in situ FBH formation may include separating at least a portion of the ammonia from the produced fluid. Furthermore, an embodiment of a method of generating ammonia from fluids produced from a formation may include hydro-treating at least a portion of the produced fluids to generate ammonia.

In an embodiment, a method of enhancing pyridines production from an in situ FBH formation may include controlling at least one condition within at least a portion of the formation to enhance production of pyridines in formation fluid. Additionally, pyridines may be separated from produced formation fluids.

In certain embodiments, a method of selecting a FBH formation to be treated in situ such that production of pyridines is enhanced may include examining pyridines concentrations in a plurality of samples from oil shale or other FBH formations. The method may further include selecting a formation for treatment at least partially based on the pyridines concentrations. Consequently, the production of pyridines to be produced from the formation may be enhanced.

In an embodiment, a method of enhancing pyrroles production from an in situ FBH formation may include controlling at least one condition within at least a portion of the formation to enhance production of pyrroles in formation fluid. In addition, pyrroles may be separated from produced formation fluids.

In certain embodiments, a FBH formation to be treated in situ may be selected such that production of pyrroles is enhanced. The method may include examining pyrroles concentrations in a plurality of samples from oil shale formations. The formation may be selected for treatment at least partially based on the pyrroles concentrations, thereby enhancing the production of pyrroles to be produced from such formation.

In one embodiment, thiophenes production from an in situ FBH formation may be enhanced by controlling at least one condition within at least a portion of the formation to enhance production of thiophenes in formation fluid. Additionally, the thiophenes may be separated from produced formation fluids.

An embodiment of a method of selecting a FBH formation to be treated in situ such that production of thiophenes is enhanced may include examining thiophenes concentrations in a plurality of samples from oil shale formations. The method may further include selecting a formation for treatment at least partially based on the thiophenes concentrations, thereby enhancing the production of thiophenes from such formations.

In an embodiment, a method for treating a compound in a heated formation in situ may include controlling: moisture; temperature; pressure; catalyst activity or concentration; hydrocarbon concentration; the partial pressure of H.sub.2, O.sub.2 and/or other vapors; and or other parameters within in a selected section of the formation.

In-Formation Hydrogen Production—Certain embodiments may include providing a reducing agent to at least a portion of the formation. A reducing agent may be added to, or generated within the formation. A reducing agent provided to a portion of the formation during heating may increase production of selected formation fluids. A reducing agent may include, but is not limited to, molecular hydrogen. Hydrogen may be produced from the formation by any means. In a preferred embodiment, a fully, or nearly fully mineralized zone of the formation (e.g. a treated zone in which residual carbon remains largely as in organic 'coke', graphite, carbon fibers, tubes, or similar structures) is treated with a fluid comprising a thermal energy carrier fluid, such as water steam, a hydrocarbon, or the like. Beneficial reactions of the thermal energy carrier fluid, with carbon at elevated temperatures provide for in situ production of molecular hydrogen. Carbon compounds used for the generation of molecular hydrogen may be either inorganic, organic, or both. Carbon compounds useful in the generation of molecular hydrogen may derive from spent (e.g. partially or fully retorted), or from untreated sections of an oil shale formation. Alternatively, or in addition, the carbon compounds may derive from the fluid-based cracking of thermal energy carrier fluids, produced hydrocarbons fluids, or from the direct action upon fixed or mineralized carbon compounds found in the developed section of a formation. The water may derive from sources within a developed section of the formation, or from outside the developed section of a formation, or from other combustion, surface or sub-surface operations. Any method of in situ hydrogen production, including but not limited to injection of thermal energy carrier fluid at temperatures in excess of 1000 degrees F., may also be used. The hydrogen may be produced or used as a reductant. Pyrolyzing at least some hydrocarbons in an oil shale formation may include forming hydrocarbon intermediates and free radicals. Such hydrocarbon intermediates and free radicals may react with each other and other compounds present in the formation. Reaction of these intermediates and free radicals may increase production of olefin and aromatic compounds from the formation. Therefore, a reducing agent provided to the formation may react with hydrocarbon fragments to form selected products and/or inhibit the production of non-selected products.

In an embodiment, a hydrogenation reaction between a reducing agent provided to a FBHF and at least some of the hydrocarbons within the formation may generate heat. The generated heat may be allowed to transfer such that at least a portion of the formation may be heated. In an embodiment, some or all of the heat generated through in-formation chemical reactions, including but not limited to hydrogenation, is transferred to one or more thermal energy carrier fluids. In this form, the heat may be conducted and/or transferred to other segments of the formation, used within the same segment to advance the retort or participate in other chemical processes or produced from one or more producing well. For hydrogenation and other chemical reductions, reducing agent(s) such as molecular hydrogen may also be autogenously generated within a portion of an FBH formation during an in situ conversion process for hydrocarbons.

Certain embodiments may also include providing a fluid produced in a first portion of an FBH formation to a second portion of the formation. A fluid produced in a first portion of an FBH formation may be used to produce a reducing environment in a second portion of the formation. For example, molecular hydrogen generated in a first portion of an oil shale formation may be provided to a second portion of the formation. Alternatively, at least a portion of formation fluids produced from a first portion of the formation may be provided to a second portion of the formation to provide a reducing environment (or reducing equivalents) within the second portion.

In an embodiment, a method for hydrotreating a compound in a heated formation in situ may include controlling moisture, temperature, pressure, catalyst activity or concentration, hydrocarbon concentration, the H.sub.2 partial pressure, and or other parameters within a selected section of the formation. For hydrotreating a formation fluid, a compound or a process stream, sufficient H.sub.2 may be present in the selected section of the formation for effective hydrotreatment. The methods of this invention may further comprise providing one or more compound(s) to at least one selected section of the formation to assist, accelerate, inhibit or otherwise modulate the hydrotreating process so as to produce a mixture from the formation that comprises at least a plurality of beneficially hydrotreated compounds.

Certain embodiments may include controlling heat and/or thermal energy carrier fluid provided to at least a portion of the formation such that a thermal conductivity of the portion may be increased to greater than about 0.30 Btu/(ft.degree.F.) or, in some embodiments, greater than about 0.35 Btu/(ft.degree.F.).

In certain embodiments, the mass of carbon present in at least a portion of the FBHF may be reduced due, for example, to the production of formation fluids from the formation. As such, a permeability and porosity of at least a portion of the formation may increase. This permeability increase may be in addition to increases in permeability brought by artificial or natural means as a result of formation development. In addition, removing water and/or injecting thermal energy carrier fluid at elevated pressure during the heating of the formation may further increase the permeability and porosity of at least a portion of the formation.

Certain embodiments may include increasing permeability of at least a portion of a fixed-bed hydrocarbon formation to greater than about 0.01, 0.1, 1, 10, 20, 50, 100, or 500 darcy. In addition, certain embodiments may include substantially uniformly increasing a permeability of at least a portion of an oil shale or other FBH formation. Some embodiments may include increasing porosity of at least a portion of an oil shale or other FBH formation substantially uniformly. In some embodiments, an increasing permeability is developed by a method comprising formation fracturing, with or without use of optional proppant materials.

Hydrocarbon fluids produced from a formation may vary depending on conditions within the formation. For example, a heating rate of a selected pyrolyzation section may be controlled to increase the production of selected products. In addition, pressure within the formation may be controlled to vary the composition of the produced fluids.

In an embodiment, heat is provided from a first (or first set of) thermal energy carrier injection well(s) to a first zone of an oil shale or other FBH formation so as to pyrolyze a portion of the hydrocarbons in the zone. Heat may also be provided from a second (or second set of) thermal energy carrier injection well(s) to a second zone of the formation. The heat may alter the composition, initiate partial pyrolysis, or otherwise reduce the viscosity of hydrocarbons in the second zone so that a portion of the hydrocarbons in the second zone become mobile. A portion of the hydrocarbons from the first zone and/or second zone may be induced to flow into one or more producing wells. Also, in one embodiment, the hydrocarbons mobilized in one zone pass in situ through a second zone, so as to contact the second zone. Alternatively or additionally, a portion of the hydrocarbons from the second zone may be induced to flow into the first section. A mixture of hydrocarbons derived from the first and second zones may be produced from the formation. The produced mixture may include at least some pyrolyzed hydrocarbons. The pyrolized hydrocarbons may include at least some hydrocarbons generated through hydrocarbon cracking within the formation. The cracking may occur by a method in which mobilized hydrocarbons contact at least one second heating zone.

In an embodiment, at least a portion of the heat provided to at least a portion of an oil shale or other FBH formation comprises a heated thermal energy carrier fluid. The heated carrier fluid may be supplied to a selected segment (e.g. zone) of a formation as a gas, a liquid, a combination of the two, or as a supercritical fluid. The heat may transfer through any number of means to a selected segment of the formation so as to decrease a viscosity of one or more hydrocarbon compounds within the selected segment. Additionally, vapor phase thermal energy carrier fluid or other gases may be provided to the selected segment of the formation so as to displace hydrocarbons from the selected segment towards one or more production well(s). A mixture of hydrocarbons may be produced from the selected segment through the production well or production wells.

In some embodiments, thermal energy supplied to a segment of a formation may be selectively limited to control temperature and to inhibit coke formation at or near the point(s) of heat injection. In some embodiments, the portion of the injection well through which heat is injected is altered beneficially to limit coke formation and/or to work around coke already formed within the formation in close proximity to one or more previous injection points. In some embodiments, areas of elevated coke formation, and/or areas in which temperature has been reduced by process intervention (such as by altering the injection point into a formation), may be used to produce a mixture of hydrocarbons and other products. In some embodiments, the mixture of products produced from high coke or low temperature sections are enriched in specific desired hydrocarbons (e.g., short chain alkanes and olefins), and/or synthesis gas components, and/or hydrogen.

In certain embodiments, a quality of a produced mixture may be controlled by varying a location for producing the mixture. The location of production may be varied by varying the depth in the formation from which fluid is produced relative to an overburden or underburden. The location of production may also be varied by varying which production wells are used to produce fluid. In some embodiments, the production wells used to remove fluid may be chosen based on a distance of the production wells from activated heat sources, heat injection wells or heated zones within the formation.

In some embodiments, heat may be provided to a selected segment of an oil shale formation to pyrolyze some hydrocarbons in a lower portion of the formation. A mixture of hydrocarbons may be produced from an upper portion of the formation. The mixture of hydrocarbons may include at least some pyrolyzed hydrocarbons from the lower portion of the formation.

In certain embodiments, a production rate of fluid from the formation may be controlled to adjust an average time that hydrocarbons are in, or flowing into, a pyrolysis zone or exposed to pyrolysis temperatures. Controlling the production rate may allow for production of a large quantity of hydrocarbons of a desired quality from the formation.

Synthesis Gas Production—A heated formation may also be used to produce synthesis gas. Synthesis gas may be produced from the formation prior to or subsequent to producing a formation fluid from the formation. For example, synthesis gas generation may be commenced before and/or after formation fluid production decreases to an uneconomical level. Heat provided to pyrolyze hydrocarbons within the formation may also be used to generate synthesis gas. For example, if a portion of the formation is at a temperature from approximately 520 degrees F. to approximately 705.degrees. C. (or 750 degrees F., in some embodiments) after pyrolyzation, then less additional heat is generally required to heat such portion to a temperature sufficient to support synthesis gas generation.

In certain embodiments, synthesis gas is produced after production of pyrolysis fluids. For example, after pyrolysis of a portion of a formation, synthesis gas may be produced from carbon and/or hydrocarbons remaining within the formation. Pyrolysis of the portion may produce a relatively high, substantially uniform permeability throughout the portion. Such a relatively high, substantially uniform permeability may allow generation of synthesis gas from a significant portion of the formation at relatively low pressures. The portion may also have a large surface area and/or surface area/volume. The large surface area may allow synthesis gas producing reactions to be substantially at equilibrium conditions during synthesis gas generation. The relatively high, substantially uniform permeability may result in a relatively high recovery efficiency of synthesis gas, as compared to synthesis gas generation in an oil shale formation that has not been so treated.

Pyrolysis of at least some hydrocarbons may in some embodiment convert about 15 weight % or more of the carbon initially available. Synthesis gas generation may convert approximately up to an additional 80 weight % or more of carbon initially available within the portion. In situ production of synthesis gas from an oil shale formation may allow conversion of larger amounts of carbon initially available within the portion. The amount of conversion achieved may, in some embodiments, be limited by subsidence concerns.

Certain embodiments may include providing heat from one or more heat sources to heat the formation to a temperature sufficient to allow synthesis gas generation (e.g., in a range of approximately 840 degrees F. to approximately 2200 degrees F. or higher). At a lower end of the temperature range, generated synthesis gas may have a high hydrogen (H.sub.2) to carbon monoxide (CO) ratio. At an upper end of the temperature range, generated synthesis gas may include mostly H.sub.2 and CO in lower ratios (e.g., approximately a 1:1 ratio).

Heat sources for synthesis gas production may include any of the heat sources as described in any of the embodiments set forth herein. Alternatively, heating may include transferring heat from a heat transfer fluid (e.g., steam or combustion products from a burner) flowing within a plurality of well bores within the formation.

A synthesis gas generating fluid (e.g., liquid water, steam, carbon dioxide, air, oxygen, hydrocarbons, and mixtures thereof) may be provided to the formation. For example, the synthesis gas generating fluid mixture may include steam and oxygen. In an embodiment, a synthesis gas generating fluid may include aqueous fluid produced by pyrolysis of at least some hydrocarbons within one or more other portions of the formation. Providing the synthesis gas generating fluid may alternatively include raising a water table of the formation to allow water to flow into it. Synthesis gas generating fluid may also be provided through at least one injection well bore. The synthesis gas generating fluid will generally react with carbon in the formation to form H.sub.2, water, methane, CO.sub.2, and/or CO. A portion of the carbon dioxide may react with carbon in the formation to generate carbon monoxide. Hydrocarbons such as ethane may be added to a synthesis gas generating fluid. When introduced into the formation, the hydrocarbons may crack to form hydrogen and/or methane. The presence of methane in produced synthesis gas may increase the heating value of the produced synthesis gas.

Synthesis gas formation is, in some embodiments, an endothermic process. Additional heat may be added to the formation during synthesis gas generation to maintain a high temperature within the formation. The heat may be added from heater wells, thermal energy carrier fluid injection wells, and/or from oxidizing carbon and/or hydrocarbons within the formation.

In an embodiment, an oxidant may be added to a synthesis gas generating fluid. The oxidant may include, but is not limited to, air, oxygen enriched air, oxygen, hydrogen peroxide, other oxidizing fluids, or combinations thereof. The oxidant may react with carbon within the formation to exothermically generate heat. Reaction of an oxidant with carbon in the formation may result in production of CO.sub.2 and/or CO. Introduction of an oxidant to react with carbon in the formation may economically allow raising the formation temperature high enough to result in generation of significant quantities of H.sub.2 and CO from hydrocarbons within the formation. Synthesis gas generation may be via a batch process or a continuous process.

Synthesis gas may be produced from the formation through one or more production wells that are/were being used for heat injection. Such heat sources may operate to promote production of the synthesis gas with a desired composition.

Synthesis gas may also be used for other purposes. Synthesis gas may be combusted as fuel. Synthesis gas may also be used for synthesizing a wide range of organic and/or inorganic compounds, such as hydrocarbons and ammonia. Synthesis gas may be used to generate electricity by combusting it as a fuel, by reducing the pressure of the synthesis gas in turbines, and/or using the temperature of the synthesis gas to make steam (and then run turbines). Synthesis gas may also be used in an energy generation unit such as a molten carbonate fuel cell, a solid oxide fuel cell, or other type of fuel cell.

Certain embodiments may include separating a fuel cell feed stream from fluids produced from pyrolysis of at least some of the hydrocarbons within a formation. The fuel cell feed stream may include H.sub.2, hydrocarbons, and/or carbon monoxide. In addition, certain embodiments may include directing the fuel cell feed stream to a fuel cell to produce electricity. The electricity generated from the synthesis gas or the pyrolyzation fluids in the fuel cell may power electric heaters, which may heat at least a portion of the formation. Certain embodiments may include separating carbon dioxide from a fluid exiting the fuel cell. Carbon dioxide produced from a fuel cell or a formation may be used for a variety of purposes.

Example 23

Development of a "Steam-Wall" Displacement and Containment Barrier

An area selected for in-situ retorting and other methods provided herein may be initially dewatered by injecting superheated steam at temperatures ranging from about 450° F. to 550° F. and at pressures of about 50 to 200 psi higher than the normal hydrostatic pressure of the water in the aquifers (or mini-aquifers) being dewatered. This injection of superheated steam into a line of 16 injection wells, spaced at about 330-ft, drill-site spacing, and extending over a 1-mile length, will create a "steam wall" which advances at a linear rate in the two directions perpendicularly away from the 1-mile-long line of 16 steam-injection wells. For example, if these injection wells are completed for injection into the 15-ft-thick "A-groove" aquifer at the top of the Mahogany zone of oil shale, then this steam displacement wall will advance most rapidly through the most permeable portions of this aquifer and more slowly through the less permeable portions of this aquifer. As this "steam wall" advances through the cold-aquifer's porous rock, it will lose heat and condense into distilled water. Consequently, there will be a condensed-water zone advancing ahead of the advancing "steam wall."

Figure 11A:
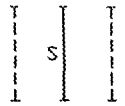
FIGS. 11 *a-g* are illustrations showing a sequence of development of an oil shale formation using 1 mile, 16 well segments with a)-g) representing successive stages of development.

In a typical operating example, a 1-mile-long line of 16 production wells at 330-ft spacing may be drilled at a ½-mile distance on both sides of the above described line of injection wells as illustrated in FIG. 11*a*. Each of these two parallel lines of production wells may be produced at about 50% of the rate of water used for injecting steam into the line of steam-injection wells. Consequently, the mass of water produced will approximately equal the mass of water injected as steam. The production-well pressures will be whatever is necessary to produce the desired water mass (i.e., equal to the mass of water injected as steam). This water-production rate will provide sufficient water supply, needed for generating the injection steam and for other water-use needs, without creating excessive water production requiring water-disposal operations.

Figure 11B:
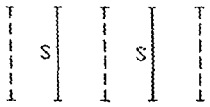

When the "steam-wall" front has arrived at the line of producing wells, as evidenced by their producing dominantly steam, then that line of producing wells will be changed to steam-injection wells. Also, at a ½-mile distance from each such line of newly created, steam-injection wells, adjacent, parallel lines of new producing wells can be drilled and completed for production as illustrated in FIG. 11*b*. Then, the new steam-injection wells will inject superheated steam outward for another ½ mile to the new production wells until they produced dominantly steam. Consequently, the formation water will have been displaced from a two-mile width of such aquifer (i.e., "A-groove") over the 1-mile length of each such line of wells. Optionally, the operator may elect to use longer lengths of well lines such as 1½-miles or 2-miles instead of the 1-mile line length previously described.

Figure 11C:
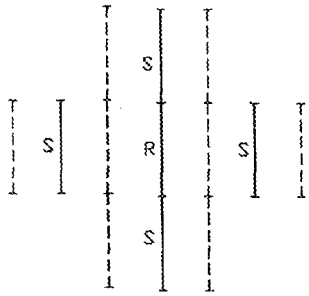
Figure 11D:
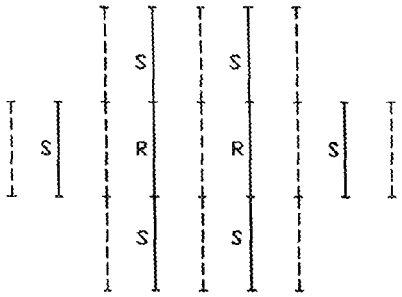
Figure 11E:
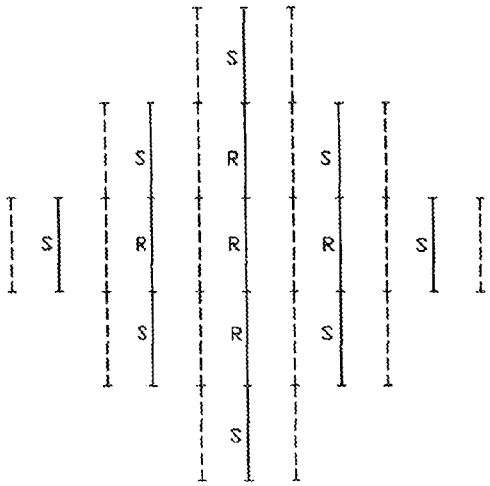
Figure 11F:
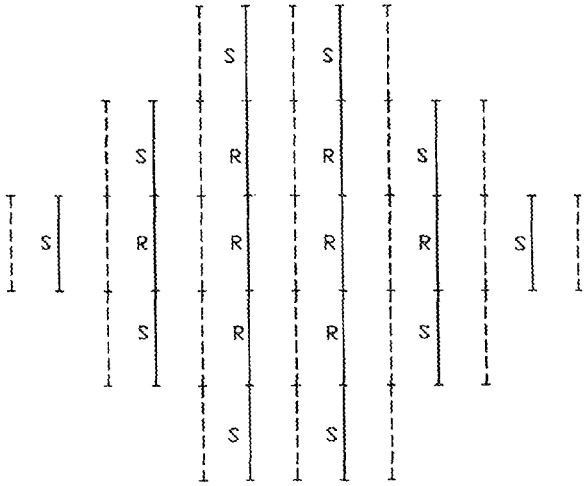
Figure 11G:
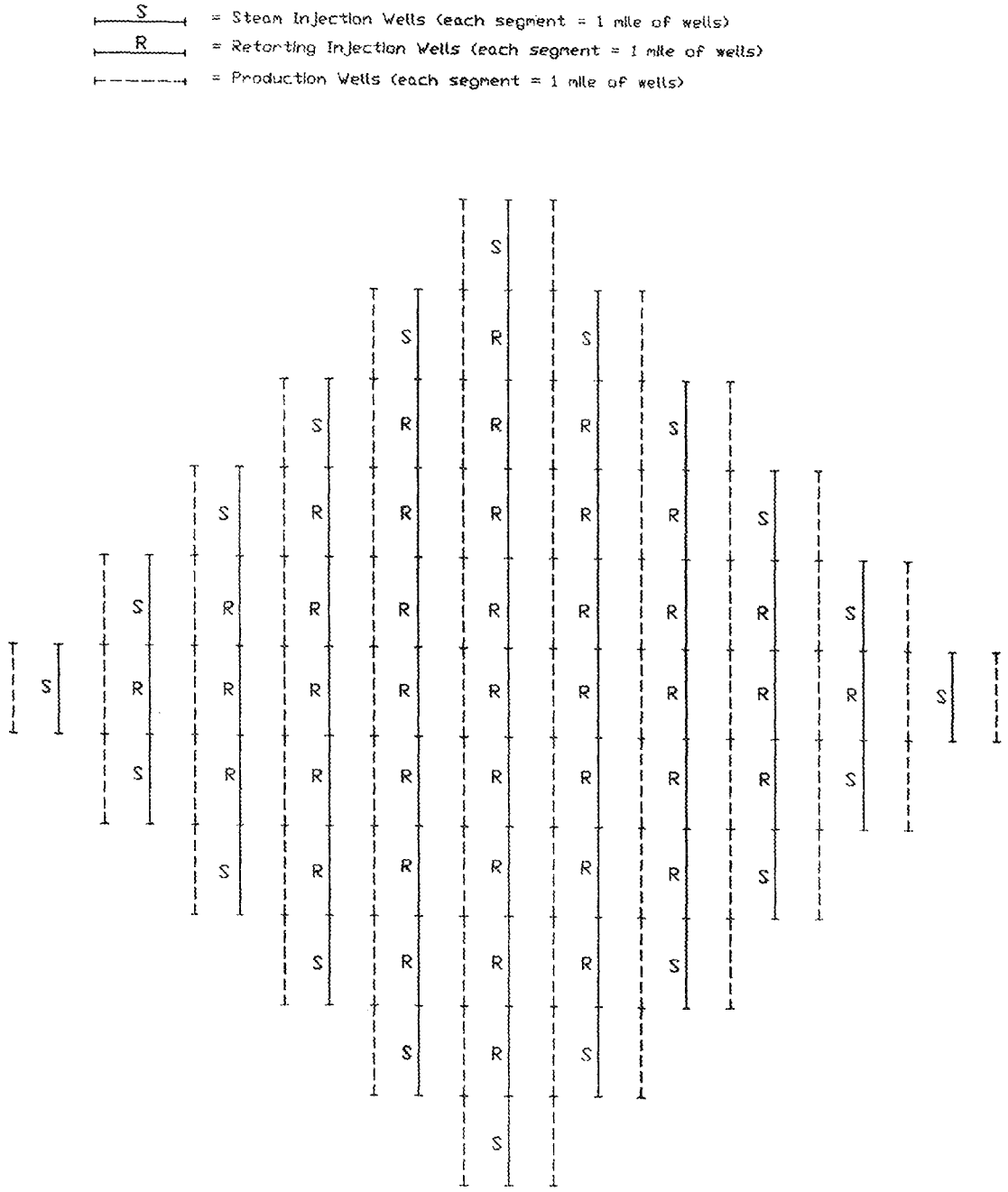

Next, the first line of injection wells can be used for injection of the selected, retorting, thermal-energy carrier fluid at about 900° F. to 1,100° F. as shown in FIG. 11*c*. This 900° F. to 1,100° F., thermal-energy carrier fluid will flow from the central line of injection wells to the %-mile-spaced, production line of wells. When the productions wells start to produce oil-shale-retorted products at production temperatures of about 600° F., then reverse the flow direction so that the prior production wells become injection wells (i.e. injecting 900° F. to 1,100° F., thermal-energy carrier fluids) and the prior injection wells become retorted-product production wells as shown in FIG. 11*d*. Also, the next line of wells on each side becomes "retorted-product-production wells".

As the retorting operation progresses, there is always a buffer zone of 450° F. to 550° F. steam in front of the advancing retorting zones (i.e., 600° F. to 1,000° F.) as illustrated in FIGS. 11*d*, 11*e*, 11*f* and 11*g*. The retorting zones are operated at pressures substantially below the normal, aquifer water pressures. Therefore, there will always be a strong-hydrodynamic pressure gradient of controlled water flow from the exterior, non-retorted, water-saturated aquifers inward toward the retorted zones. Thus, any water-soluble, retorted products will be carried by this hydrodynamic-controlled water flow inwardly toward the "steam-wall" area where they will be vaporized into steam and then flow inwardly to production wells in the low-pressure production sump. If desired, an additional, hydrodynamic pressure barrier can be imposed by injection of water into the aquifers in a ½-mile zone outside the "steam wall."

Therefore, the containment of any water-soluble retorted products is best contained by this ½-mile wide, expanding, "steam-wall" barrier. Then, inside the "steam-wall" barrier, all fluid flow is inward into the retorted-zone's pressure sump. This multi-level, exterior-pressure wall, plus the perimeter "steam wall" and the interior-pressure sump, provide maximum security against lateral leakage through the aquifers. Also, the natural low permeability, R-8, oil-shale barrier above the Mahogany (R-7) zone can be reinforced by two horizontal fracs at about 50-ft intervals which can be pressurized by water injection to be assured of strong, downward, hydrodynamic water flow through any preexisting tectonic fracture which may have existed in this cap-rock barrier is illustrated in FIGS. 9*a*, 9*b*, 9*c* and 9*d* and FIGS. 10*a*, 10*b*, 10*c* and 10*d*. Consideration may be given to injecting superheated steam into the lower one of these two horizontal fractures to further guarantee downward fluid flow in any such preexisting tectonic fractures as well as to provide oil-shale-rock plasticity to seal such fractures. Great care should be provided to guarantee no water-flow leakage upward through this R-8 cap rock.

This "steam-wall" barrier, plus the other hydrodynamic-containment provisions of this technology, will be both more effective and also much lower cost than the "freeze-wall" containment system currently proposed in the art.

This example provides a series of engineering and geologic strategies for hydro-dynamically isolating an active retort zone from the surrounding aquifer(s). It addresses the principles and methods necessary to achieve multiple redundancy and assure maximal environmental protection. In most cases, such redundancy also enhances the overall productivity of the active retort zone. Many other embodiments of multiply redundant containment systems will be apparent to one of skill in the art.

Example 24 a-b

Compression Systems Enabled Using the Invention a) Construction of Hydro-Mechanical ICS Steam Engine Using a Treated Formation In some embodiments, the present invention comprises a system for producing and condensing useful hydrocarbon fuels and chemicals by transferring heat, chemical and/or mechanical energy provided by one segment of the system. In this example, a system is a substantially integrated set of operations occurring in an operator-managed and/or locally coordinated and/or integrated manner, and may comprise the coordinated operation of any number of individual systems and methods provided for herein.

Generally, the embodiments described in this example employ to advantage one or more in situ heating elements to do physical work at a location that is substantially distinct from the in situ retorting location. In many embodiments, the present examples illustrate the utility of the in situ heating element to supply force or energy necessary for a surface operation. In some embodiments, the present examples comprise at least one compression and or adiabatic expansion operation.

In one example and embodiment of coordinated operations, the invention comprises a method for hydraulically compressing air, oxygen enriched air, or oxygen in one or more hydraulic cylinders with controlled water injection to establish the desired combination of adiabatic, isothermal, and intermediate adiabatic/isothermal compression, followed by a combined, fuel-and-water injection in a controlled flow of compressed air through a combustion chamber during the expansion cycle, followed by the nearly adiabatic expansion of the resulting combustion gases and steam to drive the hydraulic-piston fluid through a hydraulic motor, or hydraulic turbine, to extract useful shaft power. By using a hydraulic-water/hydraulic-oil fluid exchanger between the compression/combustion/expansion hydraulic cylinder and the hydraulic motor, or hydraulic turbine, a multitude of dirty fuels and ash-producing fuels, such as pulverized coal slurries, asphalt slurries, heavy-oil emulsions, etc., may be burned in the combustion chamber of this internal-combustion steam engine. The internal-combustion-steam-engine cycle (ICS cycle) for this example can provide very high, thermal-energy efficiency in producing shaft horsepower. Importantly, this internal-combustion steam engine can be operated to advantage at relatively low combustion temperatures to prevent formation of $NO_X$ and minimize other combustion exhaust pollutants.

A Type-Example of the Hydro-Mechanical Internal-Combustion-Steam-Engine.

In this example, a compression stroke starts with the compression/expansion cylinder having been filled with a fresh charge of either air, oxygen-enriched air, or oxygen. Then, water, or some selected, non-combustible liquid, is injected into the bottom of this cylinder to act as a liquid piston moving upward to compress the air/oxygen-gas in a nearly adiabatic process. At a selected compression pressure, this air/oxygen-gas undergoing continuing compression is caused to flow from the compression/expansion cylinder into an adjacent storage cylinder at a controlled rate while water is being injected into this flow stream to create an intermediate, adiabatic/isothermal-compression process in a desired temperature range in this storage. At the end of this compression stroke, the spherical buoyancy ball, floating on top of the hydraulic water piston, impacts the top of the compression cylinder almost simultaneously or slightly later than the spherical buoyancy ball in the storage cylinder impacts the bottom of that cylinder. Each of these spherical buoyancy balls will create a positive fluid-flow stoppage when it seats against the outlet port in each's respective cylinder.

In one embodiment, an operator or engineer may use log-log plots of air/oxygen volume vs. pressure during this compression cycle to illustrate the pressure, temperature and/or other physical relationships relevant to the process. For example, one may assess the temperature effects intrinsic in achieving compression ratios of about 100× (i.e., 1,500 psi) and 200× (i.e., 3,000 psi) respectively. The maximum temperature of the compressed gas is determined by the pressure at which the compression process is changed from approximately adiabatic compression to intermediate, adiabatic/isothermal or nearly isothermal compression by the injection of water for vaporization cooling. The maximum temperature can be selected to be low enough to minimize $NO_X$ production, and if powdered coal slurry is used as fuel, it should be low enough to prevent ash-melting with slag formation.

The combustion portion of this ICS cycle occurs when the water-hydraulic piston in the compression/expansion cylinder starts to move downward and the water-hydraulic piston in the adjacent storage cylinder starts to move upward resulting in a flow of compressed air/oxygen from across or through the combustion chamber. Then fuel and water are simultaneously injected into the combustion chamber, in the proper ratio, to cause a nearly constant-temperature combustion at a selected pressure profile with a volume expansion caused by the combustion of fuel, plus the conversion of liquid water into steam to drive the water-hydraulic piston, in the expansion cylinder, downward.

After the combustion portion of this ICS cycle is completed, then these hot combustion gases plus steam will undergo a nearly adiabatic, power-stroke expansion. The adiabatic cooling of these expanding gases will result in condensation of this steam near the end of this power-stroke expansion of the ICS cycle. The water-hydraulic piston's downward movement will cause this water-hydraulic fluid to flow out from the expansion-cylinder port and through a hydraulic motor, or hydraulic turbine, to generate shaft power delivered to a power load.

After the power-stroke, near-adiabatic expansion is complete and preparatory for the next compression stroke, the combustion gases then remaining in this cylinder can be displaced by a fresh charge of slightly compressed air/oxygen. Then, this sequence of compression, combustion, and expansion can be repeated over a multiplicity of cycles to deliver shaft horsepower through the hydraulic motor, or hydraulic turbine, to the power load.

An inertia flywheel may be used on this power shaft to smooth out the power delivery rate and to maintain a more nearly uniform RPM on the power load. Also, the hydraulic-power-delivery rate can be made more uniform by connecting multiple, ICS-engine units, with staggered stroke timing, to the same power shaft, flywheel, and power load. For example, 2 ICS-engine units can be used at 180° phase angle; 3 ICS-engine units can be used at 120° phase angle; 4 ICS-engine units can be used at 90° phase angle; 6 ICS-engine units can be used at 60° phase angle; 8 ICS-engine units can be used at 45° phase angle; 12 ICS-engine units can be used at 30° phase angle; or any other number of ICS-engine units can be used at appropriate phase angles. The larger the number of ICS-engine units used on the same power shaft and the larger the inertia flywheel used, the more uniform will be the RPM and the power delivery rate into the power load.

The inside surfaces of the compression/expansion cylinder and the adjacent storage cylinder, plus the tubing and combustion chamber between them, may be lined with a temperature-tolerant insulating material such as selected ceramics, porcelain, glass, etc., to minimize heat loss through these walls. Possibly, these insulating materials could be foamed or mixed with other materials to improve their insulating properties and also decrease their specific heat values to further reduce heat flow into or out of these walls. This reduction in heat flow into or out of these walls will make it possible to more closely approximate the adiabatic compression and expansion desired for this ICS cycle. The outer portion of these cylinders, tubing and combustion chamber may be made out of high-strength steel or other high-strength metal capable of tolerating the ICS cycle temperatures and pressures. Additional insulation may be added outside the high-strength metal cylinders and tubes to further reduce heat loss.

Alternatively, the inner cylinder or tube may be the high-strength-steel (or other metals) cylinder which is then surrounded by insulation material to reduce heat loss. Furthermore, a series of 3, 4, or 6 such compression/expansion cylinders may be placed close to each other, and the cluster of such cylinders can be covered and surrounded by thick layers of insulation to minimize heat loss out through the walls.

The desired adiabatic compression and expansion can be more closely approximated by increasing the ratio of fluid volume divided by fluid-surface-contact area. This can be accomplished by increasing the cylinder's diameter as large as possible within practical-structural, pressure-tolerance limits. For large, fixed-plant, ICS-engine installations, these cylinder diameters may range from 2 ft to 4 ft, or possibly larger. The compression/expansion cylinder length may typically range from about 5 ft to 40 ft, or any other length desired for any specific surface plant design.

The oxygen needed for combustion in this ICS cycle may come from air, oxygen-enriched air, or oxygen. The thermal efficiency of this ICS cycle may be increased by using oxygen-enriched air or oxygen with minimal amounts of inert gases (i.e., nitrogen, etc.) to be compressed in the compression/expansion cylinder. A 40%-oxygen-60%-nitrogen mixture may be economically achieved by using a molecular-sieve procedure to partially remove the nitrogen from compressed air to achieve a desired oxygen-enriched air for this purpose. By selecting optimized values of these variables, the thermal efficiencies and operational economies can be maximized.

When dirty fuel, such as pulverized-coal slurries or some petroleum products, is used, a hydraulic oil-water, fluid-exchange cylinder may be inserted between the compression/expansion cylinder and the hydraulic motor, or hydraulic turbine. In this configuration, the hydraulic water discharged from the bottom of the compression/expansion cylinder will enter the bottom of the oil-water, fluid-exchange cylinder and thereby displace this oil upward and then into the hydraulic motor or hydraulic turbine. Consequently, the hydraulic motor, or hydraulic turbine, will receive only clean hydraulic oil as power fluid and will not receive any dirty water containing ash from pulverized coal or other dirty fuels. During the last part of the expansion cycle, the steam condenses into liquid water which falls like rain in the expansion cylinder to entrap and wash away essentially all of the ash residue from the combustion of pulverized coal or other dirty fuels. This condensed water, carrying most of the ash and other solid particulates from combustion, will be discharged with the combustion exhaust products through the exhaust-discharge port.

It may be desirable to carry the expansion cycle out to a volume of about 2 times (possibly 3× or 4×) the original volume at the start of the compression cycle. Several alternative means can be designed to accomplish the last part of the expansion cycle whose expanded volume exceeds the original compression volume. One such design is achieved by moving the exhaust port in the compression/expansion cylinder upward to a height of 50% of the cylinder's total height (for expansion of 2× original volume), or possibly to 67% of this cylinder's total height (for expansion of 3× original volume), or any other height needed to achieve the desired ratio of expansion-to-compression volumes.

In an alternative method, additional, expansion, power extraction beyond the original compression volume may be provided by directing the combustion exhaust and steam from the exhaust port in the compression/expansion cylinder to a low-pressure, low-temperature, power-extraction, gas-expansion system, such as a gas turbine, or through a gas/liquid fluid exchanger to a hydraulic motor or hydraulic turbine. Engineers, skilled in the science and art of gas-expansion, power-extraction systems, may design several alternative systems to achieve this objective.

b) Improvements and Variations of the Hydro-Mechanical ICS-Cycle Engine

The preceeding example is but one typical application of the hydro-mechanical system of an hydro-ICS-cycle engine as illustrated in FIGS. 19*a* and 19*b*. Starting with the process of discharging the expanded exhaust gases out the exhaust port and the recharging of a fresh charge of air, oxygen-enhanced air, or oxygen in the compression/expansion cylinder, valves described here as 1-A and 1-B and shown in FIGS. 19*a* and 19*b* are set to pump hydraulic fluid from the fluid-supply tank through the hydraulic pump, or turbine, and into the top of the fluid-exchange cylinder. This hydraulic fluid then displaces downward the buoyancy ball and the water as shown in FIG. 19*b*. The water displaced out of the bottom of the fluid exchanger is pushed into the bottom of the compression/expansion cylinder, thereby displacing the buoyancy ball upward in this cylinder.

In this type example, we use cylinders of 48" ID with a wall thickness of 3" to give a 54" O.D. The outer most portion of this wall consists of a 1"-thick, high-strength, steel cylinder capable of handling a 3,000-psi working pressure at working temperatures of about 2,000° F. (i.e., a steel cylinder with a 54" OD and a 52" ID). The innermost portion of this wall consists of a 1"-thick, high-temperature, ceramic cylinder (i.e., 50" OD×48" ID), possibly with some stainless-steel, reinforcing wire wrapped around the outside of this ceramic cylinder. The 1"-thick space between the inner ceramic cylinder and the outer steel cylinder may be filled with high-compressive-strength, small-diameter, hollow-glass beads with good thermal-insulating qualities, or other material with similar qualities. Consequently, these 3"-thick, 3-layered cylinder walls will have relatively good thermal-insulating qualities, plus adequate burst strength, to provide long-term, safe, cyclic operations at about 3,000-psi working pressure, and about 2,000° F. working temperatures. Of course, many alternative designs may be used to achieve the necessary operating conditions for these cylinders as used in this invention.

The height of these cylinders may be about 30 ft with the exhaust port in the compression/expansion cylinder located at the midpoint of this height to provide for an expansion volume of 2× the compression volume. Consequently, in this example, the compression volume would be about 188.5-$ft^3$/cycle, and the expansion volume would be about 377-$ft^3$/cycle. While the hydraulic pump is pushing hydraulic fluid into the fluid-exchange cylinder, as shown in FIG. 19*b*, which displaces water into the compression/expansion cylinder, the valve labeled 3-B in the exhaust port is held open permitting the exhaust combustion gases and steam in the cylinder to be discharged. Simultaneously, the 3-A valve in the air or oxygen-supply system is opened to provide a flow of air or oxygen into this cylinder. Consequently, the exhaust combustion gases above the exhaust port are being displaced downward with a fresh charge of air, oxygen-enriched air (i.e., 40%' $O_2$), or oxygen, and the exhaust combustion gases and steam below the exhaust port are being displaced by the upward-moving water piston and buoyancy ball.

When the displacement-water piston from below and the fresh charge of air/oxygen from above simultaneously reaches the exhaust port, the 3-B exhaust valve and the 3-A air/oxygen inlet valve are closed. Then, the continuing upward movement of the water piston and the floating buoyancy ball, pushed upward by the hydraulic pump or hydraulic-turbine fluid displacement, will cause nearly adiabatic compression of the fresh air/oxygen charge in this compression/expansion cylinder. At a predetermined pressure, selected by the operator (i.e., often between 300 psi and 500 psi), the valves 2-A and 2-B can be turned to permit a controlled rate of flow of hydraulic fluid out of the adjacent storage cylinder, through the hydraulic motor, or hydraulic turbine, and into the hydraulic-fluid storage tank.

This controlled rate of displacement of hydraulic fluid out of the storage cylinder results in a controlled rate of flow of compressed air/oxygen through the combustion chamber and into the top of the storage cylinder. As this compressed air/oxygen charge flows through the combustion chamber, a controlled rate of water is injected into this flow stream to provide a desired profile of temperature, pressure, and volume as illustrated in FIGS. 20*a* and 20*b*. When the buoyancy ball, floating on top of the upward-moving water piston, reaches the top of the compression/expansion cylinder, the buoyancy ball seats against the cylinder exit port thereby terminating this compression cycle with essentially all of the compressed air/oxygen now located in the adjacent storage cylinder at a temperature of about 1,500° F. to 2,000° F. (or any other desired operating temperature) and a pressure of about 3,000 psi as illustrated in FIGS. 20*a* and 20*b*.

The expansion power stroke is started by moving valves 2-A and 2-B to pump hydraulic fluid from the supply tank through the hydraulic pump or hydraulic turbine into the bottom of the storage cylinder, which then displaces the compressed air/oxygen through the combustion chamber and into the large compression/expansion cylinder. Simultaneously, valves 1-A and 1-B are opened to cause the pressurized hydraulic fluid to flow through the hydraulic motor or hydraulic turbine and into the hydraulic-fluid storage tank, thereby permitting gaseous expansion within the compression/expansion cylinder.

As the compressed air/oxygen flows through the combustion chamber, fuel is injected, at a controlled rate, to create a stoichiometric combustion mixture in the air/oxygen flow. Simultaneous with this stoichiometric fuel injection, water is injected at a controlled rate which will create sufficient steam to absorb the heat-of-combustion and thereby maintain a near constant temperature of about 1,500° F. to 2,000° F. for the combined combustion products and steam. Consequently, the fuel-combustion burn may be sustained at a near constant temperature (i.e., isothermal) and at a pressure which may increase, or decrease, or remain nearly constant (i.e., isobaric).

After the fuel-combustion burn and the corresponding water/steam injection are completed, the resulting fuel-combustion products and steam will expand at a nearly adiabatic expansion rate. If the exhaust port is positioned at 50% of the height of the compression/expansion cylinder, as described hereinabove, this expansion volume (i.e., 377 $ft^3$) can continue to twice the original compression volume (i.e., 188.5 $ft^3$). By positioning the exhaust port further up the compression/expansion cylinder, the expansion volume may be established at 3×, 4×, 5×, or more compared to the compression volume. At some point on this near-adiabatic-expansion cycle, the combustion gases and steam will be cooled down sufficiently to condense the steam into water drops. These water drops, falling like rain, will cleanse these expanding gases of most of the particulate matter (i.e., ash) and water-soluble components which subsequently are flushed out of this cylinder through the exhaust port.

Throughout the fuel-combustion burn, with simultaneous steam generation and the subsequent gas expansion, as shown in FIGS. 20*a* and 20*b*, the water forced out of the bottom of the compression/expansion cylinder displaces the hydraulic fluid in the fluid-exchange cylinder, which then flows through the hydraulic motor, or hydraulic turbine, to deliver shaft horsepower to the power load and inertia flywheel as shown in FIGS. 19*a* and 19*b*. When the expansion has reached its maximum volume, the buoyancy ball in the compression/expansion cylinder seats against the exit port at the bottom of this cylinder, which stops all fluid flow through the fluid-exchange cylinder and the hydraulic motor or hydraulic turbine. Then the valves 1-A and 1-B are reversed to cause the hydraulic pump or hydraulic turbine to pump hydraulic fluid out of the supply tank and into the fluid-exchange cylinder to displace water therefrom into the bottom of the compression/expansion cylinder, and thereby start the repetition of this ICS cycle as described above.

The thermal efficiency of converting the thermal energy of fuel combustion into useful shaft horsepower, connected to a power load, can be estimated from the areas using a number of well-known (e.g. log-log, and other) plots as illustrated in FIGS. 20*a* and 20*b*.

In one embodiment of this example, the thermal efficiency is increased by injecting water to create a large volume of steam during the combustion process. Also, this thermal efficiency can be increased by using a 40%-oxygen-60%-nitrogen mixture (i.e., oxygen-enriched air), or a $90^+$%-oxygen feed.

The oxygen-enriched air (i.e., 40%-oxygen-60%-nitrogen mixture) may be economically produced for this ICS-cycle engine by a molecular-sieve process to remove a portion of the nitrogen from the air prior to charging the compression/expansion cylinder in preparation for compression. Additional oxygen enrichment of the air may be achieved by a succession of 2 or 3 such molecular sieves to eliminate more of the nitrogen. In some cases, it may be desirable to use cryogenically produced oxygen of industrial grade (maybe 90 to 95% oxygen).

Engineers skilled in thermodynamic analysis and/or mechanical design can develop a multitude of mechanical and/or thermodynamic designs to accomplish the intent of this invention.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which an exclusive privilege and property right is claimed are defined as follows:

1. A system for producing hydrocarbons in situ from a heavy-oil and tar sand fixed-bed, hydrocarbon deposit distributed substantially within a natural, three dimensional, high-permeability zone, the high permeability zone disposed below a ground surface, the system comprising:

at least one injection well in the hydrocarbon deposit;

at least one production well in the hydrocarbon deposit, the injection well at least 50 feet apart from the production well;

at least one hydraulic fracture having a permeability in a range of 100 to 2000 darcy in the high-permeability zone and disposed between the injection well and the production well, the high-permeability zone having an initial, natural permeability in a range of 2 to 10 darcy, the hydraulic fracture increasing energy transfer within the high-permeability zone between the injection well and the production well;

a heated thermal-energy carrier fluid injected into the injection well and circulated through the hydraulic fracture for mobilizing hydrocarbons in at least a portion of the hydrocarbon deposit in situ by heating the hydraulic fracture and surrounding high-permeability zone and producing at least a portion of mobilized hydrocarbons by flowing the carrier fluid with the mobilized hydrocarbons through the production well to the ground surface; and means for fractionating a produced fluid held in the carrier fluid to generate a plurality of fluid fractions having different hydrocarbon compositions.

2. The system as described in claim 1 wherein the carrier fluid has an injection well pressure in a range of 300 to 500 psi.

3. The system as described in claim 1 wherein the carrier fluid has a production well pressure from the hydraulic fracture in a range of 100 to 300 psi.

4. The system as described in claim 1 wherein the carrier fluid has a temperature in a range of 400 to 1800 degrees F. when injected under pressure from the injection well through the hydraulic fracture.

5. The system as described in claim 1 further including a recirculated carrier fluid circulated back into the injection well after the means for fractionating has generated a plurality of fluid fractions held in the carrier fluid.

6. The system as described in claim 5 wherein the recirculated carrier fluid includes unburned hydrocarbons, compressed air, combustion chamber exhaust products and noncondensed vapors and gases.

7. The system as described in claim 5 further including a combustion chamber for heating combustion gases and other components in the recirculated carrier fluid to a temperature in a range of 400 to 1800 degrees F. for injection into the injection well.

8. The system as described in claim 5 further including a heat-exchange boiler for heating the recirculated carrier fluid to a temperature in a range of 400 to 1800 degrees F. for injection into the injection well.

9. The system as described in claim 1 further including a catalyst for catalytic cracking the hydrocarbons in situ.

10. The system as described in claim 9 wherein the catalyst is at least one zeolite.

11. The system as described in claim 1 further including a plurality of injection wells in the hydrocarbon deposit and a plurality of production wells in the hydrocarbon deposit.

12. The system as described in claim 11 wherein a spacing between the injection wells and the production wells is in a range of 100 to 300 feet.

13. The system as described in claim 11 wherein a spacing between pairs of injection wells and pairs of production wells is in a range of 300 to 700 feet.

14. The system as described in claim 1 further including means for controlling at least one fluid pressure, pressure gradient, flow rate, temperature, temperature gradient, and potentiometric surface gradient of the carrier fluid circulated through the hydraulic fracture.

15. The system as described in claim 14 wherein the means for controlling is disposed in the injection well.

16. The system as described in claim 14 wherein the means for controlling is disposed in the production well.

17. The system as described in claim 1 wherein a fluid pressure of the carrier fluid at the production well in the formation is in a range of 5% to 95% of a fluid pressure of the carrier fluid at the injection well in the formation.

18. The system as described in claim 1 wherein the means for fractionating the hydrocarbons is a condenser.

19. The system as described in claim 18 wherein the condenser separates heavy-end hydrocarbon components above C5 and leaves light-end hydrocarbon components for recycling as part of the carrier fluid.

20. The system as described in claim 1 further including a heat-exchange boiler and bottom-hole electric heater for compressing the carrier fluid into superheated steam in a pressure range of 300 to 700 psi and heated to a temperature in a range of 400 to 1800 degrees F. for injection into the injection well.

21. A system for producing hydrocarbons in situ from a heavy-oil and tar sand bed, hydrocarbon deposit distributed substantially within a natural three dimensional, high-permeability zone, the high-permeability zone disposed below a ground surface, the system comprising:

at least one injection well in the hydrocarbon deposit;

at least one production well in the hydrocarbon deposit, the injection well at least 50 feet apart from the production well;

at least one proppant-packed hydraulic fracture in the high-permeability zone, the high-permeability zone having an initial, natural permeability in a range of 2 to 10 darcy and disposed between the injection well and the production well, the hydraulic fracture having a permeability in a range of 100 to 2000 darcy, the hydraulic fracture increasing energy transfer within the high permeability zone and between the injection well and the production well;

a heated thermal-energy carrier fluid injected into the injection well and circulated through the hydraulic fracture for mobilizing hydrocarbons in at least a portion of the hydrocarbon deposit in situ by heating the hydraulic fracture and surrounding high-permeability zone and producing at least a portion of mobilized hydrocarbons by flowing the carrier fluid with the mobilized hydrocarbons through the production well to the ground surface; and means for fractionating a produced fluid held in the carrier fluid to generate a plurality of fluid fractions having different hydrocarbon compositions.

22. The system as described in claim 21 wherein the proppant-packed, hydraulic fracture has a thickness in a range of ¼ inch to 6 inches with coarse grained, hydraulic fracture proppants received therein.

23. The system as described in claim 21 further including a plurality of proppant-packed hydraulic fractures in the formation and disposed between the injection well and the production well and the carrier fluid is circulated from the injection well through the proppant-packed hydraulic fractures in the three dimensional, high permeability zone to the production well.

24. The system as described in claim 23 wherein the plurality of hydraulic fractures have a thickness in a range of about ¼ th inches to 6 inches with coarse grained, hydraulic fracture proppants received therein.

25. The system as described in claim 21 wherein the means for fractionating provides for enrichment of noncondensible hydrocarbons in at least one fraction.

26. The system as described in claim 21 wherein the means for fractionating provides for enrichment of condensable hydrocarbons in at least one fraction.

27. The system as described in claim 21 wherein the means for fractionating provides for enrichment of the carrier fluid in at least one fraction.

28. A secondary recovery system for producing hydrocarbons in situ from a depleted oil and gas fixed-bed, hydrocarbon deposit within a natural three dimensional, high-permeability zone disposed below a ground surface, the system comprising:

at least one injection well in the hydrocarbon deposit;

at least one production well in the hydrocarbon deposit, the injection well at least 50 feet apart from the production well;

a thermal-energy carrier fluid heated in a range of 400 to 1800 degrees F. and injected into the injection well and through the high-permeability zone between the injection well and the production well, the high-permeability zone having an initial, natural permeability in a range of 2 to 10 darcy, the carrier fluid mobilizing hydrocarbons in at least a portion of the hydrocarbon deposit in situ by heating the high-permeability zone and surrounding formation and producing at least a portion of mobilized hydrocarbons by flowing the carrier fluid with the mobilized hydrocarbons through the production well to the ground surface; and means for fractionating the hydrocarbons held in the carrier fluid to generate a plurality of fluid fractions having different chemical compositions.

29. The system as described in claim 28 wherein the carrier fluid mobilizes and retorts the hydrocarbons in situ.

30. The system as described in claim 28 wherein the carrier fluid mobilizes and pyrolizes the hydrocarbons in situ.

31. The system as described in claim 28 wherein the carrier fluid mobilizes and cracks the hydrocarbons in situ.

32. The system as described in claim 28 further including a catalyst for catalytic cracking the hydrocarbons in situ.

33. The system as described in claim 32 wherein the catalyst is at least one zeolite.

34. The system as described in claim 28 further including a plurality of injection wells and a plurality of production wells, the wells disposed in a linear and parallel grid system.

35. The system as described in claim 34 wherein a spacing between the injection wells and the production wells is in a range of 100 to 300 feet.

36. The system as described in claim 28 wherein a spacing between pairs of injection wells and pairs of production wells is in a range of 300 to 700 feet.

37. The system as described in claim 28 wherein the carrier fluid circulated through the high-permeability zone also includes displacing a formation fluid therein at a pressure greater than an existing hydrostatic formation fluid pressure found in the high-permeability zone.

38. The system as described in claim 37 wherein the formation fluid in the high-permeability zone is water.

39. The system as described in claim 37 wherein the formation fluid in the high-permeability zone is gas.

40. The system as described in claim 28 wherein an injection well pressure of the carrier fluid circulated through the high-permeability zone is in a range of an existing hydrostatic formation fluid pressure found in the high-permeability zone up to a geostatic rock pressure found in the high-permeability zone.

41. The system as described in claim 28 wherein a fluid pressure of the production well in the high-permeability zone is in a range of about 5% to 95% of a fluid injection pressure found at the injection well in the high-permeability zone.

42. The system as described in claim 28 further including a recirculated carrier fluid circulated back into the injection well and recirculated through the high-permeability zone.

43. The system as described in claim 28 further including at least one hydraulic fracture in the high-permeability zone, the hydraulic fracture having a permeability in a range of 100 to 2000 darcy, the hydraulic fracture increasing energy transfer between the injection well and the production well.

44. The system as described in claim 43 wherein the hydraulic fracture has a thickness in a range of about ¼ inches to 6 inches with coarse grained, hydraulic fracture proppants received therein.

45. The system as described in claim 43 further including at least one proppant-packed hydraulic fracture in the formation and disposed between the injection well and the production well, the carrier fluid circulated through the proppant-packed hydraulic fracture and mobilizing hydrocarbons in at least a portion of the hydrocarbon deposit and producing at least a portion of the mobilized hydrocarbons by flowing the carrier fluid with mobilized hydrocarbons through the production well to the ground surface.

46. The system as described in claim 45 further including a plurality of proppant-packed hydraulic fractures in the formation and disposed between the injection well and the production well, the carrier fluid circulated through the proppant-packed hydraulic fractures and mobilizing hydrocarbons in at least a portion of the hydrocarbon deposit and producing at least a portion of the mobilized hydrocarbons by flowing the carrier fluid with mobilized hydrocarbons through the production well to the ground surface.

47. The system as described in claim 46 wherein the plurality of proppant-packed hydraulic fractures have a thickness in a range of about ¼th inches to 6 inches with coarse grained, hydraulic fracture proppants received therein.

48. The system as described in claim 28 wherein the means for fractionating provides for enrichment of non-condensable hydrocarbons in at least one fraction.

49. The system as described in claim 28 wherein the means for fractionating provides for enrichment of condensable hydrocarbons in at least one fraction.

50. The system as described in claim 28 wherein the means for fractionating provides for enrichment of the carrier fluid in at least one fraction.

* * * * *